US007309552B2

(12) United States Patent
Arizumi et al.

(10) Patent No.: US 7,309,552 B2
(45) Date of Patent: Dec. 18, 2007

(54) ELECTROPHOTOGRAPHIC PHOTOCONDUCTOR, ELECTROPHOTOGRAPHY, ELECTROPHOTOGRAPHIC APPARATUS, PROCESS CARTRIDGE FOR ELECTROPHOTOGRAPHIC APPARATUS AND AZO COMPOUND

(75) Inventors: Yuko Arizumi, Kanagawa (JP); Masayuki Shoshi, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 400 days.

(21) Appl. No.: 10/943,262

(22) Filed: Sep. 17, 2004

(65) Prior Publication Data

US 2005/0266331 A1 Dec. 1, 2005

(30) Foreign Application Priority Data

| | | |
|---|---|---|
| Sep. 18, 2003 | (JP) | 2003-325536 |
| Sep. 18, 2003 | (JP) | 2003-326000 |
| Sep. 19, 2003 | (JP) | 2003-327126 |
| Mar. 11, 2004 | (JP) | 2004-069181 |
| May 18, 2004 | (JP) | 2004-147112 |
| May 18, 2004 | (JP) | 2004-148174 |
| May 19, 2004 | (JP) | 2004-148626 |

(51) Int. Cl.
*G03G 5/06* (2006.01)

(52) U.S. Cl. ..... 430/78; 430/70; 430/72; 430/96

(58) Field of Classification Search ..... 430/78, 430/72, 70, 96
See application file for complete search history.

(56) References Cited

U.S. PATENT DOCUMENTS

| | | | |
|---|---|---|---|
| 4,444,844 | A | 4/1984 | Kubo et al. |
| 4,567,124 | A | 1/1986 | Ohta et al. |
| 4,603,097 | A | 7/1986 | Shoshi et al. |
| 4,851,315 | A | 7/1989 | Fujio et al. |
| 4,912,002 | A | 3/1990 | Ishibashi et al. |
| 4,992,109 | A | 2/1991 | Yoshikawa et al. |
| 5,072,043 | A | 12/1991 | Shoshi et al. |
| 5,158,847 | A | 10/1992 | Go et al. |
| 5,159,084 | A | 10/1992 | Shoshi |
| 5,227,512 | A | 7/1993 | Shoshi |
| 5,234,623 | A | 8/1993 | Shoshi |

(Continued)

FOREIGN PATENT DOCUMENTS

| | | |
|---|---|---|
| JP | 2-111958 | 4/1990 |

(Continued)

OTHER PUBLICATIONS

U.S. Appl. No. 10/242,485, filed Sep. 13, 2002, Shoshi et al.

(Continued)

*Primary Examiner*—Hoa Van Le
(74) *Attorney, Agent, or Firm*—Oblon, Spivak, McClelland, Maier & Neustadt, P.C.

(57) ABSTRACT

To provide a highly sensitive and highly durable electrophotographic photoconductor, electrophotography, photographic apparatus and process cartridge for the electrophotographic apparatus which is practical for a high-speed copying machine as well as for a laser printer.

The electrophotographic photoconductor includes a photoconductive layer on a conductive support, in which the photoconductive layer contains an azo compound expressed by Formula (1) and wherein at least one of "$Cp_1$" and "$Cp_2$" contains a coupler residue selected from Formula (2), Formula (3) and Formula (4).

33 Claims, 16 Drawing Sheets

U.S. PATENT DOCUMENTS

| | | | |
|---|---|---|---|
| 5,241,102 | A | 8/1993 | Shoshi et al. |
| 5,292,896 | A | 3/1994 | Shoshi et al. |
| 5,310,503 | A | 5/1994 | Shoshi |
| 5,314,997 | A | 5/1994 | Shoshi et al. |
| 5,350,653 | A | 9/1994 | Shoshi et al. |
| 5,387,487 | A | 2/1995 | Shoshi et al. |
| 5,460,909 | A | 10/1995 | Shoshi et al. |
| 5,486,438 | A | 1/1996 | Shoshi et al. |
| 5,492,784 | A | 2/1996 | Yoshikawa et al. |
| 5,618,935 | A | 4/1997 | Shoshi et al. |
| 5,700,614 | A | 12/1997 | Kawahara et al. |
| 5,750,762 | A | 5/1998 | Kawahara et al. |
| 5,853,935 | A | 12/1998 | Suzuki et al. |
| 5,942,362 | A | 8/1999 | Tadokoro et al. |
| 6,068,956 | A | 5/2000 | Namba et al. |
| 6,074,792 | A | 6/2000 | Namba et al. |
| 6,087,055 | A | 7/2000 | Niimi |
| 6,313,288 | B1 | 11/2001 | Shimada et al. |
| 6,465,648 | B1 | 10/2002 | Tadokoro et al. |
| 6,524,761 | B2 | 2/2003 | Shimada et al. |
| 6,544,701 | B2 | 4/2003 | Tadokoro et al. |
| 2003/0190540 | A1* | 10/2003 | Shoshi et al. ..... 430/78 |

FOREIGN PATENT DOCUMENTS

| | | | |
|---|---|---|---|
| JP | 2-210454 | | 8/1990 |
| JP | 2003207914 | * | 7/2003 |

OTHER PUBLICATIONS

U.S. Appl. No. 07/403,055, filed Sep. 5, 1989, Shoshi et al.
U.S. Appl. No. 06/839,965, filed Mar. 17, 1986, Shoshi et al.
U.S. Appl. No. 11/190,972, filed Jul. 28, 2005, Shoshi et al.
U.S. Appl. No. 10/943,262, filed Sep. 17, 2004, Arizumi et al.
U.S. Appl. No. 11/209,755, filed Aug. 24, 2005, Shoshi.

* cited by examiner

ELECTROPHOTOGRAPHIC PHOTOCONDUCTOR, ELECTROPHOTOGRAPHY, ELECTROPHOTOGRAPHIC APPARATUS, PROCESS CARTRIDGE FOR ELECTROPHOTOGRAPHIC APPARATUS AND AZO COMPOUND

BACKGROUND OF THE INVENTION

1. Field of the Invention

The present invention relates to an electrophotographic photoconductor containing a new specifically structured azo compound, electrophotography, an electrophotographic apparatus, a process cartridge for the electrophotographic apparatus, a new azo compound, a method for manufacturing the azo compound and a photoconductive layer material.

2. Description of the Related Art

Largely classified, various inorganic and organic photoconductors are conventionally known as the photoconductors of photoconductors used in electrophotography. "Electrophotography" referred to herein is an image formation process, which is the so-called Carlson process that generally, a photoconductor having a photoconductive property is first electrically charged, for example, by performing corona discharge in a dark place, then an image is exposed, the electric charge of only an exposed section is selectively dispersed to obtain a latent electrostatic image, which is visualized to form an image. Then this latent electrostatic image was developed by a toner which is formed of coloring agents such as dyes and pigments, high-molecular materials or the like, namely, was visualized to form an image. Since a photoconductor which, uses an organic electrophotographic photoconductor has more advantageous aspects such as degree of freedom in photoconductive wavelength area, layer deposition property, flexibility, transparency of layer, productivity, toxicity and cost than those of an inorganic photoconductor, an organic electrophotographic photoconductor is now used for almost all photoconductors. The photoconductor repeatedly used in the electrophtography and similar processes requires excellency in electrostatic properties representing sensitivity, receptible potential, potential retainability, potential stability, residual electric potential, spectral-response property and the like.

In light of the foregoing, there are known an azo compound (see Japanese Patent Application Laid-Open (JP-A) No. 54-22834 and Japanese Patent Application Laid-Open (JP-A) No. 61-151659), a phthalocyanine compounds (see Japanese Patent Application Laid-Open (JP-A) No. 48-34189 and Japanese Patent Application Laid-Open (JP-A) No. 57-14874), perylene compounds (see Japanese Patent Application Laid-Open (JP-A) No. 53-98825 and Japanese Patent Application Laid-Open (JP-A) No. 63-266457), polycyclic quinone compounds (see Japanese Patent Application Laid-Open (JP-A) No. 61-48861), squarylium compounds (see Japanese Patent Application Laid-Open (JP-A) No. 49-105536 and Japanese Patent Application Laid-Open (JP-A) No. 58-21416) and the like as the organic photoconductors that have been so far proposed and actually used in the industry.

Above all, the azo compounds can be easily synthesized, since the electrophotographic properties and spectral sensitivity area are largely different due to the facts that the degree of freedom of for molecular design is big and the molecular structures such as azo components, coupler components and bonding types are different, they have been eagerly studied as not only an analogue recording photoconductor but also a digital recording photoconductor. Azo compounds that have been known up to now as the azo compounds showing a good sensitivity include an azo compound having a carbazole skeleton (see Japanese Patent Application Laid-Open (JP-A) No. 53-95033), an azo compound having a distyryl benzene skeleton (see Japanese Patent Application Laid-Open (JP-A) No. 53-133445), an azo compound having a triphenylamine skeleton (see Japanese Patent Application Laid-Open (JP-A) No. 53-132347), an azo compound having a dibenzothiophene (see Japanese Patent Application Laid-Open (JP-A) No. 54-21728), an azo compound having an oxadiazole skeleton (see Japanese Patent Application Laid-Open (JP-A) No. 54-12742), an azo compound having a fluorenone skeleton (see Japanese Patent Application Laid-Open (JP-A) No. 54-22834), an azo compound having a bisstilbene skeleton (see Japanese Patent Application Laid-Open (JP-A) No. 54-17733), an azo compound having a distyrloxadiazole skeleton (see Japanese Patent Application Laid-Open (JP-A) No. 54-2129), and an azo compound having a distyrylcarbazole skeleton (see Japanese Patent Application Laid-Open (JP-A) No. 54-14967).

Also known are a benzidine bisazo compound (see Japanese Patent Application Laid-Open (JP-A) No. 47-37543 and Japanese Patent Application Laid-Open (JP-A) No. 52-55643), a stylbenzene bisazo compound (see Japanese Patent Application Laid-Open (JP-A) No. 52-8832), a diphenylhexatriene bisazo compound (see Japanese Patent Application Laid-Open (JP-A) No. 58-222152), a diphenylbutadiene bisazo compound (see Japanese Patent Application Laid-Open (JP-A) No. 58-222153) and the like.

In addition, already known as the coupler compounds used for the afore-mentioned compounds are a naphthol coupler (see Japanese Patent Application Laid-Open (JP-A) No. 47-37543), a benzcarbazole coupler (see Japanese Patent Application Laid-Open (JP-A) No. 58-122967), a naphthalimide coupler (see Japanese Patent Application Laid-Open (JP-A) No. 54-79632), a perinone coupler (see Japanese Patent Application Laid-Open (JP-A) No. 57-176055), an azulene coupler (see Japanese Patent Application Laid-Open (JP-A) No. 60-10256), an anthracene coupler (see Japanese Patent Application Laid-Open (JP-A) No. 61-257953) or the like.

However, when a conventional azo compound is used for a laminated stacked type photoconductor, which is one embodiment of an electrophotographic photoconductor, it is not enough in practical use since sensitivity and durability are generally low, and it is desirable that sensitivity and durability should be further improved to satisfy various needs, which are required for an electrophotographic process.

In addition, from the viewpoint of the simplification of a manufacturing process and the like, a single laminar constitution is also advantageous as a photoconductor, which uses an organic material.

Conventionally, known as single laminar photoconductors are (i) a charge transport complexes type photoconductor comprising polyvinyl carbazole (PVK) and trinitrofluorene (see Specification of the United States Patent (US-B) No. 3489237), (ii) since a eutectic mixture comprising a thiapyrrylium dye and polycarbonate (see J. Appl. Phys., 49, 5555 (1978)), and (iii) a photoconductor where a perylene pigment and a hydrazone compound are dispersed in a resin (see Japanese Patent Application Laid Open (JP-A) No. 02-37354). Of these, for items (i) and (ii), since the sensitivities of the photoconductors are low, and the electrostatic and mechanical durability is low, they have a problem in the repeated use. For item (iii), since the sensitivity of the photoconductor is low, a high-speed copying process caused inappropriate defects. Further, electrification potentional and sensitivity were low in a system where the components of the laminated type photoconductor that was industrially used were merely dispersed, particularly, since weatherability and electrostatic and mechanical durability were low, there was a defect that electrostatic property largely varied with the repeated use of the photoconductor.

Thus, for the single laminar photoconductor, a difficult task lies in the development of a high-sensitivity and high-durability organic material, particularly, for a charge-generating material, since a charge-generating point is located on the surface side of the photoconductive layer, which is different from the laminated type photoconductor, more weatherability and durability used for the laminated type photoconductor are required.

SUMMARY OF THE INVENTION

It is therefore an object of the present invention, which was conceived in view of the above problems, to provide a high-sensitivity and high durability electrophotographic photoconductor which is practical not only as a high-speed copying machine but also as a laser printer, electrophotography, an electrophotographic apparatus, a process cartridge for an electrophotographic apparatus, new azo compounds preferably used in the electrophotographic photoconductor, a method for efficiently manufacturing the new azo compounds and photoconductive materials.

The inventors relating to the present invention have eagerly continued study for solving the afore-mentioned problems and finally found that an electrophotographic photoconductor that uses an azo compound having a new coupler residue of specific structure has a practical sensitivity and durability. A further persistent study has caused the inventors to find that if the central skeleton of an azo compound is a dibenzo[a,c]phenadine skeleton of specific structure, an azo compound having a new coupler residue of specific structure in the present invention exerts extreme high-sensitivity and excellent durability and reach the present invention.

That is, the present invention is characterized by the below-mentioned:

A first aspect of the present invention is an electrophotographic photoconductor comprising a photoconductive layer on a conductive support, wherein the electrophotographic photoconductor contains an azo compound expressed by Formula (1).

(1)

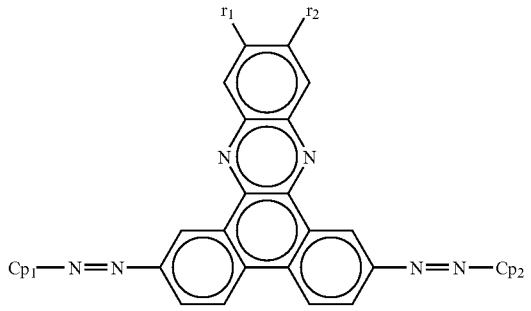

-continued (2)

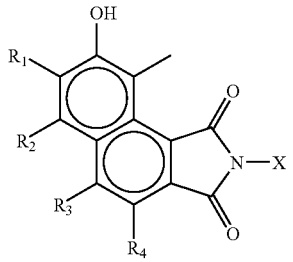

(3)

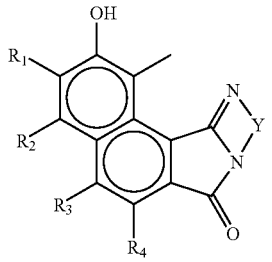

(4)

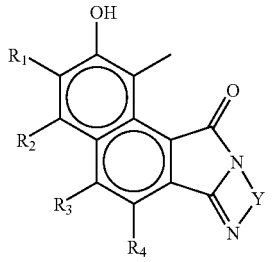

(Formula (1): wherein, "$r_1$" and "$r_2$" represent one of hydrogen atom, alkyl group, alkoxy group, halogen atom, nitro group, amino group, cyano group, acetyl group, benzoyl group which may have a substituent, carboxyl group, alkoxycarbonyl group, phenoxycarbonyl group which may have a substituent and aryl group which may have a substituent, "$CP_1$" and "$CP_2$" represent a coupler residue, and at least one of the "$CP_1$" and the "$CP_2$" is a coupler residue selected from a group consisting of Formula (2), Formula (3) and Formula (4). Formula (2), Formula (3) and Formula (4): wherein, "$R_1$", "$R_2$", "$R_3$" and "$R_4$" represent one of hydrogen atom, alkyl group, alkoxy group, halogen atom, amino group, hydroxy group, nitro group, cyano group, acetyl group, benzoyl group which may have a substituent, alkoxycarbonyl group, phenoxycarbonyl group which may have a substituent and carbamoyl group which may have a substituent. Provided that "$R_1$" and "$R_2$" may be mutually bonded to form one of a substituted or non-substituted ring by alkylene group, a substituted or non-substituted unsaturated aliphatic ring and a substituted or non-substituted aromatic ring. "X" represents one of hydrogen atom, a substituted or non-substituted alkyl group, a substituted or non-substituted cycloalkyl group, a substituted or non-substituted aromatic hydrocarbon group, a substituted or non-substituted heterocyclic group and a substituted or non-substituted amino group, and "Y" represents one of a substituted or non-substituted alkylene group, a substituted or non-substituted cycloalkylene group, a substituted or non-substituted aralkylene group, a substituted or non-substituted bivalent organic residue having aromaticity, a substituted or non-substituted bivalent organic residue having heterocyclic aromaticity, bivalent organic residue containing carbonyl group expressed by —CO-Z- (provided that "Z" represents one of a substituted or non-substituted alkylene, a substituted or non-substituted cycloalkylene, a substituted or non-substituted bivalent organic residue having aromaticity and a substituted or non-substituted bivalent organic residue having heterocyclic aromaticity.)

A second aspect of the present invention is an electrophotographic photoconductor according to Claim 1, wherein at least one of said "$CP_1$" and said "$CP_2$" is a coupler residue expressed by Formula (5) in the azo compounds expressed by said Formula (1).

(5)

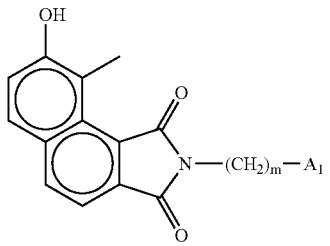

(wherein, "$A_1$" represents one of a substituted or non-substituted aromatic hydrocarbon group or a substituted or non-substituted heterocyclic group, and "m" represents the integer of 1 to 6.)

A third aspect of the present invention is an electrophtographic photoconductor according to Claim 1, wherein at least one of said "$CP_1$" and said "$CP_2$" is a coupler residue expressed by one of Formula (6) and Formula (7) in the azo compounds expressed by said Formula (1).

(6)

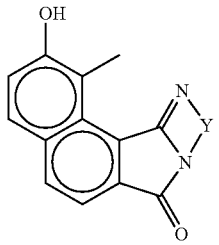

(7)

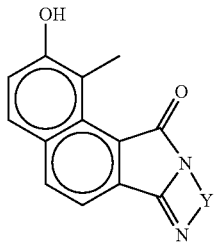

(wherein, "Y" represents one of a substituted or non-substituted alkylene group, a substituted or non-substituted cycloalkylene group, a substituted or non-substituted aralkylene group, a substituted or non-substituted bivalent organic residue having aromaticity, and a substituted or non-substituted bivalent organic residue having heterocyclic aromaticity, a substituted or non-substituted bivalent organic residue having heterocyclic aromaticity, bivalent organic residue containing carbonyl group expressed by —CO-Z- (provided that "Z" represents one of a substituted or non-substituted alkylene, a substituted or non-substituted cycloalkylene, a substituted or non-substituted bivalent organic residue having aromaticity and a substituted or non-substituted bivalent organic residue having heterocyclic aromaticity.)).

A fourth aspect of the present invention is an electrophotographic photoconductor according to Claim 1, wherein at least one of said "$CP_1$" and said "$CP_2$" is a coupler residue expressed by Formula (8) in the azo compounds expressed by said Formula (1).

(8)

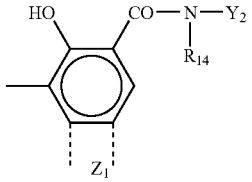

(wherein, "$Z_1$" represents one of a bivalent organic residue which condenses with a benzene ring to form a substituted or non-substituted hydrocarbon ring and a bivalent organic residue which condenses with a benzene ring to form a substituted or non-substituted heterocyclic ring, "$R_{14}$" represents one of hydrogen atom, a substituted or non-substituted alkyl group and a substituted or non-substituted phenyl group, and "$Y_2$" represents one of a substituted or non-substituted hydrocarbon ring group and a substituted or non-substituted heterocyclic ring.)

A fifth aspect of the present invention is an electrophotographic photoconductor according to Claim 1, wherein at least one of said "$CP_1$" and said "$CP_2$" is a coupler residue expressed by one of Formula (9) and Formula (10) in the azo compounds expressed by said Formula (1).

(9)

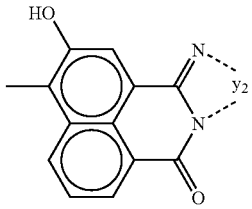

(10)

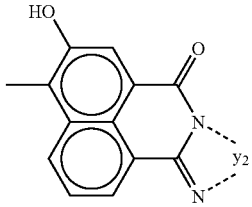

(wherein, "$y_2$" represents one of a bivalent group of aromatic hydrocarbon and a bivalent group of heterocyclic group containing nitrogen atom. These rings may be either substituted or non-substituted.)

A sixth aspect of the present invention is an electrophotographic photoconductor according to Claim 1, wherein the azo compound expressed by said Formula (1) is an azo compound obtained by allowing a diazonium compound expressed by Formula (11) to react with a coupler compound expressed by Formula (12).

(11)

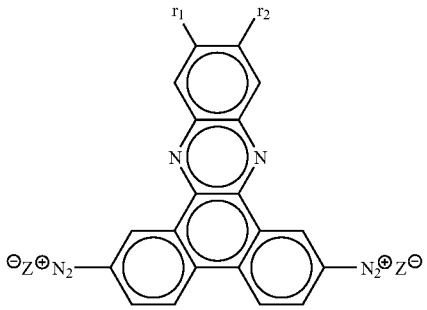

(12)

H—Cp (Formula (11): wherein, "$r_1$" and "$r_2$" represent one of hydrogen atom, alkyl group, alkoxy group, halogen atom and nitro group, and "$z^-$" represents an anion functional group. Formula (12): wherein, "Cp" represents a coupler residue.)

A seventh aspect of the present invention is an electrophotographic photoconductor according to Claim 1, wherein the photoconductive layer contains a charge-generating material and a charge transport material, and the charge-generating material is an azo compound expressed by Formula (1).

A eighth aspect of the present invention is an electrophotographic photoconductor according to Claim 1 which is a single layer-type electrophotographic photoconductor, wherein a single layer photoconductive layer is provided on the electroconductive support directly or through an intermediate layer.

A ninth aspect of the present invention is an electrophotographic photoconductor according to Claim 8, wherein said photoconductive layer further comprising a charge transport material.

A tenth aspect of the present invention is an electrophotographic photoconductor according to Claim 9, wherein said charge transport material is a stilbene compound expressed by Formula (T19).

(T19)

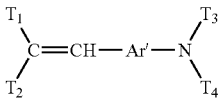

(wherein, "$T_1$" and "$T_2$" independently represent one of a substituted or non-substituted alkyl group or a substituted or non-substituted aryl group, and "$T_3$" and "$T_4$" independently represent one of hydrogen atom, a substituted or non-substituted alkyl or a substituted or non-substituted aryl group and heterocyclic group. "$T_1$" and "$T_2$" may be mutually bonded to form a ring, and "Ar'" represents one of a substituted or non-substituted aryl group and heterocyclic group.)

A eleventh aspect of the present invention is an electrophotographic photoconductor according to Claim 8, wherein said photoconductive layer further contains an acceptor compound.

A twelfth aspect of the present invention is an electrophotographic photoconductor according to Claim 11, wherein said acceptor compound is a 2,3-diphenylindene compound expressed by the following formula.

(12)

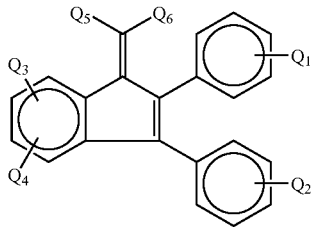

(wherein, "$Q_1$", "$Q_2$", "$Q_3$" and "$Q_4$" represent one of hydrogen atom, a substituted or non-substituted alkyl group, cyano group and nitro group, and "$Q_5$" and "$Q_6$" represent one of a hydrogen atom-substituted or non-substituted aryl group, cyano group, alkoxycarbonyl group and aryloxycarbonyl group.)

A thirteenth aspect of the present invention is an electrophotographic photoconductor according to Claim 8, wherein said photoconductive layer further contains a phenol compound.

A fourteenth aspect of the present invention is an electrophotographic photoconductor according to Claim 13, wherein said phenol compound is a phenol compound expressed by the following formula.

(13)

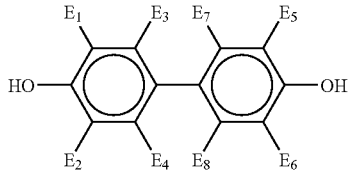

(wherein, "$E_1$", "$E_2$", "$E_3$", "$E_4$", "$E_5$", "$E_6$", "$E_7$" and "$E_8$" represent one of hydrogen atom, a substituted or non-substituted alkyl group or non-substituted alkyl, a substituted or non-substituted or non-substituted alkoxycarbonyl group, a substituted or non-substituted aryl group and a substituted or non-substituted alkoxy group.)

A fifteenth aspect of the present invention is an electrophotographic photoconductor according to Claim 9, wherein said charge transport material is a high-molecular charge transport material.

A sixteenth aspect of the present invention is an electrophotographic photoconductor according to Claim 15, wherein said high-molecular transport material is a polymer of at least one of polycarbonate, polyurethane, polyester and polyether.

A seventeenth aspect of the present invention is an electrophotographic photoconductor according to Claim 16, wherein said high-molecular charge transport material is a high-molecular compound having a triarylamine structure.

A eighteenth aspect of the present invention is an electrophotographic photoconductor according to Claim 17, wherein said high-molecular charge transport material is a polycarbonate having a triarylamine structure.

A nineteenth aspect of the present invention is an electrophotographic photoconductor according to Claim 18, wherein said high-molecular charge transport material is a polycarbonate having a triarylamine structure expressed by the following Formula (1D).

(1D)

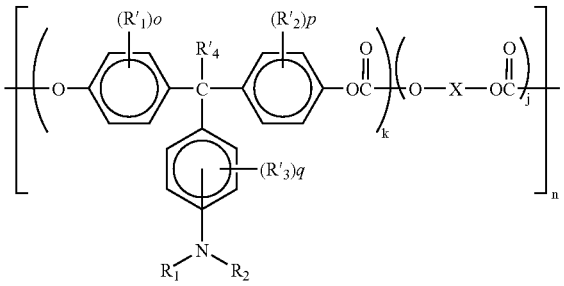

{(wherein, "$R'_1$", "$R'_2$" and "$R'_3$" independently represent one of a substituted or non-substituted alkyl group and halogen atom, and "$R'_4$" represents hydrogen atom or represent a substituted or non-substituted alkyl group. "$R_1$" and "$R_2$" represent a substituted or non-substituted aryl group. "o", "p" and "q" independently represent the integer of 0 to 4. "k" and "j" represent the compositions, where $0.1 \leqq k \leqq 1$ and $0 \leqq j \leqq 0.9$, and "n" represents a repeating unit and is the integer of 5 to 5,000. "X" represents one of the bivalent group of an aliphatic group, and a bivalent group expressed by the following Formula (A).

(A)

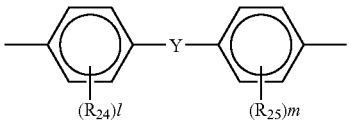

[wherein, "$R_{24}$" and "$R_{25}$" independently represent one of a substituted or non-substituted alkyl group, aryl group and halogen atom, and "l" and "m" represent the integer of 0 to 4. "Y" represents one of a single bond, a straight chain, branched or cyclic alkylene group with 1 to 12 carbon atoms, —O—, —S—, —SO—, —$SO_2$—, —CO—, —CO—O-Z-O—CO— (wherein, "Z" represents an aliphatic bivalent group) and the following Formula ().

(B)

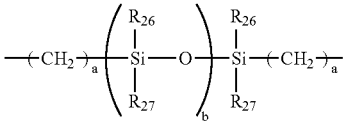

[wherein, "a" represents the integer of 1 to 20, and "b" represents the integer of 1 to 2,000. "$R_{26}$" and "$R_{27}$" represent one of a substituted or non-substituted alkyl group and aryl group.] "$R_{24}$", "$R_{25}$", "$R_{26}$", "$R_{27}$" may be identical or different.]

A twentieth aspect of the present invention is an electrophotographic photoconductor according to Claim 18, wherein said high-molecular transport material is a polycarbonate having a triarylamine structure expressed by the following Formula (2D).

(2D)

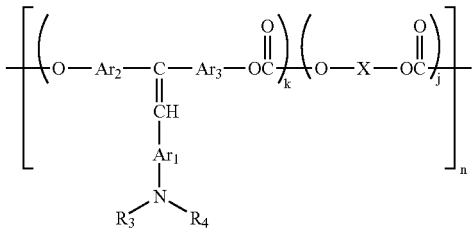

{wherein, "$R_3$" and "$R_4$" represent a substituted or non-substituted aryl group, and "$Ar_1$", "$Ar_2$" and "$Ar_3$" represent the same or different allylene group. "k" and "j" represent the compositions where $0.1 \leqq k \leqq 1$ and $0 \leqq j \leqq 0.9$, and "n" represents a repeating unit and is the integer of 5 to 5,000. "X" represents one of an aliphatic bivalent group, and a bivalent group expressed by the following Formula (A).

(A)

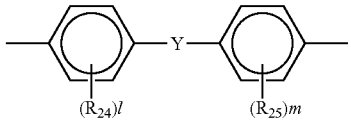

[wherein, "$R_{24}$" and "$R_{25}$" independently represent one of a substituted or non-substituted alkyl group, aryl group and halogen atom, and "l" and "m" represent the integer of 0 to 4. "Y" represents one of a single bond, a straight chain, branched or cyclic alkylene group with 1 to 12 carbon atoms, —O—, —S—, —SO—, —$SO_2$—, —CO—, —CO—O-Z-O—CO— (wherein, "Z" represents the bivalent group of an aliphatic group) and the following Formula (B).]

(B)

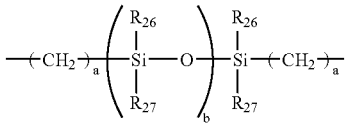

(wherein, "a" represents the integer of 1 to 20, and "b" represents the integer of 1 to 2,000. "$R_{26}$" and "$R_{27}$" represent one of a substituted or non-substituted alkyl group and aryl group.) "$R_{24}$", "$R_{25}$", "$R_{26}$", "$R_{27}$" may be identical or different.])

A twenty first aspect of the present invention is an electrophotographic photoconductor according to Claim 18, wherein said high-molecular transport material is a polycarbonate having a triarylamine structure expressed by the following Formula (3D).

(3D)

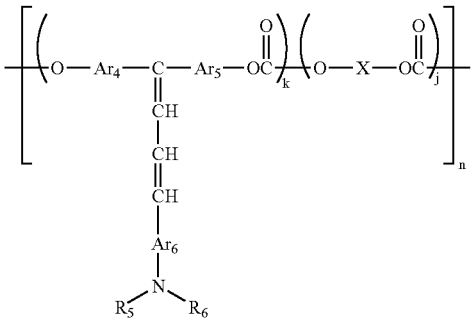

{wherein, "$R_5$" and "$R_6$" represent a substituted or non-substituted aryl group, "$Ar_4$", "$Ar_5$" and "$Ar_6$" represent the same or different allylene group. "k" and "j" represent the compositions where $0.1 \leqq k \leqq 1$ and $0 \leqq j \leqq 0.9$, and "n" represents a repeating unit and is the integer of 5 to 5,000. "X" represents one of an aliphatic bivalent group, and a bivalent group expressed by the following Formula (A).}

(A)

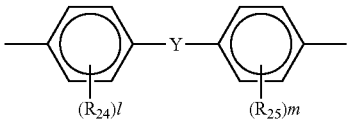

[wherein, "$R_{24}$" and "$R_{25}$" independently represent one of a substituted or non-substituted alkyl group, aryl group and halogen atom, and "l" and "m" represent the integer of 0 to 4. "Y" represents one of a single bond, a straight chain, branched or cyclic alkylene group with 1 to 12 carbon atoms, —O—, —S—, —SO—, —$SO_2$—, —CO—, —CO—O-Z-O—CO— (wherein, "Z" represents an aliphatic bivalent group) and the following Formula (B).

(B)

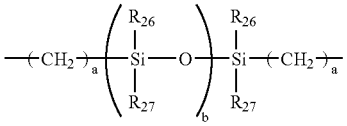

(wherein, "a" represents the integer of 1 to 20, and "b" represents the integer of 1 to 2,000. "$R_{26}$" and "$R_{27}$" represent one of a substituted or non-substituted alkyl group and aryl group.) "$R_{24}$", "$R_{25}$", "$R_{26}$", "$R_{27}$" may be identical or different.})

A twenty second aspect of the present invention is an electrophotographic photoconductor according to Claim 18, wherein said high-molecular transport material is a polycarbonate having a triarylamine structure expressed by the following Formula (4D).

(4D)

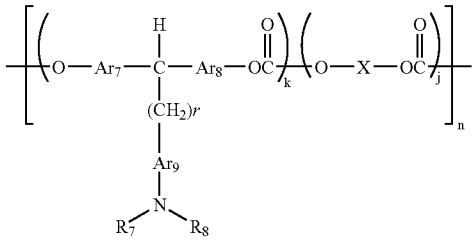

(wherein, "$R_7$" and "$R_8$" represent a substituted or non-substituted aryl group, and "$Ar_7$", "$Ar_8$" and "$Ar_9$" represent the same or different allylene group. "k" and "j" represent the compositions where $0.1 \leqq k \leqq 1$ and $0 \leqq j \leqq 0.9$, and "n" represents a repeating unit and is the integer of 5 to 5,000. "r" represents the integer of 1 to 5. "X" represents one of an aliphatic bivalent group, and a bivalent group expressed by the following Formula (A)

(A)

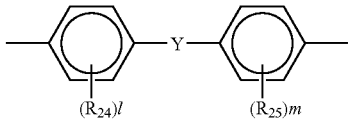

[wherein, "$R_{24}$" and "$R_{25}$" independently represent one of a substituted or non-substituted alkyl group, aryl group and halogen atom, and "l" and "m" represent the integer of 0 to 4. "Y" represents one of a single bond, a straight chain, branched or cyclic alkylene group with 1 to 12 carbon atoms, —O—, —S—, —SO—, —$SO_2$—, —CO—, —CO—O-Z-O—CO— (wherein, "Z" represents an aliphatic bivalent group) and the following Formula (B).]

(B)

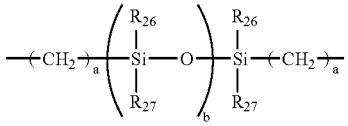

(wherein, "a" represents the integer of 1 to 20, and "b" represents the integer of 1 to 2,000. "$R_{26}$" and "$R_{27}$" represent one of a substituted or non-substituted alkyl group and aryl group.) "$R_{24}$", "$R_{25}$", "$R_{26}$", "$R_{27}$" may be identical or different.})

A twenty third aspect of the present invention is an electrophotographic photoconductor according to Claim 18, wherein said high-molecular transport material is a polycarbonate having a triarylamine structure expressed by the following Formula (5D).

(5D)

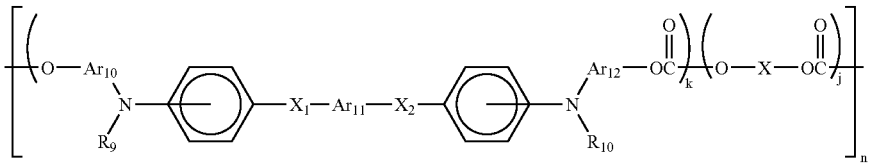

{wherein, "$R_9$" and $R_{10}$" represent a substituted or non-substituted aryl group, and "$Ar_{10}$", "$Ar_{11}$" and "$Ar_{12}$" represent the same or different allylene group. "$X_1$" and "$X_2$" represent one of a substituted or non-substituted ethylene group and a substituted or non-substituted vinylene group. "k" and "j" represent the compositions where $0.1 \leqq k \leqq 1$ and $0 \leqq j \leqq 0.9$, and "n" represents a repeating unit and is the integer of 5 to 5,000. "X" represents one of an aliphatic bivalent group, and a bivalent group expressed by the following Formula (A).

(A)

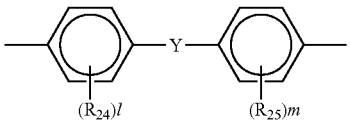

[wherein, "$R_{24}$" and "$R_{25}$" independently represent one of a substituted or non-substituted alkyl group, aryl group and halogen atom, and "l" and "m" represent the integer of 0 to 4. "Y" represents one of a single bond, a straight chain, branched or cyclic alkylene group with 1 to 12 carbon atoms, —O—, —S—, —SO—, —$SO_2$—, —CO—, —CO—O-Z-O—CO— (wherein, "Z" represents an aliphatic bivalent group) and the following Formula (B).

(B)

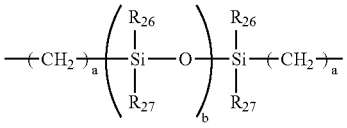

(wherein, "a" represents the integer of 1 to 20, and "b" represents the integer of 1 to 2,000. "$R_{26}$" and "$R_{27}$" represents one of a substituted or non-substituted alkyl group and aryl group.) "$R_{24}$", "$R_{25}$", "$R_{26}$", "$R_{27}$" may be identical or different.]}

A twenty fourth aspect of the present invention is an electrophotographic photoconductor according to Claim 18, wherein said high-molecular transport material is a polycarbonate having a triarylamine structure expressed by the following Formula (6D).

(6D)

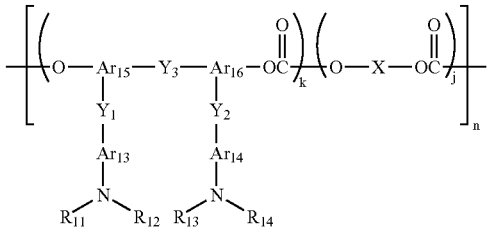

[wherein, "$R_{11}$", "$R_{12}$", "$R_{13}$" and "$R_{14}$" represent a substituted or non-substituted aryl group, and "$Ar_{13}$", "$Ar_{14}$", "$Ar_{15}$" and "$Ar_{16}$" represent the same or different allylene group. "$Y_1$", "$Y_2$" and "Y3" represent one of a single bond, a substituted or non-substituted alkylene group, a substituted or non-substituted cycloalkylene group, a substituted or non-substituted alkyleneether group, oxygen atom, sulfur atom and vinylene group and may be the same or different. "k" and "j" represent the compositions where $0.1 \leqq k \leqq 1$ and $0 \leqq j \leqq 0.9$, and "n" represents a repeating unit and is the integer of 5 to 5,000. "X" represents one of an aliphatic bivalent group, and a bivalent group expressed by the following Formula (A).

(A)

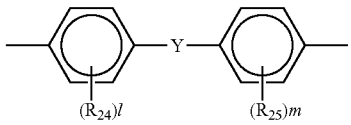

[wherein, "$R_{24}$" and "$R_{25}$" independently represent one of a substituted or non-substituted alkyl group, aryl group and halogen atom, and "l" and "m" represent the integer of 0 to 4. "Y" represents one of a single bond, a straight chain, branched or cyclic alkylene group with 1 to 12 carbon atoms, —O—, —S—, —SO—, —$SO_2$—, —CO—, —CO—O-Z-O—CO— (wherein, "Z" represents an aliphatic bivalent group) and the following Formula (B).]

(B)

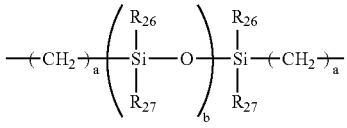

(wherein, "a" represents the integer of 1 to 20, and "b" represents the integer of 1 to 2,000. "$R_{26}$" and "$R_{27}$" represent one of a substituted or non-substituted alkyl group and aryl group.) "$R_{24}$", "$R_{25}$", "$R_{26}$", "$R_{27}$" may be identical or different.]}

A twenty fifth aspect of the present invention is an electrophotographic photoconductor according to Claim 18, wherein said high-molecular transport material is a polycarbonate having a triarylamine structure expressed by the following Formula (7D).

(7D)

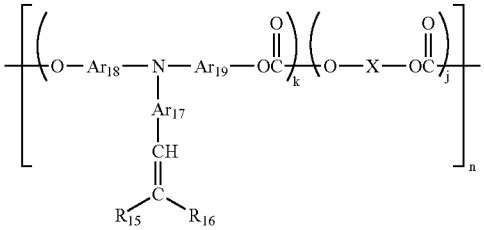

[wherein, "$R_{15}$" and "$R_{16}$" represent one of hydrogen atom, and a substituted or non-substituted aryl group, and may form a ring. "$Ar_{17}$", "$Ar_{18}$" and "$Ar_{19}$" represent the same or different allylene group. "k" and "j" represent the compositions where $0.1 \leqq k \leqq 1$ and $0 \leqq j \leqq 0.9$, and "n" represents a repeating unit and is the integer of 5 to 5,000. "X" represents one of an aliphatic bivalent group, and a bivalent group expressed by the following Formula (A).]

(A)

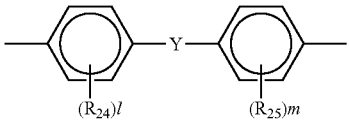

[wherein, "$R_{24}$" and "$R_{25}$" independently represent one of a substituted or non-substituted alkyl group, aryl group and halogen atom, and "l" and "m" represent the integer of 0 to 4. "Y" represents one of a single bond, a straight chain, branched or cyclic alkylene group with 1 to 12 carbon atoms, —O—, —S—, —SO—, —$SO_2$—, —CO—, —CO—O-Z-O—CO— (wherein, "Z" represents an aliphatic bivalent group) and the following Formula (B).]

(B)

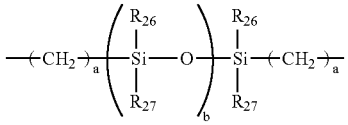

(wherein, "a" represents the integer of 1 to 20, and "b" represents the integer of 1 to 2,000. "$R_{26}$" and "$R_{27}$" represent one of a substituted or non-substituted alkyl group and aryl group.) "$R_{24}$", "$R_{25}$", "$R_{26}$", "$R_{27}$" may be identical or different.])

A twenty sixth aspect of the present invention is an electrophotographic photoconductor according to Claim 18, wherein said high-molecular transport material is a polycarbonate having a triarylamine structure expressed by the following Formula (8D).

(8D)

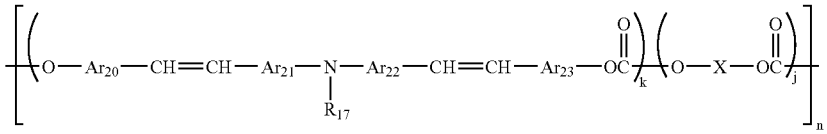

[wherein, "$R_{17}$" represents a substituted or non-substituted aryl group, "$Ar_{20}$", "$Ar_{21}$", "$Ar_{22}$" and "$Ar_{23}$" represent the same or different allylene group. "k" and "j" represent the compositions where $0.1 \leqq k \leqq 1$ and $0 \leqq j \leqq 0.9$, and "n" represents a repeating unit and is the integer of 5 to 5,000. "r" represents integer of 1 to 5. "X" represents one of an aliphatic bivalent group, and a bivalent group expressed by the following Formula (A).

(A)

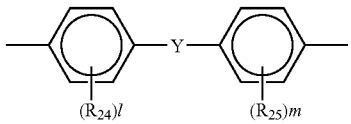

[wherein, "$R_{24}$" and "$R_{25}$" independently represent one of a substituted or non-substituted alkyl group, aryl group and halogen atom, and "l" and "m" represent the integer of 0 to 4. "Y" represents one of a single bond, a straight chain, branched or cyclic alkylene group with 1 to 12 carbon atoms, —O—, —S—, —SO—, —$SO_2$—, —CO—, —CO—O-Z-O—CO— (wherein, "Z" represents an aliphatic bivalent group) and the following Formula (B).

(B)

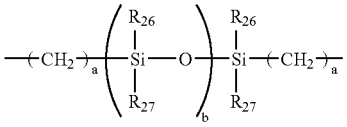

(wherein, "a" represents the integer of 1 to 20, and "b" represents the integer of 1 to 2,000. "$R_{26}$" and "$R_{27}$" represent one of a substituted or non-substituted alkyl group and aryl group.) "$R_{24}$", "$R_{25}$", "$R_{26}$", "$R_{27}$" may be identical or different.]}

A twenty seventh aspect of the present invention is an electrophotographic photoconductor according to Claim 18, wherein said high-molecular transport material is a polycarbonate having a triarylamine structure expressed by the following Formula (9D).

(9D)

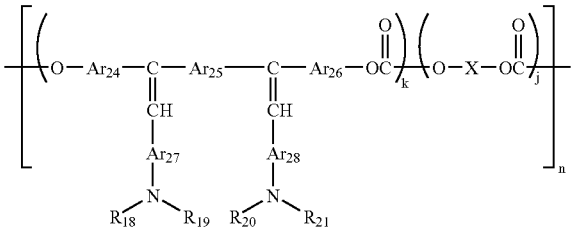

{wherein, "$R_{18}$", "$R_{19}$", "$R_{20}$" and "$R_{21}$" represent a substituted or non-substituted aryl group, "$Ar_{24}$", "$Ar_{25}$", "$Ar_{26}$", "$Ar_{27}$" and "$Ar_{28}$" represent the same or different allylene group. "k" and "j" represent the compositions where $0.1 \leqq k \leqq 1$ and $0 \leqq j \leqq 0.9$, and "n" represents a repeating unit and is the integer of 5 to 5,000. "X" represents one of an aliphatic bivalent group, and a bivalent group expressed by the following Formula (A).

(A)

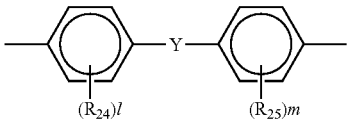

[wherein, "$R_{24}$" and "$R_{25}$" independently represent one of a substituted or non-substituted alkyl group, aryl group and halogen atom, and "l" and "m" represent the integer of 0 to 4. "Y" represents one of a single bond, a straight chain, branched or cyclic alkylene group with 1 to 12 carbon atoms, —O—, —S—, —SO—, —$SO_2$—, —CO—, —CO—O-Z-O—CO— (wherein, "Z" represents an aliphatic bivalent group) and the following Formula (B).

(B)

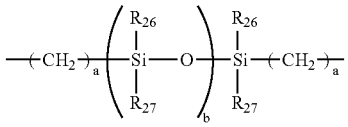

(wherein, "a" represents the integer of 1 to 20, and "b" represents the integer of 1 to 2,000. "$R_{26}$" and "$R_{27}$" represent one of a substituted or non-substituted alkyl group and aryl group.) "$R_{24}$", "$R_{25}$", "$R_{26}$", "$R_{27}$" may be identical or different.]}

A twenty eighth aspect of the present invention is an electrophotographic photoconductor according to Claim 18, wherein said high-molecular transport material is a polycarbonate having a triarylamine structure expressed by the following Formula (10D).

(10D)

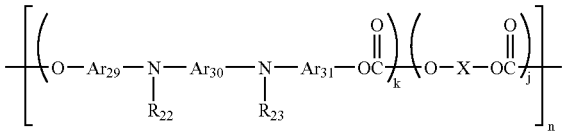

[wherein, "$R_{22}$" and "$R_{23}$" represent a substituted or non-substituted aryl group, "$Ar_{29}$", "$Ar_{30}$" and "$Ar_{31}$" represent the same or different allylene group. "k" and "j" represent the compositions where $0.1 \leqq k \leqq 1$ and $0 \leqq j \leqq 0.9$, and "n" represents a repeating unit and is the integer of 5 to 5,000. "X" represents one of an aliphatic bivalent group, and a bivalent group expressed by the following Formula (A).

(A)

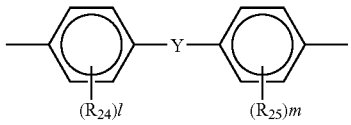

[wherein, "$R_{24}$" and "$R_{25}$" independently represent one of a substituted or non-substituted alkyl group, aryl group and halogen atom, and "l" and "m" represent the integer of 0 to 4. "Y" represents one of a single bond, a straight chain, branched or cyclic alkylene group with 1 to 12 carbon atoms, —O—, —S—, —SO—, —$SO_2$—, —CO—, —CO—O-Z-O—CO— (wherein, "Z" represents an aliphatic bivalent group) and the following Formula (B).

(B)

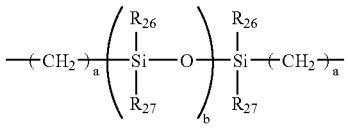

(wherein, "a" represents the integer of 1 to 20, and "b" represents the integer of 1 to 2,000. "$R_{26}$" and "$R_{27}$" represent one of a substituted or non-substituted alkyl group and aryl group.) "$R_{24}$", "$R_{25}$", "$R_{26}$", "$R_{27}$" may be identical or different.))

A twenty ninth aspect of the present invention is an electrophotographic photoconductor according to Claim 18, wherein said high-molecular transport material is a polycarbonate having a triarylamine structure expressed by the following Formula (11D).

(11D)

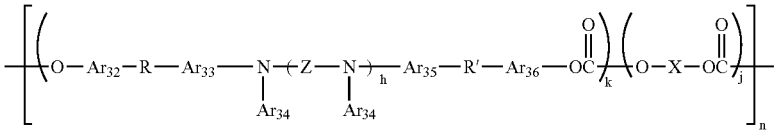

{wherein, "$Ar_{32}$", "$Ar_{33}$", "$Ar_{35}$" and "$Ar_{36}$" represent a substituted or non-substituted allylene group, and "$Ar_{34}$" represents a substituted or non-substituted aryl group. "Z" represents allylene group or —$Ar_{37}$-Za-$Ar_{37}$—, "$Ar_{37}$" represents a substituted or non-substituted allylene group. "Za" represents one of O, S and allylene group. "R" and "R" represent one of a straight chain or branched allylene group and —O—. "h" represents 0 or 1. "k" and "j" represent the compositions where $0.1 \leqq k \leqq 1$ and $0 \leqq j \leqq 0.9$, and "n" represents a repeating unit and is the integer of 5 to 5,000. "X" represents one of an aliphatic bivalent group, a substituted or non-substituted aromatic bivalent group, a bivalent group that can be formed by bonding these groups and bivalent group expressed by the following Formula (A'), Formula (F) and Formula (G).

(A')

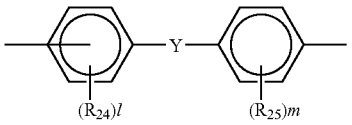

(F)

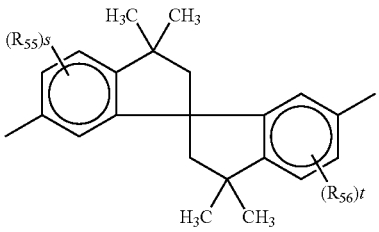

(G)

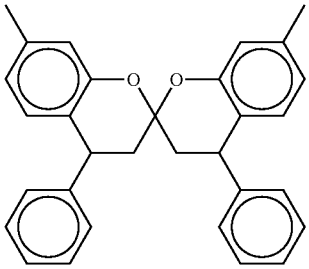

[wherein, "$R_{24}$", "$R_{25}$", "$R_{55}$" and "$R_{56}$" independently represent one of a substituted or non-substituted alkyl group, a substituted or non-substituted aryl group and halogen atom. "l" and "m" represent the integer of 0 to 4. "s" and "t" independently represent the integer of 0 to 3. "$R_{24}$", "$R_{25}$", "$R_{55}$", "$R_{56}$" may be the same or different if a plurality of them are present, respectively. "Y" represents one of a single bond, a straight chain, branched or cyclic alkylene group with 1 to 12 carbon atoms, a bivalent group comprising an alkylene with 1 to 10 carbon atoms, at least one oxygen atom and at least one sulfur atom, —O—, —S—, —SO—, —$SO_2$—, —CO—, —COO—, —CO—O-$Z_1$-O—CO— and —CO-$Z_2$—CO— (wherein, "$Z_1$" and "$Z_2$" represent one of an aliphatic bivalent group and a substituted or non-substituted allylene group) and the following Formula (B) and Formulas (H) (I) (J) (K) (L) (M) and (N).

(B)

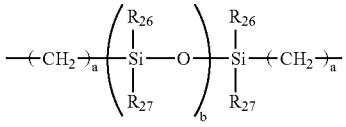

(H)

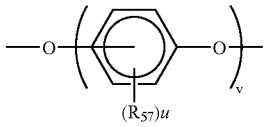

(I)

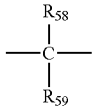

(J)

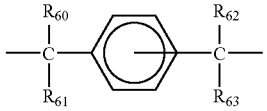

(K)

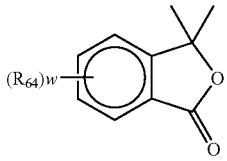

(L)

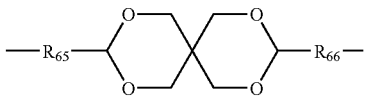

(M)

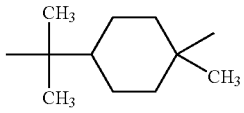

-continued (N)

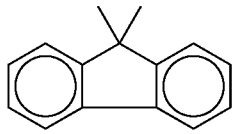

(wherein, "$R_{26}$" and "$R_{27}$" independently represent one of a substituted or non-substituted alkyl group and a substituted or non-substituted aryl group. "$R_{57}$", "$R_{58}$" and "$R_{64}$" independently represent one of halogen atom, a substituted or non-substituted alkyl group and a substituted or non-substituted aryl group and a substituted or non-substituted aryl group. "$R_{59}$", "$R_{60}$", "$R_{61}$", "$R_{62}$" and "$R_{63}$" independently represent one of hydrogen atom, halogen atom, a substituted or non-substituted alkyl group, a substituted or non-substituted alkoxy group and a substituted or non-substituted aryl group. "$R_{58}$" and "$R_{59}$" may be bonded to form ring having 5 to 12 carbon atoms. "$R_{65}$" and "$R_{66}$" represent an alkylene group with a single bond or having 1 to 4 carbon atoms. "a" represents the integer of 1 to 20, "b" represents the integer of 1 to 2000, "u" and "w" represent the integer of 0 to 4 and "v" represents 1 or 2. "$R_{26}$", "$R_{27}$", "$R_{57}$" and "$R_{64}$" may be the same or different if a plurality of them are present, respectively.)]}

A thirtieth aspect of the present invention is an electrophotographic photoconductor according to claim 15, wherein said photoconductive layer further contains an acceptor compound.

A thirty first aspect of the present invention is an electrophotographic photoconductor according to Claim 30, wherein said acceptor compound is a 2,3-diphenylindene compound expressed by the following Formula.

(11)

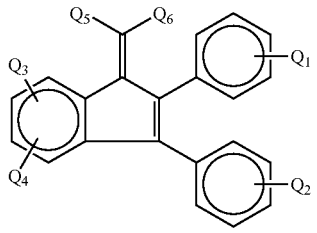

(wherein, "$Q_1$", "$Q_2$", "$Q_3$" and "$Q_4$" represent one of hydrogen atom, halogen atom, a substituted or non-substituted alkyl group, cyano group and nitro group, and "$Q_5$" and "$Q_6$" represent one of a hydrogen atom-substituted or non-substituted aryl group, cyano group, alkoxycarbonyl group and aryloxycarbonyl group.)

A thirty second aspect of the present invention is an electrophotographic photoconductor according to Claim 15, wherein said photoconductive layer further contains a phenol compound.

A thirty third aspect of the present invention is an electrophotographic photoconductor according to Claim 32, wherein said phenol compound is a phenol compound expressed by the following Formula.

(12)

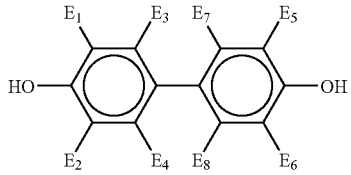

(wherein, "$E_1$", "$E_2$", "$E_3$", "$E_4$", "$E_5$", "$E_6$", "$E_7$", and "$E_8$" represent one of hydrogen atom, a substituted or non-substituted alkyl group, a substituted or non-substituted alkoxycarbonyl group, a substituted or non-substituted aryl group and a substituted or non-substituted alkoxy group.)

A thirty fourth aspect of the present invention is an electrophotography comprising:

for charging an electrophotographic photoconductor;

uniformly exposing said electrophotographic photoconductor electrified by said electrification process to form a latent electrostatic image;

for forming a toner image by feeding a developer to said latent electrostatic image to visualize the latent electrostatic image; and for transferring the toner image formed by the development process on a transfer material, wherein the electrophotographic photoconductor is an electrophotographic photoconductor including a photoconductive layer on a conductive support, wherein the electrophotographic photoconductor contains an azo compound expressed by Formula (1).

(1)

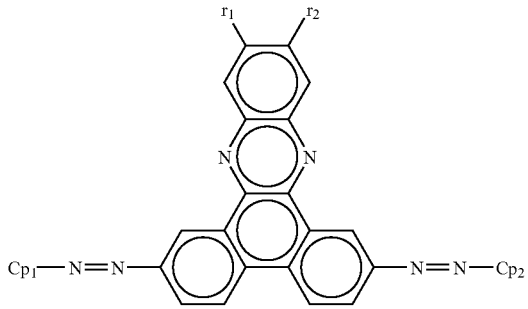

(2)

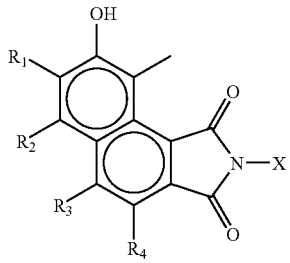

-continued (3)

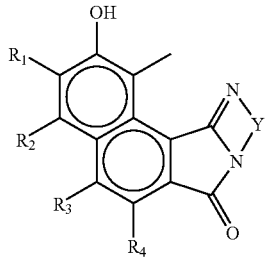

(4)

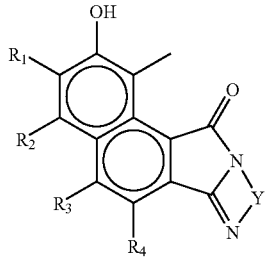

(Formula (1): wherein, "r1" and "r2" represent one of hydrogen atom, alkyl group, alkoxy group, halogen atom, nitro group, amino group, cyano group, acetyl group, benzoyl group which may have a substituent, carbonyl group, alkoxycarbonyl group, phenoxycarbonyl group which may have a substituent and aryl group which may have a substituent. "$CP_1$" and "$CP_2$" represent a coupler residue, and at least one of the "$CP_1$" and "$CP_2$" is a coupler residue selected from Formula (1), Formula (2), Formula (3) and Formula (4). Formula (2), Formula (3) and Formula (4): wherein, "$R_1$", "$R_2$", "$R_3$" and "$R_4$" represent one of hydrogen, alkyl group, alkoxy group, halogen atom, amino group, hydroxy group, nitro group, cyano group, acetyl group, benzoyl group which may have a substituent, alkoxycarbonyl group, phenoxycarbonyl group which may have a substituent, and carbamoyl group which may have a substituent However, "$R_1$" and "$R_2$" may be mutually bonded to form one of a substituted or non-substituted ring by alkylene, a substituted or non-substituted unsaturated aliphatic ring (corresponding to the Claim of an azo compound) and a substituted or non-substituted aromatic ring. "X" represents one of hydrogen atom, a substituted or non-substituted alkyl group, a substituted or non-substituted cycloalkyl group, a substituted or non-substituted aromatic hydrocarbon group, a substituted or non-substituted heterocyclic group and a substituted or non-substituted amino group, and "Y" represents one of a substituted or non-substituted alkylene group, a substituted or non-substituted cycloalkylene group, a substituted or non-substituted aralkylene group, a bivalent organic residue having a substituted or non-substituted aromaticity, a bivalent organic residue having a substituted or non-substituted heterocyclic aromaticity, a bivalent organic residue containing carbonyl group expressed by —CO-Z- (however, provided that Z represents a substituted or non-substituted alkylene group, a substituted or non-substituted cycloalkylene group, a bivalent organic residue having a substituted or non-substituted aromaticity and a bivalent organic residue having a substituted or non-substituted heterocyclic aromaticity.))

A thirty fifth aspect of the present invention is an electrophotographic apparatus comprising:

an electrophotographic photoconductor;

a charger configured to charge charging the electrophotographic photoconductor;

an exposure apparatus configured to expose uniformly said electrophotographic photoconductor electrified by the charger to form a latent electrostatic image;

a developing apparatus configured to form a toner image by feeding a developer to the latent electrostatic image to visualize the latent electrostatic image; and a transferring apparatus configured to transfer the toner image formed by the developing apparatus onto a transfer material, wherein the electrophotographic photoconductor is an electrophotographic photoconductor including a photoconductive layer on a conductive support, wherein the electrophotographic photoconductor contains an azo compound expressed by Formula (1).

(1)

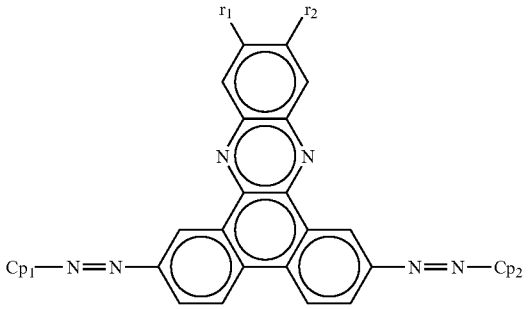

(2)

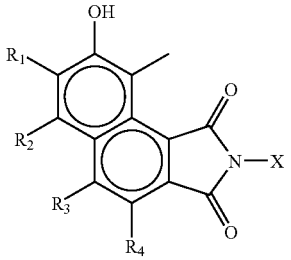

(3)

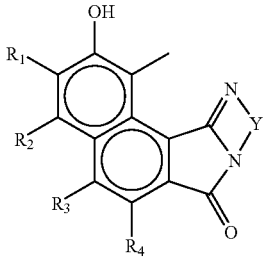

(4)

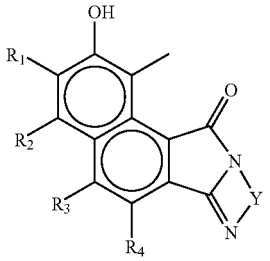

(Formula (1): wherein, "$r_1$" and "$r_2$" represent one of hydrogen atom, alkyl group, alkoxy group, halogen atom, nitro group, amino group, cyano group, acetyl group, benzoyl group which may have a substituent, carboxyl group, alkoxycarbonyl group, phenoxycarbonyl group which may have a substituent and aryl group which may have a substituent, "$CP_1$" and "$CP_2$" represent a coupler residue, and at least one of the "$CP_1$" and the "$CP_2$" is a coupler residue selected from a group consisting of Formula (2), Formula (3) and Formula (4). Formula (2), Formula (3) and Formula (4): wherein, "$R_1$", "$R_2$", "$R_3$" and "$R_4$" represent one of hydrogen atom, alkyl group, alkoxy group, halogen atom, amino group, hydroxy group, nitro group, cyano group, acetyl group, benzoyl group which may have a substituent, alkoxycarbonyl group, phenoxycarbonyl group which may have a substituent and carbamoyl group which may have a substituent. Provided that "$R_1$" and "$R_2$" may be mutually bonded to form one of a substituted or non-substituted ring by alkylene, a substituted or non-substituted unsaturated aliphatic ring and a substituted or non-substituted aromatic ring. "X" represents one of hydrogen atom, a substituted or non-substituted alkyl group, a substituted or non-substituted cycloalkyl group, a substituted or non-substituted aromatic hydrocarbon group, a substituted or non-substituted heterocyclic group and a substituted or non-substituted amino group, and "Y" represents one of a substituted or non-substituted alkylene group, a substituted or non-substituted cycloalkylene group, a substituted or non-substituted aralkylene group, a substituted or non-substituted bivalent organic residue having aromaticity, a substituted or non-substituted bivalent organic residue having heterocyclic aromaticity, bivalent organic residue containing carbonyl group expressed by —CO-Z- (provided that "Z" represents one of a substituted or non-substituted alkylene, a substituted or non-substituted cycloalkylene, a substituted or non-substituted bivalent organic residue having aromaticity and a substituted or non-substituted bivalent organic residue having heterocyclic aromaticity.)

A thirty sixth aspect of the present invention is an process cartridge for an electrophotographic photoconductor comprising:

at least one of a configured to charge uniformly a surface of the electrophotographic photoconductor; an exposure apparatus configured to form a latent electrostatic image by uniformly exposing the charged electrophotographic photoconductor; a cleaning apparatus for cleaning the surface of the electrophotographic photoconductor; a developing apparatus configured to form a toner image by feeding a developer to the latent image on the electrophotographic photoconductor to visualize the latent electrostatic image; and a transferring apparatus configured to transfer the toner image formed by the developing apparatus to the transfer material; and the electrophotographic photoconductor, the electrophotographic photoconductor and the at least of the charger, the exposure apparatus, the cleaning apparatus, the developing apparatus, the transferring apparatus being detachably configured as an integral structure with respect to the electrophotographic apparatus body, wherein the electrophotographic photoconductor is an electrophotographic photoconductor including a photoconductive layer on a conductive support, wherein the electrophotographic photoconductor contains an azo compound expressed by Formula (1).

(1)

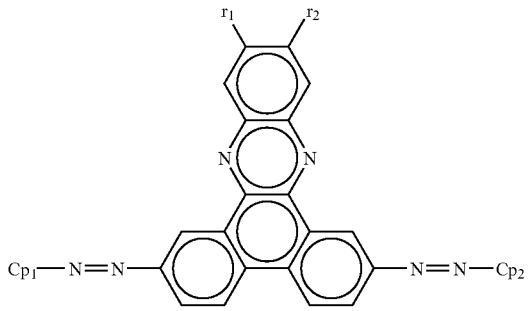

(2)

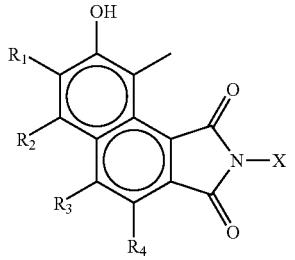

(3)

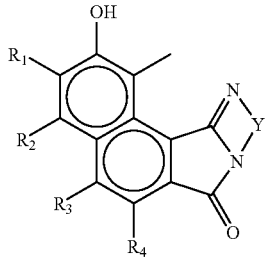

(4)

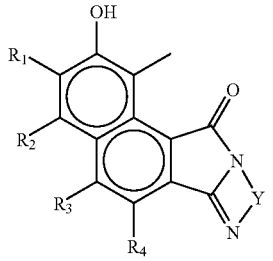

(Formula (1): wherein, "$r_1$" and "$r_2$" represent one of hydrogen atom, alkyl group, alkoxy group, halogen atom, nitro group, amino group, cyano group, acetyl group, benzoyl group which may have a substituent, carboxyl group, alkoxycarbonyl group, phenoxycarbonyl group which may have a substituent and aryl group which may have a substituent, "$CP_1$" and "$CP_2$" represent a coupler residue, and at least one of the "$CP_1$" and the "$CP_2$" is a coupler residue selected from a group consisting of Formula (2), Formula (3) and Formula (4). Formula (2), Formula (3) and Formula (4): wherein, "$R_1$", "$R_2$", "$R_3$" and "$R_4$" represent one of hydrogen atom, alkyl group, alkoxy group, halogen atom, amino group, hydroxy group, nitro group, cyano group, acetyl group, benzoyl group which may have a substituent, alkoxycarbonyl group, phenoxycarbonyl group which may have a substituent and carbamoyl group which may have a substituent. Provided that "$R_1$"and "$R_2$" may be mutually bonded to form one of a substituted or non-substituted ring by alkylene, a substituted or non-substituted unsaturated aliphatic ring and a substituted or non-substituted aromatic ring. "X" represents one of hydrogen atom, a substituted or non-substituted alkyl group, a substituted or non-substituted cycloalkyl group, a substituted or non-substituted aromatic hydrocarbon group, a substituted or non-substituted heterocyclic group and a substituted or non-substituted amino group, and "Y" represents one of a substituted or non-substituted alkylene group, a substituted or non-substituted cycloalkylene group, a substituted or non-substituted aralkylene group, a substituted or non-substituted bivalent organic residue having aromaticity, a substituted or non-substituted bivalent organic residue having heterocyclic aromaticity, bivalent organic residue containing carbonyl group expressed by —CO-Z- (provided that "Z" represents one of a substituted or non-substituted alkylene, a substituted or non-substituted cycloalkylene, a substituted or non-substituted bivalent organic residue having aromaticity and a substituted or non-substituted bivalent organic residue having heterocyclic aromaticity.)

A thirty seventh aspect of the present invention is an azo compound, wherein the azo compound is expressed by the following Formula (1).

(1)

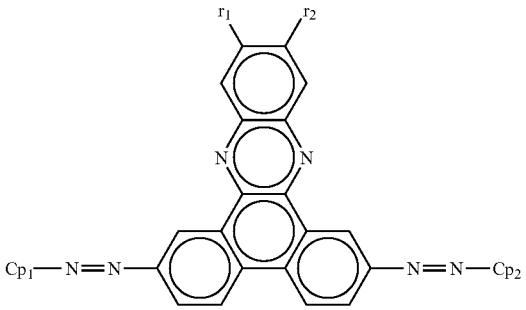

(2)

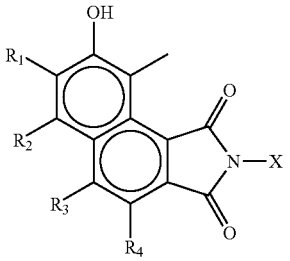

-continued (3)

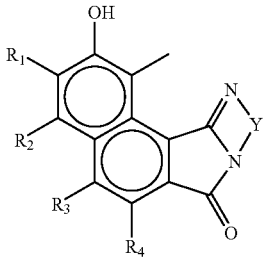

(4)

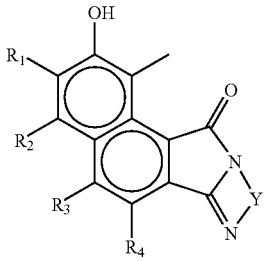

(Formula (1): wherein, "r1" and "r2" independently represent one of hydrogen atom, alkyl group, alkoxy group, halogen atom, nitro group, amino group, cyano group, acetyl group, benzoyl group which may have a substituent, carboxyl group, alkoxycarbonyl group, phenoxycarbonyl group which may have substituent and aryl group which may have a substituent. "$Cp_1$" and "$Cp_2$" represent a coupler residue, and at least one of "$Cp_1$" and "$Cp_2$" is a coupler residue expressed by one of the following Formula (2), Formula (3) and Formula (4).

Formula (2), Formula (3) and Formula (4) above: wherein, "$R_1$", "$R_2$", "$R_3$" and "$R_4$" independently represent one of hydrogen atom, alkyl group, or alkoxy group, halogen atom, amino group, hydroxy group, nitro group, cyano group, acetyl group, benzoyl group which may have a substituent, alkoxycarbonyl group, phenoxycarbonyl group which may have a substituent and carbamoyl group which may have a substituent. However, "$R_1$" and "$R_2$" may be mutually bonded to form one of a substituted or non-substituted ring by alkylene, a substituted or non-substituted unsaturated aliphatic ring, and a substituted or non-substituted aromatic ring. "X" represents one of hydrogen atom, alkyl group, cycloalkyl group, cyclic unsaturated aliphatic group, aromatic group, heterocyclic group, and amino group, and a substituent may be further substituted for these. "Y" represents one of a substituted or non-substituted alkylene group, a substituted or non-substituted cycloalkylene group, a substituted or non-substituted aralkylene group, a substituted or non-substituted bivalent group having aromaticity, a substituted or non-substituted bivalent group having heterocyclic aromaticity, and an organic residue having carbonyl group expressed by CO-Z- (however, provided that "Z" represents one of alkylene group, cycloalkylene group, bivalent organic residue having aromaticity and bivalent organic residue having heterocyclic aromaticity, and a substituent may be further substituted for these.).

A thirty eighth aspect of the present invention is an azo compound according to Claim 37, wherein at least one of said "$Cp_1$" and "$Cp_2$" in Formula (1) is a coupler residue expressed by the following Formula (5).

(5)

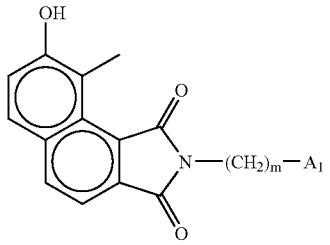

Wherein, "$A_1$" represents one of a substituted or non-substituted aromatic group and a substituted or non-substituted heterocyclic group, and "m" represents the integer of 1 to 6.

A thirty ninth aspect of the present invention is an azo compound according to Claim 37, wherein at least one of said "$Cp_1$" and "$Cp_2$" in Formula (1) is a coupler residue expressed by one of the following Formula (6) and Formula (7).

(6)

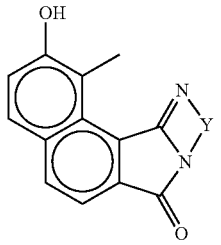

(7)

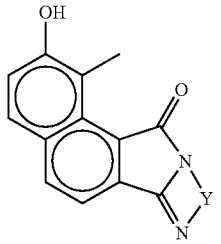

Wherein, "Y" represents one of a substituted or non-substituted alkylene group, a substituted or non-substituted cycloalkylene group, a substituted or non-substituted aralkylene group, a substituted or non-substituted bivalent organic group having aromaticity, a substituted or non-substituted bivalent organic group having heterocyclic aromaticity, and organic residue containing bivalent carbonyl group expressed by CO-Z- (however, provided that "Z" represents one of alkylene group, cycloalkylene group, bivalent organic residue having aromaticity and bivalent organic residue having heterocyclic aromaticity, and the substituent may be further substituted for these groups.).

A fortieth aspect of the present invention is an azo compound according to claim 37, wherein at least one of said "$Cp_1$" and "$Cp_2$" in Formula (1) is a coupler residue expressed by the following Formula (8).

(8)

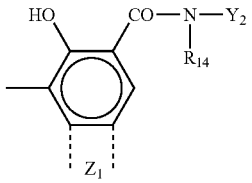

Wherein, "$Z_1$" represents one of bivalent organic group which condenses with a benzene ring in the Formula to form a substituted or non-substituted hydrocarbon ring and bivalent organic group which condenses with a benzene ring in the Formula to form a substituted or non-substituted heterocyclic ring. "$R_{14}$" represents one of hydrogen atom, a substituted or non-substituted alkyl group, and a substituted or non-substituted phenyl group. "$Y_2$" represents one of a substituted or non-substituted hydrocarbon ring and a substituted or non-substituted heterocyclic ring.

A forty first aspect of the present invention is an azo compound according to claim 37 wherein at least one of said "$Cp_1$" and "$Cp_2$" in Formula (1) is a coupler residue expressed by one of the following Formula (9) and Formula (10).

(9)

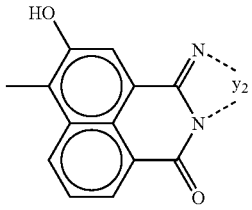

(10)

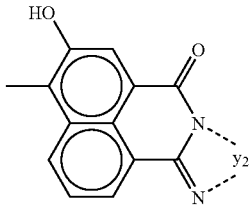

Wherein, "$y_2$" rep resents one of bivalent group of aromatic hydrocarbon and bivalent group of heterocyclic ring containing nitrogen in the ring. The ring may be further substituted for these rings.

A forty second aspect of the present invention is a method for manufacturing an azo compound, wherein a diazonium compound expressed by the following Formula (11) is allowed to react with a coupler compound expressed by the following Formula (12).

(11)

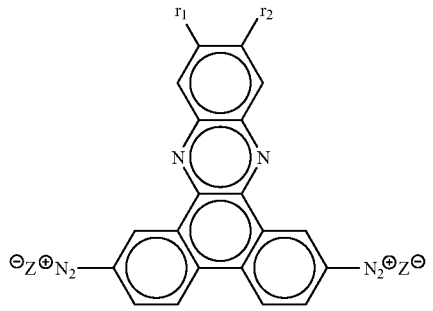

(12)

H—Cp (Formula (11): wherein, "$r_1$" and "$r_2$" represent one of hydrogen atom, alkyl group, alkoxy group, halogen atom, and nitro group, and $z^-$ represents anion functional group. Formula (12): wherein, "Cp" represents a coupler residue.)

A forty third aspect of the present invention is a photoconductive material comprising an azo compound according to claim 37.

DESCRIPTION OF THE PREFERRED EMBODIMENTS

Figure 1:
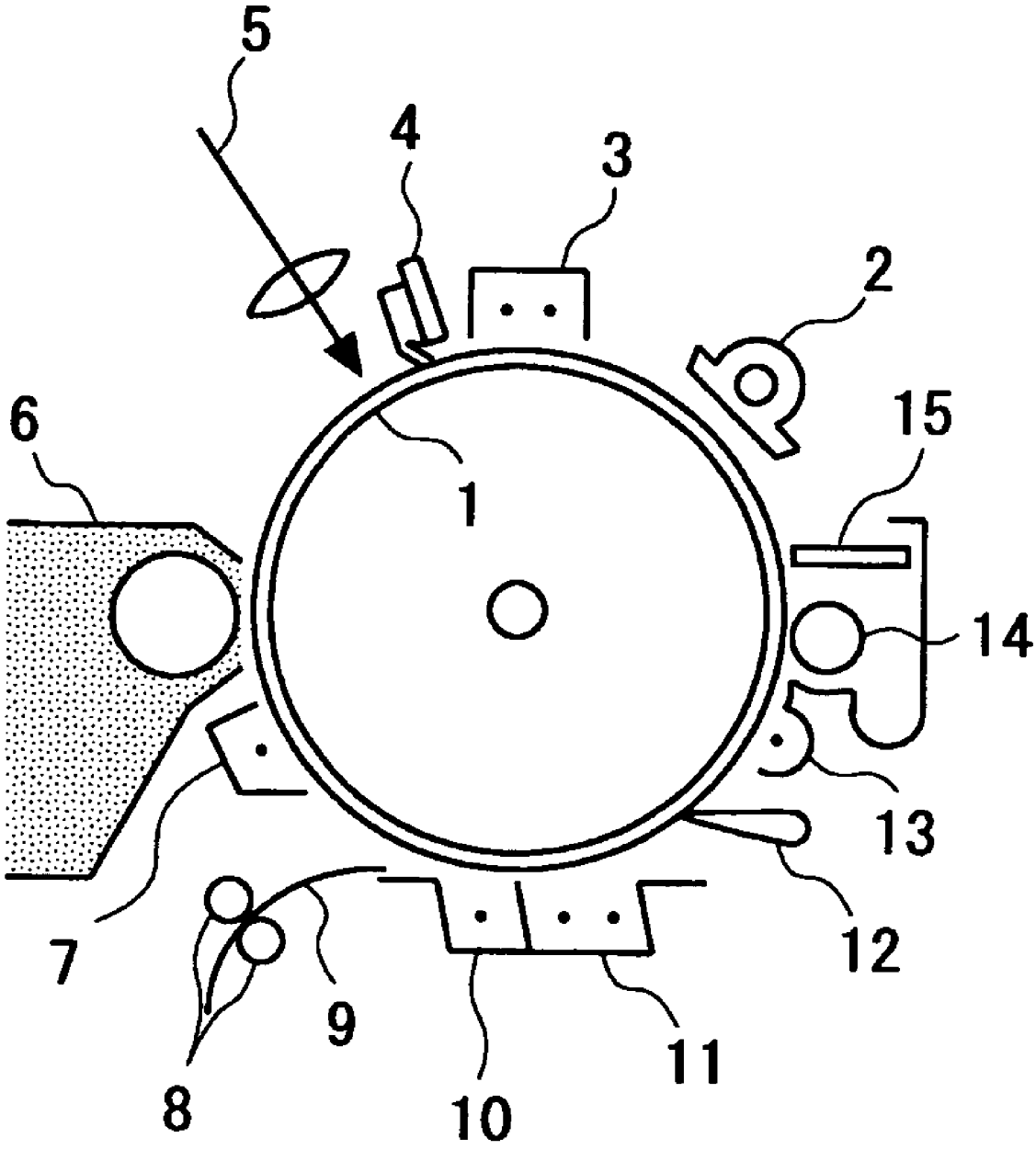
FIG. 1 is a schematic diagram showing one example of the electrophotographic apparatus relating to the present invention.

Hereafter, the Embodiments relating to the present invention will be explained.

The azo compounds relating to the present invention are described in detail.

First, the dibenzo[a,c]phenazine skeleton, which is the azo skeleton of the azo compounds relating to the present invention is described in detail.

In Formula (1) and Formula (11): wherein "$r_1$" and "$r_2$" represent hydrogen atom, alkyl groups, methyl group, ethyl group, propyl group and butyl group, alkoxy groups such as methoxy group and ethoxy group, halogen atoms such as fluorine atom, chlorine atom and bromine atom, amino groups such as dimethylamino group, diethylamino group and diphenylamino group, nitro group, cyano group, acetyl group, benzoyl group which may have a substitute, carboxyl group, alkoxycarbonyl group, phenoxycarbonyl group which may have a substitute, aryl group which may have a substitute or the like.

Formula (11), wherein, $Z^-$ represents anionic functional groups such as

Formula (11)

$Cl^-$, $Br^-$, $I^-$, $BF_4^-$, $PF_6^-$, $B(C_6H_5)_4^-$, $ClO_4^-$, $SO_4^{2-}$,

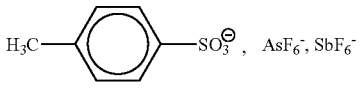

, $AsF_6^-$, $SbF_6^-$ above all, particularly, $BF_4^-$ is appropriate. In addition, the compound expressed by Formula (11) is the compound, which is the manufacturing material to be used for manufacturing the compound expressed by Formula (1) by allowing the compound to react with a coupler compound as stated later.

The diazonium compound expressed by Formula (11) can be manufactured by diazotizing an equivalent 2,7-diaminodibenzo[a,c]phenazine compound in accordance with a publicly known process, for example, the process disclosed in Japanese Patent Application Publication (JP-B) No. 07-2725.

Below shown in Table 1 is an example of the diazonium compound expressed by Formula (11) relating to the present invention. [Table 1]

TABLE 1

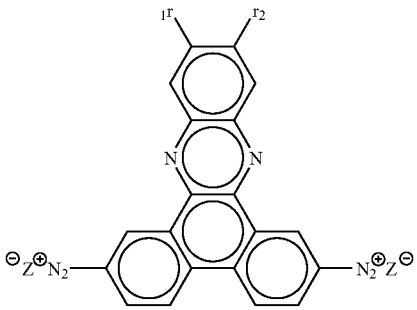

| Diazonium Compound No. | $r_1$ | $r_2$ |
|---|---|---|
| Ar1 | H | H |
| Ar2 | —$CH_3$ | H |
| Ar3 | —$CH_3$ | —$CH_3$ |
| Ar4 | —Cl | H |
| Ar5 | —Cl | —Cl |
| Ar6 | —$OCH_3$ | H |
| Ar7 | —$OCH_3$ | —$OCH_3$ |
| Ar8 | —$NO_2$ | H |
| Ar9 | —$N(CH_3)_2$ | H |
| Ar10 | —CN | H |
| Ar11 | —COOH | H |
| Ar12 | —CO— 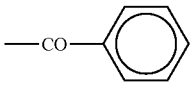 | H |
| Ar13 | 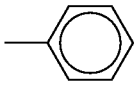 | H |

In the method for manufacturing the azo compound relating to the present invention, the diazonium compound expressed by Formula (11) is allowed to react with the coupler compound expressed by Formula (12) below.

HCp Formula (12)

However, Cp in Formula (12) above represents a coupler residue.

The details of the azo compound relating to the present invention will be clarified through the description of the method for manufacturing the azo compound relating to the present invention.

The azo compound and the manufacturing material of the azo compound relating to the present invention can be manufactured by the methods below.

Namely, a styrene compound expressed by Formula (111) below and an acetylenedicarboxylate expressed by Formula (112) are allowed to react with each other under the following chemical reaction (Diels-Alder reaction) to obtain a naphthalene compound expressed by Formula (113) below.

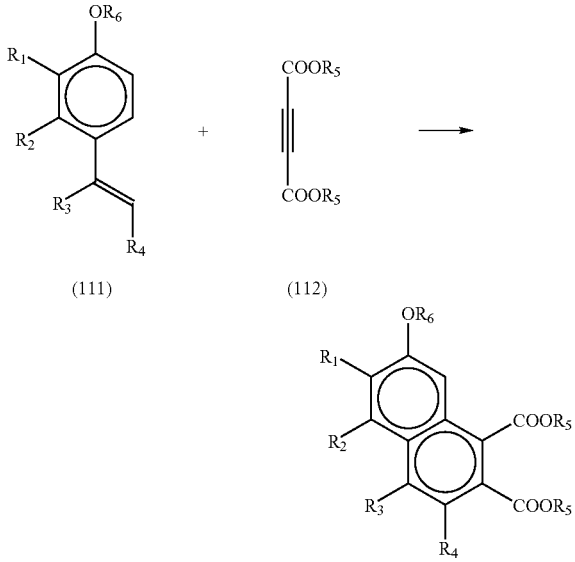

(111) (112) (113)

However, the above reaction is the Diels-Alder reaction accompanied by oxidation, and Liebigs Ann. Chem., 595, 1 (1955) describes the reaction with hydroquinones and iodine, and Ber., 69, 1686 (1936) describes the reaction with maleic anhydride in a nitrobenzene solvent, respectively. In the present invention, the naphthalene compound expressed by Formula (113) above can be obtained at a high yield in a one-step reaction by controlling the reaction with the acetylenedicarboxylate in the nitrobenzene solvent at a reaction temperature of 100 to 160° C., further preferably at 130 to 150° C.

Next, the naphthalene compound expressed by Formula (114) below can be obtained by removing "$R_6$", which is a protective group of the naphthalene compound expressed by Formula (113) obtained above in the following way (the deprotecting group).

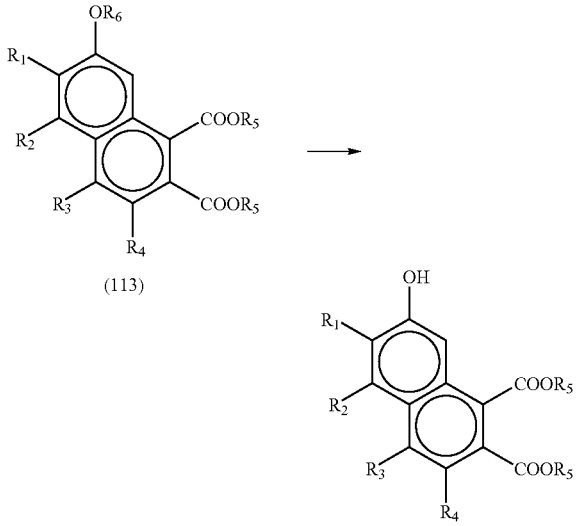

(113) (114)

However, "$R_6$" in Formula (114) above is not particularly limited if it is the protective group of a OH group, and it can be suitably selected in accordance with a purpose, and for example, taken up are methyl group, iso-propyl group, t-butyl group, benzyl group, aryl group, methoxymethyl group, tetrahydropyranyl group, trimethoxysilyl group and the like. Of these, further preferably taken up are iso-propyl group, t-butyl group and methoxymethyl group, which may be removed in the presence of an acid catalyst at a room temperature. Taken up as the catalysts above are, for example, sulfuric acid, trifluoroacetic acid, hydrobromic acid, methanesulfonic acid, trifluoromethanesulfonic acid and the like.

Next, the coupler compound expressed by Formula (116) below can be obtained by allowing the naphthalene compound expressed by Formula (114) above and the amine compound expressed by Formula (115) below to react with each other under the ester/amide exchange reaction as shown below.

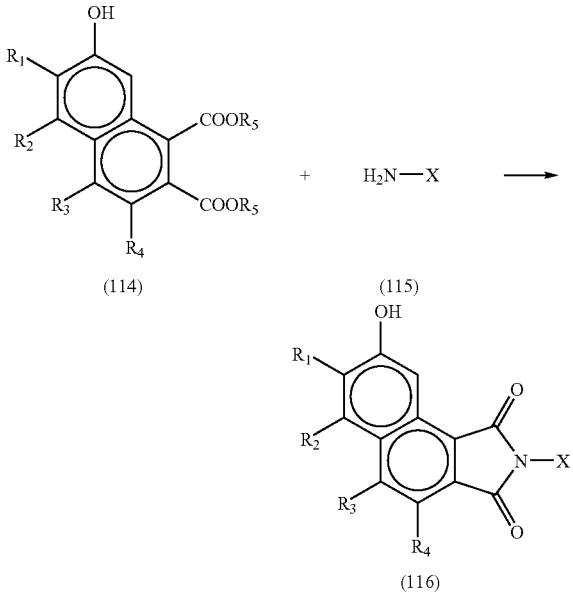

Generally, the ester/amide exchange reaction is performed in the presence of a basic catalyst. However, J. Am. Chem. Soc., 71, 1245 (1945) describes that the addition of glycol system, water or glycerol system solvent is effective for the ester/amide exchange reaction. In the present invention, the coupler compound expressed by Formula (116) above can be obtained at a high yield by allowing the naphthalene compound expressed by Formula (114) above and the amine compound expressed by Formula (115) to react with each other under the ester/imide exchange reaction (including ring closure) in the system containing at least one kind selected from a glycol system and glycerol system solvent and by controlling a reaction temperature at 100 to 170° C., preferably at 110 to 150° C.

In addition, the coupler compounds expressed by the following Formula (118) or (119) is manufactured from the naphthalene compound expressed by Formula (114) above obtained in the synthesis above and the diamine compound expressed by the following Formula (117) below as shown in the following formula.

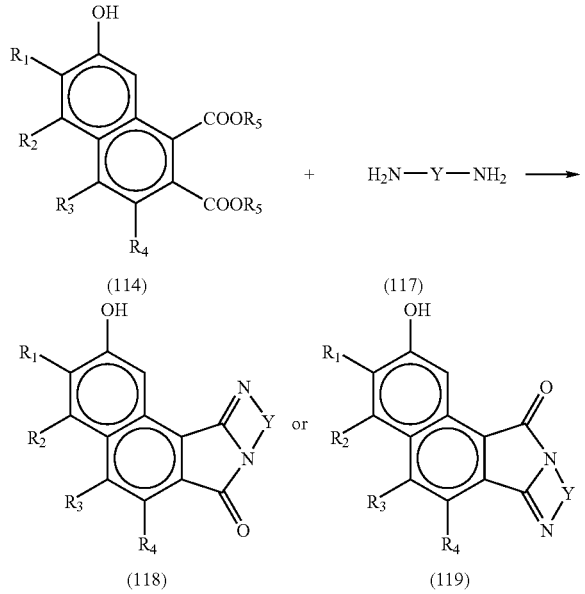

In this case, the same ester/imide exchange reaction (including two ring closures) as in the manufacture of the coupler compound expressed by Formula (116) above can be used. It is, however, provided that the reaction temperature is 130 to 180° C., preferably 140 to 170° C.

In addition, the coupler compound expressed by Formulas (116), (118) and (119) may be manufactured by the methods as shown below.

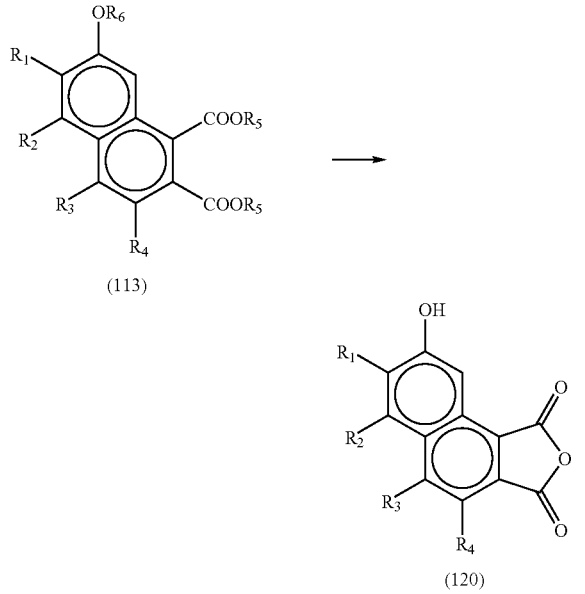

Namely, the naphthalene compound expressed by Formula (120) can be obtained by allowing the naphthalene compound expressed by Formula (113) to react in the presence of an acid catalyst. In this case, $R_6$ is not particularly limited if it is a protective group. However, methyl group, iso-propyl group or the like can be generally used, and methyl group can be preferably used. Taken up as the acid catalysts are hydrobromic acid, boron tribromide and the like.

Next, the coupler compound expressed by Formula (116) above can be obtained by allowing the naphthalene compound expressed by Formula (120) above obtained in the synthesis above and the amine compound expressed by Formula (115) above to react with each other in the presence of an acid catalyst. As the acid catalysts, for example, acetic acid, sulfuric acid or the like can be used. The reaction can be more efficiently performed by discharging water produced by the reaction to the outside of the reaction system as required.

In addition, the coupler compound expressed by Formula (118) or (119) above can be obtained by allowing the naphthalene compound expressed by Formula (120) above obtained in the synthesis above and the diamine compound expressed by Formula (117) above to react with each other in the presence of an acid catalyst. As the acid catalysts, for example, acetic acid, sulfuric acid or the like can be used. The reaction can be more efficiently performed by discharging water produced by the reaction to the outside of the reaction system as required.

The azo compound expressed by Formula (1) above can be obtained by the following Formula (15). First, an equivalent 2,7-diaminobenzo[a,c]phenazine compound is determined to be an initial material, after this material is azotized and is then isolated as a diazonium compound expressed by Formula (11), and the azo compound can be obtained by allowing a coupling reaction to be performed on this material and the coupler compound expressed by Formula (12) corresponding to each pigment above in a suitable organic solvent (N,N-dimethylformaldehyde or the like) in the presence of an alkali.

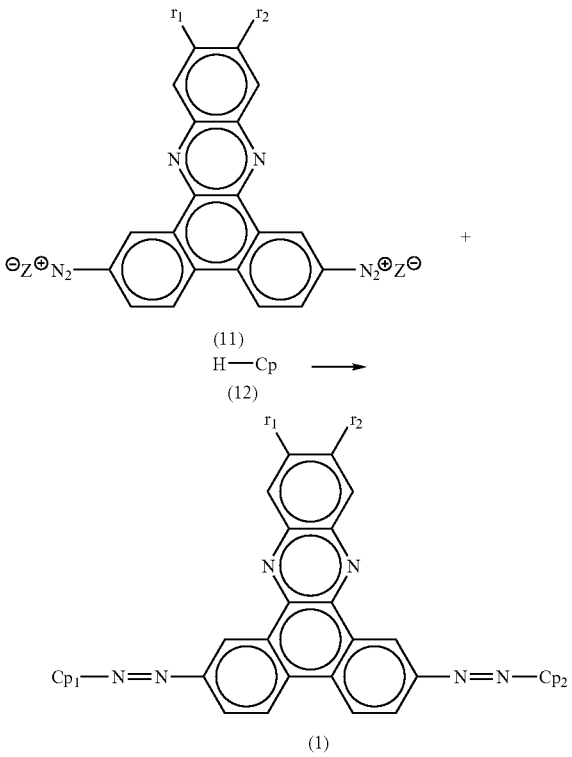

(15)

In some cases, the coupler compounds (12) of two kinds or more of the azo compounds expressed by Formula (1) relating to the resent invention may be used. In this case, the coupler compounds, can be obtained by allowing diazonium compound expressed by Formula (11) above to sequentially in two steps react with the coupler compounds expressed by Formulas (116) above, Formula (118) or (119) and with the coupler compounds exemplified by Formula (Cp1) to Formula (Cp15) or after the diazonium compound obtained by the first coupling reaction is isolated, the azo compounds can be obtained by further allowing the diazonium compound to react with the coupler compounds corresponding thereto.

In Formula (1) above, "$r_1$" and "$r_2$" independently represent hydrogen atom, alkyl group, alkoxy group, halogen atom or nitro group. In this case, for alkyl group, preferably an alkyl group having 1 to 25 carbon atoms is, more preferably an alkyl group having 1 to 8 carbon atoms is, and taken up are, for example, methyl group, ethyl group, propyl group, butyl group and the like but it is not limited to them. For alkoxy group "$r_1$" and "$r_2$" are preferably an alkoxy group having 1 to 25 carbon atoms, more preferably an alkoxy group having 1 to 8 carbon atoms, for example, methoxy group, ethoxy group, propoxy group and butoxy group are taken up, but it is not limited to them. For halogen atom, examples of "$r_1$" and "$r_2$" may include fluorine atom, chlorine atom, bromine atom and the like. In addition, "Z" represents $Cl^-$, $Br^-$, $I^-$, $BF^-$, $PF^-$, $B(C_6H_5)_4^-$, $ClO_4^-$, $SO_4^{2-}$, $AsF_6^-$, a group expressed by the following formula, anionic functional groups such as $SbF_6^-$, above all, $BF_4^-$ is particularly preferable.

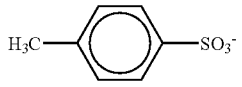

In addition, in the aforesaid Formula (2), Formula (3), Formula (4), Formula (111), Formula (113), Formula (114), Formula (116), Formula (118), Formula (119), and Formula (120), "$R_1$", "$R_2$", "$R_3$" and "$R_4$" independently represent hydrogen atom, alkyl group, alkoxy group, or halogen atom. However, "$R_1$" and "$R_2$" may form a ring by a substituted or non-substituted alkylene, a substituted or non-substituted unsaturated aliphatic ring, or a substituted or non-substituted aromatic ring by mutually bonding them. For alkyl group, an alkyl group having 1 to 25 carbon atoms is preferable, an alkyl group having 1 to 8 carbon atoms is more preferable, and for example, taken up are methyl group, ethyl group, propyl group, butyl group and the like, but it is not limited to them. For alkoxy group, "$R_1$", "$R_2$", "$R_3$" and "$R_4$" are, respectively, preferably an alkoxy group having 1 to 25 carbons, more preferably an alkoxy group having 1 to 8 carbon atoms, and for example, taken up are methoxy group, ethoxy group, propoxy group and butoxy group, but it is not limited to them. Taken up as halogen atoms are, for example, fluorine atom, chlorine atom, bromine atom and the like. In the aforesaid Formula (2), Formula (3) and Formula (4), "$R_1$", "$R_2$", "$R_3$" and "$R_4$" also independently represent one of amino group such as a dimethylamino, diethylamino and diphenylamino, hydroxy group, nitro group, cyano group, acetyl group, benzoyl group which may have a substituent, alkoxycarbonyl group, phenoxycarbonyl group which may have a substituent and carbamoyl group which may have a substituent. If a ring is formed by mutually bonding "$R_1$" and "$R_2$", taken up as atom groups formed by mutually bonding "$R_1$" and "$R_2$" are a substituted or non-substituted alkylene groups such as a substituted or non-substituted propylene group, a substituted or non-substituted butylenes group, a substituted or non-substituted pentylene, a substituted or non-substituted alkenylene groups such as a substituted or non-substituted propenylene group, a substituted or non-substituted butenylene group, a substituted or non-substituted pentenylene group, or aromatic rings such as a substituted or non-substituted benzene ring and a substituted or non-substituted naphthalene ring. In this case, taken up as substitutes are alkyl groups such as methyl group, ethyl group, propyl group and butyl group, alkoxy groups such as methoxy group and ethoxy group, halogen atoms such as fluorine atom, chlorine atom and bromine atom. When "alkylene group" is referred to in this specification, methylene group having carbon number of 1 is also contained, unless otherwise excluded.

In addition, in the aforementioned Formula (112), Formula (113) and Formula (114), for "$R_5$", taken up are alkyl groups such as preferably an alkyl group having 1 to 25 carbon atoms, more preferably an alkyl group having 1 to 8 carbon atoms and benzyl group of methyl group, ethyl group, propyl group, butyl group and the like and substituted alkyl groups such as 2-methoxyethyl group.

In addition, in the aforementioned Formula (111) and Formula (113), "$R_6$" is not particularly limited if it is the protective group of a OH group. Preferably taken up are methyl group, iso-propyl group, t-butyl group, benzyl group, aryl group, methoxymethyl group, tetrahydropyranyl group, trimethylsilyl group and the like. More preferably taken up are iso-propyl group and t-butyl group. However, it is not limited to them.

In addition, in the aforesaid Formula (2), Formula (115) and Formula (116), X represents hydrogen atom, a substituted or non-substituted alkyl group, a substituted or non-substituted cycloalkyl group, a substituted or non-substituted cyclo-unsaturated aliphatic group, a substituted or non-substituted aromatic group, a substituted or non-substituted heterocyclic group, or a substituted or non-substituted amino group. In this case, the alkyl group above is preferably an alkyl group having 1 to 25 carbon atoms, more preferably an alkyl group having 1 to 12 carbon atoms. For example, taken up are alkyl groups such as methyl group, ethyl group, propyl group, butyl group, pentyl group, hexyl group, octyl group, and decyl group. However, it is not limited to them. The cycloalkyl group above is preferably a cycloalkyl group having 5 to 8 carbon atoms, and for example, taken up is cyclohexyl group. However, it is not limited to them. For the cyclo-unsaturated aliphatic group, for example, taken up are indanyl group and tetranyl group. However, it is not limited to them. The aromatic group above is preferably an aromatic hydrocarbon group having 6-30 carbon atoms, for example, taken up are phenyl group, naphthyl group, anthracenyl group, phenanthrenyl group, pyrenyl group and the like. However, it is not limited to them. The heterocyclic group should be the atoms forming a ring which contain at least one complex atom such as nitrogen, oxygen and sulfur. For example, taken up are pyridyl group, pyrazino group, quinolino group, oxazolyl group, benzooxazolyl group, thiazolyl group, benzothiazolyl group, imidazolyl group, benzoimidazolyl group, indolyl group and the like. Taken up as the amino groups are, for example, alkylamino groups such as methylamino group and ethylamino group, aromatic amino groups such as phenylamino group and naphthylamino group and carboamino groups such as acetylamino group and benzoylamino group. However, it is not limited to them.

Taken up as the substitutes of alkyl group, cycloalkyl group, cyclo-unsaturated aliphatic group, aromatic group, heterocyclic group and amino group are alkyl groups such as methyl group, ethyl group, propyl group and butyl group; substituted alkyl groups such as benzyl group, phenetyl phenethyl group and methoxymethyl group; alkoxy groups such as methoxy group, ethoxy group and phenoxy group; phenyl group, which may have a substitute; aromatic groups such as naphthyl group, anthracenyl group, phenanthrenyl group and pyrenyl group which may have a substitute; halogen atoms such as fluorine atom, chlorine atom and bromine; hydroxy group; amino group, which may have a substitute; carboamino group such as acetylamino group and benzoylamino group, which may have a substitute; nitro group; cyano group; acetyl group; benzoyl group, which may have a substitute; alkoxycarbonyl group which may have a substitute; phenoxycarbonyl group, which may have a substitute; carbamoyl group, which may have a substitute.

Of the coupler residues expressed by Formula (2) above, preferable is a coupler residue where "X" is a substituted or non-substituted alkyl group, above all, particularly preferable is the coupler residue expressed by Formula (5) above.

In Formula (5) above, "$A_1$" represents a substituted or non-substituted aromatic group or a substituted or non-substituted heterocyclic group. In this case, the aromatic group is preferably an aromatic hydrocarbon group having 6 to 30 carbon atoms, for example, taken up are phenyl group, naphthyl group, anthracenyl group, phenanthrenyl group, pyrenyl group and the like. However, it is not limited to them. For the heterocyclic group, the atoms forming a ring contain at least one complex atom such as nitrogen, oxygen and sulfur or the like, for example, taken up are pyridyl group, pyrazino group, quinolino group, oxazolyl group, benzooxazolyl group, thiazolyl group, benzothiazolyl group, imidazolyl group, benzoimidazolyl group, indolyl group and the like. Taken up as the amino groups are, for example, alkylamino groups such as methylamino group and ethylamino group, aromatic amino groups such as phenylamino group and naphthylamino group and carboamino groups such as acetylamino group and benzoylamino group. However, it is not limited to them. Taken up as their substitutes are alkyl groups such as methyl group, ethyl group, propyl group and butyl group, substituted alkyl groups such as benzyl group, phenethyl group and methoxymethyl group, alkoxy groups such as methoxy group, ethoxy group and phenoxy group, phenyl group, which may have a substitute, halogen atoms such as fluorine atom, chlorine atom and bromine, trifluoromethyl group, cyano group, alkoxycarbonyl group, carbamoyl group which may have a substitute.

In addition, in the aforesaid Formula (3), Formula (4), Formula (6), Formula (7), Formula (118) and Formula (119), Y represents a substituted or non-substituted alkylene group, a substituted or non-substituted cyclo alkylene group, a substituted or non-substituted aralkylene group, a bivalent organic residue having a substituted or non-substituted aromaticity, a bivalent organic residue having a substituted or non-substituted complex aromaticity, or organic residue containing bivalent carbonyl group expressed by CO-Z- (however, Z represents a substituted or non-substituted alkylene group, a substituted or non-substituted cyclo alkylene group, a bivalent organic residue having a substituted or non-substituted aromaticity, or a bivalent organic residue having a substituted or non-substituted complex aromaticity. In this case, the alkylene group is preferably an alkyl group having 1 to 25 carbon atoms, more preferably an alkyl group having 1 to 12 carbon atoms, and for example, taken up are alkylene groups such as methylene group, ethylene group, propylene group, butylenes group, pentylene group, hexylene group, octylene group, decylene group. However, it is not limited to them. For the alkylene group, an aromatic ring may be formed in the carbon-carbon bonding. The cycloalkylene group is preferably a cycloalkylene group having 5 to 8 carbon atoms, and for example, taken up are cyclopentylene group and cyclohexylene group. However, it is not limited to them. The aralkylene group is preferably an aralkylene group having 7 to 20 carbon atoms, and for example, taken up are toluylene group, xylylene group, ethylene phenylene ethylene group, phenylmethylene group and phenylene ethylene group. However, it is not limited to them. The bivalent organic residue having aromaticity is preferably an aryl group having 6 to 30 carbon atoms or the skeleton of an aryl group, into which a saturated aliphatic ring or an unsaturated aliphatic ring is further condensed, and for example, taken up are o-phenylene group, 1,8-naphtylene group, 2,3-naphtylene group, 1,2-anthrylene group, 9,10-phenanthrylene group and the like. However, it is not limited to them. The bivalent organic residue having heterocyclic aromaticity contains at least one complex atom such as nitrogen, oxygen and sulfur in the atoms forming the ring, and also contains a saturated aliphatic ring or a compound where, an unsaturated or a complex ring is further condensed into the skeleton of the heterocyclic aromatic group as well as a heterocyclic aromatic group. Taken up are, for example, 3,4-pyrazolediyl group, 2,3-pyridinediyl group, 5,6-pyrimidinediyl group, benzimidazolediyl group, 6,7-quinolinediyl group and the like. However, it is not limited to them. As a bivalent organic residue containing carbonyl group, taken up are 2-benzoyl group and 2-naphtylcarbonyl group and the like. However, it is not limited to them.

Taken up as bivalent organic residues having these alkylene group, cycloalkylene group aralkylene group and aromaticity and the substitute of a bivalent organic residue having complex aromaticity are alkyl groups such as methyl group, ethyl group, propyl group and butyl group, substituted alkyl groups such as benzyl group, phenethyl group and methoxymethyl group, alkoxy groups such as methoxy group, ethoxy group and phenoxy group, phenyl group which may have a substitute, naphthyl group which may have a substitute, aromatic groups such as anthracenyl group, phenanthracenyl group and pyrenyl group, halogen atoms such as fluorine atom, chlorine atom and bromine atom, hydroxy group, amino group which may have a substitute, acetylamino group, carboamino groups such as benzoylamino group which may have a substitute, nitro group, cyano group, acetyl group, benzoyl group which may have a substitute, alkoxycarbonyl group, phenoxycarbonyl group which may have a substitute, carbamoyl group which may have a substitute and the like.

Of the coupler residues expressed by the aforesaid Formula (3) and Formula (4), preferable are the coupler residues expressed by the aforesaid Formula (6) and Formula (7), and of these, preferable are the coupler residues where "Y" is a substituted or non-substituted alkylene group or bivalent organic residues containing a substituted or non-substituted carbonyl group, and of these, particularly preferable are the coupler residues expressed by the following Formula (13) and Formula (14).

(13)

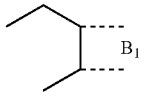

(14)

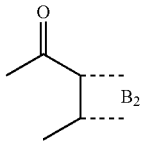

B1 in Formula (13) above and "$B_2$" in Formula (14) above represent, for example, bivalent groups of aromatic hydrocarbon rings such as o-phenylene group and 2,3-naphtylene group and for example, bivalent groups of aromatic heterocyclic rings such as 2,3-pyrinyl group, 3,4-prazoleyl group, 2,3-pyridinyl group, 4,5-pyridinyl group and 4,5-imidazoleyl group. Taken up as their substitutes are, for example, alkyl groups such as methyl group, ethyl group, propyl group and butyl group, alkoxy groups such as methoxy group, ethoxy group and phenoxy group, halogen atoms such as fluorine atom, chlorine atom and bromine atom, nitro group and the like.

Below shown in Tables 2-1 to 5-3 are the examples of the coupler compounds corresponding to new coupler residues Cp1 and Cp2 expressed by Formulas (2), (3) and (4) relating to the present invention.

TABLE 2

<Exemplification of Coupler Compound>

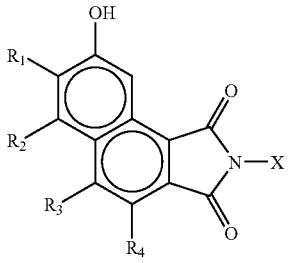

| Coupler No. | R1 | R2 | R3 | R4 | X |
|---|---|---|---|---|---|
| C1 | H | H | H | H | $—C_6H_{13}$ |
| C2 | H | H | H | H | $—C_8H_{17}$ |
| C3 | $—CH_3$ | H | H | H | $—C_6H_{13}$ |

TABLE 2-continued
<Exemplification of Coupler Compound>
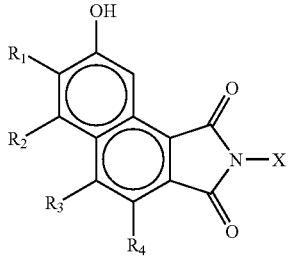
| Coupler No. | R1 | R2 | R3 | R4 | X |
|---|---|---|---|---|---|
| C4 | H | —$CH_3$ | H | H | —$C_6H_{13}$ |
| C5 | H | H | H | H | —$CH_2$— |
| C6 | H | —$CH_3$ | H | H | —$CH_2$— |
| C7 | —$CH_2CH_2CH_2CH_2$— | | —$CH_3$ | H | —$CH_2$— |
| C8 | H | H | H | —$C_2H_5$ | —$CH_2$— |
| C9 | H | H | H | H | —$CH_2$—$CH_3$ |
| C10 | H | H | H | H | —$CH_2$—$OCH_3$ |
| C11 | H | H | H | H | —$CH_2$—Cl |
| C12 | H | H | H | H | —$CH_2$—$OCH_3$ |
| C13 | H | H | H | H | —$CH_2$— |
| C14 | H | H | H | H | —$CH_2CH_2$— |
| C15 | —$OCH_3$ | H | H | H | —$CH_2CH_2$— |

TABLE 2-continued
<Exemplification of Coupler Compound>
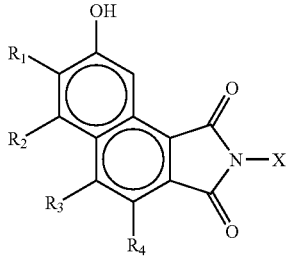
| Coupler No. | R1 | R2 | R3 | R4 | X |
|---|---|---|---|---|---|
| C16 | H | H | H | H | 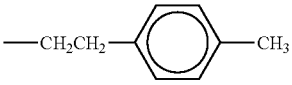 |
| C17 | H | H | H | H | 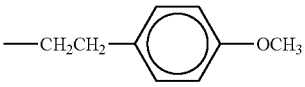 |
| C18 | H | H | H | H | 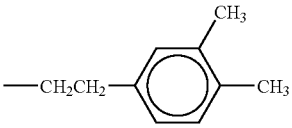 |
| C19 | H | H | H | H | 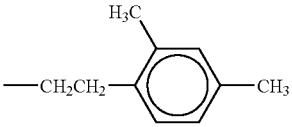 |
| C20 | H | H | H | H | 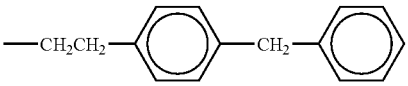 |
| C21 | H | H | H | H | 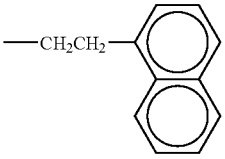 |
| C22 | H | H | H | H | 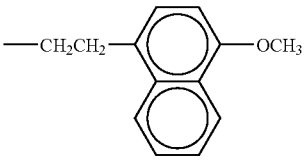 |
| C23 | H | H | H | H | 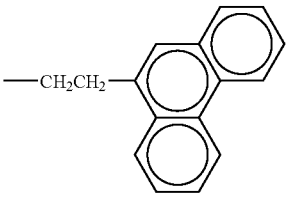 |
| C24 | H | H | H | H | 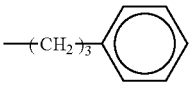 |

TABLE 2-continued
<Exemplification of Coupler Compound>
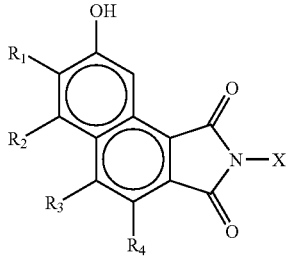
| Coupler No. | R1 | R2 | R3 | R4 | X |
|---|---|---|---|---|---|
| C25 | H | —$NO_2$ | H | H | —$(CH_2)_4$—  |
| C26 | H | H | H | H | —$C_2H_4OCH_3$ |
| C27 | H | H | H | H | —$C_2H_4OCOCH_3$ |
| C28 | H | H | H | H | 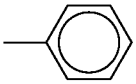 |
| C29 | —$CH_3$ | H | H | H | 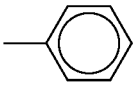 |
| C30 | H | —$OCH_3$ | —$CH_3$ | H | 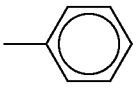 |
| C31 | H | —Cl | H | H | 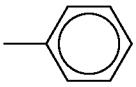 |
| C32 | H | H | H | H | 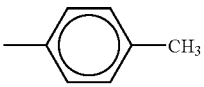  |
| C33 | H | H | H | H | 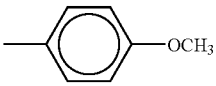  |
| C34 | H | H | H | H | 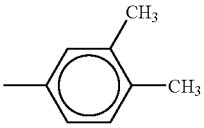  |
| C35 | H | H | —$CH_3$ | H | 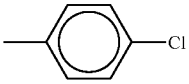  |
| C36 | H | H | H | H | 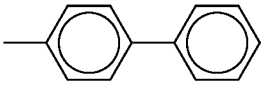 |
| C37 | H | H | H | H | 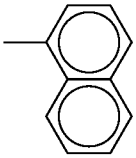 |

TABLE 2-continued
<Exemplification of Coupler Compound>
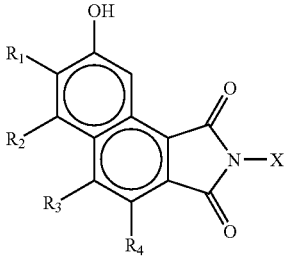
| Coupler No. | R1 | R2 | R3 | R4 | X |
|---|---|---|---|---|---|
| C38 | H | H | H | H | 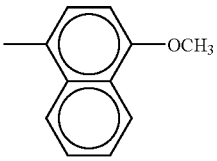 |
| C39 | H | H | H | H | 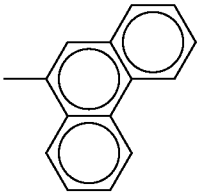 |
| C40 | H | H | H | H | 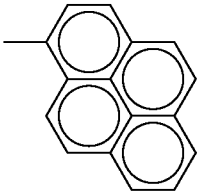 |
| C41 | H | H | H | H | 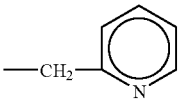 |
| C42 | H | H | H | H | 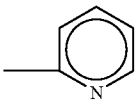 |
| C43 | H | H | H | H | 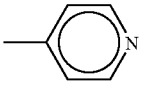 |
| C44 | H | H | H | H | 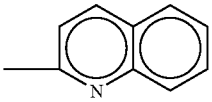 |
| C45 | H | H | H | H | 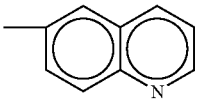 |
| C46 | H | H | H | H | H |
| C47 | H | H | H | H | —$CH_3$ |
| C48 | H | H | H | H | —$C_2H_5$ |

TABLE 2-continued
<Exemplification of Coupler Compound>
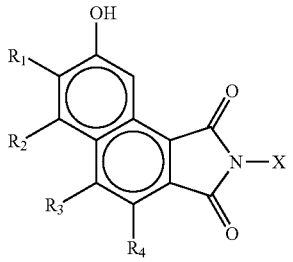
| Coupler No. | R1 | R2 | R3 | R4 | X |
|---|---|---|---|---|---|
| C49 | H | H | H | H | 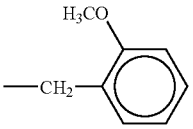 |
| C50 | H | H | H | H | 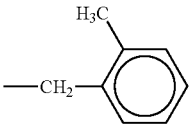 |
| C51 | H | H | H | H | 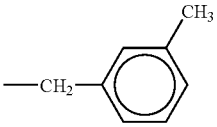 |
| C52 | H | H | H | H | 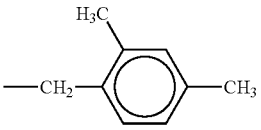 |
| C53 | H | H | H | H | 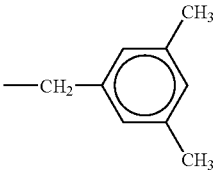 |
| C54 | H | H | H | H | 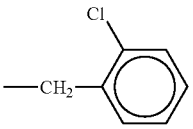 |
| C55 | H | H | H | H | 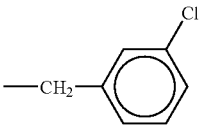 |
| C56 | H | H | H | H | 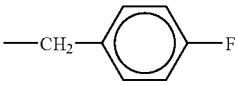 |

TABLE 2-continued
<Exemplification of Coupler Compound>
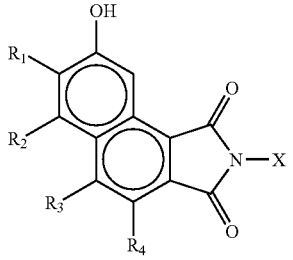
| Coupler No. | R1 | R2 | R3 | R4 | X |
|---|---|---|---|---|---|
| C57 | H | H | H | H | 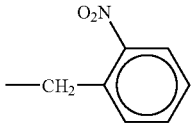 |
| C58 | H | H | H | H | 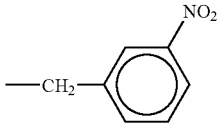 |
| C59 | H | H | H | H | 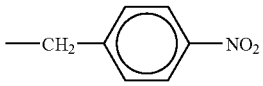 |
| C60 | H | H | H | H | 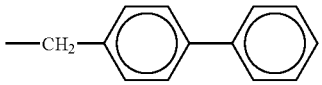 |
| C61 | H | H | H | H | 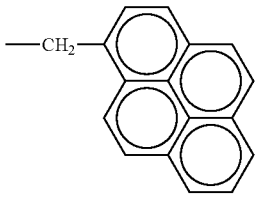 |
| C62 | H | H | H | H | 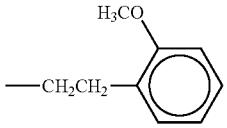 |
| C63 | H | H | H | H | 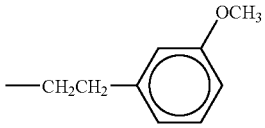 |
| C64 | H | H | H | H | 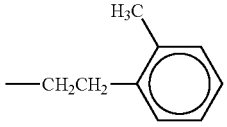 |
| C65 | H | H | H | H | 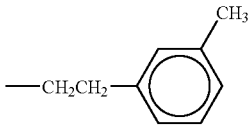 |

TABLE 2-continued
<Exemplification of Coupler Compound>
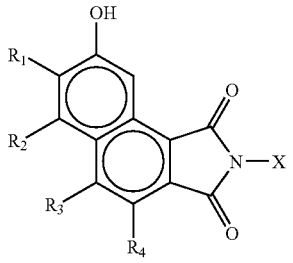
| Coupler No. | R1 | R2 | R3 | R4 | X |
|---|---|---|---|---|---|
| C66 | H | H | H | H | 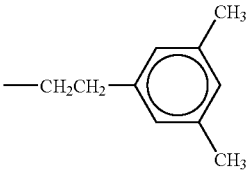 |
| C67 | H | H | H | H | 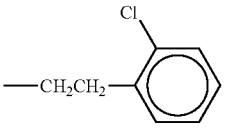 |
| C68 | H | H | H | H | 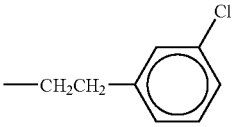 |
| C69 | H | H | H | H | 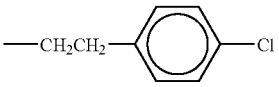 |
| C70 | H | H | H | H | 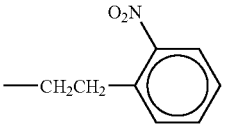 |
| C71 | H | H | H | H | 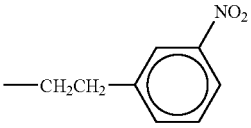 |
| C72 | H | H | H | H | 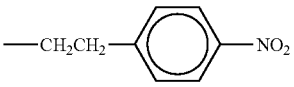 |
| C73 | H | H | H | H | 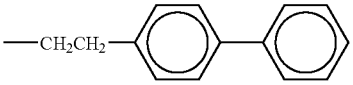 |
| C74 | H | H | H | H | $—C_3H_7$ |
| C75 | H | H | H | H | $—C_4H_9$ |
| C76 | H | H | H | H | $—C_5H_{11}$ |

TABLE 2-continued
<Exemplification of Coupler Compound>
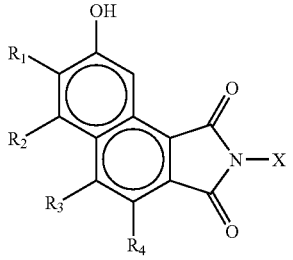
| Coupler No. | R1 | R2 | R3 | R4 | X |
|---|---|---|---|---|---|
| C77 | H | H | H | H | 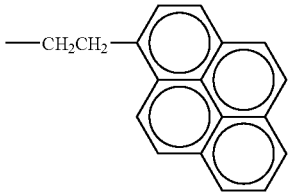 |
| C78 | H | H | H | H | 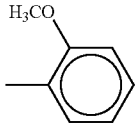 |
| C79 | H | H | H | H | 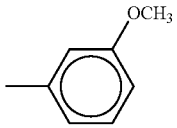 |
| C80 | H | H | H | H | 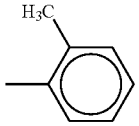 |
| C81 | H | H | H | H | 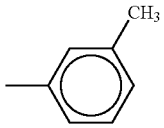 |
| C82 | H | H | H | H | 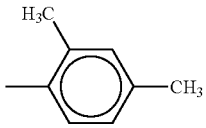 |
| C83 | H | H | H | H | 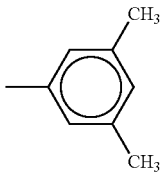 |
| C84 | H | H | H | H | 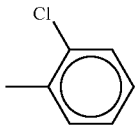 |

TABLE 2-continued
<Exemplification of Coupler Compound>
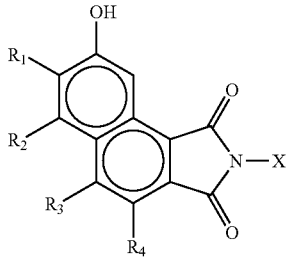
| Coupler No. | R1 | R2 | R3 | R4 | X |
|---|---|---|---|---|---|
| C85 | H | H | H | H | 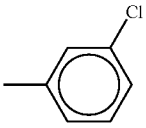  |
| C86 | H | H | H | H | 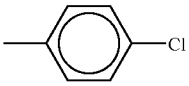  |
| C87 | H | H | H | H | 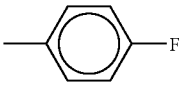  |
| C88 | H | H | H | H | 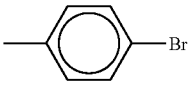  |
| C89 | H | H | H | H | 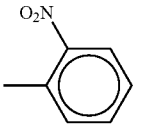  |
| C90 | H | H | H | H | 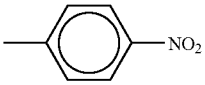  |
| C91 | H | H | H | H | 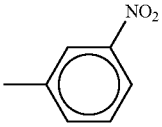  |
| C92 | H | H | H | H | 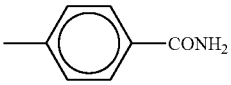  |
| C93 | H | H | H | H | 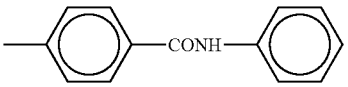  |
| C94 | H | H | H | H | 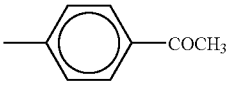  |
| C95 | H | H | H | H | 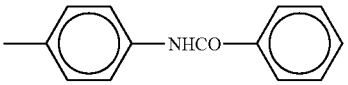  |

TABLE 2-continued
<Exemplification of Coupler Compound>
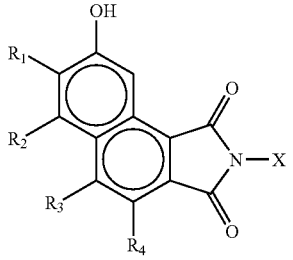
| Coupler No. | R1 | R2 | R3 | R4 | X |
|---|---|---|---|---|---|
| C96 | H | H | H | H | 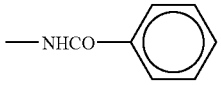  |
| C97 | H | H | H | H | 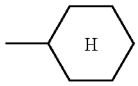  |
| C98 | H | H | H | H | 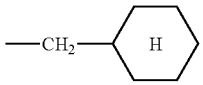  |
| C99 | H | H | H | H | 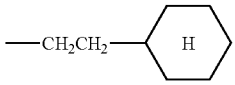  |
| C100 | H | H | H | H | 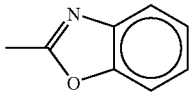  |
| C101 | H | H | H | H | 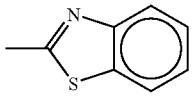  |
| C102 | H | H | H | H | 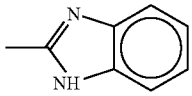  |
| C103 | H | H | H | H | 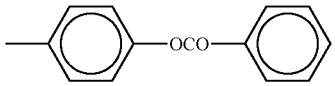  |
| C104 | H | H | H | H | 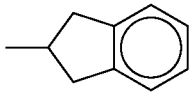 |
| C105 | H | H | H | H | 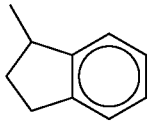 |
| C106 | H | H | H | H | 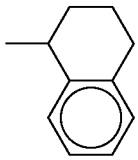 |

TABLE 2-continued
<Exemplification of Coupler Compound>
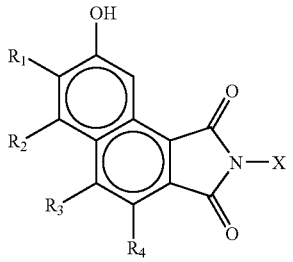
| Coupler No. | R1 | R2 | R3 | R4 | X |
|---|---|---|---|---|---|
| C107 | H | H | H | H | 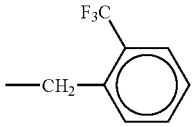 |
| C108 | H | H | H | H | 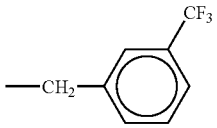 |
| C109 | H | H | H | H | 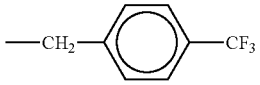 |
| C110 | H | H | H | H | 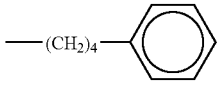 |
| C111 | H | H | H | H | 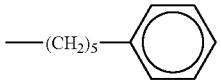 |
| C112 | H | H | H | H | 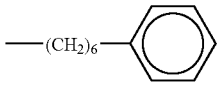 |
| C113 | H | H | H | H | 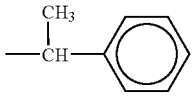 |
| C114 | H | H | H | H | 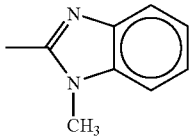 |

TABLE 3
<Exemplification of Coupler Compound>
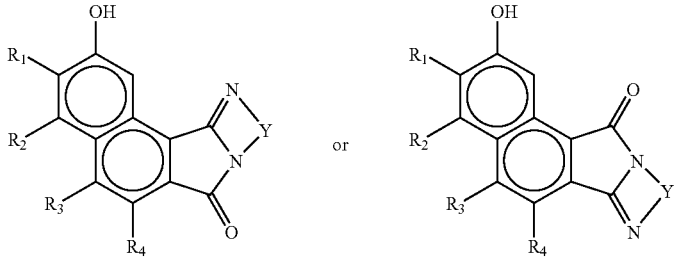
| Coupler No. | R1 | R2 | R3 | R4 | Y |
|---|---|---|---|---|---|
| E1 | H | H | H | H | $-CH_2-CH_2-$ |
| E2 | H | $-CH_3$ | H | H | $-CH_2-CH_2-$ |
| E3 | | $-CH_2CH_2CH_2-$ | H | H | $-CH(CH_3)-CH(CH_3)-$ |
| E4 | H | H | H | H | 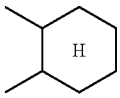 |
| E5 | H | H | $-CH_3$ | H | 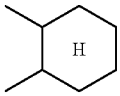 |
| E6 | H | $-CN$ | H | H | 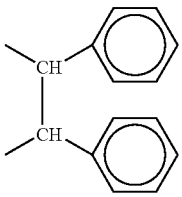 |
| E7 | H | H | H | H | $-CH_2-CH_2-CH_2-$ |
| E8 | H | H | $-CH_3$ | H | $-CH_2-CH_2-CH_2-$ |
| E9 | H | $-OCH_3$ | H | H | $-CH_2-CH_2-CH_2-$ |

TABLE 3-continued
<Exemplification of Coupler Compound>
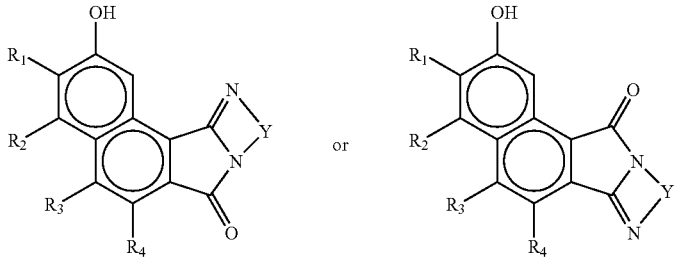
| Coupler No. | R1 | R2 | R3 | R4 | Y |
|---|---|---|---|---|---|
| E10 | H | —CN | H | H | 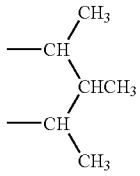 |
| E11 | H | —$N(C_2H_5)_2$ | H | H | 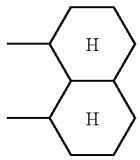 |
| E12 | H | H | H | H | 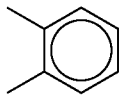 |
| E13 | —$CH_3$ | H | H | H | 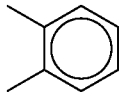 |
| E14 | H | —$OCH_3$ | H | H | 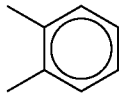 |
| E15 | H | H | —$CH_3$ | H | 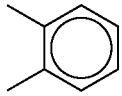 |
| E16 | H | H | H | —$CH_3$ | 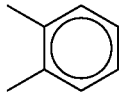 |
| E17 | H | H | H | H | 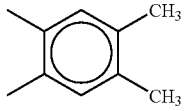 |
| E18 | H | —$CH_3$ | H | H | 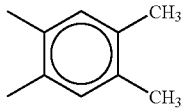 |

TABLE 3-continued
<Exemplification of Coupler Compound>
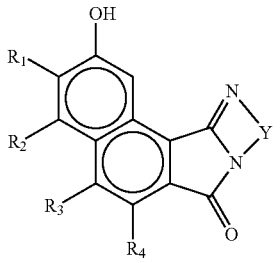
or
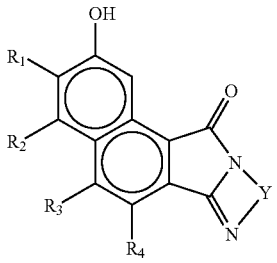
| Coupler No. | R1 | R2 | R3 | R4 | Y |
|---|---|---|---|---|---|
| E19 | H | H | H | H | 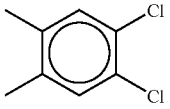 |
| E20 | H | H | H | H | 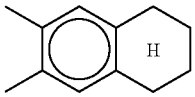 |
| E21 | H | H | H | H | 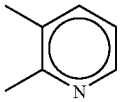 |
| E22 | H | —N(CH$_3$)$_2$ | H | H | 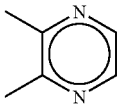 |
| E23 | H | H | H | H | 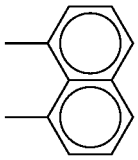 |
| E24 | —CH$_3$ | H | H | H | 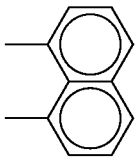 |
| E25 | H | H | —CH$_3$ | H | 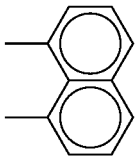 |
| E26 | H | H | H | H | 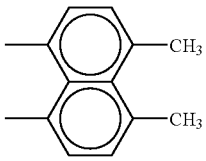 |

TABLE 3-continued
<Exemplification of Coupler Compound>
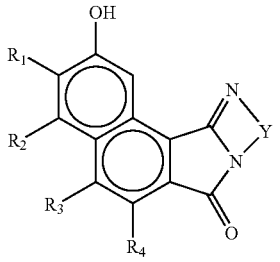
or
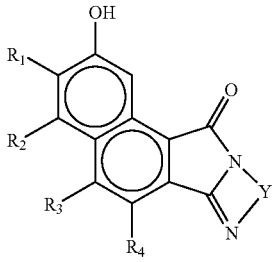
| Coupler No. | R1 | R2 | R3 | R4 | Y |
|---|---|---|---|---|---|
| E27 | H | H | H | H | 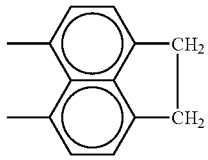  |
| E28 | H | H | H | H | 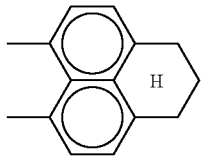  |
| E29 | H | H | H | H | 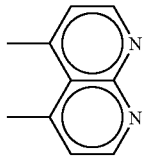  |
| E30 | H | H | H | H | 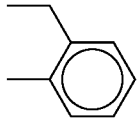 |
| E31 | H | H | H | H | 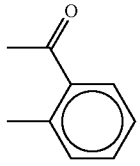  |

TABLE 4
<Exemplification of Coupler Compound>
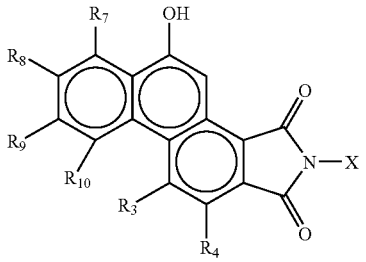
| Coupler No. | R1 | R8 | R9 | R10 | R3 | R4 | X |
|---|---|---|---|---|---|---|---|
| F1 | H | H | H | H | H | H | $—C_6H_{13}$ |
| F2 | H | H | H | H | H | H | $—C_8H_{17}$ |
| F3 | $—CH_3$ | H | H | H | H | H | $—C_6H_{13}$ |
| F4 | H | $—CH_3$ | H | H | H | H | $—C_6H_{13}$ |
| F5 | H | H | H | H | H | H | 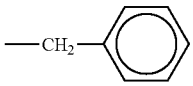 |
| F6 | H | $—CH_3$ | H | H | H | H | 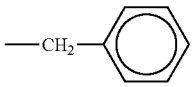 |
| F7 | H | H | $—CH_3$ | H | H | H | 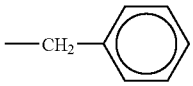 |
| F8 | H | H | H | H | H | $—C_2H_5$ | 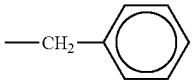 |
| F9 | H | H | H | H | H | H | 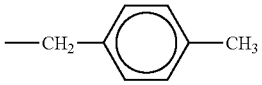 |
| F10 | H | H | H | H | H | H | 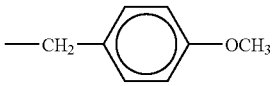 |
| F11 | H | H | H | H | H | H | 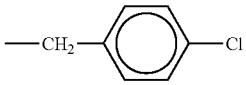 |
| F12 | H | H | H | H | H | H | 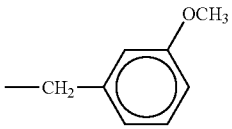 |
| F13 | H | H | H | H | H | H | 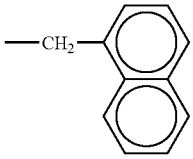 |
| F14 | H | H | H | H | H | H | 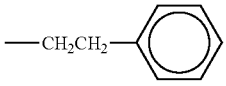 |

TABLE 4-continued
<Exemplification of Coupler Compound>
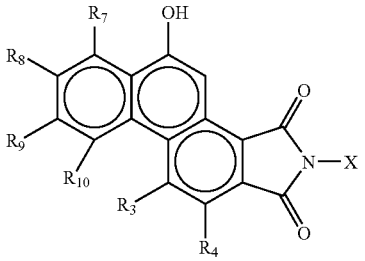
| Coupler No. | R1 | R8 | R9 | R10 | R3 | R4 | X |
|---|---|---|---|---|---|---|---|
| F15 | —$OCH_3$ | H | H | H | H | H | 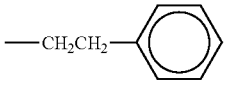 |
| F16 | H | H | H | H | H | H | 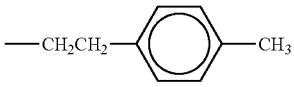 |
| F17 | H | H | H | H | H | H | 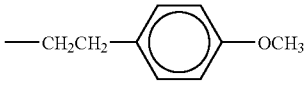 |
| F18 | H | H | H | H | H | H | 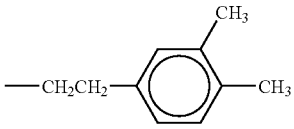 |
| F19 | H | H | H | H | H | H | 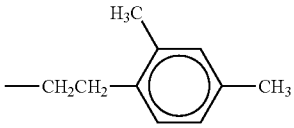 |
| F20 | H | H | H | H | H | H | 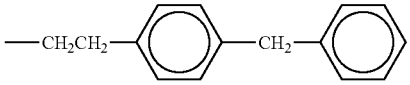 |
| F21 | H | H | H | H | H | H | 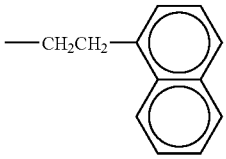 |
| F22 | H | H | H | H | H | H | 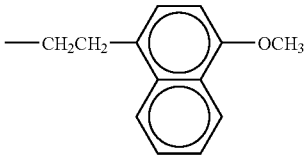 |
| F23 | H | H | H | H | H | H | 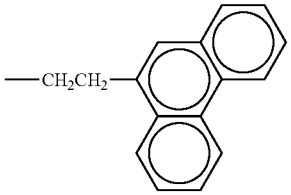 |

TABLE 4-continued
<Exemplification of Coupler Compound>
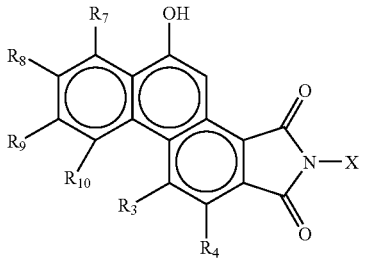
| Coupler No. | R1 | R8 | R9 | R10 | R3 | R4 | X |
|---|---|---|---|---|---|---|---|
| F24 | H | H | H | H | H | H | 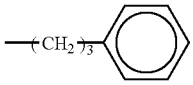 |
| F25 | H | —$NO_2$ | H | H | H | H | 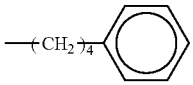 |
| F26 | H | H | H | H | H | H | —$C_2H_4OCH_3$ |
| F27 | H | H | H | H | H | H | —$C_2H_4OCOCH_3$ |
| F28 | H | H | H | H | H | H | 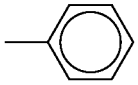 |
| F29 | —$CH_3$ | H | H | H | H | H | 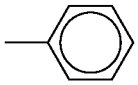 |
| F30 | H | —$OCH_3$ | —$CH_3$ | H | H | H | 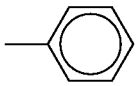 |
| F31 | H | —Cl | H | H | H | H | 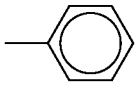 |
| F32 | H | H | H | H | H | H | 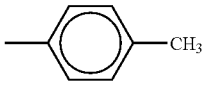 |
| F33 | H | H | H | H | H | H | 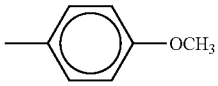 |
| F34 | H | H | H | H | H | H | 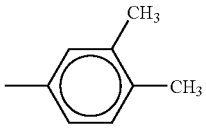 |
| F35 | H | H | —$CH_3$ | H | H | H | 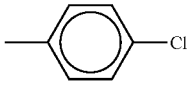 |
| F36 | H | H | H | H | H | H | 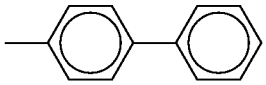 |

TABLE 4-continued
<Exemplification of Coupler Compound>
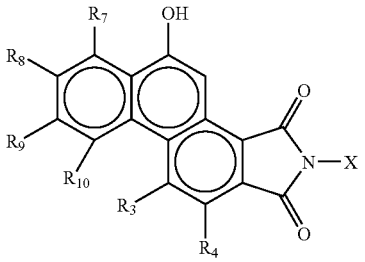
| Coupler No. | R1 | R8 | R9 | R10 | R3 | R4 | X |
|---|---|---|---|---|---|---|---|
| F37 | H | H | H | H | H | H | 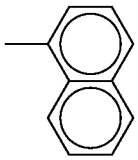 |
| F38 | H | H | H | H | H | H | 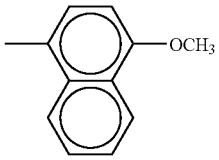 |
| F39 | H | H | H | H | H | H | 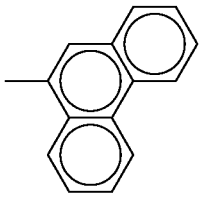 |
| F40 | H | H | H | H | H | H | 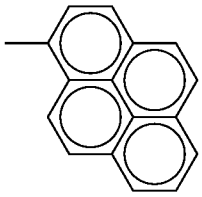 |
| F41 | H | H | H | H | H | H | 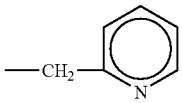 |
| F42 | H | H | H | H | H | H | 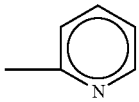 |
| F43 | H | H | H | H | H | H | 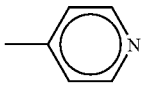 |
| F44 | H | H | H | H | H | H | 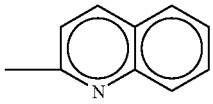 |

TABLE 4-continued
<Exemplification of Coupler Compound>
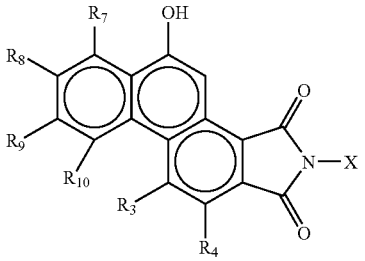
| Coupler No. | R1 | R8 | R9 | R10 | R3 | R4 | X |
|---|---|---|---|---|---|---|---|
| F45 | H | H | H | H | H | H | 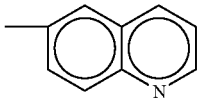 |
| F46 | H | H | H | H | H | H | H |
| F47 | H | H | H | H | H | H | —$CH_3$ |
| F48 | H | H | H | H | H | H | —$C_2H_5$ |
| F49 | H | H | H | H | H | H | 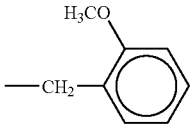 |
| F50 | H | H | H | H | H | H | 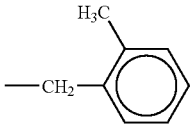 |
| F51 | H | H | H | H | H | H | 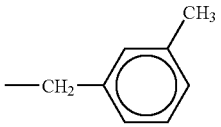 |
| F52 | H | H | H | H | H | H | 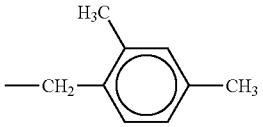 |
| F53 | H | H | H | H | H | H | 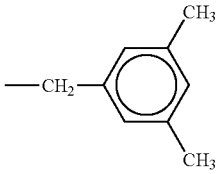 |
| F54 | H | H | H | H | H | H | 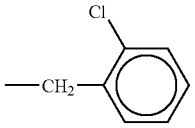 |
| F55 | H | H | H | H | H | H | 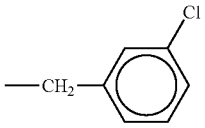 |

TABLE 4-continued
<Exemplification of Coupler Compound>
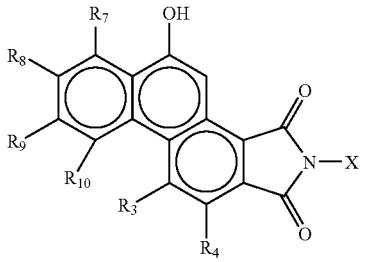
| Coupler No. | R1 | R8 | R9 | R10 | R3 | R4 | X |
|---|---|---|---|---|---|---|---|
| F56 | H | H | H | H | H | H | 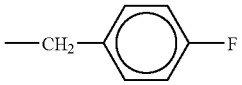 |
| F57 | H | H | H | H | H | H | 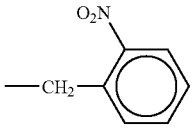 |
| F58 | H | H | H | H | H | H | 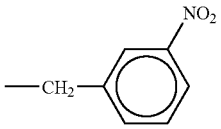 |
| F59 | H | H | H | H | H | H | 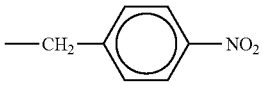 |
| F60 | H | H | H | H | H | H | 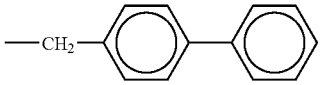 |
| F61 | H | H | H | H | H | H | 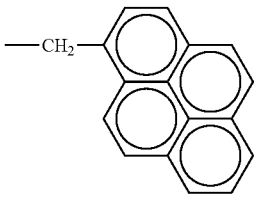 |
| F62 | H | H | H | H | H | H | 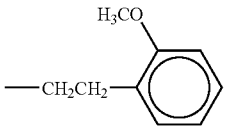 |
| F63 | H | H | H | H | H | H | 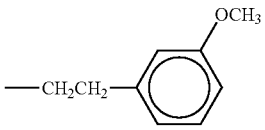 |
| F64 | H | H | H | H | H | H | 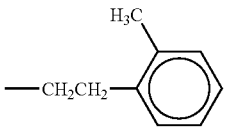 |

TABLE 4-continued
<Exemplification of Coupler Compound>
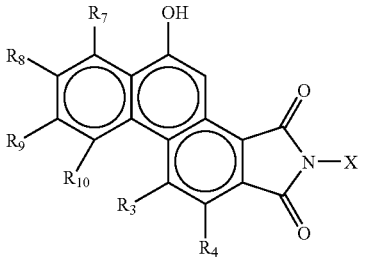
| Coupler No. | R1 | R8 | R9 | R10 | R3 | R4 | X |
|---|---|---|---|---|---|---|---|
| F65 | H | H | H | H | H | H | 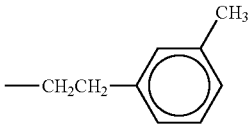 |
| F66 | H | H | H | H | H | H | 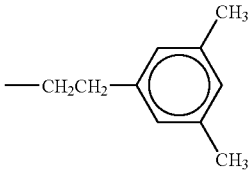 |
| F67 | H | H | H | H | H | H | 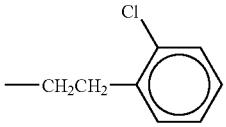 |
| F68 | H | H | H | H | H | H | 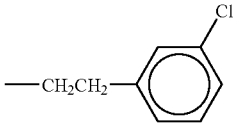 |
| F69 | H | H | H | H | H | H | 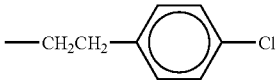 |
| F70 | H | H | H | H | H | H | 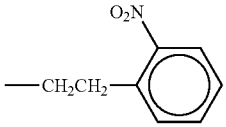 |
| F71 | H | H | H | H | H | H | 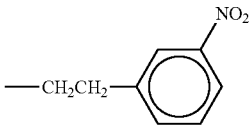 |
| F72 | H | H | H | H | H | H | 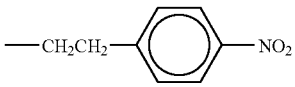 |
| F73 | H | H | H | H | H | H | 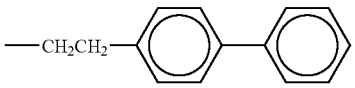 |
| F74 | H | H | H | H | H | H | $—C_3H_7$ |
| F75 | H | H | H | H | H | H | $—C_4H_9$ |
| F76 | H | H | H | H | H | H | $—C_5H_{11}$ |

TABLE 4-continued
<Exemplification of Coupler Compound>
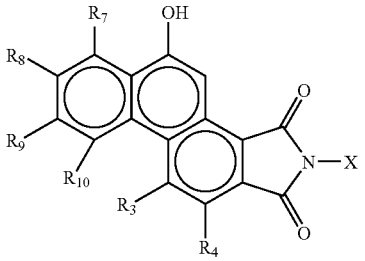
| Coupler No. | R1 | R8 | R9 | R10 | R3 | R4 | X |
|---|---|---|---|---|---|---|---|
| F77 | H | H | H | H | H | H | 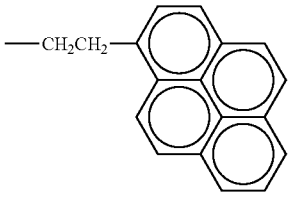 |
| F78 | H | H | H | H | H | H | 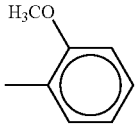 |
| F79 | H | H | H | H | H | H | 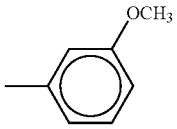 |
| F80 | H | H | H | H | H | H | 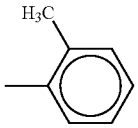 |
| F81 | H | H | H | H | H | H | 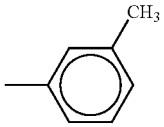 |
| F82 | H | H | H | H | H | H | 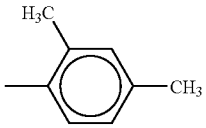 |
| F83 | H | H | H | H | H | H | 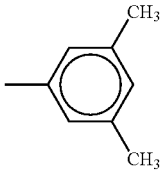 |
| F84 | H | H | H | H | H | H | 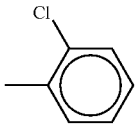 |

TABLE 4-continued
<Exemplification of Coupler Compound>
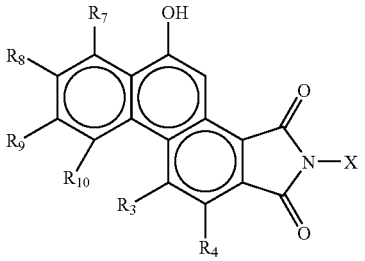
| Coupler No. | R1 | R8 | R9 | R10 | R3 | R4 | X |
|---|---|---|---|---|---|---|---|
| F85 | H | H | H | H | H | H | 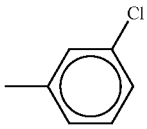 |
| F86 | H | H | H | H | H | H | 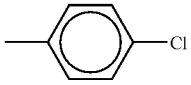 |
| F87 | H | H | H | H | H | H | 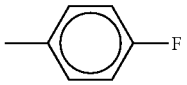 |
| F88 | H | H | H | H | H | H | 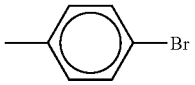 |
| F89 | H | H | H | H | H | H | 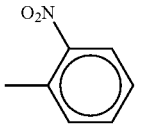 |
| F90 | H | H | H | H | H | H | 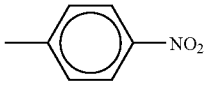 |
| F91 | H | H | H | H | H | H | 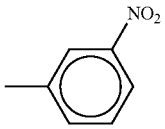 |
| F92 | H | H | H | H | H | H | 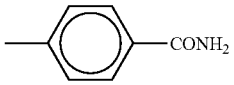 |
| F93 | H | H | H | H | H | H | 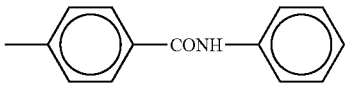 |
| F94 | H | H | H | H | H | H | 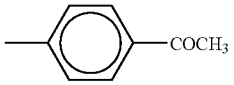 |
| F95 | H | H | H | H | H | H | 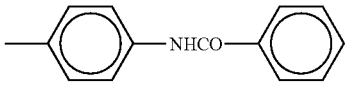 |

TABLE 4-continued
<Exemplification of Coupler Compound>
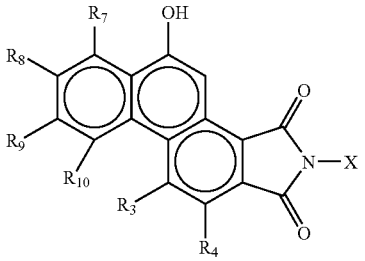
| Coupler No. | R1 | R8 | R9 | R10 | R3 | R4 | X |
|---|---|---|---|---|---|---|---|
| F96 | H | H | H | H | H | H | 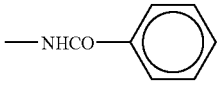  |
| F97 | H | H | H | H | H | H | 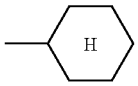  |
| F98 | H | H | H | H | H | H | 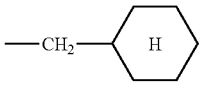  |
| F99 | H | H | H | H | H | H | 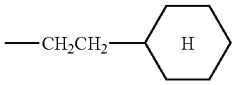  |
| F100 | H | H | H | H | H | H | 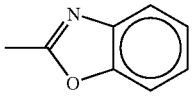  |
| F101 | H | H | H | H | H | H | 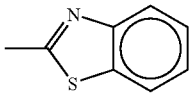  |
| F102 | H | H | H | H | H | H | 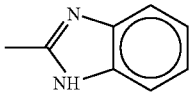  |
| F103 | H | H | H | H | H | H | 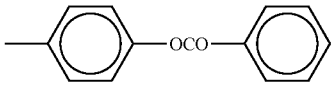  |
| F104 | H | H | H | H | H | H | 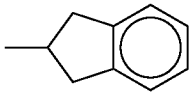 |
| F105 | H | H | H | H | H | H | 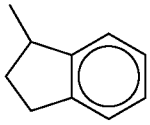 |
| F106 | H | H | H | H | H | H | 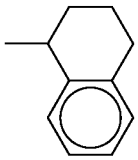 |

TABLE 4-continued
<Exemplification of Coupler Compound>
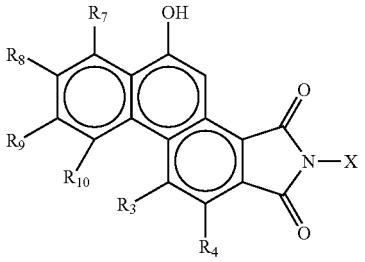
| Coupler No. | R1 | R8 | R9 | R10 | R3 | R4 | X |
|---|---|---|---|---|---|---|---|
| F107 | H | H | H | H | H | H | 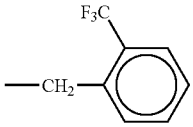 |
| F108 | H | H | H | H | H | H | 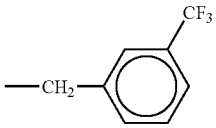 |
| F109 | H | H | H | H | H | H | 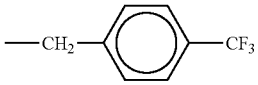 |
| F110 | H | H | H | H | H | H | 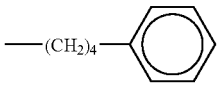 |
| F111 | H | H | H | H | H | H | 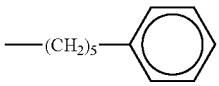 |
| F112 | H | H | H | H | H | H | 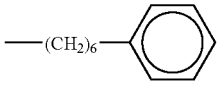 |
| F113 | H | H | H | H | H | H | 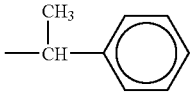 |
| F114 | H | H | H | H | H | H | 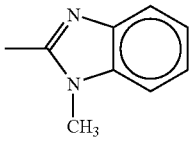 |

TABLE 5
<Exemplification of Coupler Compound>
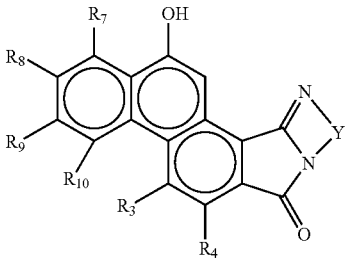
or
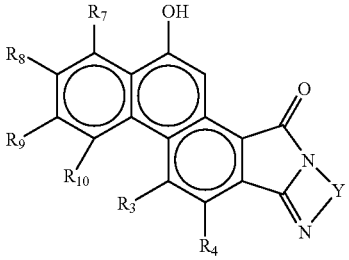
| Coupler No. | R7 | R8 | R9 | R10 | R3 | R4 | Y |
|---|---|---|---|---|---|---|---|
| G1 | H | H | H | H | H | H | 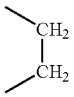 |
| G2 | H | —$CH_3$ | H | H | H | H | 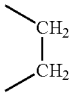 |
| G3 | H | H | H | H | H | H | 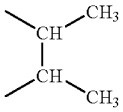 |
| G4 | H | H | H | H | H | H | 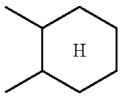 |
| G5 | H | H | —$CH_3$ | H | H | H | 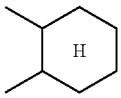 |
| G6 | H | —CN | H | H | H | H | 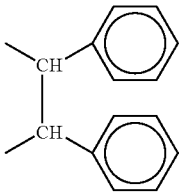 |
| G7 | H | H | H | H | H | H | 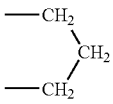 |

TABLE 5-continued
| | | | | | | | |
|---|---|---|---|---|---|---|---|
| G8 | H | H | —$CH_3$ | H | H | H | 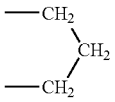 |
| G9 | H | —$OCH_3$ | H | H | H | H | 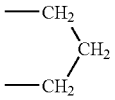 |
| G10 | H | —CN | H | H | H | H | 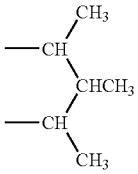 |
| G11 | H | —$N(Et)_2$ | H | H | H | H | 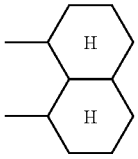 |
| G12 | H | H | H | H | H | H | 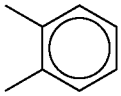 |
| G13 | —$CH_3$ | H | H | H | H | H | 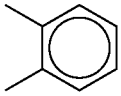 |
| G14 | H | —$OCH_3$ | H | H | H | H | 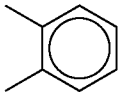 |
| G15 | H | H | —$CH_3$ | H | H | H | 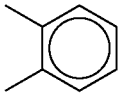 |
| G16 | H | H | H | H | H | —$CH_3$ | 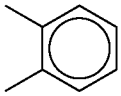 |
| G17 | H | H | H | H | H | H | 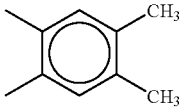 |
| G18 | H | —$CH_3$ | H | H | H | H | 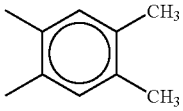 |
| G19 | H | H | H | H | H | H | 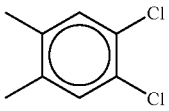 |

TABLE 5-continued
| | | | | | | | |
|---|---|---|---|---|---|---|---|
| G20 | H | H | H | H | H | H | 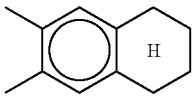 |
| G21 | H | H | H | H | H | H | 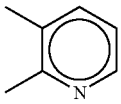 |
| G22 | H | —N(CH$_3$)$_2$ | H | H | H | H | 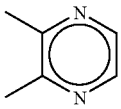 |
| G23 | H | H | H | H | H | H | 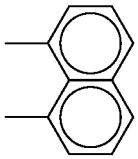 |
| G24 | —CH$_3$ | H | H | H | H | H | 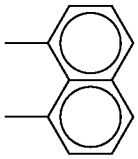 |
| G25 | H | H | —CH$_3$ | H | H | H | 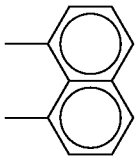 |
| G26 | H | H | H | H | H | H | 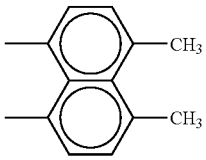 |
| G27 | H | H | H | H | H | H | 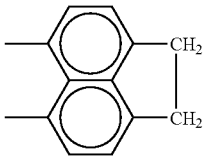 |
| G28 | H | H | H | H | H | H | 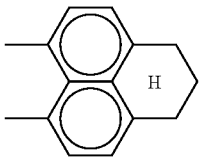 |
| G29 | H | H | H | H | H | H | 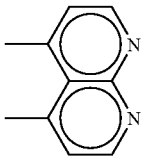 |

TABLE 5-continued

| | | | | | | | |
|---|---|---|---|---|---|---|---|
| G30 | H | H | H | H | H | H | |
| G31 | H | H | H | H | H | H | |

In addition, in the azo compound expressed by Formula (1) relating to the present invention, coupler residues other than those expressed by aforesaid Formula (2), Formula (3) and Formula (4) may be used. Taken up as coupler residues $Cp_1$, $Cp_2$ which may coexist other than those expressed by Formula (2), Formula (3) and Formula (4) other than are, for example, compounds having phenolic hydroxyl group such as phenols and naphthols, aromatic amino compounds having amino group, compounds having amino groups such as aminonaphthols and phenolic hydroxyl group and compounds having aliphatic or aromatic enolic ketone group (a compound having an active methylene group) and the like. Further preferable are the compounds expressed by the following Formulas (Cp 1) to (Cp 15).

(Cp1)

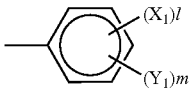

(Cp2)

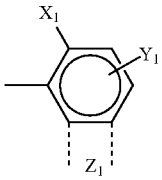

(Cp3)

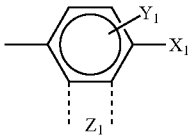

(Cp4)

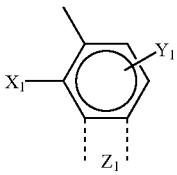

Formulas (Cp 1) to (Cp 4); wherein "$X_1$", "$Y_1$", "$Z_1$", "1" and "m" each represents the following:

$X_1$: —OH, —N($R_{11}$)($R_{12}$), or —NHSO$_2$—$R_{13}$ (wherein "$R_{11}$" and "$R_{12}$" represent hydrogen atom or a substituted or non-substituted alkyl group, and "$R_{13}$" represents a substituted or non-substituted alkyl group, or a non-substituted aryl group.)

$Y_1$: represents hydrogen atom, halogen, a substituted or non-substituted alkyl group, a substituted or non-substituted alkoxy group, carboxy group, sulpho group, a substituted or non-substituted sulphamoyl group or —CON ($R_{14}$) ($Y_2$)

["$R_{14}$" represents an alkyl group or its substituent, a phenyl group or its substituent, and "$Y_2$" represents a hydrocarbon ring group or its substituent, a heterocyclic group or its substituent, or —N═C $R_{15}$) ($R_{16}$)

("$R_{15}$" represents a hydrocarbon ring group or its substituent, a heterocyclic group or its substituent or a styryl group or its substituent, "$R_{16}$" represents hydrogen, an alkyl group, a phenyl group or its substituent, or "$R_{15}$" and "$R_{16}$" and a carbon atom, which bonds to "$R_{15}$" and "$R_{16}$" may form a ring.)]

$Z_1$: Hydrocarbon ring or its substituent, or a heterocyclic ring or its substituent 1: Integer of 1 or 2 m: Integer of 1 or 2

(Cp5)

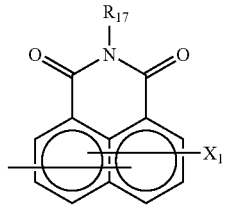

[Formula (Cp 5); wherein "$R_{17}$" represents a substituted or non-substituted hydrocarbon group and "$X_1$" represents the same as in "$R_{17}$".]

(Cp6)

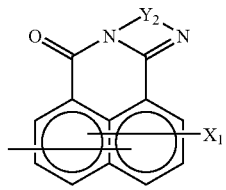

[In Formula (Cp 6); wherein "$Y_2$" represents the bivalent group of an aromatic hydrocarbon or the bivalent group of heterocyclic rings which contains a nitrogen atom therein. These rings may be substituted or non-substituted. "$X_1$" represents the foregoing.]

(Cp7)

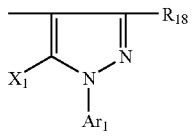

[In Formula (Cp7); wherein "$R_{18}$" represents an alkyl group, a carbamoyl group or its ester, "$Ar_1$" represents a hydrocarbon ring group or its substituent, and "$X_1$" represents the foregoing.]

(Cp8)

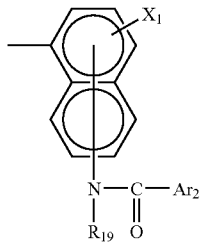

(Cp9)

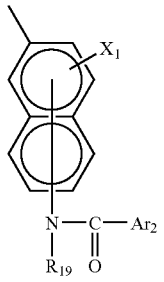

[In Formulas (Cp 8) and (Cp 9); wherein "$R_{19}$" represents hydrogen atom or a substituted or non-substituted hydrocarbon group, and "$Ar_2$" represents a hydrocarbon ring group or its substituent.]

A benzene ring, a naphthalene ring or the like can be exemplified as the hydrocarbon rings of "$Z_1$" in Formulas (Cp 1) to (Cp 4) above. Further, as heterocyclic rings which may have a substituent, an indole ring, a carbazole ring, a benzofuran ring, dibenzofuran ring or the like can be exemplified. As a substituent in the ring of "$Z_1$", chlorine atom, bromine atom or the like can be exemplified.

As the hydrocarbon ring groups in "$Y_2$" and "$R_{15}$", a phenyl group, naphthyl group, an anthryl group, pyrenyl group or the like can be exemplified, as the heterocyclic group, pyridyl group, thienyl group, furyl group, indoryl group, benzofuranyl group, carbazolyl group, dibenzofuranyl group or the like can be exemplified. Further, as a ring formed by bonding "$R_{15}$" and "$R_{16}$", a fluorine ring or the like can be exemplified.

As substituents in a ring formed by a hydrocarbon ring group or heterocyclic group in "$Y_2$" or by "$R_{15}$" and "$R_{16}$", taken up are alkyl groups such as methyl group, ethyl group, propyl group, butyl group, alkoxy groups such as methoxy group, ethoxy group, propoxy group and butoxy group, halogen atoms such as chlorine atom and bromine atom, dialkylamino groups such as dimethylamino group and diethylamino group, halomethyl groups such as trifluoromethyl group, nitro group, cyano group, carboxyl group or its ester, hydroxyl group, sulfonate groups such as —$SO_3Na$ and the like.

As a substituent of phenyl group in "$R_{14}$", halogen atoms such as chlorine atom or bromine atom can be exemplified.

As the representative example of a hydrocarbon group in "$R_{17}$" or "$R_{19}$", alkyl groups such as methyl group, ethyl group, propyl group and butyl group, aryl groups such as phenyl group or these substitutes can be exemplified.

As substitutes of the hydrocarbon groups in "$R_{17}$" or "$R_{19}$", alkyl groups such as methyl group, ethyl group, propyl group and butyl group, alkoxy groups such as methoxy group, ethoxy group, propoxy group and butoxy group, halogen atoms such as chlorine atom and bromine atom, hydroxyl group, nitro group or the like can be exemplified.

As hydrocarbon ring groups in "$Ar_1$" and "$Ar_2$", their representative examples are phenyl group, naphtyl group and the like. In addition, as substituents in these groups, alkyl groups such as methyl group, ethyl group, propyl group, butyl group, alkoxy groups such as methoxy group, ethoxy group, propoxy group and butoxy group, nitro group, halogen atoms such as chlorine atom and bromine atom, cyano group, dialkylamino groups such as dimethylamino group and diethylamino group can be exemplified.

In addition, in "$X_1$", particularly, hydroxyl group is appropriate.

Among the coupler residues above, preferable are the coupler residues expressed by Formulas (Cp 2), (Cp 5), (Cp 6), (Cp 7), (Cp 8) and (Cp 9). Above all, preferable is the coupler residue of a hydroxyl group in "$X_1$" of Formulas above.

Among the coupler residues expressed by Formula (Cp 2), particularly preferable is the coupler residue expressed by Formula (Cp 10), and further preferable is the coupler residue expressed by Formula (Cp 11).

(Cp10)

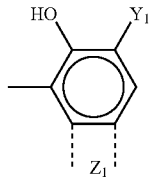

("$Y_1$" and "$Z_1$" are the same as mentioned above.)

(Cp11)

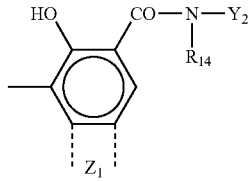

("$Z_1$", "$Y_2$" and "$R_{14}$" are the same as mentioned above.)

Furthermore, of the preferable coupler residues above, particularly preferable is the coupler residue expressed by Formula (Cp 12) or (Cp 13).

(Cp12)

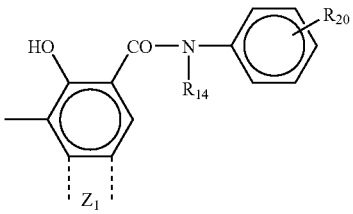

(Cp13)

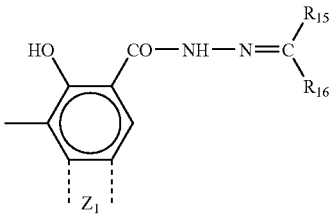

("$Z_1$", "$R_{14}$", "$R_{15}$" and "$R_{16}$" are the same as mentioned above, and as "$R_{20}$", the substituent of "$Y_2$" above can be exemplified.)

In addition, among the coupler residues expressed by Formula (Cp 6), particularly preferable is the coupler residue expressed by Formula (Cp 14) or (Cp 15).

(Cp14)

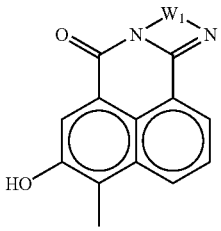

(Cp15)

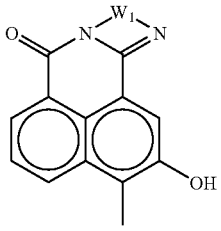

(wherein "$W_1$" represents the bivalent group of an aromatic hydrocarbon or the bivalent group of a heterocyclic ring where nitrogen is contained. These rings may be substituted or non-substituted.)

Of the preferable coupler residues, the coupler residues expressed by Formulas (8), (9) and (10) are preferable since the azo compound obtained by combining the coupler residue with the new coupler residue in the present invention shows high sensitivity and excellent electrification stability.

Below shown in Tables 6-1 to 21 are the examples of the coupler compounds corresponding to the coupler residues Cp1, Cp2, which may coexist other than the new coupler residues in the present invention.

TABLE 6

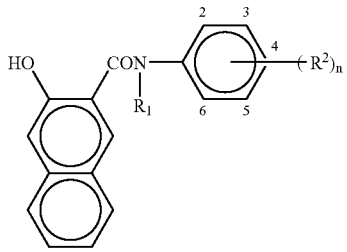

| Coupler No. | $R^1$ | $(R^2)_n$ | Melting point (° C.) |
|---|---|---|---|
| 1 | H | H | 243~244 |
| 2 | H | 2-$NO_2$ | 194~196 |
| 3 | H | 3-$NO_2$ | 246~247 |
| 4 | H | 4-$NO_2$ | 266~267.5 |
| 5 | H | 2-$CF_3$ | 178~179 |
| 6 | H | 3-$CF_3$ | 237.5~238.5 |
| 7 | H | 4-$CF_3$ | 279~281 |
| 8 | H | 2-CN | 221~222.5 |
| 9 | H | 3-CN | 256.5~258.5 |
| 10 | H | 4-CN | 274.5~277 |
| 11 | H | 2-I | 199~199.5 |
| 12 | H | 3-I | 258.5~259.5 |
| 13 | H | 4-I | 261.5~262 |
| 14 | H | 2-Br | 217~218 |
| 15 | H | 3-Br | 254~255 |
| 16 | H | 4-Br | 265~268 |
| 17 | H | 2-Cl | 228~230 |
| 18 | H | 3-Cl | 256.5~257 |
| 19 | H | 4-Cl | 264~266 |
| 20 | H | 2-F | 223.0~224.0 |
| 21 | H | 3-F | 250.0~251.0 |
| 22 | H | 4-F | 265.0~267.0 |
| 23 | H | 2-$CH_3$ | 195.5~198.0 |
| 24 | H | 3-$CH_3$ | 214.5~216.5 |
| 25 | H | 4-$CH_3$ | 227.0~229.0 |
| 26 | H | 2-$C_2H_5$ | 168.5~169.5 |
| 27 | H | 4-$C_2H_5$ | 203.0~204.5 |
| 28 | H | 2-$OCH_3$ | 167~168 |
| 29 | H | 3-$OCH_3$ | 195.5~198.0 |
| 30 | H | 4-$OCH_3$ | 229~230 |
| 31 | H | 2-$OC_2H_5$ | 157~158 |
| 32 | H | 3-$OC_2H_5$ | 188.5~189.0 |
| 33 | H | 4-$OC_2H_5$ | 225.0~225.5 |
| 34 | H | 4-$N(CH_3)_2$ | 232.0~233.5 |
| 35 | —$CH_3$ | H | 189.5~190.5 |
| 36 | 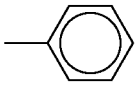 | H | 182.0~183.0 |
| 37 | H | 2-$OCH_3$, 5-$OCH_3$ | 186.0~188.0 |
| 38 | H | 2-$OC_2H_5$, 5-$OC_2H_5$ | 173.0~173.5 |
| 39 | H | 2-$CH_3$, 5-$CH_3$ | 207.0~208.5 |
| 40 | H | 2-Cl, 5-Cl | 253.5~254.5 |
| 41 | H | 2-$CH_3$, 5-Cl | 245~247 |
| 42 | H | 2-$OCH_3$, 4-$OCH_2$ | 151.0~152.0 |
| 43 | H | 2-$CH_3$, 4-$CH_3$ | 226~228 |
| 44 | H | 2-$CH_3$, 4-Cl | 244~245 |
| 45 | H | 2-$NO_2$, 4-$OCH_3$ | 179.5~181.0 |
| 46 | H | 3-$OCH_3$, 5-$OCH_3$ | 180.5~182.0 |
| 47 | H | 2-$OCH_3$, 5-Cl | 219.0~220.0 |
| 48 | H | 2-$OCH_3$, 5-$OCH_3$, 4-Cl | 193.5~195.5 |
| 49 | H | 2-$OCH_3$, 4-$OCH_3$, 5-Cl | 193~194 |
| 50 | H | 3-Cl, 4-Cl | 272.5~273.5 |
| 51 | H | 2-Cl, 4-Cl, 5-Cl | 257.5~258.5 |
| 52 | H | 2-$CH_3$, 3-Cl | 227.5~228.5 |
| 53 | H | 3-Cl, 4-$CH_3$ | 259.5~260.5 |
| 54 | H | 2-F, 4-F | 246.0~246.5 |
| 55 | H | 2-F, 5-F | 259.0~260.0 |
| 56 | H | 2-Cl, 4-$NO_2$ | 283.0~284.0 |

TABLE 6-continued

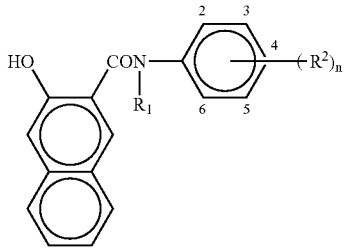

| Coupler No. | $R^1$ | $(R^2)_n$ | Melting point (° C.) |
|---|---|---|---|
| 57 | H | 2-$NO_2$, 4-Cl | 226.5~227.5 |
| 58 | H | 2-Cl, 3-Cl, 4-Cl, 5-Cl | 280.0~281.5 |
| 59 | H | 4-OH | 268 |

TABLE 7

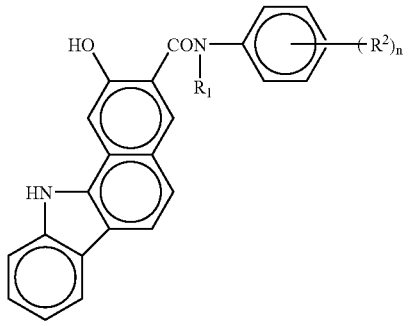

| Coupler No. | $R^1$ | $(R^2)_n$ | Melting point (° C.) |
|---|---|---|---|
| 60 | H | H | >300 |
| 61 | H | 2-$NO_2$ | 283~284 |
| 62 | H | 3-$NO_2$ | >300 |
| 63 | H | 4-$NO_2$ | >300 |
| 64 | H | 2-Cl | >300 |
| 65 | H | 3-Cl | >300 |
| 66 | H | 4-Cl | >300 |
| 67 | H | 2-$CH_3$ | >300 |
| 68 | H | 3-$CH_3$ | >300 |
| 69 | H | 4-$CH_3$ | >300 |
| 70 | H | 2-$C_2H_5$ | 271~273 |
| 71 | H | 4-$C_2H_5$ | >300 |
| 72 | H | 2-$OCH_3$ | 276~278 |
| 73 | H | 3-$OCH_3$ | >300 |
| 74 | H | 4-$OCH_3$ | >300 |
| 75 | H | 2-$OC_2H_5$ | 273.5~275.0 |
| 76 | H | 4-$OC_2H_5$ | >300 |
| 77 | H | 2-$CH_3$, 4-$OCH_3$ | 296 |
| 78 | H | 2-$CH_3$, 4-$CH_3$ | >300 |
| 79 | H | 2-$CH_3$, 5-$CH_3$ | 274.0~276.0 |
| 80 | H | 2-$CH_3$, 6-$CH_3$ | >300 |
| 81 | H | 2-$OCH_3$, 4-$OCH_3$ | 296.5~298.5 |
| 82 | H | 2-$OCH_3$, 5-$OCH_3$ | 284.5~286.5 |
| 83 | H | 3-$OCH_3$, 5-$OCH_3$ | 300.5~302.0 |
| 84 | H | 2-$CH_3$, 3-Cl | 296.0~297.5 |
| 85 | H | 2-$CH_3$, 4-Cl | >300 |
| 86 | H | 2-$CH_3$, 5-Cl | 290.5~292.0 |
| 87 | H | 4-NH— | 304 |
| 88 | H | 2-$CH(CH_3)_2$ | 239.0~240.0 |

TABLE 8

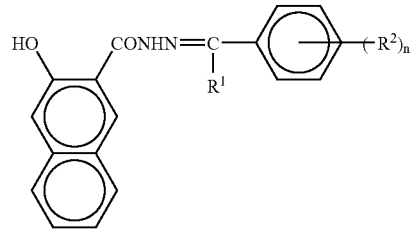

| Coupler No. | $R^1$ | $(R^a)_n$ | Melting point (° C.) |
|---|---|---|---|
| 89 | H | H | 228.0~230.0 |
| 90 | H | 4-N $(CH_3)_2$ | 238.5~240.0 |
| 91 | H | 2-$OCH_3$ | 218.0~222.0 |
| 92 | H | 3-$OCH_3$ | 186.5~188.5 |
| 93 | H | 4-$OCH_3$ | 224.5~225.0 |
| 94 | H | 4-$OC_2H_5$ | 236.0~237.5 |
| 95 | H | 2-$CH_3$ | 227.0~228.0 |
| 96 | H | 3-$CH_3$ | 212.5~214.0 |
| 97 | H | 4-$CH_3$ | 233.0~236.0 |
| 98 | H | 2-F | 233.0~233.5 |
| 99 | H | 3-F | 248.5 |
| 100 | H | 4-F | 239.5~240.0 |
| 101 | H | 2-Cl | 254.0~255.0 |
| 102 | H | 3-Cl | 226.5~230.0 |
| 103 | H | 4-Cl | 265.5~269.0 |
| 104 | H | 2-Br | 243.0 |
| 105 | H | 3-Br | 231.0~231.5 |
| 106 | H | 4-Br | 259.0 |
| 107 | H | 2-Cl, 4-Cl | 251.5~252.0 |
| 108 | H | 3-Cl, 4-Cl | 260.0~261.0 |
| 109 | H | 2-CN | 175.0~176.5 |
| 110 | H | 4-CN | 267.5~268.0 |
| 111 | H | 2-$NO_2$ | 240.0 |
| 112 | H | 3-$NO_2$ | 255.5~257.0 |
| 113 | H | 4-$NO_2$ | 260.0~261.0 |
| 114 | H | 2-$CH_3$, 4-$CH_3$ | 234.5~236.5 |
| 115 | H | 2-$OCH_3$, 5-$OCH_3$ | 221.5~222.0 |
| 116 | H | 2-$OCH_3$, 3-$OCH_3$, 4-$OCH_3$ | 191.0~192.0 |
| 117 | —$CH_3$ | H | 248.5~250.0 |
| 118 | —$CH_2$— | H | 182.5~185.0 |
| 119 | — | H | 213.0~214.5 |
| 120 | H | 4-N(—)$_2$ | 237.0~237.5 |

TABLE 9
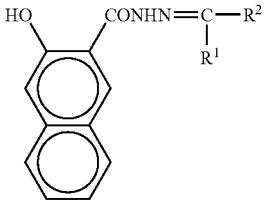
| Coupler No. | $R^1$ | $R^2$ | Melting point (° C.) |
|---|---|---|---|
| 121 | $CH_3$ | $CH_3$ | 232.5~233.0 |
| 122 | H | 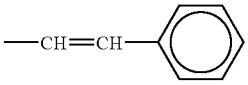 | 208.5~209.0 |
| 123 | H | 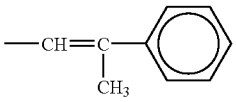 | 224.0~224.5 |
| 124 | H | 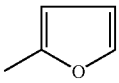 | 197.5~199.0 |
| 125 | H | 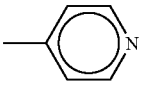 | 188.0~188.5 |
| 126 | H | 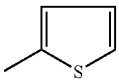 | 227.0~228.0 |
| 127 | —$CH_3$ | 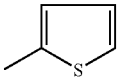 | 225.5~226.0 |
| 128 | H | 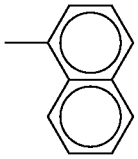 | 212.5~214.0 |
| 129 | H | 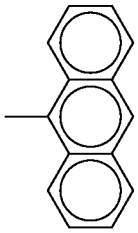 | 257 |
| 130 | H | 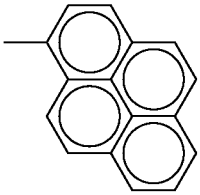 | 250 |
TABLE 9-continued
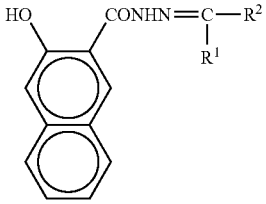
| Coupler No. | $R^1$ | $R^2$ | Melting point (° C.) |
|---|---|---|---|
| 131 | H | 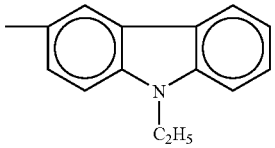 | 232.5~236.0 |
| 132 | H | 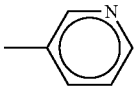 | 240.5~241.5 |
TABLE 10
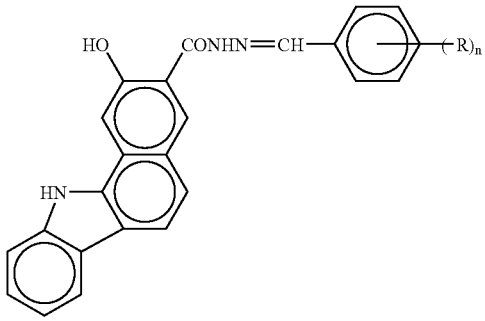
| Coupler No. | $(R)_n$ | Melting point (° C.) |
|---|---|---|
| 133 | H | >300 |
| 134 | 2-$OCH_3$ | 268 |
| 135 | 3-$OCH_3$ | 281.0~283.0 |
| 136 | 4-$OCH_3$ | 293 |
| 137 | 2-$CH_3$ | 297 |
| 138 | 3-$CH_3$ | 296 |
| 139 | 4-$CH_3$ | >300 |
| 140 | 4-Cl | >300 |
| 141 | 2-$NO_2$ | >300 |
| 142 | 4-$NO_2$ | >300 |
| 143 | 2-OH | >300 |
| 144 | 2-OH, 3-$NO_2$ | >300 |
| 145 | 2-OH, 5-$NO_2$ | >300 |
| 146 | 2-OH, 3-$OCH_3$ | >300 |

TABLE 11
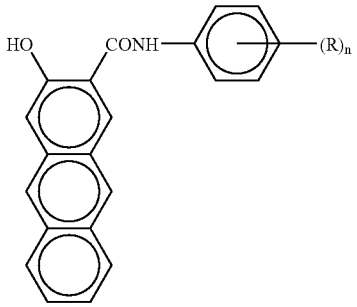
| Coupler No. | $(R)_n$ | Melting point (° C.) |
|---|---|---|
| 147 | 4-Cl | >300 |
| 148 | 2-$NO_2$ | 268~274 |
| 149 | 3-$NO_2$ | >300 |
| 150 | 4-$NO_2$ | >300 |
| 151 | 4-NH 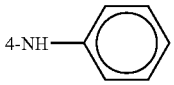 | 296 |
| 152 | H | 300~307 |
| 153 | 2-$OCH_3$ | 242~248 |
| 154 | 3-$OCH_3$ | 269~275 |
| 155 | 4-$OCH_3$ | 312 |
| 156 | 2-$CH_3$ | 265~270 |
| 157 | 3-$CH_3$ | 270~278 |
| 158 | 4-$CH_3$ | 304 |
| 159 | 2-Cl | 283~288 |
| 160 | 3-Cl | 281~287 |
TABLE 12
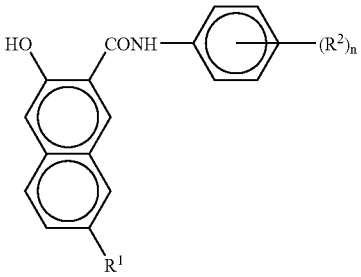
| Coupler No. | $R^1$ | $(R^a)_n$ | Melting point (° C.) |
|---|---|---|---|
| 161 | H | 2-$OCH_3$, 4-Cl, 5-$CH_3$ | 208.0~208.5 |
| 162 | —$OCH_3$ | H | 230.5~231.5 |
| 163 | —$OCH_3$ | 2-$CH_3$ | 205.5~206.0 |
| 164 | —$OCH_3$ | 2-$OCH_3$, 5-$OCH_3$, 4-Cl | 245.5~246.0 |
TABLE 13
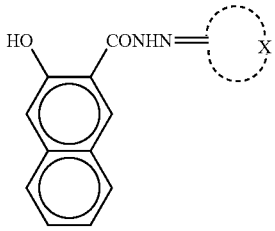
| Coupler No. | X | Melting point (° C.) |
|---|---|---|
| 165 | 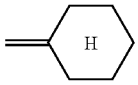 | 207.0~209.0 |
| 166 | 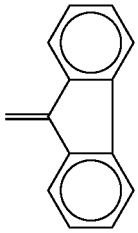 | 257.0~259.0 |
| 167 | 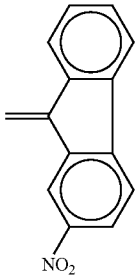 | 290 |
TABLE 14
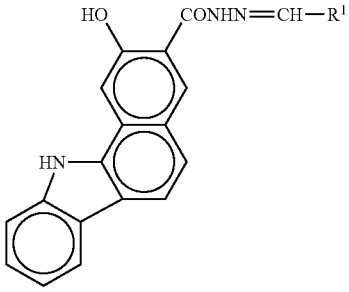
| Coupler No. | $R^1$ | Melting point (° C.) |
|---|---|---|
| 168 | 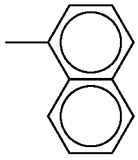 | >300 |

TABLE 14-continued
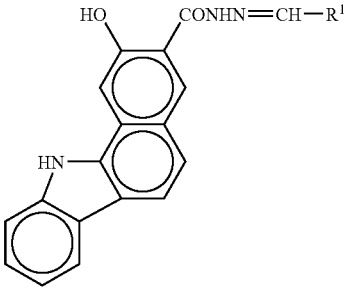
| Coupler No. | $R^1$ | Melting point (° C.) |
|---|---|---|
| 169 | 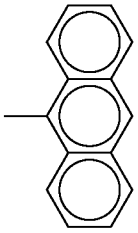 | >300 |
| 170 | 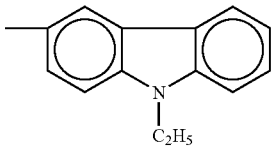  | >300 |
| 171 | 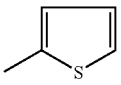  | 298 |
TABLE 15
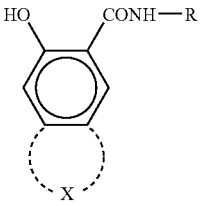
| Coupler No. | X | R | Melting point (° C.) |
|---|---|---|---|
| 172 | 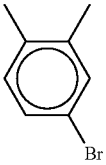  | 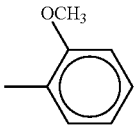  | 180~183 |
| 173 | 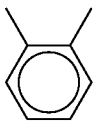 | 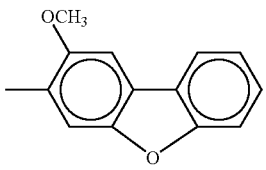  | 228.5~229.5 |
TABLE 15-continued
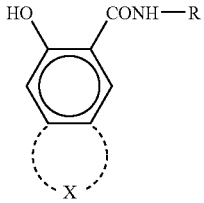
| Coupler No. | X | R | Melting point (° C.) |
|---|---|---|---|
| 174 | 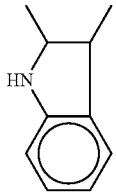  | 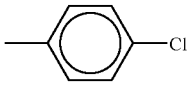  | >262 |
| 175 | 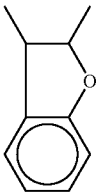  | 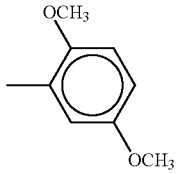  | 226.5~227.0 |
| 176 | 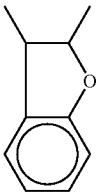  | 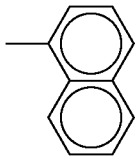 | 308~310 |
| 177 | 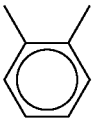 | 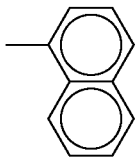 | 222~223 |
TABLE 16
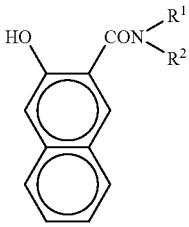
| Coupler No. | $R^1$ | $R^2$ | Melting point (° C.) |
|---|---|---|---|
| 178 | H | H | 220.5~221.5 |
| 179 | —$CH_3$ | H | 190.5~192.5 |
| 180 | —$CH_3$ | —$CH_3$ | 196.0~198.0 |

TABLE 16-continued
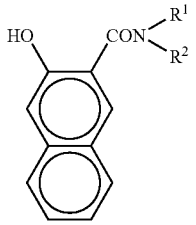
| Coupler No. | $R^1$ | $R^2$ | Melting point (° C.) |
|---|---|---|---|
| 181 | H | 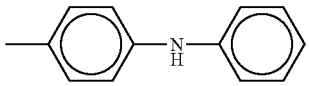 | 222.0~223.0 |
TABLE 17
| Coupler No. | Structure | Melting point (° C.) |
|---|---|---|
| 182 | 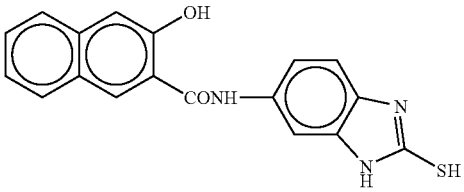 | >300 |
| 183 | 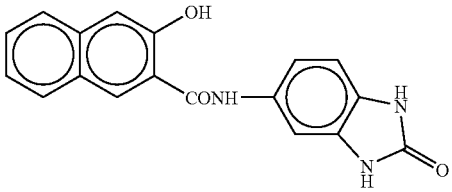 | >300 |
| 184 | 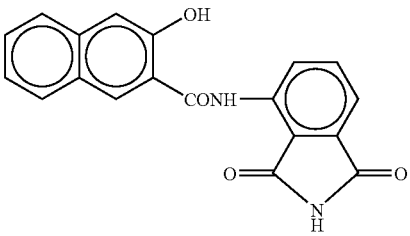 | >300 |
| 185 | 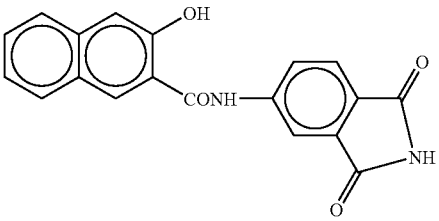 | >300 |

TABLE 17-continued
| Coupler No. | Structure | Melting point (° C.) |
|---|---|---|
| 186 | 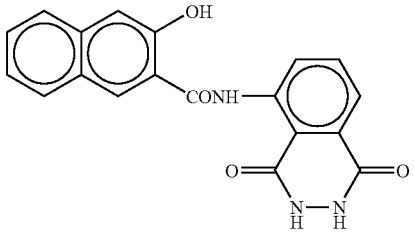 | >300 |
| 187 | 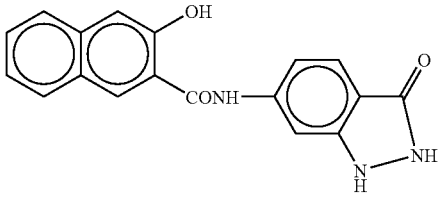 | >300 |
| 188 | 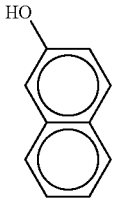 | 122.0~122.5 |
| 189 | 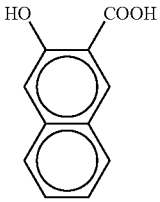 | 222.5~224.0 |
| 190 | 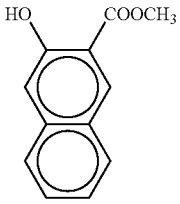 | 74.5~75.5 |
| 191 | 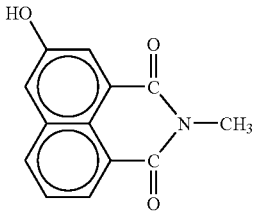 | 275.5~276.5 |
| 192 | 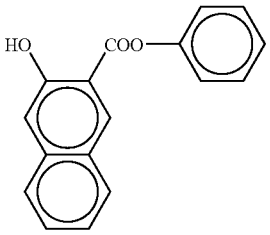 | 130.5~131.5 |

TABLE 17-continued
| Coupler No. | Structure | Melting point (° C.) |
|---|---|---|
| 193 | 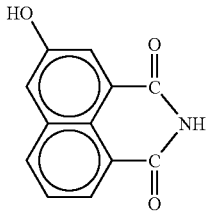 | >300 |
| 194 | 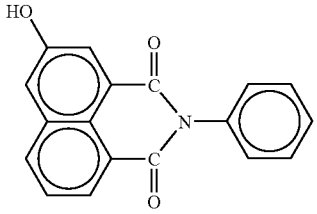 | >300 |
| 195 | 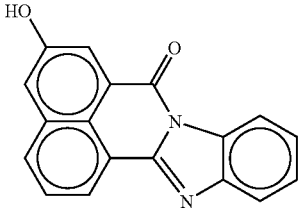 | >300 |
| 196 | 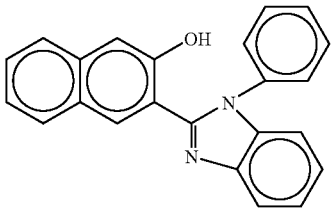 | 172.5~173.5 |
| 197 | 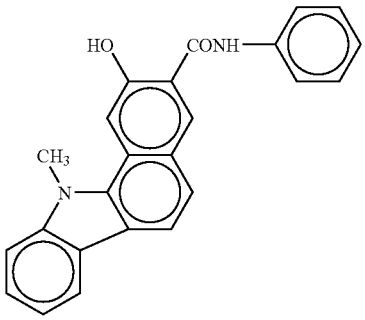 | 262.5~265.5 |
| 198 | 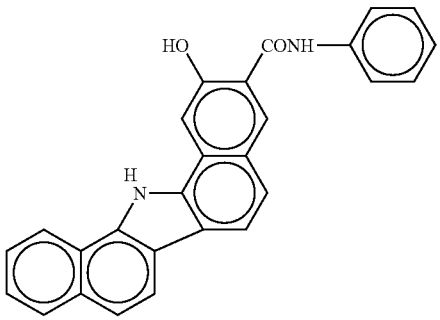 | >300 |

TABLE 17-continued

| Coupler No. | Structure | Melting point (° C.) |
|---|---|---|
| 199 | 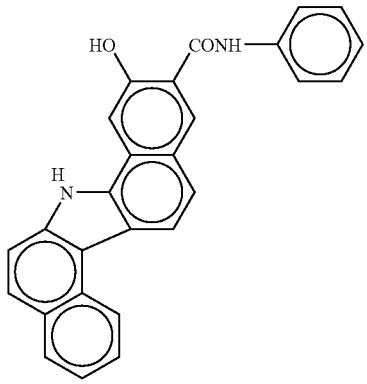 | >300 |
| 200 | 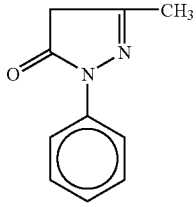 | 128.0~129.0 |

TABLE 18

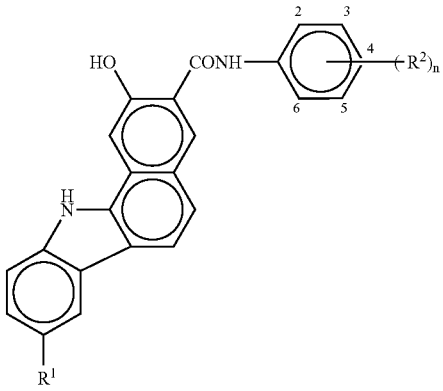

| Coupler No. | $R^1$ | $(R^2)_n$ | Melting point (° C.) |
|---|---|---|---|
| 201 | Cl | H | >300 |
| 202 | Cl | 2-$OCH_3$ | >300 |
| 203 | Cl | 3-$OCH_3$ | >300 |
| 204 | Cl | 4-$OCH_3$ | >300 |
| 205 | Cl | 2-$CH_3$ | >300 |
| 206 | Cl | 3-$CH_3$ | >300 |
| 207 | Cl | 4-$CH_3$ | >300 |
| 208 | Cl | 2-Cl | >300 |
| 209 | Cl | 3-Cl | >300 |
| 210 | Cl | 4-Cl | >300 |
| 211 | Cl | 2-$NO_2$ | >300 |
| 212 | Cl | 3-$NO_2$ | >300 |
| 213 | Cl | 4-$NO_2$ | >300 |
| 214 | Cl | 2-$CH_3$, 4-Cl | >300 |
| 215 | Cl | 2-$CH_3$, 4-$CH_3$ | >300 |
| 216 | Cl | 2-$C_2H_5$ | 299.0~301.0 |
| 217 | $CH_3$ | H | >300 |
| 218 | $CH_3$ | 2-$OCH_3$ | 297 |
| 219 | $CH_3$ | 3-$OCH_3$ | >300 |
| 220 | $CH_3$ | 4-$OCH_3$ | >300 |

TABLE 18-continued

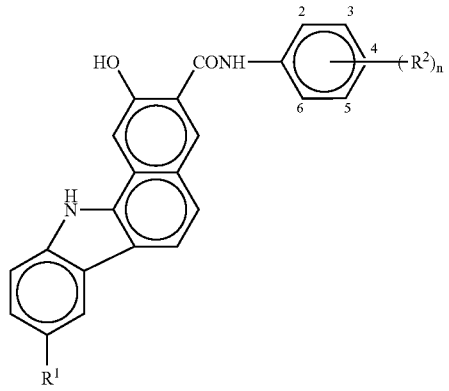

| Coupler No. | $R^1$ | $(R^2)_n$ | Melting point (° C.) |
|---|---|---|---|
| 221 | $CH_2$ | 2-$CH_2$ | >300 |
| 222 | $CH_3$ | 3-$CH_3$ | >300 |
| 223 | $CH_3$ | 4-$CH_3$ | >300 |
| 224 | $CH_3$ | 2-Cl | >300 |
| 225 | $CH_3$ | 3-Cl | >300 |
| 226 | $CH_3$ | 4-Cl | >300 |
| 227 | $CH_3$ | 2-$NO_2$ | >300 |
| 228 | $CH_3$ | 3-$NO_2$ | >300 |
| 229 | $CH_3$ | 4-$NO_2$ | >300 |
| 230 | $CH_3$ | 2-$CH_3$, 4-Cl | >300 |
| 231 | $CH_3$ | 2-$CH_3$, 4-$CH_3$ | >300 |
| 232 | $CH_3$ | 2-$C_2H_5$ | 268.5~270.0 |
| 233 | $OCH_3$ | H | 289.0 |
| 234 | $OCH_3$ | 2-$OCH_3$ | 268.0~270.0 |
| 235 | $OCH_3$ | 3-$OCH_3$ | >300 |
| 236 | $OCH_3$ | 4-$OCH_3$ | >300 |
| 237 | $OCH_3$ | 2-$CH_3$ | 284.5~285.5 |
| 238 | $OCH_3$ | 3-$CH_3$ | >300 |
| 239 | $OCH_3$ | 4-$CH_3$ | >300 |
| 240 | $OCH_3$ | 2-Cl | >300 |

TABLE 18-continued
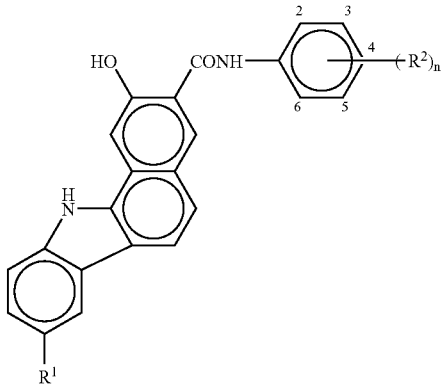
| Coupler No. | $R^1$ | $(R^2)_n$ | Melting point (° C.) |
|---|---|---|---|
| 241 | $OCH_3$ | 3-Cl | >300 |
| 242 | $OCH_3$ | 4-Cl | >300 |
| 243 | $OCH_3$ | 2-$NO_2$ | >300 |
| 244 | $OCH_3$ | 3-$NO_2$ | >300 |
| 245 | $OCH_3$ | 4-$NO_2$ | >300 |
| 246 | $OCH_3$ | 2-$C_2H_5$ | 264.5~266.5 |
TABLE 19
| Coupler No. | Structure |
|---|---|
| 247 | 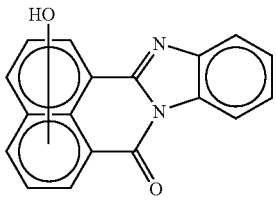 |
| 248 | 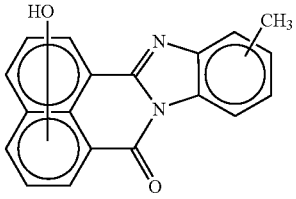 |
| 249 | 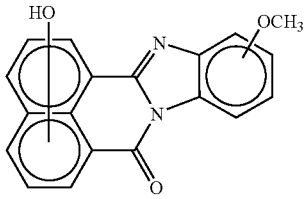 |
| 250 | 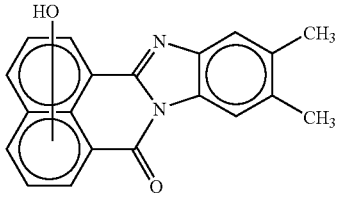 |
TABLE 19-continued
| Coupler No. | Structure |
|---|---|
| 251 | 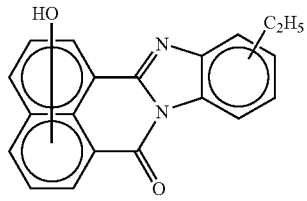 |
| 252 | 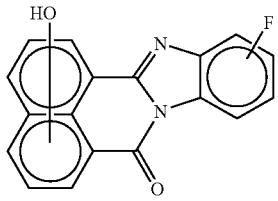 |
| 253 | 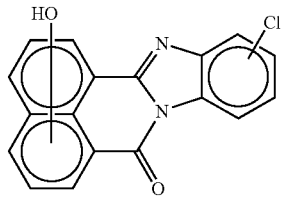 |
| 254 | 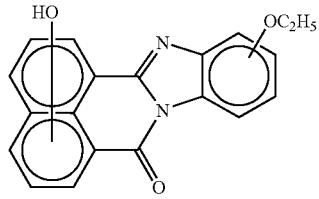 |
| 255 | 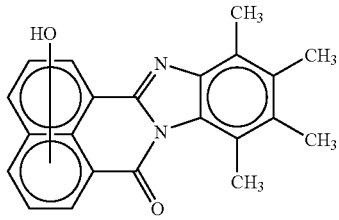 |
| 256 | 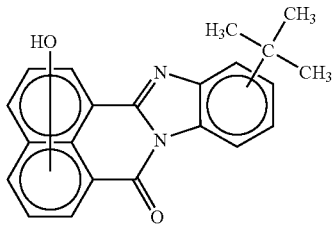 |
| 257 | 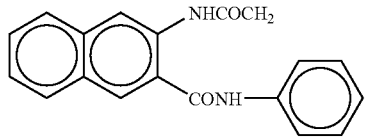 |

TABLE 19-continued

| Coupler No. | Structure |
|---|---|
| 258 | 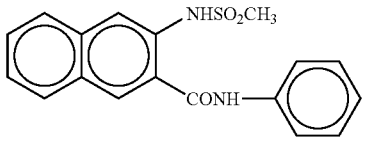 |

TABLE 20

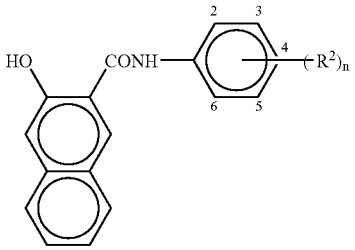

| Coupler No. | $(R^2)_n$ |
|---|---|
| 259 | 2-Cl, 3-Cl |
| 260 | 2-Cl, 4-Cl |
| 261 | 3-Cl, 5-Cl |

TABLE 21

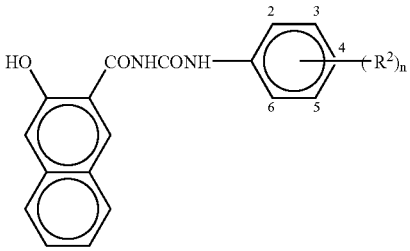

| Coupler No. | $(R^2)_n$ |
|---|---|
| 262 | 4-$CH_3$ |
| 263 | 3-$NO_2$ |
| 264 | 2-Cl |
| 265 | 3-Cl |
| 266 | 4-Cl |
| 267 | 2-Cl, 3-Cl |
| 268 | 2-Cl, 4-Cl |
| 269 | 3-Cl, 5-Cl |
| 270 | 2-Cl, 5-Cl |
| 271 | 3-Cl, 4-Cl |

Next, the concrete examples of the azo compounds expressed by Formula (1) relating to the present invention is shown below. For simplification, the diazo compounds and the coupler compounds are shown, and the azo compounds are shown by the combination of each number. However, the azo compounds relating to the present invention are not limited to this exemplification

TABLE 22

| Azo compound No. | Diazonium compound No. | Coupler No. Cp1 | Coupler No. Cp2 |
|---|---|---|---|
| P1 | Ar1 | C1 | C1 |
| P2 | Ar1 | C1 | 1 |
| P3 | Ar1 | C5 | C5 |
| P4 | Ar1 | C5 | 1 |
| P5 | Ar1 | C5 | 60 |
| P6 | Ar1 | C5 | 64 |
| P7 | Ar1 | C5 | 73 |
| P8 | Ar1 | C5 | 195 |
| P9 | Ar1 | C5 | 201 |
| P10 | Ar1 | C9 | C9 |
| P11 | Ar1 | C9 | 1 |
| P12 | Ar1 | C10 | C10 |
| P13 | Ar1 | C10 | 1 |
| P14 | Ar1 | C11 | C11 |
| P15 | Ar1 | C11 | 1 |
| P16 | Ar1 | C12 | C12 |
| P17 | Ar1 | C12 | 1 |
| P18 | Ar1 | C13 | C13 |
| P19 | Ar1 | C13 | 1 |
| P20 | Ar1 | C14 | C14 |
| P21 | Ar1 | C14 | 1 |
| P22 | Ar1 | C14 | 60 |
| P23 | Ar1 | C14 | 64 |
| P24 | Ar1 | C14 | 73 |
| P25 | Ar1 | C14 | 195 |
| P26 | Ar1 | C14 | 201 |
| P27 | Ar1 | C24 | C24 |
| P28 | Ar1 | C24 | 1 |
| P29 | Ar1 | C24 | 60 |
| P30 | Ar1 | C24 | 64 |
| P31 | Ar1 | C24 | 73 |
| P32 | Ar1 | C24 | 195 |
| P33 | Ar1 | C24 | 201 |
| P34 | Ar1 | C28 | C28 |
| P35 | Ar1 | C28 | 1 |
| P36 | Ar1 | C28 | 60 |
| P37 | Ar1 | C28 | 64 |
| P38 | Ar1 | C28 | 73 |
| P39 | Ar1 | C28 | 195 |
| P40 | Ar1 | C28 | 201 |
| P41 | Ar1 | C37 | C37 |
| P42 | Ar1 | C37 | 1 |
| P43 | Ar1 | C40 | C40 |
| P44 | Ar1 | C40 | 1 |
| P45 | Ar1 | C49 | C49 |
| P46 | Ar1 | C49 | 1 |
| P47 | Ar1 | C50 | C50 |
| P48 | Ar1 | C50 | 1 |
| P49 | Ar1 | C54 | C54 |
| P50 | Ar1 | C54 | 1 |
| P51 | Ar1 | C55 | C55 |
| P52 | Ar1 | C55 | 1 |
| P53 | Ar1 | C56 | C56 |
| P54 | Ar1 | C56 | 1 |
| P55 | Ar1 | C59 | C59 |
| P56 | Ar1 | C59 | 1 |
| P57 | Ar1 | C60 | C60 |
| P58 | Ar1 | C60 | 1 |
| P59 | Ar1 | C61 | C61 |
| P60 | Ar1 | C61 | 1 |
| P61 | Ar1 | C83 | C83 |
| P62 | Ar1 | C83 | 1 |
| P63 | Ar1 | C92 | C92 |
| P64 | Ar1 | C92 | 1 |
| P65 | Ar1 | C95 | C95 |
| P66 | Ar1 | C95 | 1 |
| P67 | Ar1 | C101 | C101 |
| P68 | Ar1 | C101 | 1 |
| P69 | Ar1 | C104 | C104 |
| P70 | Ar1 | C104 | 1 |
| P71 | Ar1 | C105 | C105 |
| P72 | Ar1 | C105 | 1 |
| P73 | Ar1 | C106 | C106 |
| P74 | Ar1 | C106 | 1 |
| P75 | Ar1 | C107 | C107 |

TABLE 22-continued

| Azo compound No. | Diazonium compound No. | Coupler No. Cp1 | Coupler No. Cp2 |
|---|---|---|---|
| P76 | Ar1 | C107 | 1 |
| P77 | Ar1 | C108 | C108 |
| P78 | Ar1 | C108 | 1 |
| P79 | Ar1 | C109 | C109 |
| P80 | Ar1 | C109 | 1 |
| P81 | Ar1 | C110 | C110 |
| P82 | Ar1 | C110 | 1 |
| P83 | Ar1 | C110 | 60 |
| P84 | Ar1 | C110 | 64 |
| P85 | Ar1 | C110 | 73 |
| P86 | Ar1 | C110 | 195 |
| P87 | Ar1 | C110 | 201 |
| P88 | Ar1 | C111 | C111 |
| P89 | Ar1 | C111 | 1 |
| P90 | Ar1 | C113 | C113 |
| P91 | Ar1 | C113 | 1 |
| P92 | Ar1 | E12 | E12 |
| P93 | Ar1 | E12 | 1 |
| P94 | Ar1 | E23 | E23 |
| P915 | Ar1 | E23 | 1 |
| P96 | Ar1 | E30 | E30 |
| P97 | Ar1 | E30 | 1 |
| P98 | Ar1 | E30 | 60 |
| P99 | Ar1 | E30 | 64 |
| P100 | Ar1 | E30 | 73 |
| P101 | Ar1 | E30 | 195 |
| P102 | Ar1 | E30 | 201 |
| P103 | Ar1 | E31 | E31 |
| P104 | Ar1 | E31 | 1 |
| P105 | Ar1 | E31 | 60 |
| P106 | Ar1 | E31 | 64 |
| P107 | Ar1 | E31 | 73 |
| P108 | Ar1 | E31 | 195 |
| P109 | Ar1 | E31 | 201 |
| P110 | Ar1 | F5 | F5 |
| P111 | Ar1 | F5 | 1 |
| P112 | Ar1 | F5 | 60 |
| P113 | Ar1 | F5 | 64 |
| P114 | Ar1 | F5 | 73 |
| P115 | Ar1 | F5 | 195 |
| P116 | Ar1 | F5 | 201 |
| P117 | Ar1 | F14 | F14 |
| P118 | Ar1 | F14 | 1 |
| P119 | Ar1 | F14 | 60 |
| P120 | Ar1 | F14 | 64 |
| P121 | Ar1 | F14 | 73 |
| P122 | Ar1 | F14 | 195 |
| P123 | Ar1 | F14 | 201 |
| P124 | Ar1 | F24 | F24 |
| P125 | Ar1 | F24 | 1 |
| P126 | Ar1 | F24 | 60 |
| P127 | Ar1 | F24 | 64 |
| P128 | Ar1 | F24 | 73 |
| P129 | Ar1 | F24 | 195 |
| P130 | Ar1 | F24 | 201 |
| P131 | Ar1 | F28 | F28 |
| P132 | Ar1 | F28 | 1 |
| P133 | Ar1 | F28 | 60 |
| P134 | Ar1 | F28 | 64 |
| P135 | Ar1 | F28 | 73 |
| P136 | Ar1 | F28 | 195 |
| P137 | Ar1 | F28 | 201 |
| P138 | Ar1 | G23 | G23 |
| P139 | Ar1 | G23 | 1 |
| P140 | Ar1 | G23 | 60 |
| P141 | Ar1 | G23 | 64 |
| P142 | Ar1 | G23 | 73 |
| P143 | Ar1 | G23 | 195 |
| P144 | Ar1 | G23 | 201 |
| P145 | Ar1 | G30 | G30 |
| P146 | Ar1 | G30 | 1 |
| P147 | Ar1 | G30 | 60 |
| P148 | Ar1 | G30 | 64 |
| P149 | Ar1 | G30 | 73 |
| P150 | Ar1 | G30 | 195 |

TABLE 22-continued

| Azo compound No. | Diazonium compound No. | Coupler No. Cp1 | Coupler No. Cp2 |
|---|---|---|---|
| P151 | Ar1 | G30 | 201 |
| P152 | Ar1 | G31 | G31 |
| P153 | Ar1 | G31 | 1 |
| P154 | Ar1 | G31 | 60 |
| P155 | Ar1 | G31 | 64 |
| P156 | Ar1 | G31 | 73 |
| P157 | Ar1 | G31 | 195 |
| P158 | Ar1 | G31 | 201 |
| P159 | Ar2 | C5 | C5 |
| P160 | Ar2 | C5 | 1 |
| P161 | Ar2 | C5 | 73 |
| P162 | Ar2 | C5 | 201 |
| P163 | Ar2 | C14 | C14 |
| P164 | Ar2 | C14 | 1 |
| P165 | Ar2 | C14 | 73 |
| P166 | Ar2 | C14 | 201 |
| P167 | Ar2 | C24 | C24 |
| P168 | Ar2 | C24 | 1 |
| P169 | Ar2 | C24 | 73 |
| P170 | Ar2 | C24 | 201 |
| P171 | Ar2 | C28 | C28 |
| P172 | Ar2 | C28 | 1 |
| P173 | Ar2 | C28 | 73 |
| P174 | Ar2 | C28 | 201 |
| P175 | Ar2 | E30 | E30 |
| P176 | Ar2 | E30 | 1 |
| P177 | Ar2 | E30 | 73 |
| P178 | Ar2 | E30 | 201 |
| P179 | Ar3 | C5 | C5 |
| P180 | Ar3 | C5 | 1 |
| P181 | Ar3 | C5 | 73 |
| P182 | Ar3 | C5 | 201 |
| P183 | Ar3 | C14 | C14 |
| P184 | Ar3 | C14 | 1 |
| P185 | Ar3 | C14 | 73 |
| P186 | Ar3 | C14 | 201 |
| P187 | Ar3 | C24 | C24 |
| P188 | Ar3 | C24 | 1 |
| P189 | Ar3 | C24 | 73 |
| P190 | Ar3 | C24 | 201 |
| P191 | Ar3 | C28 | C28 |
| P192 | Ar3 | C28 | 1 |
| P193 | Ar3 | C28 | 73 |
| P194 | Ar3 | C28 | 201 |
| P195 | Ar3 | E30 | E30 |
| P196 | Ar3 | E30 | 1 |
| P197 | Ar3 | E30 | 73 |
| P198 | Ar3 | E30 | 201 |
| P199 | Ar4 | C5 | C5 |
| P200 | Ar4 | C5 | 1 |
| P201 | Ar4 | C5 | 73 |
| P202 | Ar4 | C5 | 201 |
| P203 | Ar4 | C14 | C14 |
| P204 | Ar4 | C14 | 1 |
| P205 | Ar4 | C14 | 73 |
| P206 | Ar4 | C14 | 201 |
| P207 | Ar4 | C24 | C24 |
| P208 | Ar4 | C24 | 1 |
| P209 | Ar4 | C24 | 73 |
| P210 | Ar4 | C24 | 201 |
| P211 | Ar4 | C28 | C28 |
| P212 | Ar4 | C28 | 1 |
| P213 | Ar4 | C28 | 73 |
| P214 | Ar4 | C28 | 201 |
| P215 | Ar4 | E30 | E30 |
| P216 | Ar4 | E30 | 1 |
| P217 | Ar4 | E30 | 73 |
| P218 | Ar4 | E30 | 201 |
| P219 | Ar5 | C5 | C5 |
| P220 | Ar5 | C5 | 1 |
| P221 | Ar5 | C5 | 73 |
| P222 | Ar5 | C5 | 201 |
| P223 | Ar5 | C14 | C14 |
| P224 | Ar5 | C14 | 1 |
| P225 | Ar5 | C14 | 73 |

TABLE 22-continued

| Azo compound No. | Diazonium compound No. | Coupler No. Cp1 | Coupler No. Cp2 |
|---|---|---|---|
| P226 | Ar5 | C14 | 201 |
| P227 | Ar5 | C24 | C24 |
| P228 | Ar5 | C24 | 1 |
| P229 | Ar5 | C24 | 73 |
| P230 | Ar5 | C24 | 201 |
| P231 | Ar5 | C28 | C28 |
| P232 | Ar5 | C28 | 1 |
| P233 | Ar5 | C28 | 73 |
| P234 | Ar5 | C28 | 201 |
| P235 | Ar5 | E30 | E30 |
| P236 | Ar5 | E30 | 1 |
| P237 | Ar5 | E30 | 73 |
| P238 | Ar5 | E30 | 201 |
| P239 | Ar6 | C24 | C24 |
| P240 | Ar6 | C24 | 1 |
| P241 | Ar6 | C24 | 73 |
| P242 | Ar6 | C24 | 201 |
| P243 | Ar7 | C24 | C24 |
| P244 | Ar7 | C24 | 1 |
| P245 | Ar7 | C24 | 73 |
| P246 | Ar7 | C24 | 201 |
| P247 | Ar8 | C24 | C24 |
| P248 | Ar8 | C24 | 1 |
| P249 | Ar8 | C24 | 73 |
| P250 | Ar8 | C24 | 201 |
| P251 | Ar2 | E31 | E31 |
| P252 | Ar2 | F24 | F24 |
| P253 | Ar2 | G23 | G23 |
| P254 | Ar3 | E31 | E31 |
| P255 | Ar3 | F24 | F24 |
| P256 | Ar3 | G23 | G23 |
| P257 | Ar4 | E31 | E31 |
| P258 | Ar4 | F24 | F24 |
| P259 | Ar4 | G23 | G23 |
| P260 | Ar5 | E31 | E31 |
| P261 | Ar5 | F24 | F24 |
| P262 | Ar5 | G23 | G23 |
| P263 | Ar6 | E31 | E31 |
| P264 | Ar6 | F24 | F24 |
| P265 | Ar6 | G23 | G23 |
| P266 | Ar7 | E31 | E31 |
| P267 | Ar7 | F24 | F24 |
| P268 | Ar7 | G23 | G23 |
| P269 | Ar8 | E31 | E31 |
| P270 | Ar8 | F24 | F24 |
| P271 | Ar8 | G23 | G23 |
| P272 | Ar9 | C24 | C24 |
| P273 | Ar9 | C24 | 1 |
| P274 | Ar10 | C24 | C24 |
| P275 | Ar10 | C24 | 1 |
| P276 | Ar11 | C24 | C24 |
| P277 | Ar11 | C24 | 1 |
| P278 | Ar12 | C24 | C24 |
| P279 | Ar12 | C24 | 1 |
| P280 | Ar13 | C24 | C24 |
| P281 | Ar13 | C24 | 1 |
| P282 | Ar2 | C5 | 195 |
| P283 | Ar2 | C14 | 195 |
| P284 | Ar2 | C24 | 195 |
| P285 | Ar2 | C28 | 195 |
| P286 | Ar2 | C110 | 195 |
| P287 | Ar2 | E30 | 195 |
| P288 | Ar3 | C5 | 195 |
| P289 | Ar3 | C14 | 195 |
| P290 | Ar3 | C24 | 195 |
| P291 | Ar3 | C28 | 195 |
| P292 | Ar3 | C110 | 195 |
| P293 | Ar3 | E30 | 195 |
| P294 | Ar4 | C5 | 195 |
| P295 | Ar4 | C14 | 195 |
| P296 | Ar4 | C24 | 195 |
| P297 | Ar4 | C28 | 195 |
| P298 | Ar4 | C110 | 195 |
| P299 | Ar4 | E30 | 195 |
| P300 | Ar5 | C5 | 195 |

TABLE 22-continued

| Azo compound No. | Diazonium compound No. | Coupler No. Cp1 | Coupler No. Cp2 |
|---|---|---|---|
| P301 | Ar5 | C14 | 195 |
| P302 | Ar5 | C24 | 195 |
| P303 | Ar5 | C28 | 195 |
| P304 | Ar5 | C110 | 195 |
| P305 | Ar5 | E30 | 195 |
| P306 | Ar6 | C5 | 195 |
| P307 | Ar6 | C14 | 195 |
| P308 | Ar6 | C24 | 195 |
| P309 | Ar6 | C28 | 195 |
| P310 | Ar6 | C110 | 195 |
| P311 | Ar6 | E30 | 195 |
| P312 | Ar7 | C5 | 195 |
| P313 | Ar7 | C14 | 195 |
| P314 | Ar7 | C24 | 195 |
| P315 | Ar7 | C28 | 195 |
| P316 | Ar7 | C110 | 195 |
| P317 | Ar7 | E30 | 195 |

Next, in detail described below is the electrophotographic photoconductor relating to the present invention.

The electrophotographic photoconductor relating to the present invention is an electrophotographic photoconductor including a photoconductive layer on a conductive support, wherein the electrophotographic photoconductor contains an azo compound expressed by Formula (1).

(1)

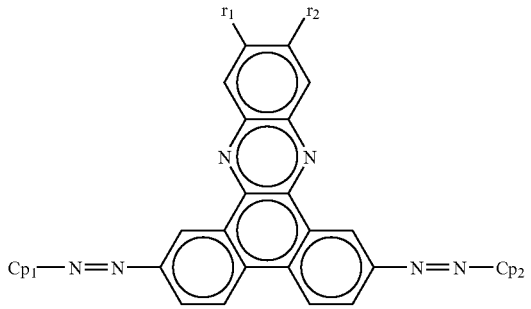

(2)

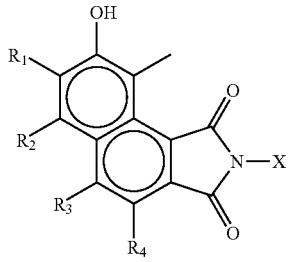

(3)

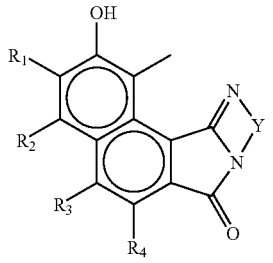

-continued (4)

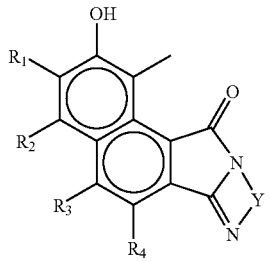

(Formula (1): wherein, "$r_1$" and "$r_2$" represent one of hydrogen atom, alkyl group, alkoxy group, halogen atom, nitro group, amino group, cyano group, acetyl group, benzoyl group which may have a substituent, carboxyl group, alkoxycarbonyl group, phenoxycarbonyl group which may have a substituent and aryl group which may have a substituent, "$CP_1$" and "$CP_2$" represent a coupler residue, and at least one of the "$CP_1$" and the "$CP_2$" is a coupler residue selected from a group consisting of Formula (2), Formula (3) and Formula (4). Formula (2), Formula (3) and Formula (4): wherein, "$R_1$", "$R_2$", "$R_3$" and "$R_4$" represent one of hydrogen atom, alkyl group, alkoxy group, halogen atom, amino group, hydroxy group, nitro group, cyano group, acetyl group, benzoyl group which may have a substituent, alkoxycarbonyl group, phenoxycarbonyl group which may have a substituent and carbamoyl group which may have a substituent. Provided that "$R_1$" and "$R_2$" may be mutually bonded to form one of a substituted or non-substituted ring by alkylene, a substituted or non-substituted unsaturated aliphatic ring and a substituted or non-substituted aromatic ring. "X" represents one of hydrogen atom, a substituted or non-substituted alkyl group, a substituted or non-substituted cycloalkyl group, a substituted or non-substituted aromatic hydrocarbon group, a substituted or non-substituted heterocyclic group and a substituted or non-substituted amino group, and "Y" represents one of a substituted or non-substituted alkylene group, a substituted or non-substituted cycloalkylene group, a substituted or non-substituted aralkylene group, a substituted or non-substituted bivalent organic residue having aromaticity, a substituted or non-substituted bivalent organic residue having heterocyclic aromaticity, bivalent organic residue containing carbonyl group expressed by —CO-Z- (provided that "Z" represents one of a substituted or non-substituted alkylene, a substituted or non-substituted cycloalkylene, a substituted or non-substituted bivalent organic residue having aromaticity and a substituted or non-substituted bivalent organic residue having heterocyclic aromaticity.)

In the present invention, a single layer-type or a laminated type (separate function type) electrophotographic photoconductor can be manufactured by a single use of a charge-generating material or by combining the charge-generating material with a charge transport material. As a layer construction, in the case of the single layer, a phoptosensitive layer where a single charge-generating material or the charge-generating material combined with the charge transport material is dispersed in a binding agent is provided on a conductive substrate. In the case of the separate function type, the charge-generating material containing the charge-generating layer is formed on the conductive substrate, and a charge transport layer containing the charge transport material is further formed thereon. The charge-generating layer and the charge transport layer may be reversely laminated. In addition, an intermediate layer may be provided between the photoconductive layer and the conductive substrate to improve adhesion and charge-blocking property. Further, a protective layer may be provided on the photoconductive layer to improve mechanical durability such as friction resistance.

In addition, one aspect of the electrophotographic photoconductor relating to the present invention is a single layer-type electrophotographic photoconductor constructed by providing a single photoconductive layer directly on a conductive support or providing the same on the conductive support through an intermediate layer.

In addition, one aspect of the electrophotographic photoconductor relating to the present invention is the photoconductive layer in the single layer-type electrophotographic photoconductor constructed by providing a single layer-photoconductive layer on the conductive support directly or through the intermediate layer, further providing a high-molecular charge transport material.

As the solvents used when controlling a dispersed liquid or solution in the photoconductive layer, taken up are, for example, N,N-dimethylformaldehyde, toluene, xylene, monochlorobenzene, 1,2-dichloroethane, 1,1,1-trichloroethane, dichloromethane, 1,1,2-trichloromethane, trichloroethylene, tetrahydrofuran, methylethylketone, methylisobutylketone, cyclohexanone, ethylacetate, butylacetate, dioxane, dioxolane and the like.

As a binding agent used when a photoconductive layer is formed, any material can be used if it is a conventionally known good-insulation binding agents for photoconductor electrophotographic, and there is no limitation. Taken up are, for example, addition polymerization-type resins, polyaddition-type resins and condensation polymerization-type resins such as polyethylene resin, polyvinybutyral resin, polyvinylformal resin, polystyrene resin, phenoxy resin, polypropylene resin, acrylic resin, methacylic resin, vinyl chloride resin, vinyl acetate resin, epoxy resin, polyurethane resin, phenol resin, polyester resin, alkyd resin, polycarbonate resin, polyamide resin, silicone resin, melamine resin, and copolymer resins containing two or more repeating units of these resins. Taken up are, for example, electric non-conductance resins such as vinyl chloride-vinyl acetate copolymer, styrene-acryl copolymer, vinyl chloride-vinyl acetate-maleic anhydride, and high-molecular organic semiconductors such as poly-N-vinylcarbazole.

These binding agents can be individually used or can be used as a mixture of two kinds or more.

The charge-generating material used in the present invention may be used by mixing and dispersing the same with the azo compounds relating to the present invention and the below-mentioned pigments to be described below. Taken up as pigments are, for example, CI pigment blue 25 (color index CI 21180), CI pigment red 41 (CI 21200), CI acid red 52 (CI 45100), CI basic red 3 (CI 45210), an azo dye having a carbazole skeleton (Japanese Patent Application Laid-Open (JP-A) No. 53-95033), the azo dyes such as an azo dye having distyrylbenzene skeleton (Japanese Patent Application Laid-Open (JP-A) No. 53-133445), an azo dye having triphenylamine skeleton (Japanese Patent Application Laid-Open (JP-A) No. 53-132347), an azo dye having dibenzothiophene skeleton (Japanese Patent Application Laid-Open (JP-A) No. 54-21728), an azo dye having oxadiazole skeleton (Japanese Patent Application Laid-Open (JP-A) No. 54-12742), an azo dye having fluorenone skeleton (Japanese Patent Application Laid-Open (JP-A) No. 54-22834), an azo dye having bisstilbene skeleton (Japanese Patent Application Laid-Open (JP-A) No. 54-17733), an azo dye having distyryloxadiazole skeleton (Japanese Patent Application Laid-Open (JP-A) No. 54-2129) and an azo dye having distilcarbazole skeleton (Japanese Patent Application Laid-Open (JP-A) No. 54-14967); phthalocyanine pigments such as CI pigment blue 16 (CI 74100), indigo pigments such as CI vat brown 5 (CI 73410) and CI vat dye (CI 73030), perylene pigments such as algo scarlet B (Bayer Yakuhin-made) and Indanthrene scarlet R (Bayer Yakuhin-made). In addition, these pigments may be individually used, or two kinds or more may be used in combination.

In addition, the azo compound relating to the present invention may be used in combination with an inorganic material. As the inorganic materials, taken up are, for example, selenium, selenium-tellurium, cadmium sulfide, cadmium sulfide-selenium, α-silicon and the like.

In addition, the azo compounds used in the present invention may be used after a specific crystal conversion treatment is performed thereon. The crystal conversion treatment methods may include, for example, solvent treatment, mechanical treatment, heating treatment and the like. The solvent treatment refers to the suspension stirring treatment of a pigment in a solvent which is performed at a room temperature or is heated, and the milling treatment refers to, for example, a treatment which is performed at a normal temperature or by heating, by using milling devices such as sand mill, ball mill or the like with glass beads, steel beads, alumina beads or the like. The treatment may be performed in a system to which a solvent is added with the milling media above. As the solvents used for these treatments, taken up are, for example, N,N-dimethylformaldehyde, N-methylpyrrolidone, 1,3-dimethyl-2-imidazolidine, dimethylsulfoxide, toluene, xylene, monochlorobenzene, 1,2-dichloroethane, 1,1,1-trichloroethane, dichloromethane, 1,1,2-trichloroethane, trichloroethylene, tetrahydrofuran, dioxane, dioxolane, methylethylketone, methylisobutylketone, cyclohexanone, ethyl acetate, butyl acetate, methanol, ethanol, isopropanol, butanol, 2-methoxyethanol and the like.

A charge-generating material is provided by being dissolved or dispersed by adding a binder resin to a proper solvent as required, and by coating and drying.

As the methods of dispersing a charge-generating material, taken up are, for example, ball mill dispersion, supersonic wave dispersion, homogenous mixer dispersion and the like. As application mechanism, taken up are dipping coating method, blade coating method, spray coating method and the like.

If the charge-generating material is dispersed to form a photoconductive layer, in order to improve the dispersibility of the material in the layer, the average particle diameter of the charge-generating material is 2 μm or less, and preferably is 1 μm or less. However, if the particle diameter is too small, it is likely to coagulate, and the resistance of the layer may increase or defective crystals may increase, whereby sensitivity and repeatable property may deteriorate. In addition, it is preferable that the lower limit of the average particle diameter is 0.01 μm, taking into account the limitation in fining.

The charge transport material used in the present invention is largely classified into two kinds of a positive hole transport material and an electron transport material. As the positive hole transport material, preferably used are, for example, poly-N-carbazole and its derivatives, poly-γ-carbazoleethylglutamate and its derivatives, pyrene-formaldehyde condensate and its derivatives, polyvinylpyrene, polyvinylphenanthrene, oxazole derivatives, imidazole derivatives, triphenylamine derivatives, and the compounds expressed by the following formulas.

Below shown are the exemplified compounds of the positive hole transport material. However, the present invention is not limited to these compounds.

As disclosed in Japanese Patent Application Laid-Open (JP-A) No. 55-154955 and Japanese Patent Application Laid-Open (JP-A) No. 55-156954.

(T1)

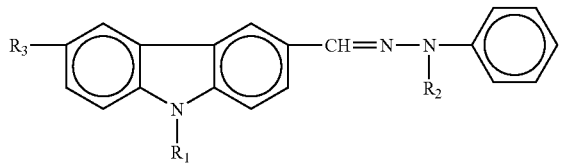

(Formula (T1): wherein, "$R_1$" represents methyl group, ethyl group, 2-hydroxyethyl group or 2-chloroethyl group, "$R_2$" represents methyl group, ethyl group benzyl group or phenyl group, and $R_3$ represents hydrogen atom, chlorine atom, bromine atom, an alkyl group having 1 to 4 carbon atoms, an alkoxy group having 1 to 4 carbon atoms, dialkylamino group or nitro group.)

As disclosed in Japanese Patent Application Laid-Open (JP-A) No. 55-52063.

(T2)

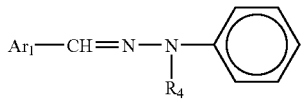

(Formula (T2): wherein, "$Ar_1$" represents naphthalene ring, anthracene ring, styryl ring and its substituent or pyridine ring, furan ring and thiophene ring, and "$R_4$" represents alkyl group or benzyl group.)

As disclosed in Japanese Patent Application Publication (JP-B) No. 56-81850.

(T3)

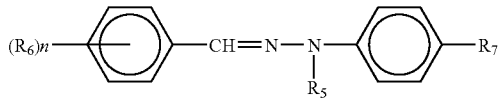

(Formula (T3): wherein, "$R_5$" represents alkyl group, benzyl group, phenyl group or naphtyl group, and "$R_6$" represents hydrogen atom, an alkyl group having 1 to 3 carbon atoms, an alkoxy group having 1 to 3 carbon atoms, dialkylamino group, diaralkylamino group or diarylamino group. "n" represents the integer of 1 to 4, and if "n" is 2 or more, "$R_6$" may be the same or different. "$R_7$" represents hydrogen atom or methoxy group.)

As disclosed in Japanese Patent Application Publication (JP-B) No. 51-10983.

(T4)

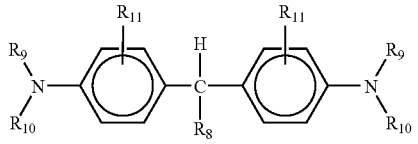

(Formula (T4): wherein, "$R_8$" represents an alkyl group having 1 to 11 carbon atoms, a substituted or non-substituted phenyl group or heterocyclic group, "$R_9$" and "$R_{10}$" may be the same as or different from each other and represent hydrogen atom, an arakyl group having 1 to 4 carbon atoms, hydrokyalkyl group, chloroalkyl group or a substituted or non-substituted aralkyl group. In addition, "$R_9$" and "$R_{10}$" may be bonded to each other to form a heterocyclic ring containing nitrogen. $R_{11}$ may be the same or different and represents hydrogen atom, an alkyl group having 1 to 4 carbon atoms, alkoxy or halogen atom.)

As disclosed in Japanese Patent Application Laid-Open (JP-A) No. 51-94829.

(T5)

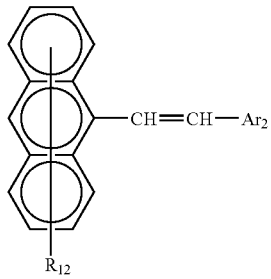

(Formula (T5): wherein, "$R_{12}$" represents hydrogen atom or halogen atom, and "$Ar_2$" represents a substituted or non-substituted phenyl group, naphtyl group, anthryl group or carbazolyl group.)

As disclosed in Japanese Patent Application Laid-Open (JP-A) No. 52-128373.

(T6)

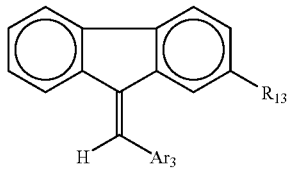

(Formula (T6): wherein, "$R_{13}$" represents hydrogen atom, halogen atom, cyano group, an alkoxy group having 1 to 14 carbon atoms an alkyl group having 1 to 4 carbon atoms, and "$Ar_3$" represents a group expressed by the following Structural Formula.)

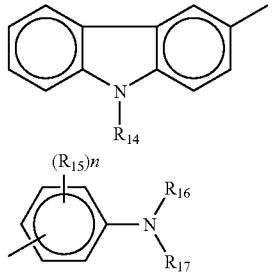

or (Formula above: wherein, "$R_{14}$" represents an alkyl group having 1 to 4 carbon atoms, and "$R_{15}$" represents hydrogen atom, halogen atom, an alkyl group having 1 to 4 carbon atoms, an alkoxy group having 1 to 4 carbon atoms or dialkylamino. "n" is 1 or 2 if "n" is 2, "$R_{15}$" may be the same or different, and "$R_{16}$" and "$R_{17}$" represent hydrogen atom, a substituted or non-substituted alkyl group having 1 to 4 carbon atoms and a substituted or non-substituted benzyl group.)

As disclosed in Japanese Patent Application Laid-Open (JP-A) No. 56-29245.

(T7)

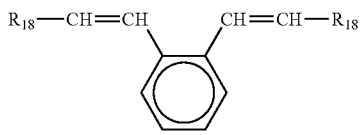

(In Formula (T7), $R_{18}$ is carbazolyl group, pyridyl group, thienyl group, indolyl group, furyl group or each substituted or non-substituted phenyl group, styryl group, naphtyl group or anthryl group. These substituents represent the groups selected from a group comprising alkylamino group, alkyl group, alkoxy group, carboxy group or its ester, halogen atom, cyano group, aralkylamino group, N-alkyl-N-aralkylamino group, amino group, nitro group and acetylamino group.)

As disclosed in Japanese Patent Application Laid-Open (JP-A) No. 58-58552.

(T8)

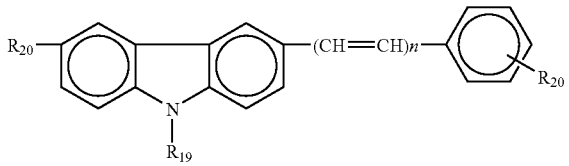

(Formula (T8): wherein, "$R_{19}$" represents low-grade alkyl group, a substituted or non-substituted phenyl group or benzyl group. "$R_{20}$" represents hydrogen atom, low-grade alkyl group, low-grade alkoxy group, halogen atom, nitro group, amino group or low-grade alkyl group or benzyl group-substituted amino group, and n represents the integer of 1 or 2.)

As disclosed in Japanese Patent Application Laid-Open (JP-A) No. 57-73075.

(T9)

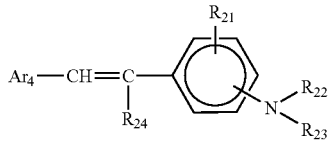

(Formula (T9): wherein, "$R_{21}$" represents hydrogen atom, alkyl group, alkoxy group or halogen atom, "$R_{22}$" and "$R_{23}$" represent alkyl group, a substituted or non-substituted aralkyl group or a substituted or non-substituted aryl group, and "$R_{24}$" represents hydrogen atom, low-grade alkyl group or a substituted or non-substituted phenyl group. Further, "$Ar_4$" represents a substituted or non-substituted phenyl group or naphtyl group.)

As disclosed in Japanese Patent Application Laid-Open (JP-A) No. 58-198043.

(T10)

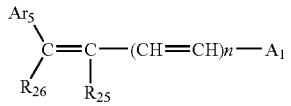

(Formula (T10): wherein, "n" represents the integer of 0 or 1, "$R_{25}$" represents hydrogen atom, alkyl group or a substituted or non-substituted phenyl group, "$Ar_5$" represents a substituted or non-substituted aryl group, and "$R_{26}$" represents alkyl group containing a substituted alkyl group or a substituted or non-substituted aryl group. "$A_1$" represents groups expressed by the following Structural Formulas, 9-anthryl group, or a substituted or non-substituted carbazolyl group.)

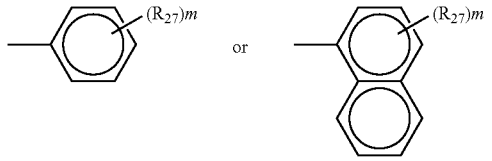

(Formulas above: wherein, "$R_{27}$" represents hydrogen atom, alkyl group, alkoxy group, halogen atom or groups expressed by the following Structural Formula. "m" represents the integer of 0 to 3 if "m" is 2 or more. "$R_{27}$" may be the same or different. In addition, if n is 0, "$A_1$" and "$R_{25}$" may jointly form a ring.)

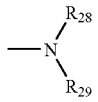

(Formula above: wherein, "$R_{28}$" and "$R_{29}$" represent alkyl group, a substituted or non-substituted aralkyl group or a substituted or non-substituted aryl group, "$R_{28}$" and "$R_{29}$" may be the same or different, and "$R_{29}$" may form a ring.)

As disclosed in Japanese Patent Application Laid-Open (JP-A) No. 49-105537.

(T11)

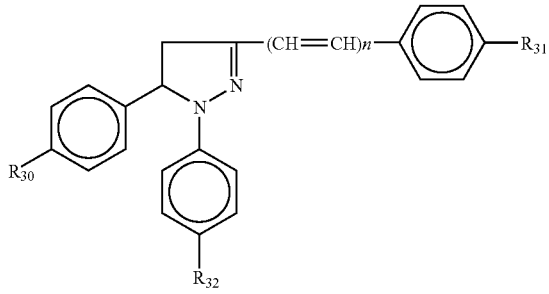

(Formula (T11): wherein, "$R_{30}$", "$R_{31}$" and "$R_{32}$" represent hydrogen atom, low-grade alkyl group, low-grade alkoxy, halogen atom or dialkylamino group, and "n" represents 0 or 1.)

As disclosed in Japanese Patent Application Laid-Open (JP-A) No. 52-13966.

(T12)

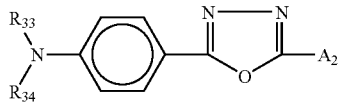

(Formula (T12): wherein, "$R_{33}$" and "$R_{34}$" represent alkyl group containing a substituted alkyl group or a substituted or non-substituted aryl group, and "$A_2$" represents a substituted amino group or a substituted or non-substituted aryl group.)

As disclosed in Japanese Patent Application Laid-Open (JP-A) No. 52-139065.

(T13)

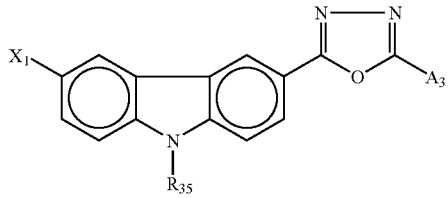

(Formula (T13): wherein, "$X_1$" represents hydrogen atom, low-grade alkyl group or halogen atom, "$R_{35}$" represents alkyl group containing a substituted alkyl group or a substituted or non-substituted aryl group, and "$A_3$" represents a substituted amino group or a substituted or non-substituted aryl group.)

As disclosed in Japanese Patent Application Laid-Open (JP-A) No. 58-32372.

(T14)

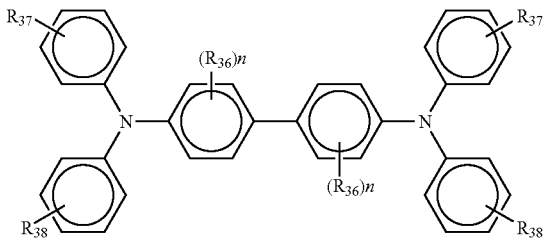

(Formula (T14): wherein, "$R_{36}$" represents low-grade alkyl group, low-grade alkoxy group or halogen atom, n represents the integer of 0 to 4, and "$R_{37}$" and "$R_{38}$" may be the same or different and represent hydrogen atom, low-grade alkyl group, low-grade alkoxy or halogen atom.)

As disclosed in Japanese Patent Application Laid-Open (JP-A) No. 02-178669.

(T15)

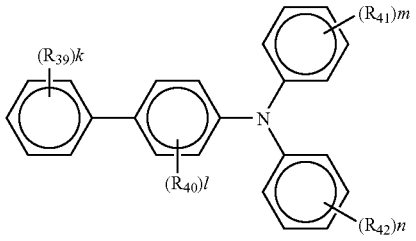

(Formula (T15): wherein, "$R_{39}$", "$R_{41}$" and "$R_{42}$" represent hydrogen amino group, alkoxy group, thioalkoxy group, aryloxy group, methyldioxy group, a substituted or non-substituted alkyl group, halogen atom or a substituted or non-substituted aryl group, and "$R_{40}$" represents hydrogen atom, alkoxy group, a substituted or non-substituted alkyl group or halogen atom. However, it excludes the case that "$R_{39}$", "$R_{40}$", "$R_{41}$" and "$R_{42}$" are all hydrogen atoms. In addition, "k", "l", "m" and "n" are the integer of 1, 2, 3 or 4, if "k", "l", "m" are the integer of 2, 3 and 4, respectively, the "$R_{39}$", "$R_{40}$", "$R_{41}$" and "$R_{42}$" may be the same or different.)

As disclosed in Japanese Patent Application Laid-Open (JP-A) No. 03-285960.

(T16)

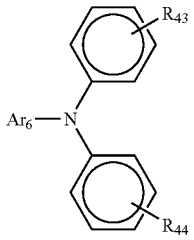

(Formula (T16): wherein, "$Ar_6$" represents a condensed polycyclic hydrocarbon having 18 or less carbons. In addition, "$R_{43}$" and "$R_{44}$" represent hydrogen atom, halogen atom, a substituted or non-substituted alkyl group, alkoxy group, a substituted or non-substituted phenyl group, and each may be the same or different.)

As disclosed in Japanese Patent Application Laid-Open (JP-A) No. 01-25748.

$$A_4\text{-CH=CH—}Ar_7\text{—CH=CH-}A_4 \quad \text{(T17)}$$

(Formula (T17): wherein, "$Ar_7$" represents a substituted or non-substituted aromatic hydrocarbon group, and "$A_4$" represents groups expressed by the following Structural Formula.)

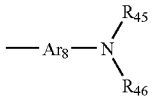

(In Formula above, "$Ar_8$" represents a substituted or non-substituted aromatic hydrocarbon group, and "$R_{45}$" and "$R_{46}$" represent a substituted or non-substituted alkyl group or a substituted or non-substituted alkyl group aryl group.)

As disclosed in Japanese Patent Application Laid-Open (JP-A) No. 04-230764.

(T18)

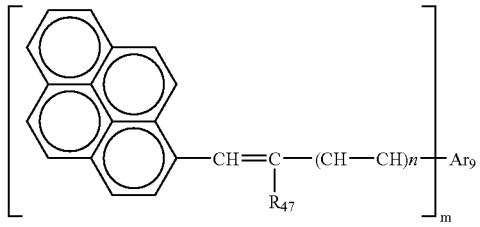

(Formula (T18): wherein, "$Ar_9$" represents a substituted or non-substituted aromatic hydrocarbon group, "$R_{47}$" represents hydrogen atom, a substituted or non-substituted alkyl group or a substituted or non-substituted aryl group. "n" is 0 or 1, "m" is 1 or 2, If "n"=0 and "m"=1, "$Ar_9$" and "$R_{47}$" may jointly form a ring.)

As the compounds expressed by Formula (T1), taken up are, for example, 9-ethylcarbazole-3-aldehyde-1-methyl-1-phenylhydrazone, 9-ethylcarbazole-3-aldehyde-1-benzyl-1-phenylhydrozone, 9-ethycarbazole-3-aldehyde-1,1-diphenylhydrazone and the like.

As the compounds expressed by Formula (T2), taken up are, for example, 4-diethylaminostryl-β-aldehyde-1-methyl-1-phenylhydrazone, 4-methoxynaphthalene-1-aldehyde-1-benzyl-1-phenylhydrazone and the like.

As the compounds expressed by Formula (T3), taken up are, for example, 4-methoxybenzaldehyde-1-methyl-1-pheylhydrazone, 2,4-dimethoxybenzaldehyde-1-benzyl-1-pheylhydrazone, 4-diethylaminobenzaldehyde-1,1-diphenylhydrazone, 4-methoxybenzaldehyde-1-(4-methoxy) phenyihydrazone, 4-diphenylaminobenzaldehyde-1-benzyl-1-phenylhydrazone, 4-dibenzylaminobenzaldehyde-1,1-diphenylhydrazone and the like.

As the compounds expressed by Formula (T4), taken up are, for example, 1,1-bis (4-dibenzylaminophenyl)propane, tris(4-diethylaminophenyl)methane, 1,1-bis(4-dibenzylaminophenyl)propane, 2,2'-dimethyl-4,4'-bis(diethylamino)-triphenylmethane and the like.

As the compounds expressed by Formula (T5), taken up are, for example, 9-(4-diethylaminostyryl)anthracene, 9-brom-10-(4-diethylaminostyryl)anthracene and the like.

As the compounds expressed by Formula (T6), taken up are, for example, 9-(4-dimethylaminobenzylidene)fluorene, 3-(9-fluorenylidene)-9-ethylcarbazole and the like.

As the compounds expressed by Formula (T7), taken up are, for example, 1,2-bis(4-diethylaminostyryl)benzene, 1,2-bis(2,4-dimethoxystryryl)benzene and the like As the compounds expressed by Formula (T8), taken up are, for example, 3-styryl-9-ethylcarbazole, 3-(4methoxystyryl)-9-ethylcarbazole and the like.

As the compounds expressed by Formula (T9), taken up are, for example, 4-diphenylaminostilbene, 4-dibenzylaminostilbene, 4-ditrylaminostilbene, 1-(4-diphenylaminostyryl)naphthalene, 1-(4-diphenylaminostyryl)naphthalene and the like.

As the compounds expressed by Formula (T10), taken up are, for example, 4'-dipheylamino-α-phenylstilbene, 4'-bis(4-methylpheny)amino-α-phenylstilbene and the like.

As the compounds expressed by Formula (T11), taken up are, for example,

1phenyl-3-(4-diethylaminostyryl)-5-(4-diethylaminophenyl)pyrazoline and the like.

As the compounds expressed by Formula (T12), taken up are, for example, 2,5-bis(4-diethylaminophenyl)-1,3,4-oxadiazole, 2-N,N-diphenylamino-5-(4-diethylaminophenyl)-1,3,4-oxadiazole, 2-(4-dimethylaminophenyl)-5-(4-diethylaminophenyl)-1,3,4-oxadiazole and the like.

As the compounds expressed by Formula (T13), taken up are, for example,

2-N,N-diphenylamino-5-(N-ethylcarbazole-3-yl)-1,3,4-oxadiazole, 2-(4-dietheylaminophenyl)-5-(N-ethylcarbazole-3-yl)-1,3,4-oxadiazole and the like.

As the benzidine compounds expressed by Formula (T14), taken up are, for example, N,N'-diphenyl-N,N'-bis(3-methylphenyl)-[1,1'-biphenyl]-4,4'-diamine, 3,3'-dimethyl-N,N,N',N-tetraxy(4-methylphenyl)-[1,1'-biphenyl]-4,4'-diamine and the like.

As the biphenylamine compounds expressed by Formula (T15), taken up are, for example, 4'-methoxy-N,N-diphenyl-[1,1'-biphenyl]-4-amine, 4'-methyl-N,N-bis(4-methylpheny)-[1,1'-biphenyl]-4-amine, 4'-methoxy-N,N-bis(4-methylphenyl)-[1,1'-biphenyl]-4-amine and the like.

As the triarylamine compounds expressed by Formula (T16), taken up are, for example, 1-diphenylaminopyrene, 1-di(p-trylamino)pyrene and the like.

As the diolefin aromatic compounds expressed by Formula (T17), taken up are, for example, 1,4-bis(4-diphenylaminostyryl)benzene, 1-[4-di(p-tryl)aminostyryl]benzene and the like.

As the styrylpyrene compounds expressed by Formula (T18), taken up are, for example, 1,4-bis(4-diphenylaminostyryl)pyrene, 1-[4-di(p-tryl)aminostyryl]pyrene and the like.

Among the positive hole transfer materials, particularly, the compounds expressed by Formulas (T1), (T10) and (T11) are of high charge transport capacity, and it is preferable since they show excellent electrostatic property when used in combination with the azo compound relating to the present invention.

In addition, since compatibility with a high-molecular matrix in the charge transport material is good and charge transport capacity is high, particularly, a stilbene compound is preferably used. Above all, the stilbene compounds expressed by Formulas (T9) and (T10) and further, the stilbene compound expressed by Formula (T19) are particularly preferable since they show excellent electrostatic property when used in combination with the azo compounds relating to the present invention.

(T19)

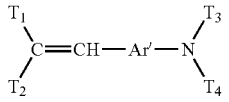

(Formula (T19): wherein, "$T_1$" and "$T_2$" independently represent a substituted or non-substituted alkyl group or a substituted or non-substituted aryl group, and "$T_3$" and "$T_4$" independently represent hydrogen atom, a substituted or non-substituted alkyl group or a substituted or non-substituted aryl group or a heterocyclic group. "$T_1$" and "$T_2$" may mutually be bonded to form a ring, and "Ar'" represents a substituted or non-substituted aryl group or a heterocyclic group.)

These charge transport materials may be individually used or two kinds or more may be combined. In case of a single photoconductive layer, the percentage of these charge transport materials to the photoconductive layer is 15% by weight to 60% by weight and is preferably 20% by weight to 40% by weight.

In addition, in the photoconductive layer relating to the present invention, an acceptor compound is used as required. Taken up as the acceptor compounds used in the present invention are, for example, chloranil, bromanil, tetracyanoethylene, tetracyanoquinodimethane, 2,4,7-trinitro-9-fluoreneone, 2,4,5,7-tetranitro-9-fluoreneone, 2,4,5,7-tetranitroxanthone, 2,4,8-trinitrothioxathone, 2,6,8-trinitro-indeno4H-indeno[1,2-b]thiophene-4-on, 1,3,7-trinitrodibenzothiophene-5,5-dioxide, the acceptor compounds expressed by the following Structural Formulas (Q-1) and (Q-2) and the like.

(Q-1)

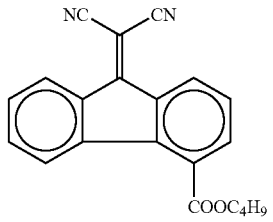

-continued (Q-2)

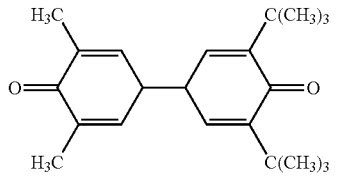

Further, a 2,3-diphenylindene compound expressed by the following Formula is preferably used since its comparability with a high-molecular matrix is good and electron transport capacity is high.

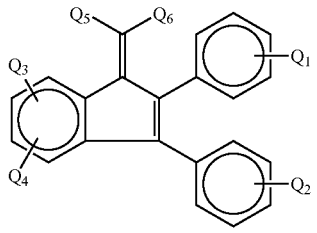

(Formula above: wherein, "$Q_1$" to "$Q_4$" represent hydrogen atom, halogen atoms such as fluorine atom and chlorine atom, alkyl groups such as methyl group, ethyl group, n-propyl group, iso-propyl group, n-butyl group and t-butyl group, substituted alkyl groups such as benzyl group, methoxymethyl group and methoxymethyl group, cyano group or nitro group, "$Q_5$" and "$Q_6$" represent hydrogen atom, halogen atoms such as fluorine atom and chlorine atom, alkyl groups such as methyl group, ethyl group, n-propyl group, iso-propyl group, n-butyl group and t-butyl group, substituted alkyl groups such as benzyl group, methoxymethyl group and methoxymethyl group, cyano group, alkoxycarbonyl groups such as methoxycarbonyl group and ethoxycarbonyl group, substituted alkylcarbonyl groups such as benzyloxycarbonyl group and methoxyethylcarbonyl group, phenyl group, aryl groups such as naphtyl groups, and taken up as its substituted groups are alkyl groups such as methyl group and ethyl group, phenyl group, methoxy group, ethoxy group, phenoxy group and halogen atoms such as fluorine atom and chlorine atom.

Particularly, preferable used is (2,3-diphenyl-1-indene)malononitrile expressed by the following Structural Formula (Q-3).

(Q-3)

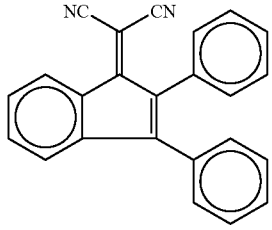

These accepter compounds may be individually used or two kinds or more thereof may be combined. The percentage of an accepter compound to the photoconductive layer is 1% by weight to 40% by weight, and is preferably 5% by weight to 40% by weight.

Further, taken up are high-molecular charge transport materials preferably used for the photoconductor relating to the present invention, particularly for a single-layer photoconductor.

As high-molecular charge transport materials like this, used is a polymer comprising at least either one of polycarbonate, polyurethane, polyester and polyether. Of these, preferable is a high-molecular charge transport material having a triarylamine structure, also of these, particularly preferable is a polycarbonate having a triarylamine structure, further of these, particularly preferable is a polycarbonate having a triarylamine structure expressed by Formulas (1D) to (11D).

Below described is the details of the high-molecular charge transport material expressed by Formula (1D):

(1D)

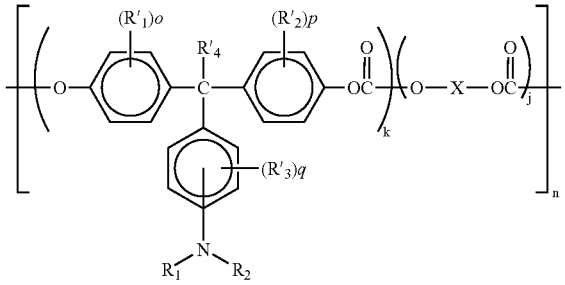

(Formula (1D): wherein, "$R'_1$", "$R'_2$" and "$R'_3$" independently represent a substituted or non-substituted alkyl group or halogen atom, and "$R'_4$" represents hydrogen atom or represent a substituted or non-substituted alkyl group. "$R_1$" and "$R_2$" represent a substituted or non-substituted aryl group. "o", "p" and "q" independently represent the integer of 0 to 4. "k" and "j" represent the compositions where $0.1 \leqq k \leqq 1$, $0 \leqq j \leqq 0.9$, and "n" represents a repeating unit and is the integer of 5 to 5,000. "X" represents the bivalent group of an aliphatic group, which may be of an acyclic aliphatic or a cyclic aliphatic, or a bivalent group expressed by the following Formula (A).

(A)

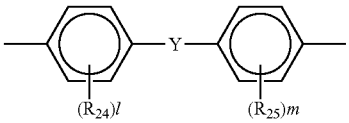

{Formula (A): wherein, "$R_{24}$" and "$R_{25}$" independently represent a substituted or non-substituted alkyl group, aryl group or halogen atom, and 1 and m represent the integer of 0 to 4. "Y" represents a single bond, a straight chain shaped, branched or cyclic alkylene group having 1 to 12 carbon toms, C, —O—, —S—, —SO—, —$SO_2$—, —CO—, —CO—O-Z-O—CO— (in the Formula, "Z" represents the bivalent group of an aliphatic group.) or the following Formula (B).}

(B)

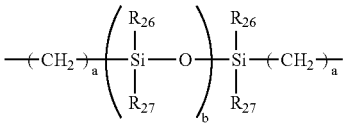

{(Formula (B): wherein, "a" represents the integer 1 to 20, and b represents the integer 1 to 2,000. "$R_{26}$" and "$R_{27}$" represent a substituted or non-substituted alkyl group or aryl group.) "$R_{24}$" and "$R_{25}$", may be the same or different, and so may be "$R_{26}$" and "$R_{27}$".} (wherein, "a single bond" means that Y never contains any atoms and two benzene rings are bonded by a single bond.)

The alkyl groups of "$R'_1$", "$R'_2$" and "$R'_3$" are preferably a straight-shaped or branched alkyl group having 1 to 12 carbon atoms, above all, with 1 to 8 carbon atoms, and further preferably with 1 to 4 carbon atoms, and these alkyl groups may further contain fluorine atom, hydroxyl group, cyano group, an alkoxy group having 1 to 4 carbon atoms, phenyl or halogen atom, an alkyl group having 1 to 4 carbon atoms or an alkoxy group having 1 to 4 carbon atoms-substituted phenyl. Taken up concretely are methyl group, ethyl group, n-propyl group, I-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, 4-phenylbenzyl group and the like. Taken up as halogen atoms are fluorine atom, chlorine atom, bromine atom and iodine atom. Taken up as "$R'_4$"-substituted or non-substituted alkyl group are similar ones to "$R'_1$", "$R'_2$" and "$R'_3$" above. Taken up as aryl groups of "$R_1$" and "$R_2$" are aromatic hydrocarbon groups such as phenyl groups, condensed polycyclic groups such as naphtyl group, pyrenyl group 2-fluorenyl group, 9,9-dimethyl-2-fluorenyl group, azulenyl group, anthryl group, triphenylenyl group, chrisenyl group, fluorenylidenephenyl group and 5H-dibenzo[a,b] cycloheptenylidenephenyl group, non-condensed polycyclic groups such as biphenyl group and terphenyl group, and heterocyclic groups such as thienyl group, benzothienyl group, furyl group, benzofuranyl group and carbazolyl group.

The aryl groups above may have the following groups as substituents (1) Halogen atom, trifluoromethyl group, cyano group, nitro group (2) Alkyl groups: Taken up are groups similar to those shown as alkyl groups of "$R'_1$" and "$R'_2$".

(3) Alkoxy groups (—$OR_{41}$): "$R_{41}$" represents alkyl groups shown in item (2) above.

Taken up concretely are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenzyloxy group, trifluoromethoxy group and the like.

(4) Aryloxy group: Taken up as aryl groups are phenyl group and naphtyl group. These groups may contain an alkoxy group having 1 to 4 carbon atoms, an alkyl group having 1 to 4 carbon atoms or halogen atom as substituents. Taken up concretely are phenoxy group, naphtyloxy group, 4-methyphenoxy group, 4-methoxphnenoxy group, 4-chlorophenoxy group, 6-methyl-2-naphtyloxy group and the like.

(5) Substituted mercaptyl group or arylmercaptyl group: Taken up concretely are methylthio group, ethylthio group, phenylthio group, p-methylphenylthio group and the like.

(6) Alkyl-substituted amino group: The alkyl group represents ones shown in item (2) above. Taken up concretely are dimethylamino group, diethylamino group, N-methyl-N-propylamino group, N,N-benzylamino group and the like.

(7) Acyl group: Taken up concretely are acetyl group, propionyl group, butyryl group, malonyl group, benzoyl group and the like.

"X" is introduced into the main chain by simultaneously using the diol compound expressed by the following Formula (C) when the diol compound having the triarylamine group expressed by the following Formula (1D') is polymerized in Phosgene Process, transesterification or the like. In this case, a polycarbonate to be manufactured is a random copolymer or a block copolymer. In addition, "X" is introduced into the repeating unit also by the polymerization reaction of the diol compound having the triarylamine group expressed by the following Formula (1D') with bischloroformate derived from the following Formula (C). In this case, polycarbonate to be manufactured is an alternating copolymer.

(1D')

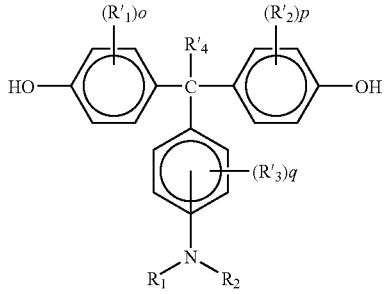

(C)

Taken up as the concrete examples of the diol compound expressed by Formula (C) are aliphatic diols such as 1,3-propanediol, 1,4-butanediol, 1,5-penthanediol, 1,6-hexanediol, 1,8-octanediol, 1,10-decandiol, 2-methyl-1,3-propanediol, 2,2-dimethyl-1, 3-propanediol, 2-ethyl-1,3-propanediol, diethylenglycol, triethyleneglycol, polyethyleneglycol, polytetramethyleneetherglycol and cyclic aliphatic diols such as 1,4-cyclohexanediol, 1,3-cyclohexanediol, cyclohexane1,4-dimethanol. In addition, taken up as diols having an aromatic ring are 4,4'-dihydroxydiphenyl, bis(4-hydroxyphenyl)methane, 1,1-bis (4-hydroxyphenyl) ethane, 1,1-bis(4-hydroxyphenyl)-1-phenylethane, 2,2-bis(4-hydroxyphenyl)propane, 2,2-bis (3-methyl-4-hydrophenyl) propane, 1,1-bis(4-hydroxyphenyl)cyclohexane, 1,1-bis (4-hydroxyphenyl)cyclopentane, 2,2-bis (3-phenyl-4-roxyphenyl) propane, 2,2-bis(3-isopropyl-4-hydroxyphenyl)propane, 2,2-bis(4-hydroxyphenyl) butane, 2,2-bis (3,5-dimethyl-4-hydroxyphenyl)propane, 2,2-bis(3,5-dibromo-4-hydroxyphenyl)propane, 4,4'-dihydroxydiphenylsulfon, 4,4'-dihydroxydipheylsulfoxide, 4,4'-dihydroxydiphenylsulfide, 3,3'-dimethyl-4,4'-dihydroxydiphenylsulfide, 4,4'-hydroxydiphenyloxide, 2,2-bis(4-hydoxyphenyl) hexafluoropropane, 9,9-bis (4-hydropneyl) fluorene, 9,9-bis(4-hydroxyphenyl) xanthene, ethyleneglycol-bis (4-hydroxybenzoate), diethyleneglycol-bis(4-hydroxybenzoate), triethylenglycol-bis (4-hydroxybenzoate), 1,3-bis(4-hydroxyphenyl)-tetramethyldisiloxane, phenol-denatured silicone oil and the like.

Next, described are the details of a high-molecular charge transport material expressed by Formula (2D).

(2D)

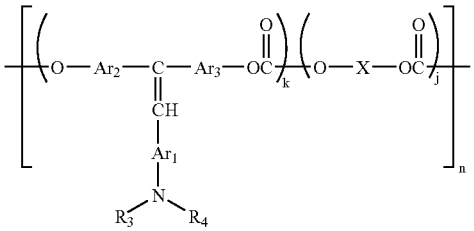

(In Formula (2D): wherein, "$R_3$" and "$R_4$" represent a substituted or non-substituted aryl group, "$Ar_1$", "$Ar_2$" and "$Ar_3$" represent the same or different allylene group. "k" and "j" represent the compositions where $0.1 \leqq k \leqq 1$ and $0 \leqq j \leqq 0.9$, and "n" represents a repeating unit and is the integer of 5 to 5,000. "X" represents a group similar to the group expressed by Formula (1D) above.)

Taken up as the aryl groups of "$R_3$" and "$R_4$" are aromatic hydrocarbon groups such as phenyl groups, condensed polycyclic groups such as naphthyl group, pyrenyl group, 2-fluorenyl group, 9,9-dimethyl-2-fluorenyl group, azulenyl group, anthryl group, triphenylenyl group, chrysenyl group, fluorenylidenephenyl group and 5H-benzo[a,d]cycloheptenylidenephenyl group, heterocyclic groups such as thienyl group, benzothienyl group, furyl group, benzofuranyl group and carbazolyl group and non-condensed polycyclic groups such as biphenyl group, terphenyl group and or groups expressed by the following Formula (a) and the like.

(a)

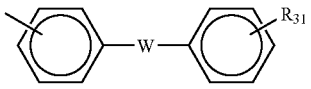

(In Formula (a): wherein, "W" represents —O—, —S—, —$SO_2$— and —CO—, and the bivalent groups expressed by the following Formulas (b), (c), (d) and (e).)

(b)

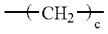

(c)

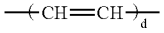

-continued (d)

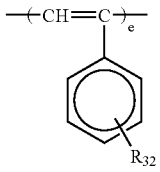

(e)

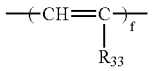

(Formulas (b), (c), (d) and (e): wherein, "c" represents the integer of 1 to 12, and "d", "e" and "f" represent the integer 1 to 3.)

In addition, taken up as the allylene groups of "$Ar_1$", "$Ar_2$" and "$Ar_3$" are the bivalent groups of aryl groups shown in "$R_3$" and "$R_4$". The aryl groups of "$R_3$" and "$R_4$" and the allylene groups of "$Ar_1$", "$Ar_2$" and "$Ar_3$" may have the groups shown below as substituents. In addition, these substituents are also the concrete examples of "$R_{31}$", "$R_{32}$" and "$R_{33}$" in Formulas (a), (b), (d) and (e).

(1) Halogen atom, trifluoromethyl group, cyano group, nitro group (2) Alkyl group: A straight or branched alkyl group preferably having 1 to 12 carbon atoms, above all, having 1 to 8 carbon atoms, further preferably having 1 to 4 carbon atoms. These alkyl groups may contain fluorine atom, hydroxyl group, cyano group, an alkoxy group having 1 to 4 carbon atoms, phenyl group or halogen atom, an alkyl group having 1 to 4 carbon atoms or an alkoxy group having 1 to 4 carbon atoms-substituted phenyl group. Concretely, taken up are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, 4-phenylbenzyl group and the like.

(3) Alkoxy group (—$OR_{41}$): "$R_{41}$" represents the alkyl groups as shown in item (2) above.

Concretely, taken up are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methylbenxyloxy group, trifluoromethoxy group and the like.

(4) Aryloxy group: Taken up as aryl groups are phenyl group and naphtyl group. These groups may contain an alkoxy group having 1 to 4 carbon atoms, an alkyl group having 1 to 4 carbon atoms or halogen atom as substituents. Concretely, taken up are phenoxy group, 1-naphtyloxy group, 2-naphtyloxy group, 4-methylphenoxy group, 4-methoxyphenoxy group, 4-chlorophenoxy group, 6-methyl-2-naphtyloxy group and the like.

(5) Substituted mercaptyl group or arylmercaptyl group: Concretely, taken up are methylthio group, ethylthio group, phenylthio group, p-methylphenylthio group and the like.

(6) Substituted amino group expressed by the Formula, —N($R_{42}$) ($R_{43}$): wherein "$R_{42}$" and "$R_{43}$" independently represent the alkyl group shown in item (2) above or the aryl group shown in "$R_3$" and "$R_4$", as a preferable aryl group, taken up are, for example, phenyl group, biphenyl group or naphthyl group. These group may contain an alkoxy group having 1 to 4 carbon atoms, an alkyl group having 1 to 4 carbon atoms or halogen atom as substituents or may jointly form a ring with a carbon atom on the aryl group. Concretely, taken up are diethylamino group, N-methylN-phenylamino group, N,N-diphenylamino group, N,N-di (p-tolyl) amino group, dibenzylamino group, piperidino group, morpholine group, yuloridyl group and the like.

(7) Alkylenedioxy group or alkylenedithio group such as methylenedioxy group or methylenedithio group.

X is introduced into the main chain by simultaneously using the diol compound expressed by the following Formula (C), when the diol compound having the triarylamine group expressed by the following Formula (2D') is polymerized in Phosgene Process, transesterification or the like. In this case, a polycarbonate to be manufactured is a random copolymer or a block copolymer. In addition, X is introduced into the repeating unit also by the polymerization reaction of the diol compound having the triarylamine group expressed by the following Formula (2D') with bischloroformate derived from the following Formula (C). In this case, polycarbonate to be manufactured is an alternating copolymer.

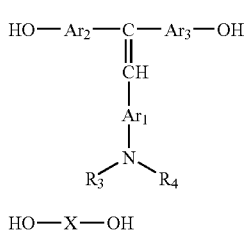

(2D')

(C)

Taken up as the concrete examples of the diol compound expressed by Formula (3D) are those exemplified in the description of Formula (1D) above.

Next, described are the details of the high-molecular charge transport material expressed by Formula (3D).

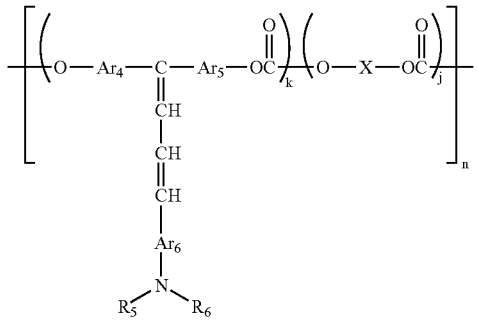

(3D)

{Formula (3D): wherein, "$R_5$" and "$R_6$" represent a substituted or non-substituted aryl group, "$Ar_4$", "$Ar_5$" and "$Ar_6$" represent the same or different allylene group. "k" and "j" represent the compositions where $0.1 \leqq k \leqq 1$ and $0 \leqq j \leqq 0.9$, and "n" represents a repeating unit and is the integer of 5 to 5,000. "X" represents a group similar to one described in Formula (1D) above.}

Taken up as the aryl groups of "$R_5$" and "$R_6$" are aromatic hydrocarbon groups such as phenyl groups, condensed polycyclic groups such as naphthyl group, pyrenyl group 2-fluorenyl group, 9,9-dimethyl-2-fluorenyl group, azulenyl group, anthryl group, triphenylenyl group, chrysenyl group, fluorenylidenephenyl group and 5H-dibenzo[a,d]cycloheptenylidenephenyl group, non-condensed polycyclic groups such as biphenyl group and terphenyl group, and heterocyclic groups such as thienyl group, benzothienyl group, furyl group, benzofuranyl group and carbazolyl group.

In addition, taken up as the allylene groups of "$Ar_4$", "$Ar_5$" and "$Ar_6$" are the bivalent groups of the aryl groups shown in "$R_5$" and "$R_6$". The aryl groups of "$R_5$" and "$R_6$" and the allylene groups of "$Ar_4$", "$Ar_5$" and "$Ar_6$" may have the groups shown below as substituents.

(1) Halogen atom, trifluoromethyl group, cyano group, nitro group (2) Alkyl group: A straight or branched alkyl group preferably having 1 to 12 carbon atoms, above all, having 1 to 8 carbon atoms, further preferably having 1 to 4 carbon atoms. These alkyl groups may contain fluorine atom, hydroxyl group, cyano group, an alkoxy group having 1 to 4 carbon atoms, phenyl group or phenyl group substituted by halogen atom, an alkyl group having 1 to 4 carbon atoms or an alkoxy group having 1 to 4 carbon atoms. Concretely, taken up are methyl group, ethyl group, n-propyl group, i-propyl group, t-butyl group, s-butyl group, n-butyl group, i-butyl group, trifluoromethyl group, 2-hydroxyethyl group, 2-cyanoethyl group, 2-ethoxyethyl group, 2-methoxyethyl group, benzyl group, 4-chlorobenzyl group, 4-methylbenzyl group, 4-methoxybenzyl group, 4-phenylbenzyl group and the like.

(3) Alkoxy group (—$OR_{41}$): "$R_{41}$" represents the alkyl groups as shown in item (2) above.

Concretely, taken up are methoxy group, ethoxy group, n-propoxy group, i-propoxy group, t-butoxy group, n-butoxy group, s-butoxy group, i-butoxy group, 2-hydroxyethoxy group, 2-cyanoethoxy group, benzyloxy group, 4-methlbenzyloxy group, trifluoromethoxy group and the like.

(4) Aryloxy group: Taken up as aryl groups are phenyl group and naphtyl group. These groups may contain an alkoxy group having 1 to 4 carbon atoms, an alkyl group having 1 to 4 carbon atoms or halogen atom as substituents. Concretely, taken up are phenoxy group, 1-naphtyloxy group, 2-naphtyloxy group, 4-methylphenoxy group, 4-methoxyphenoxy group, 4-chlorophenoxy group, 6-methyl-2-naphtyloxy group and the like.

(5) Substituted mercaptyl group or arylmercaptyl group: Concretely, taken up are methylthio group, ethylthio group, phenylthio group, p-methylphenylthio group and the like.

(6) Alkyl-substituted amino group: The alkyl group represents the alkyl group shown in item (2) above. Concretely, taken up are dimethylamino group, N-methyl-N-propylamino group, N, N-dibenzylamino group and the like.

(7) Acyl group: Concretely, taken up are acetyl group, propionyl group, butyryl group, malonyl group, benzoyl group and the like.

"X" is introduced into the main chain by simultaneously using the diol compound expressed by the following Formula (C) when the diol compound having the triarylamine group expressed by the following Formula (3D') is polymerized in Phosgene Process, transesterification or the like. In this case, a polycarbonate to be manufactured is a random copolymer or a block copolymer. In addition, "X" is introduced into the repeating unit also by the polymerization reaction of the diol compound having the triarylamine group expressed by the following Formula (3D') with bischloroformate derived from the following Formula (C). In this case, polycarbonate to be manufactured is an alternating copolymer.

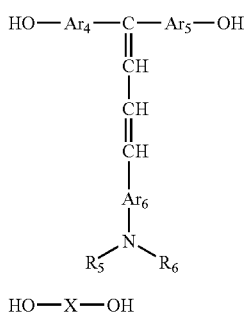

(3D')

(C)

As the concrete example of the diol compound expressed by Formula (C), taken up are those exemplified in the description of Formula (1D) above.

Next, described are the details of the high-molecular charge transport material expressed by Formula (4D).

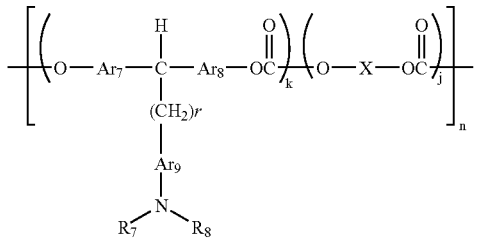

(4D)

{Formula (4D): wherein, "$R_7$" and "$R_8$" represent a substituted or non-substituted aryl group, "$Ar_7$", "$Ar_8$" and "$Ar_9$" represent the same or different allylene group. "k" and "j" represent the compositions where $0.1 \leqq k \leqq 1$ and $0 \leqq j \leqq 0.9$, and "n" represents a repeating unit and is the integer of 5 to 5,000. "r" is the integer 1 to 5. "X" represents a group similar to one described in Formula (1D) above.}

Taken up as the concrete examples of the "$R_7$" and "$R_8$" are those exemplified as the concrete examples of the aryl groups of "$R_5$" and "$R_6$" in the description of Formula (3D), and taken up as the concrete examples of allylene group are the bivalent groups of the aryl groups. In addition, taken up as the concrete examples of substituents in these aryl groups or the allylene groups are those exemplified as substituents in the aryl groups or allylene groups in the description of Formula (3D).

X is introduced into the main chain by simultaneously using the diol compound expressed by the following Formula (C) when the diol compound having the triarylamine group expressed by the following Formula (4D') is polymerized in Phosgene Process, transesterification or the like. In this case, a polycarbonate to be manufactured is a random copolymer or a block copolymer. In addition, "X" is introduced into the repeating unit also by the polymerization reaction of the diol compound having the triarylamine group expressed by the following Formula (4D') with bischloroformate derived from the following Formula (C). In this case, polycarbonate to be manufactured is an alternating copolymer.

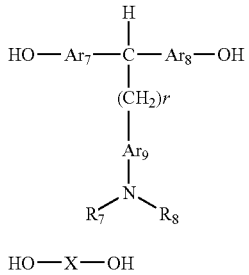

(4D')

(C)

As the concrete example of the diol compound expressed by Formula (C), taken up are those exemplified in the description of Formula (1D) above.

Next, described are the details of the high-molecular charge transport material expressed by Formula (5D).

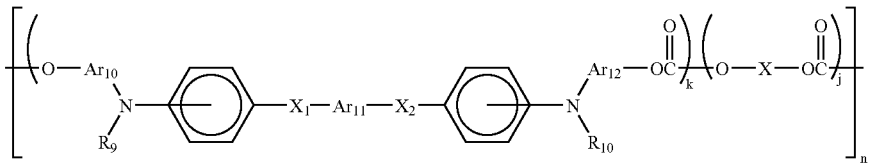

(5D)

{In Formula (5D): wherein, "$R_9$" and "$R_{10}$" represent a substituted or non-substituted aryl group, "$Ar_{10}$", "$Ar_{11}$" and "$Ar_{12}$" represent the same or different allylene group. "$X_1$" and "$X_2$" represent a substituted or non-substituted ethylene group or a substituted or non-substituted vinylene group. "k" and "j" represent the compositions where $0.1 \leqq k \leqq 1$ and $0 \leqq j \leqq 0.9$, and "n" represents a repeating unit and is the integer of 5 to 5,000. "X" represents a group similar to the group expressed by Formula (1D) above.}

Taken up as the concrete examples of the aryl group of "$R_{19}$" and "$R_{10}$" are those exemplified as the concrete examples of "$R_5$" and "$R_6$" in the description of Formula (3D), taken up as the concrete examples of allylene group of "$Ar_{10}$", "$Ar_{11}$" and "$Ar_{12}$" are the bivalent groups of those aryl groups. In addition, taken up as the concrete examples of substitutes in these aryl group or allylene group are those exemplified as the substituents in the aryl group or the allylene group in the description of Formula (3D). Taken up as the substituents in the ethylene group or the vinylene group of "$X_1$" and "$X_2$" are the aryl group exemplified as the concrete example of the aryl group of "$R_5$" and "$R_6$" in the descriptions of cyano group, halogen atom, nitro group and Formula (3D), and the alkyl group exemplified as substituent in the aryl group or the allylene group in the description (3D).

"X" is introduced into the main chain by simultaneously using the diol compound expressed by the following Formula (C) when the diol compound having the triarylamine group expressed by the following Formula (5D') is polymerized in Phosgene Process, transesterification or the like. In this case, a polycarbonate to be manufactured is a random copolymer or a block copolymer. In addition, "X" is introduced into the repeating unit also by the polymerization reaction of the diol compound having the triarylamine group expressed by the following Formula (5D') with bischloroformate derived from the following Formula (C). In this case, polycarbonate to be manufactured is an alternating copolymer.

(5D')

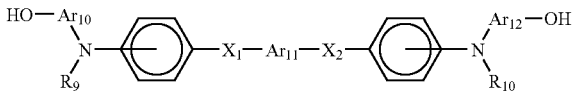

(C)

HO—X—OH

As the concrete example of the diol compound expressed by Formula (C), taken up are those exemplified in the description of Formula (1D) above.

Next, described are the details of the high-molecular charge transport material expressed by Formula (6D).

(6D)

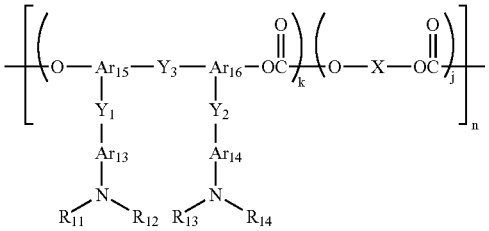

{Formula (6D): wherein, "$R_{11}$", "$R_{12}$", "$R_{13}$" and "$R_{14}$" represent a substituted or non-substituted aryl group, and "$Ar_{13}$", "$Ar_{14}$", "$Ar_{15}$" and "$Ar_{16}$" represent the same or different allylene group. "$Y_1$", "$Y_2$" and "$Y_3$" represent a single bond, a substituted or non-substituted alkylene group, a substituted or non-substituted cycloalkylene group, a substituted or non-substituted alkyleneether group, oxygen atom, sulfur atom or vinylene group and may be the same or different. "k" and "j" represent the compositions where $0.1 \leqq k \leqq 1$ and $0 \leqq j \leqq 0.9$, and "n" represents a repeating unit and is the integer of 5 to 5,000. "X" represents a group similar to the group expressed by Formula (1D) above.}

(wherein, "a single bond" means that $Y_1$, $Y_2$, and $Y_3$ never contain any atoms and two benzene rings are bonded by a single bond.)

Taken up as the concrete examples of the aryl group of "$R_{11}$", "$R_{12}$", "$R_{13}$" and "$R_{14}$" are those exemplified as the concrete examples of "$R_5$" and "$R_6$" in the description of Formula (3D), taken up as the concrete examples of allylene group of "$Ar_{13}$", "$Ar_{14}$", "$Ar_{15}$" and $Ar_{16}$ are the bivalent groups of those aryl groups. In addition, taken up as the concrete examples of substitutes in these aryl group or allylene group are those exemplified as the substituents in the aryl group or the allylene group in the description of Formula (3D).

Taken up as the alkylene group of "$Y_1$", "$Y_2$" and "$Y_3$" are the bivalent groups derived from the alkyl group exemplified as the substituent in the aryl group or the allylene group in the description of Formula (3D). Concretely, taken up are methylene group, ethylene group, 1,3-propylene group, 1,4-butylene group, 2-methyl-1,3-propylene group, difluoromethylene group, hydroxyethylene group, cyanoethylene group, methoxyethylene group, phenylmethylene group, 4-methylphenylmethylene group, 2,2-propylene group, 2,2-butylene group, diophenylmethylene and the like. Taken up as the cycloalkylene group are 1,1-cyclopentylene group, 1,1-cyclohexylene group, 1,1-cyclooctylene group and the like. In addition, taken up as the alkyleneether group are dimethyleneether group, diethyleneether group, ethylenemethyleneether group, bis(triethylene)ether group, polytetramethyleneether group and the like.

"X" is introduced into the main chain by simultaneously using the diol compound expressed by the following Formula (C) when the diol compound having the triarylamine group expressed by the following Formula (6D') is polymerized in Phosgene Process, transesterification or the like. In this case, a polycarbonate to be manufactured is a random copolymer or a block copolymer. In addition, "X" is introduced into the repeating unit also by the polymerization reaction of the diol compound having the triarylamine group expressed by the following Formula (6D') with bischloroformate derived from the following Formula (C). In this case, polycarbonate to be manufactured is an alternating copolymer.

(6D')

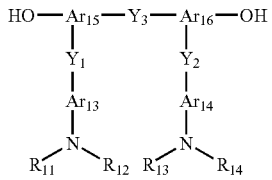

(C)

HO—X—OH

As the concrete example of the diol compound expressed by Formula (C), taken up are those exemplified in the description of Formula (1D) above.

Next, described are the details of the high-molecular charge transport material expressed by Formula (7D).

(7D)

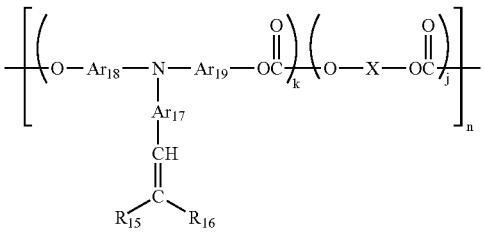

{Formula (7D): wherein, "$R_{15}$" and "$R_{16}$" represent hydrogen atom, a substituted or non-substituted aryl group and may jointly form a ring. "$Ar_{17}$", "$Ar_{18}$" and "$Ar_{19}$" represent the same or different allylene group. "k" and "j" represent the compositions where $0.1 \leqq k \leqq 1$ and $0 \leqq j \leqq 0.9$, and "n" represents a repeating unit and is the integer of 5 to 5,000. "X" represents a group similar to one described in Formula (1D) above.}

Taken up as the concrete example of the aryl groups of "$R_{15}$" and "$R_{16}$" are those exemplified as the concrete example of the aryl group of "$R_5$" and "$R_6$" in the description of Formula (3D). In the case where "$R_{15}$" and "$R_{16}$" form a ring, taken up are 9-fluorylinidene, 5H-dibenzo[a,d] cycloheptenylidenephenyl group and the like. Taken up as the concrete example of the allylene group of "$Ar_{17}$", "$Ar_{18}$" and "$Ar_{19}$" are the bivalent groups of these aryl groups. In addition, taken up as the concrete example of substituents in these aryl group or allylene groups are those exemplified as substituents in the aryl group or the allylene group in the description of Formula (3D).

"X" is introduced into the main chain by simultaneously using the diol compound expressed by the following Formula (C) when the diol compound having the triarylamine group expressed by the following Formula (7D') is polymerized in Phosgene Process, transesterification or the like. In this case, a polycarbonate to be manufactured is a random copolymer or a block copolymer. In addition, "X" is introduced into the repeating unit also by the polymerization reaction of the diol compound having the triarylamine group expressed by the following Formula (7D') with bischloroformate derived from the following Formula (C). In this case, polycarbonate to be manufactured is an alternating copolymer.

(7D')

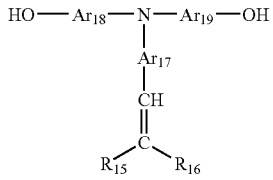

(C)

As the concrete example of the diol compound expressed by Formula (C), taken up are those exemplified in the description of Formula (1D) above.

Next, described are the details of the high-molecular charge transport material expressed by Formula (8D).

(8D)

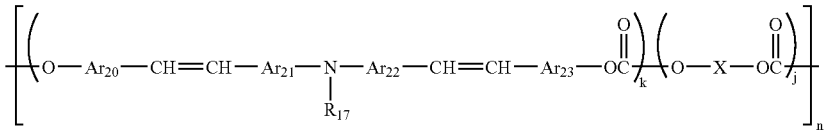

{Formula (8D): wherein, "$R_{18}$" represents a substituted or non-substituted aryl group, and "$Ar_{20}$", "$Ar_{21}$", "$Ar_{22}$" and "$Ar_{23}$" represent the same or different allylene group. "k" and "j" represent the compositions where $0.1 \leqq k \leqq 1$ and $0 \leqq j \leqq 0.9$, and "n" represents a repeating unit and is the integer of 5 to 5,000. "X" represents a group similar to one described in Formula (1D) above.}

Taken up as the concrete examples of the aryl group of "$R_{17}$" are those exemplified as the concrete examples of "$R_5$" and "$R_6$" in the description of Formula (3D). Taken up as the concrete examples of allylene group of "$Ar_{20}$", "$Ar_{21}$", "$Ar_{22}$" and "$Ar_{23}$" are the bivalent groups of those aryl groups. In addition, taken up as the concrete examples of substitutes in these aryl group or allylene group are those exemplified as the substituents in the aryl group or the allylene group in the description of Formula (3D).

"X" is introduced into the main chain by simultaneously using the diol compound expressed by the following Formula (C) when the diol compound having the triarylamine group expressed by the following Formula (8D') is polymerized in Phosgene Process, transesterification or the like. In this case, a polycarbonate to be manufactured is a random copolymer or a block copolymer. In addition, "X" is introduced into the repeating unit also by the polymerization reaction of the diol compound having the triarylamine group expressed by the following Formula (8D') with bischloroformate derived from the following Formula (C). In this case, polycarbonate to be manufactured is an alternating copolymer.

(8D')

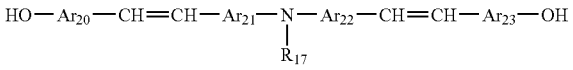

-continued $$HO—X—OH \quad (C)$$

As the concrete example of the diol compound expressed by Formula (C), taken up are those exemplified in the description of Formula (1D) above.

Next, described are the details of the high-molecular charge transport material expressed by Formula (9D).

(9D)

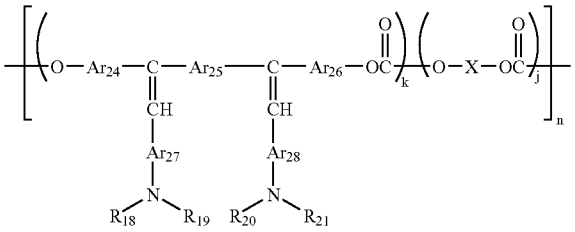

{Formula (9D): wherein, "$R_{18}$", "$R_{19}$", "$R_{20}$" and "$R_{21}$" represent a substituted or non-substituted aryl group, and "$Ar_{24}$", "$Ar_{25}$", "$Ar_{26}$", "$Ar_{27}$" and "$Ar_{28}$" represent the same or different allylene group. "k" and "j" represent the compositions where $0.1 \leqq k \leqq 1$ and $0 \leqq j \leqq 0.9$, and "n" represents a repeating unit and is the integer of 5 to 5,000. "X" represents a group similar to one described in Formula (1D) above.}

Taken up as the concrete examples of the aryl group of "$R_{18}$", "$R_{19}$", "$R_{20}$" and "$R_{21}$" are those exemplified as the concrete examples of "$R_5$" and "$R_6$" in the description of Formula (3D), and taken up as the concrete examples of allylene group of "$Ar_{24}$", "$Ar_{25}$", "$Ar_{26}$", "$Ar_{27}$" and "$Ar_{28}$" are the bivalent groups of those aryl groups. In addition, taken up as the concrete examples of substitutes in these aryl group or allylene group are those exemplified as the substituents in the aryl group or the allylene group in the description of Formula (3D).

"X" is introduced into the main chain by simultaneously using the diol compound expressed by the following Formula (C) when the diol compound having the triarylamine group expressed by the following Formula (9D') is polymerized in Phosgene Process, transesterification or the like. In this case, a polycarbonate to be manufactured is a random copolymer or a block copolymer. In addition, "X" is introduced into the repeating unit also by the polymerization reaction of the diol compound having the triarylamine group expressed by the following Formula (9D') with bischloroformate derived from the following Formula (C). In this case, polycarbonate to be manufactured is an alternating copolymer.

(9D')

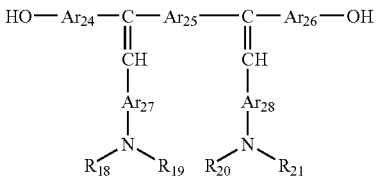

-continued $$HO—X—OH \quad (C)$$

As the concrete example of the diol compound expressed by Formula (C), taken up are those exemplified in the description of Formula (1D) above.

Next, described are the details of the high-molecular charge transport material expressed by Formula (10D).

(10D)

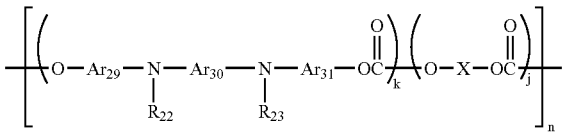

{Formula (10D): wherein, "$R_{22}$" and "$R_{23}$" represent a substituted or non-substituted aryl group, and "$Ar_{29}$", "$Ar_{30}$" and "$Ar_{31}$" represent the same or different allylene group. "k" and "j" represent the compositions where $0.1 \leqq k \leqq 1$ and $0 \leqq j \leqq 0.9$, and "n" represents a repeating unit and is the integer of 5 to 5,000. "X" represents a group similar to one described in Formula (1D) above.}

Taken up as the concrete examples of the aryl group of "$R_{22}$" and "$R_{23}$" are those exemplified as the concrete examples of "$R_5$" and "$R_6$" in the description of Formula (3D), and taken up as the concrete examples of allylene group of "$Ar_{29}$", "$Ar_{30}$" and "$Ar_{31}$" are the bivalent groups of those aryl groups. In addition, taken up as the concrete examples of substitutes in these aryl group or allylene group are those exemplified as the substituents in the aryl group or the allylene group in the description of Formula (3D).

"X" is introduced into the main chain by simultaneously using the diol compound expressed by the following Formula (C) when the diol compound having the triarylamine group expressed by the following Formula (10D') is polymerized in Phosgene Process, transesterification or the like. In this case, a polycarbonate to be manufactured is a random copolymer or a block copolymer. In addition, "X" is introduced into the repeating unit also by the polymerization reaction of the diol compound having the triarylamine group expressed by the following Formula (10D') with bischloroformate derived from the following Formula (C). In this case, polycarbonate to be manufactured is an alternating copolymer.

(10D')

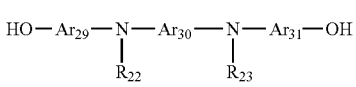

$$HO—X—OH \quad (C)$$

As the concrete example of the diol compound expressed by Formula (C), taken up are those exemplified in the description of Formula (1D) above.

Next, described are the details of the high-molecular charge transport material expressed by Formula (1D).

(11D)

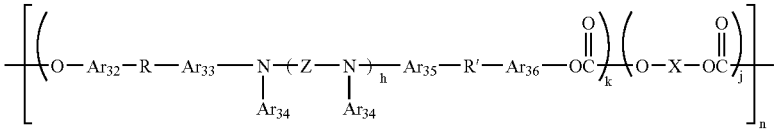

(Formula (11D): wherein, "$An_{32}$", "$Ar_{33}$", "$Ar_{35}$" and "$Ar_{36}$" represent a substituted or non-substituted allylene group, and "$Ar_{34}$" represents a substituted or non-substituted aryl group. "Z" represents allylene group or —$Ar_{37}$-Za-$Ar_{37}$—, and $Ar_{37}$ represents a substituted or non-substituted alkylene group. "Za" represents O, S or alkylene group. "R" and "R'" represent a straight chain or branched alkylene group or —O—, and h represents 0 or 1. "k" and "j" represent the compositions where $01 \leqq k \leqq 1$ and $0 \leqq j \leqq 0.9$, and "n" represents a repeating unit and is the integer of 5 to 5,000. "X" represents a substituted or non-substituted aliphatic bivalent group which may be of an acyclic aliphatic or a cyclic aliphatic, a substituted or non-substituted aromatic bivalent group or bivalent groups by bonding these groups or the groups expressed by Formula (A'), Formula (F) and Formula (G).

(A')

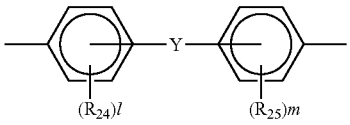

(F)

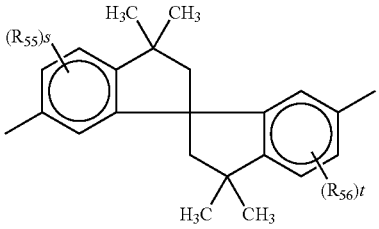

(G)

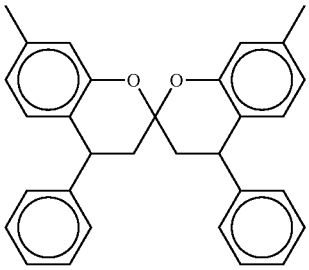

[Formulas (A'), (F) and (G): wherein, "$R_{24}$", "$R_{25}$", "$R_{55}$" and "$R_{56}$" independently represent a substituted or non-substituted alkyl group, a substituted or non-substituted aryl group or halogen atom. "l" and "m" independently represent the integer of 0 to 4, and "s" and "t" independently represent the integer of 0 to 3. "$R_{24}$", "$R_{25}$", "$R_{55}$" and "$R_{56}$" may be the same or different if a plurality of each are present. "Y" represents a single bond, straight or branched or cyclic alkylene group having a 1 to 12 carbon atoms, a bivalent group comprising an alkylene group having 1 to 10 carbon atoms and one oxygen atom or more and one sulfur atom or more (wherein, "a single bond" means that Y never contains any atoms and two benzene rings are bonded by a single bond.), or —O—, —S—, —SO—, —$SO_2$—, —CO—, —COO—, —CO—O-$Z_1$-O—CO—, —CO-$Z_2$-CO— (where, "$Z_1$" and "$Z_2$" represent a substituted or non-substituted aliphatic bivalent group, or a substituted or non-substituted allylene group) or the following Formulas (B) and (H) to (N).

(B)

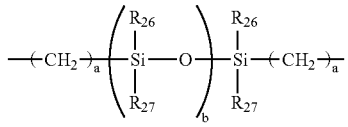

(H)

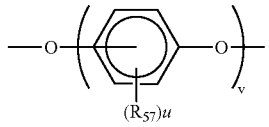

(I)

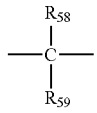

(J)

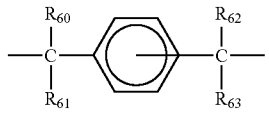

(K)

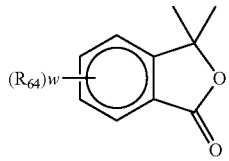

(L)

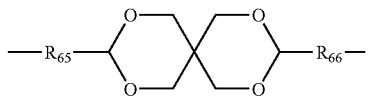

(M)

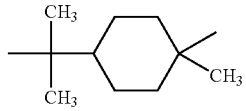

(N)

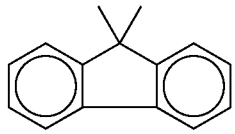

(Formulas (B) and (H) to (N): wherein, "$R_{26}$" and "$R_{27}$" independently represent a substituted or non-substituted alkyl group or a substituted or non-substituted aryl group. "$R_{57}$", "$R_{58}$" and "$R_{64}$" represent halogen atom, a substituted or non-substituted alkyl group or a substituted or non-substituted alkoxy group or a substituted or non-substituted aryl group. "$R_{59}$", "$R_{60}$", "$R_{61}$", "$R_{62}$" and "$R_{63}$" independently represent hydrogen atom, halogen atom, a substituted or non-substituted alkyl group, a substituted or non-substituted alkoxy group or a substituted or non-substituted aryl group. "$R_{58}$" and "$R_{59}$" may be bonded to form a carbon ring with 5 to 12 carbon atoms. "$R_{65}$" and "$R_{66}$" represent a terminal bonding or an alkylene group having 1 to 4 carbon atoms. "a" represents the integer 1 to 20, "b" represents the integer 1 to 2,000, "u" and "w" represent the integer of 0 to 4, and "v" represents 1 or 2. "$R_{26}$", "$R_{27}$", "$R_{57}$" and "$R_{64}$" may be the same or different if a plurality of each are present.)

Taken up as the concrete example of the aryl group of "$Ar_{34}$" are those exemplified as the concrete example of the aryl group of "$Ar_5$" and "$Ar_6$" in the description of Formula (3D), and taken up as the concrete examples of the allylene group of "$Ar_{32}$", "$Ar_{33}$", "$Ar_{35}$" and "$Ar_{36}$" are the bivalent groups of these aryl groups. In addition, taken up as the concrete examples of substituents in the aryl groups and the allylene groups are those exemplified as substituents in the aryl groups or the allylene groups in the description of Formula (3D).

"X" is introduced into the main chain by simultaneously using the diol compound expressed by the following Formula (C) when the diol compound having the triarylamine group expressed by the following Formula (11D') is polymerized in Phosgene Process, transesterification or the like. In this case, a polycarbonate to be manufactured is a random copolymer or a block copolymer. In addition, "X" is introduced into the repeating unit also by the polymerization reaction of the diol compound having the triarylamine group expressed by the following Formula (11D') with bischloroformate derived from the following Formula (C). In this case, polycarbonate to be manufactured is an alternating copolymer.

(11D')

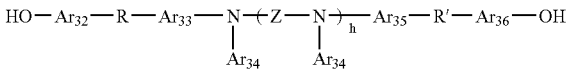

(C)

As the concrete example of the diol compound expressed by Formula (C), taken up are those exemplified in the description of Formula (1D) above.

Shown below are the concrete examples of the high-molecular charge transport materials expressed by Formulas (1D) to (11D). However, the high-molecular charge transport materials relating to the present invention are not limited to them.

(1D-01)

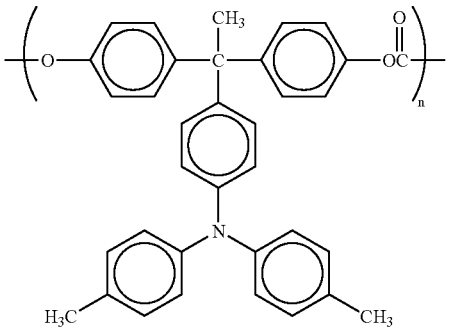

(1D-02)

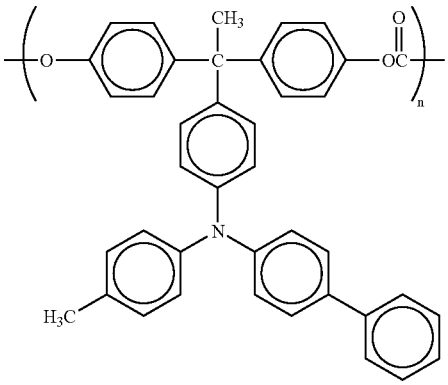

(1D-03)

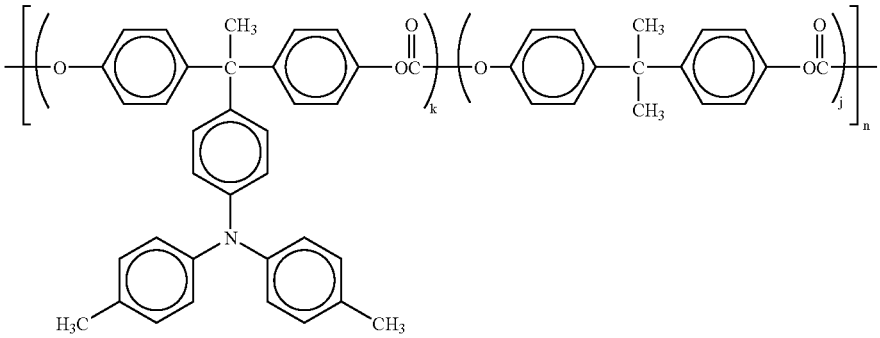

-continued
(1D-04)
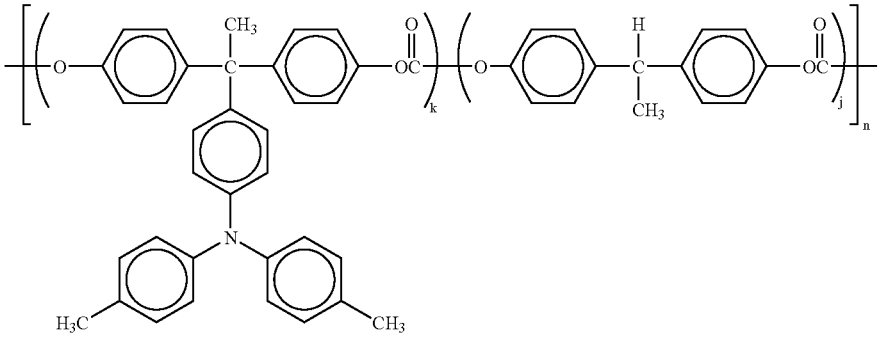
(1D-05)
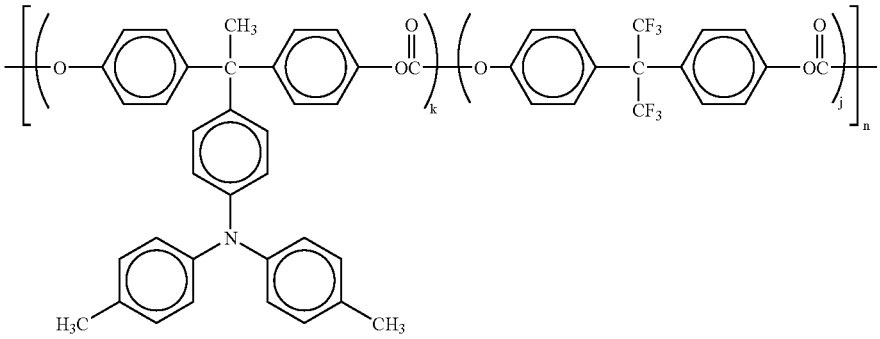
(1D-06)
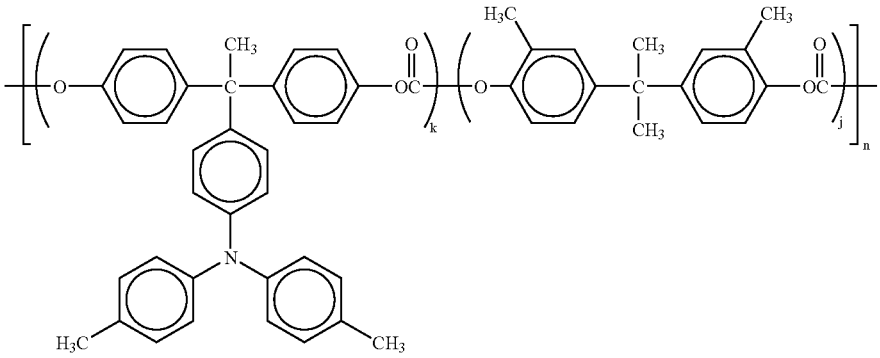
(1D-07)
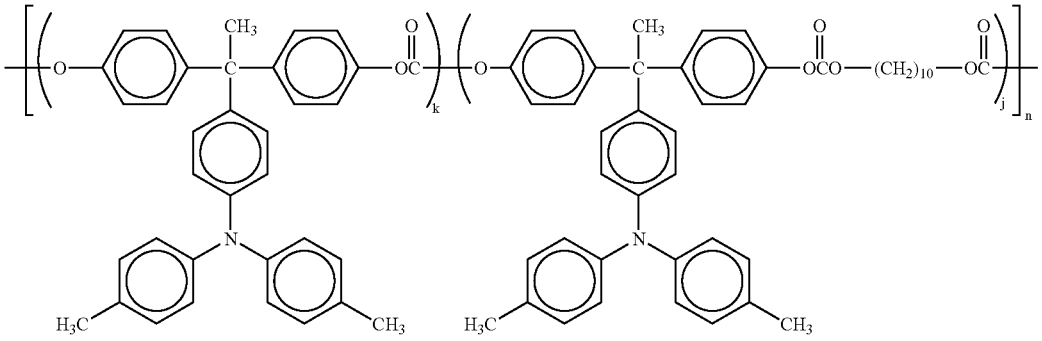

-continued
(2D-01)
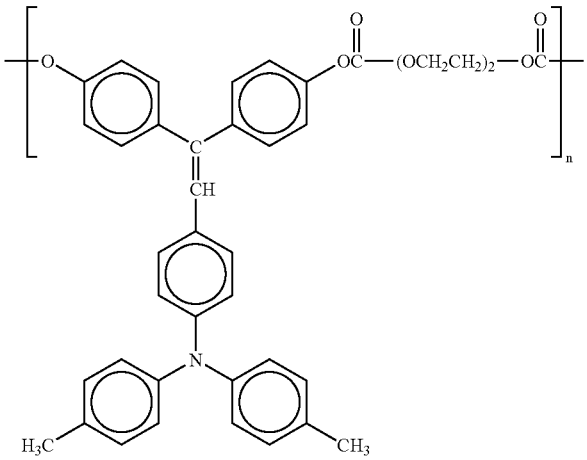
(2D-02)
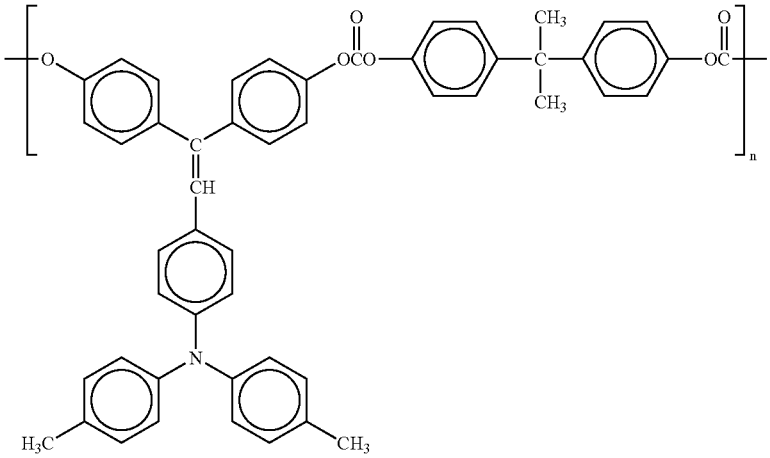
(2D-03)
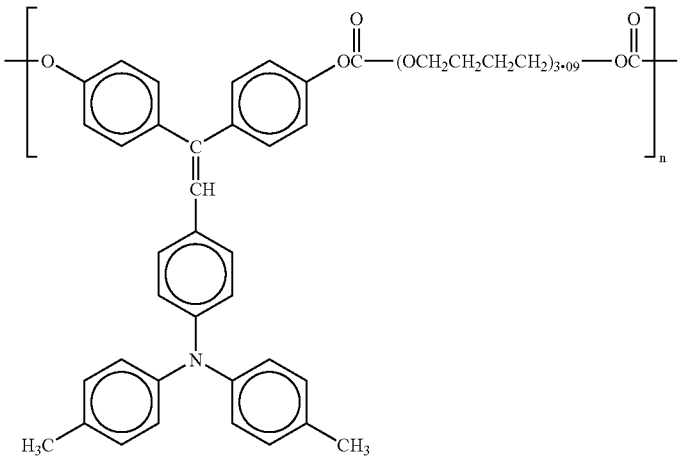

-continued
(2D-04)
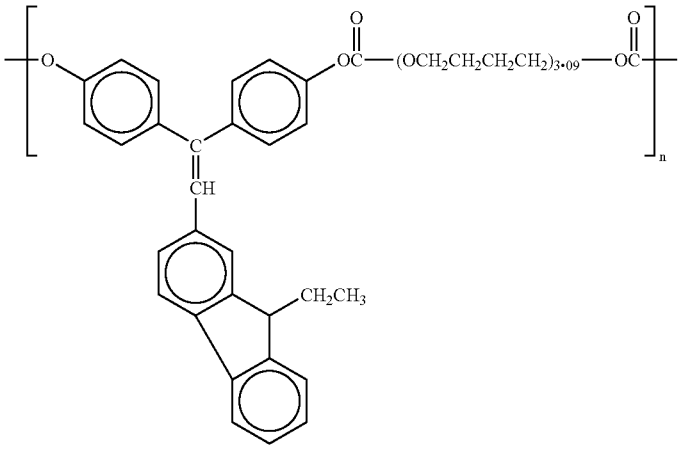
(2D-05)
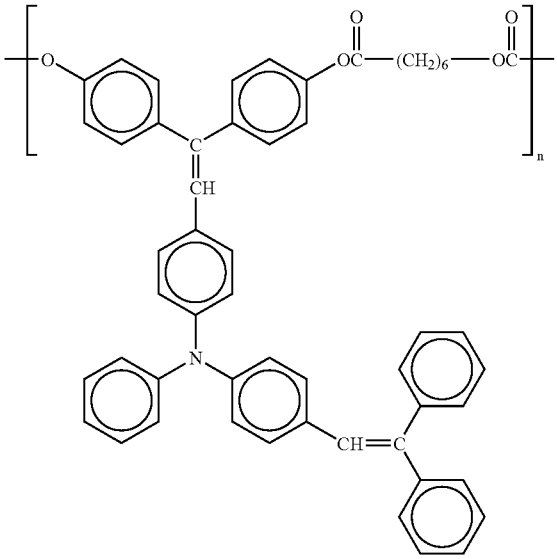
(2D-06)
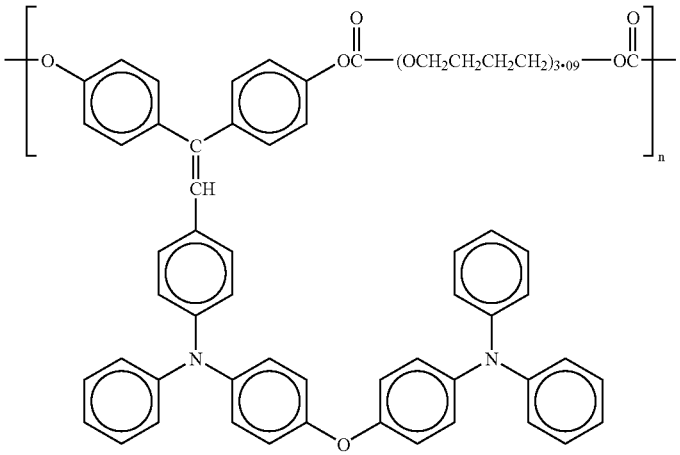

-continued
(2D-07)
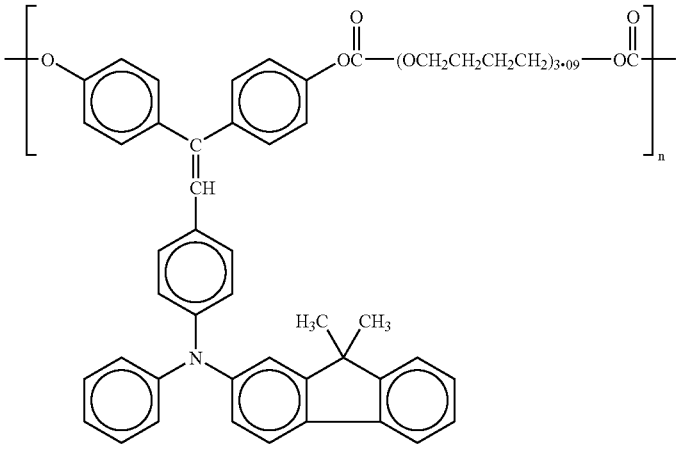
(2D-08)
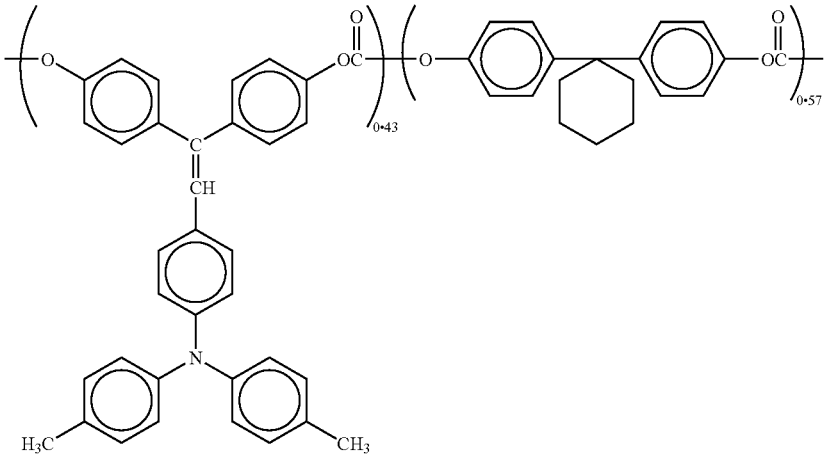
(2D-09)
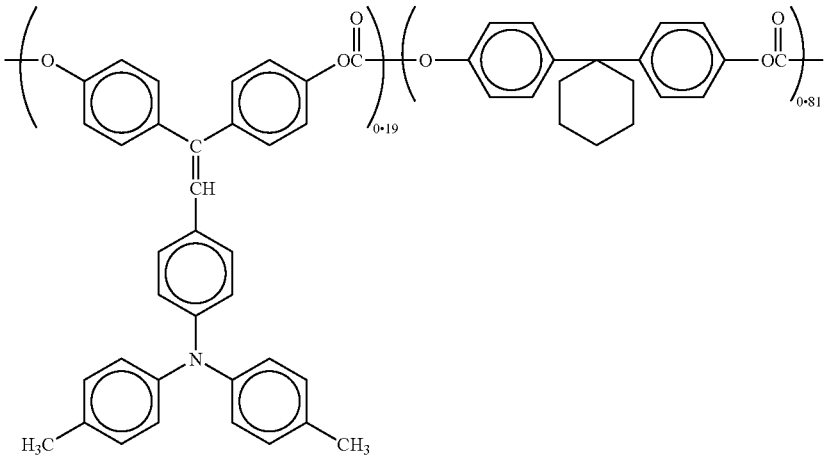

-continued
(2D-10)
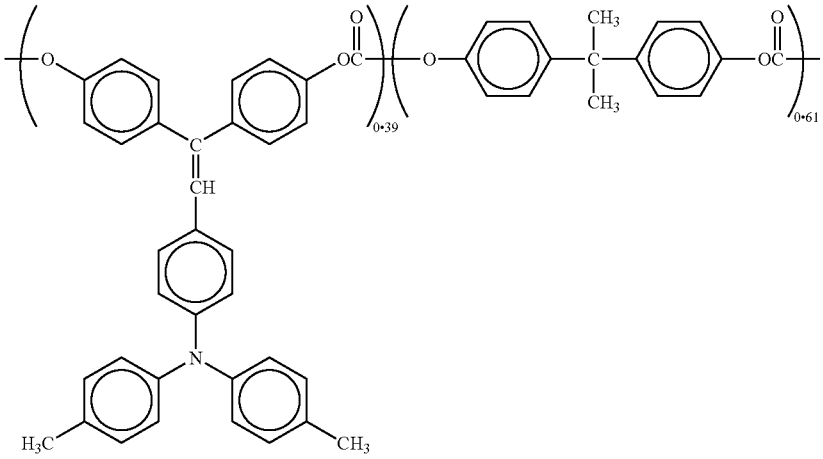
(2D-11)
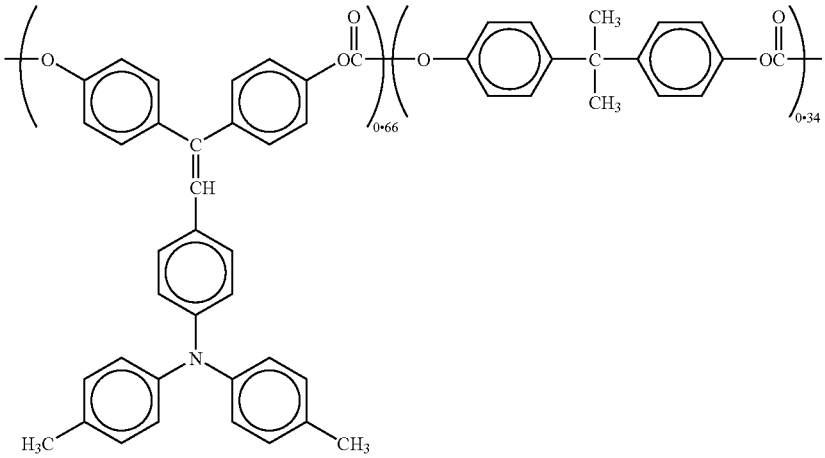
(2D-12)
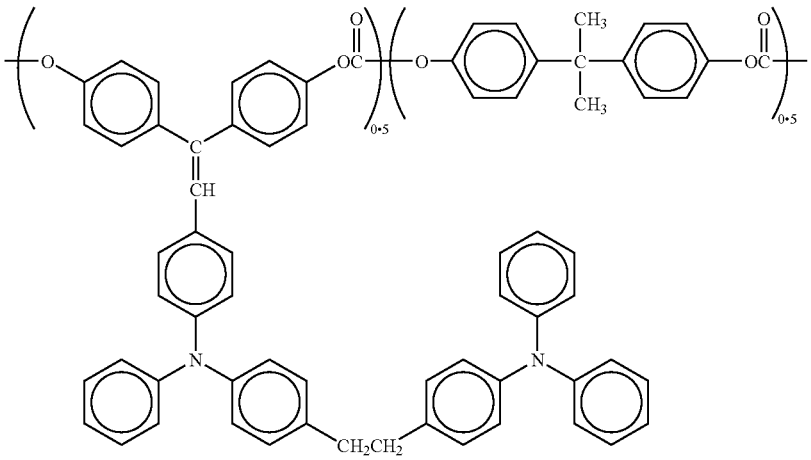

-continued
(2D-13)
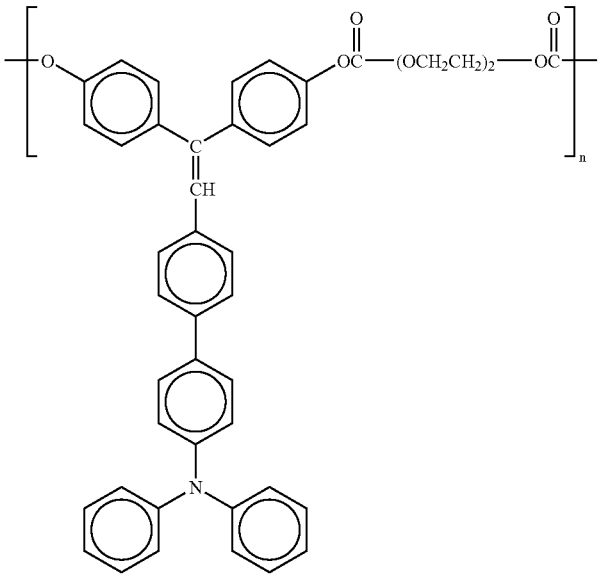
(2D-14)
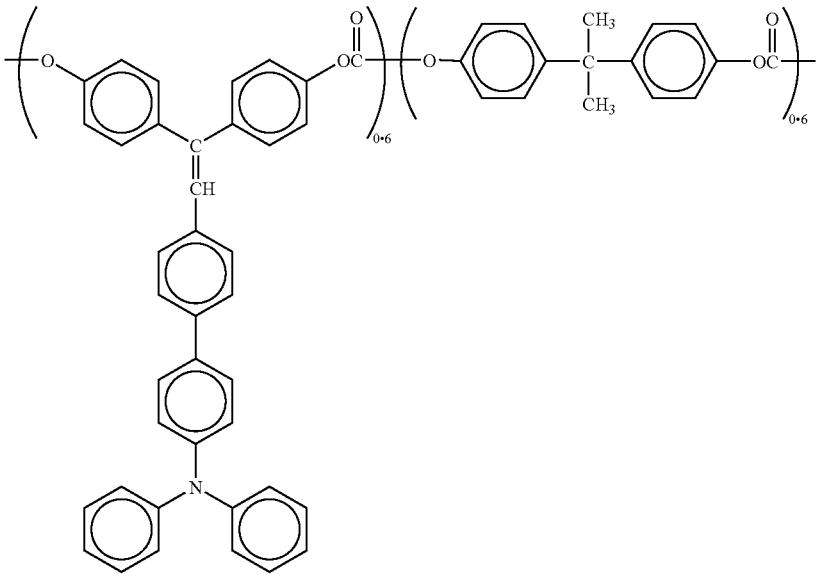

-continued
(2D-15)
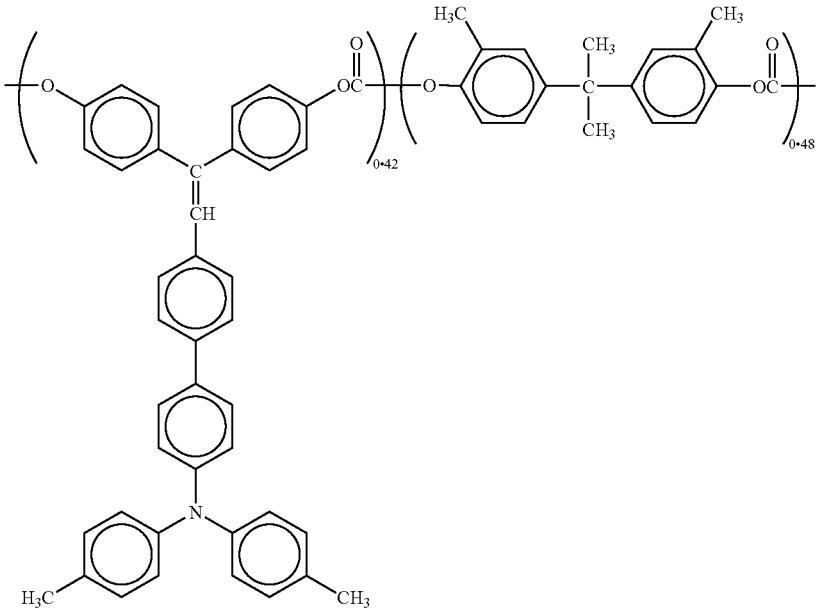
(2D-16)
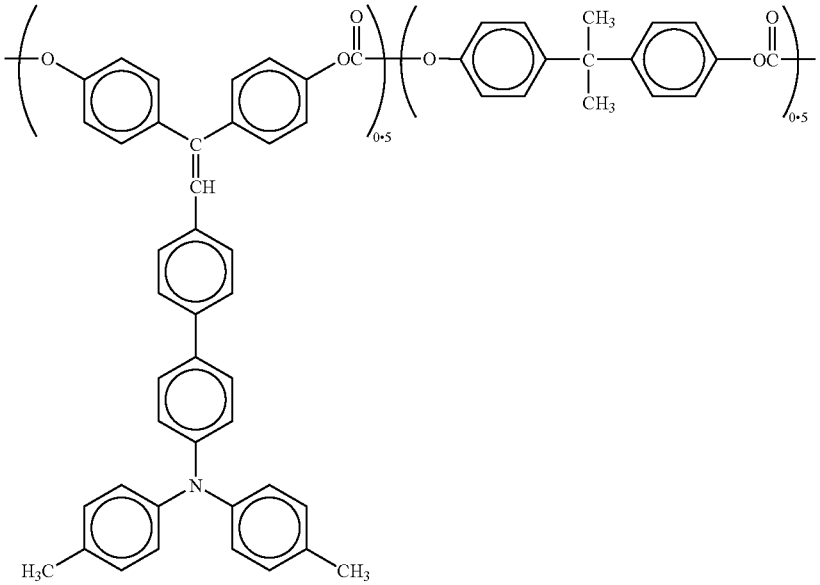

-continued
(2D-17)
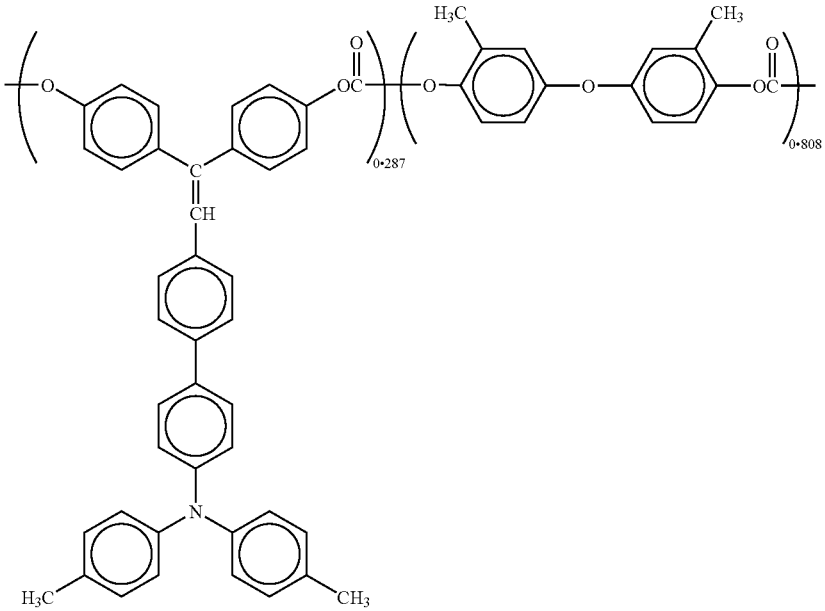
(3D-01)
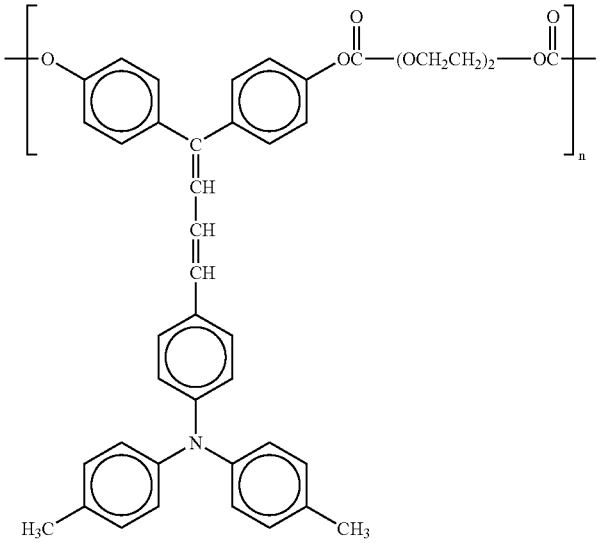

-continued
(3D-02)
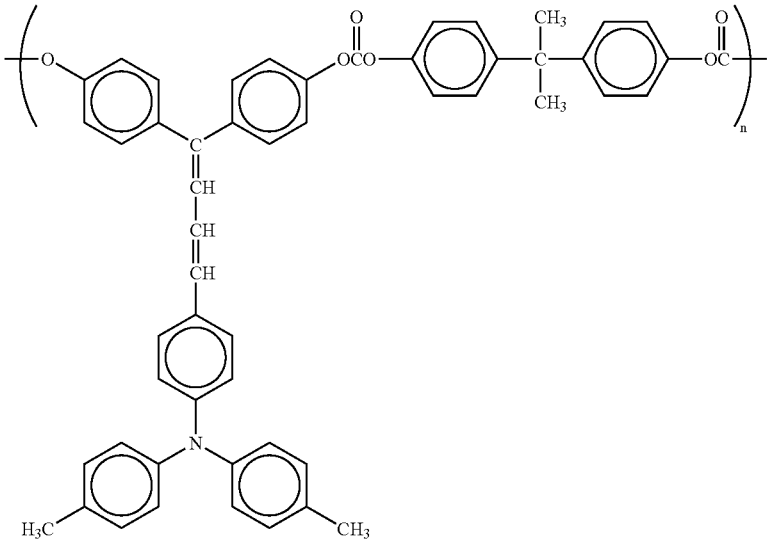
(3D-03)
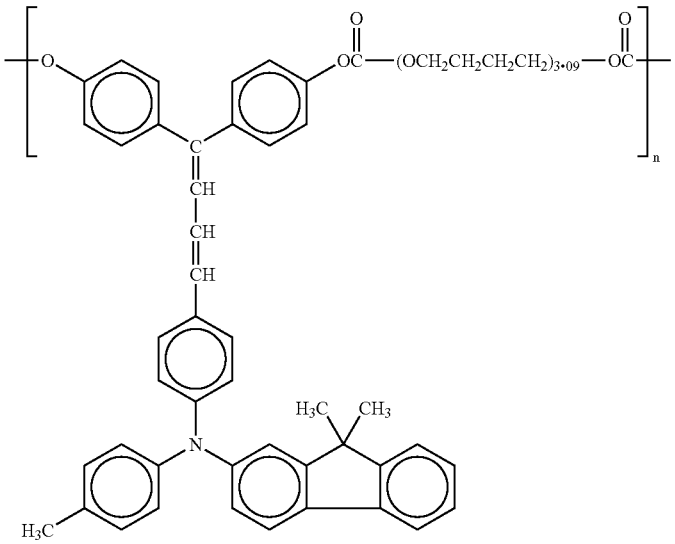
(4D-01)
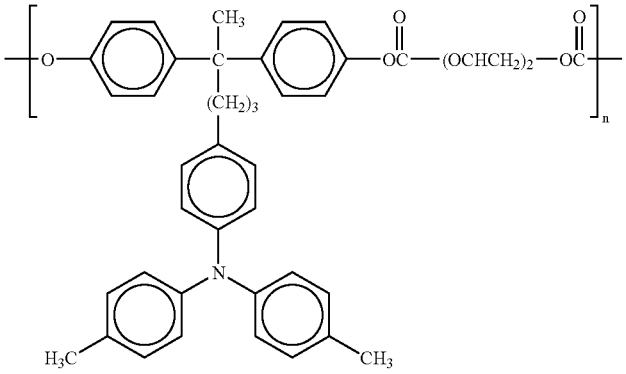

-continued
(4D-02)
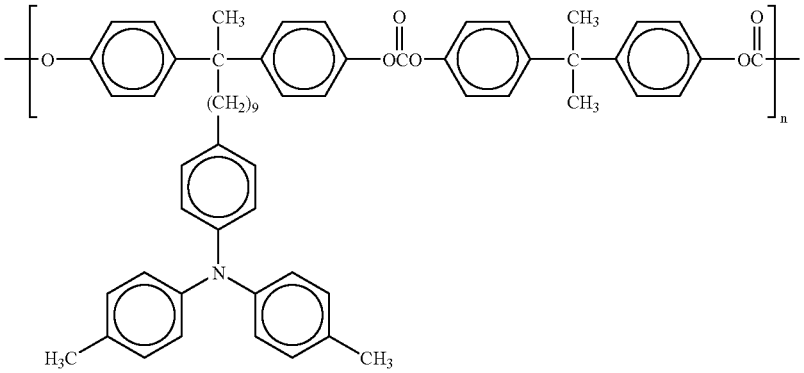
(4D-03)
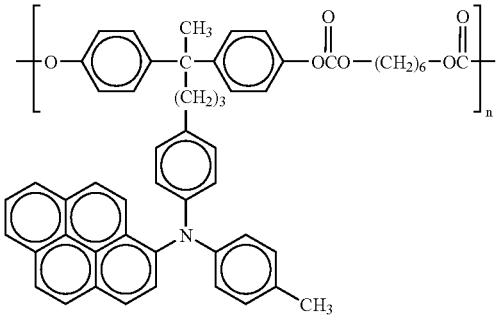
(4D-04)
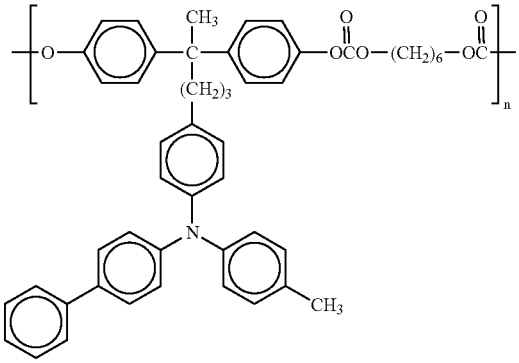
(5D-01)
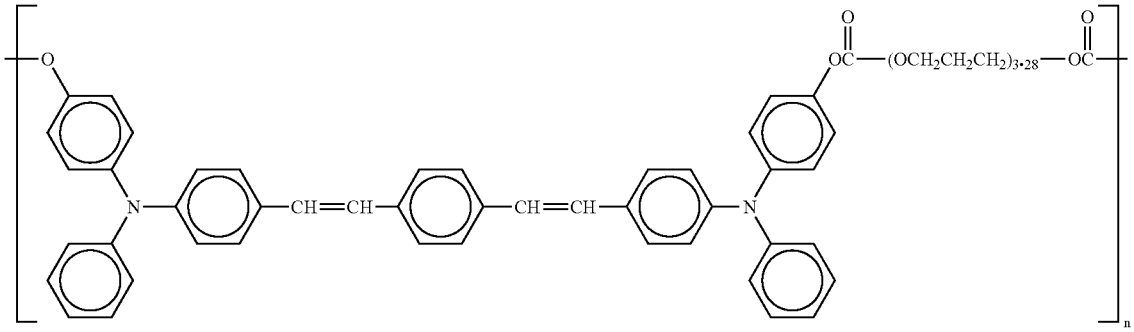
(5D-02)
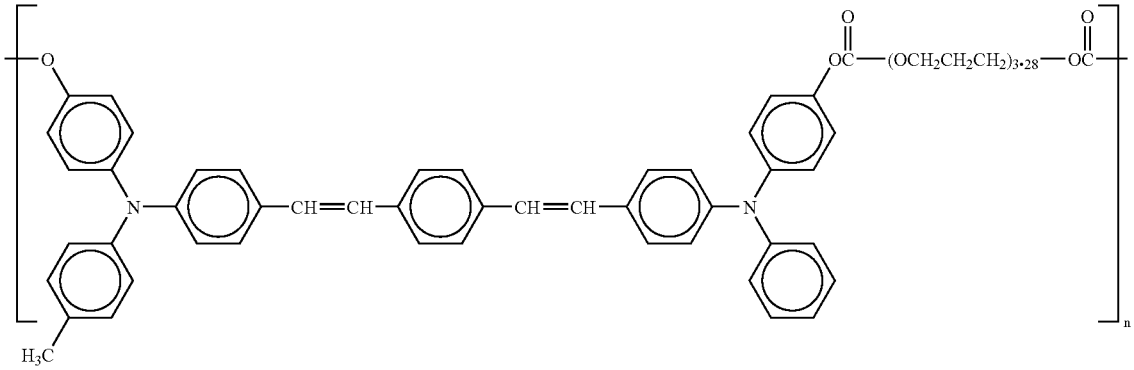

-continued
(5D-03)
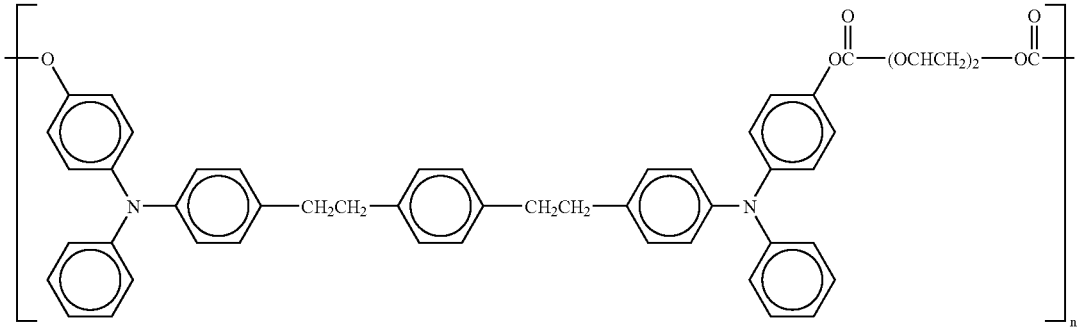
(5D-04)
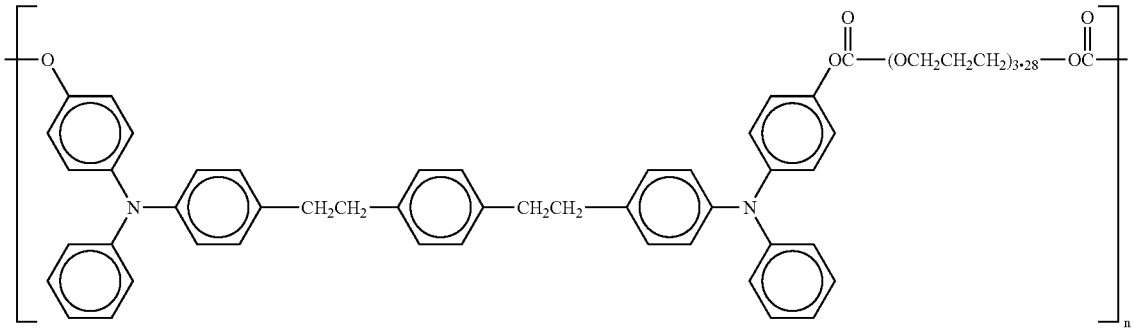
(6D-01)
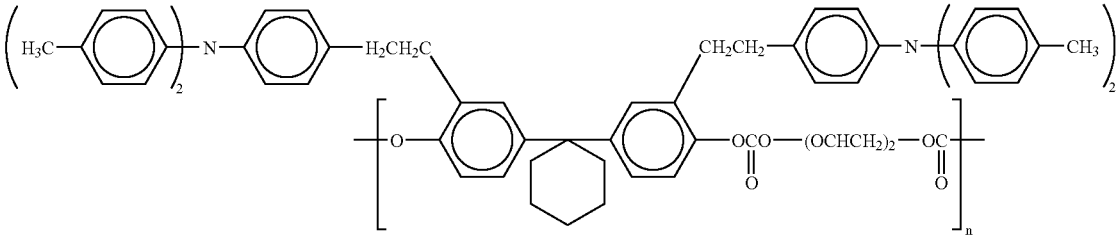
(6D-02)
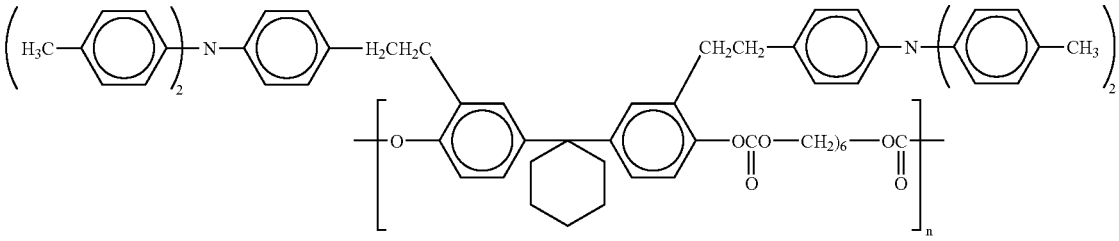
(6D-03)
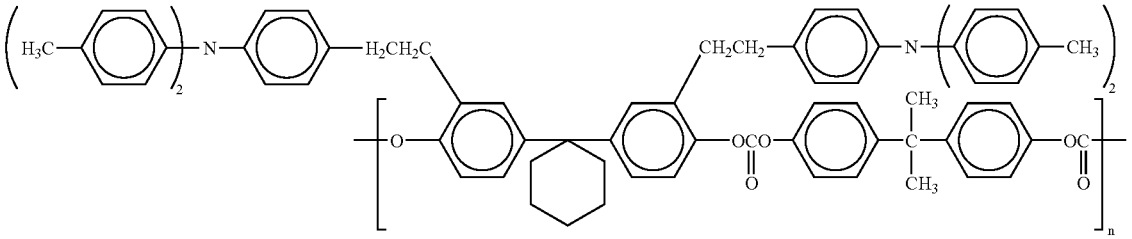

-continued
(7D-01)
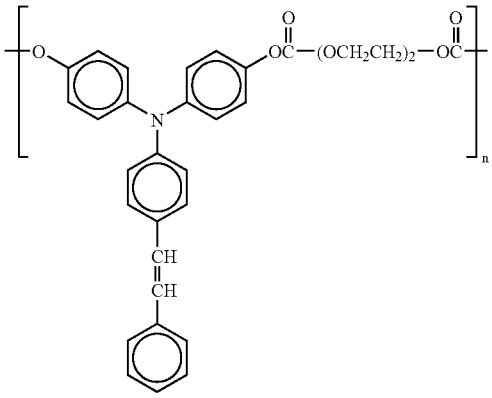
(7D-02)
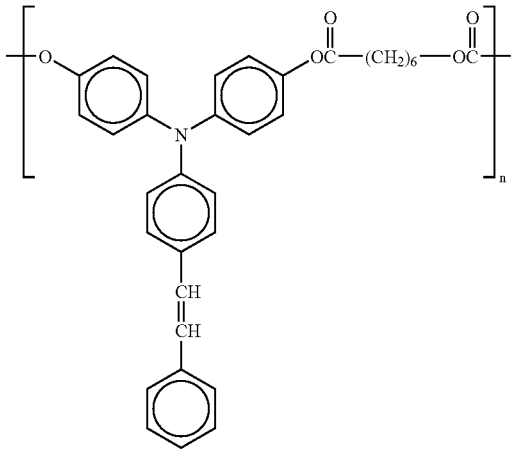
(8D-01)
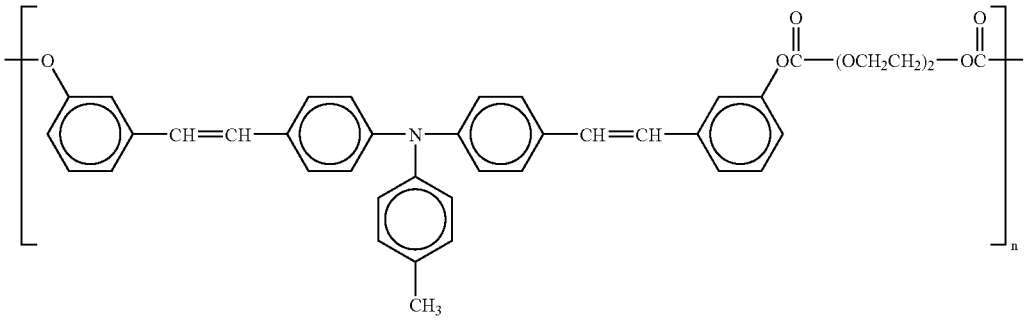
(8D-02)
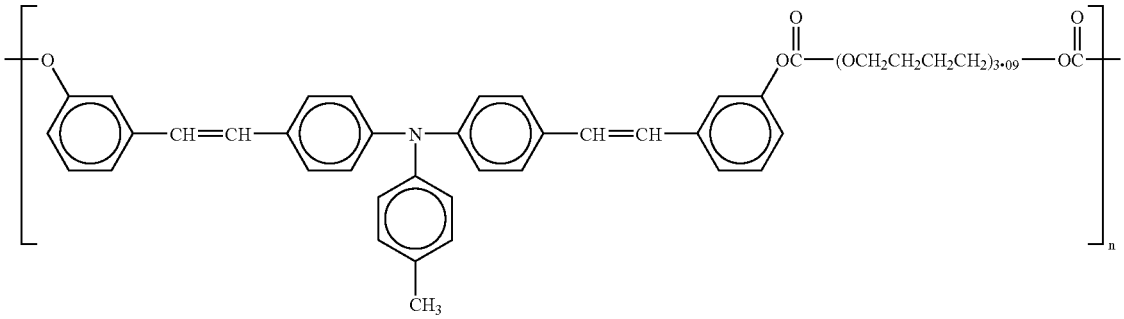
(8D-03)
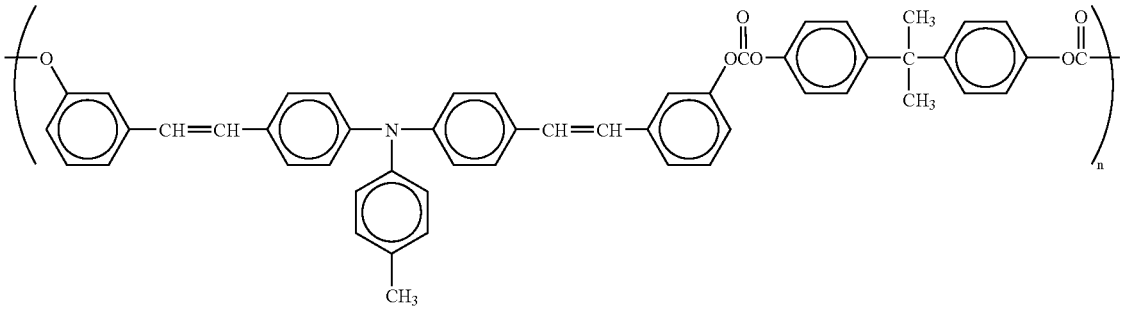

-continued
(9D-01)
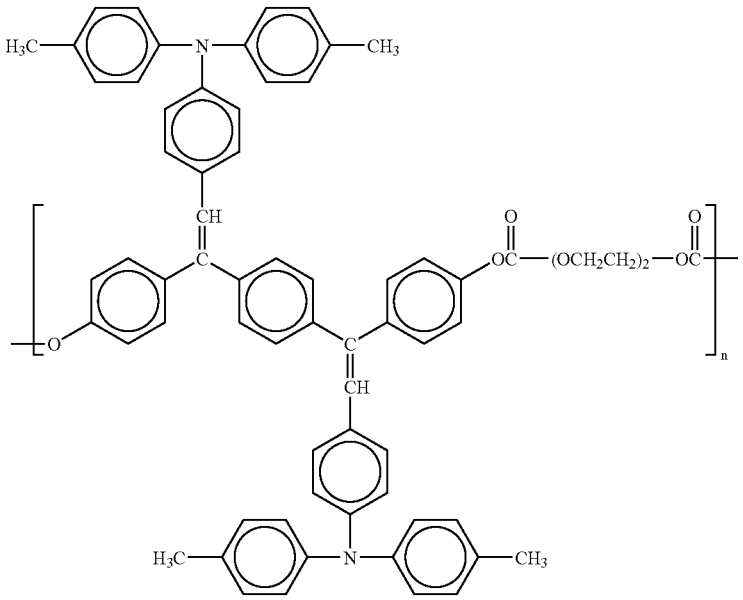
(9D-02)
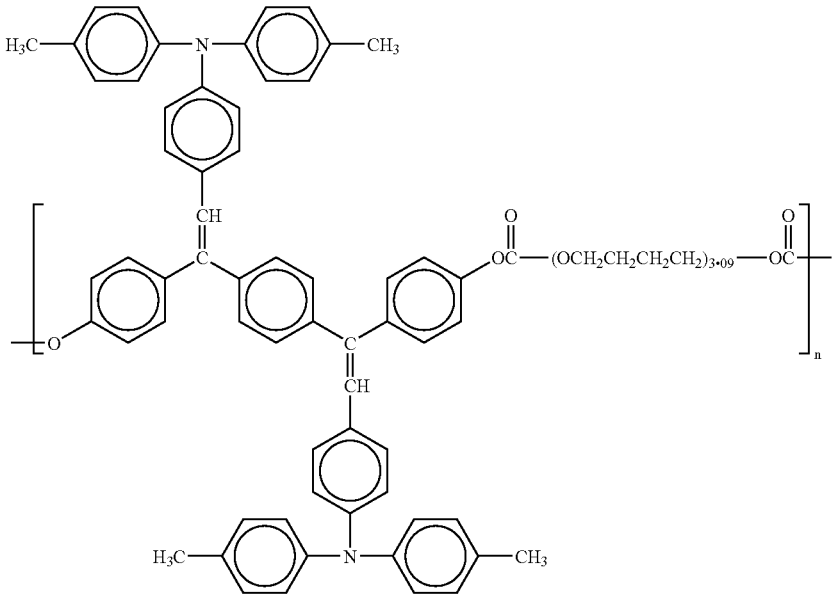

-continued
(9D-03)
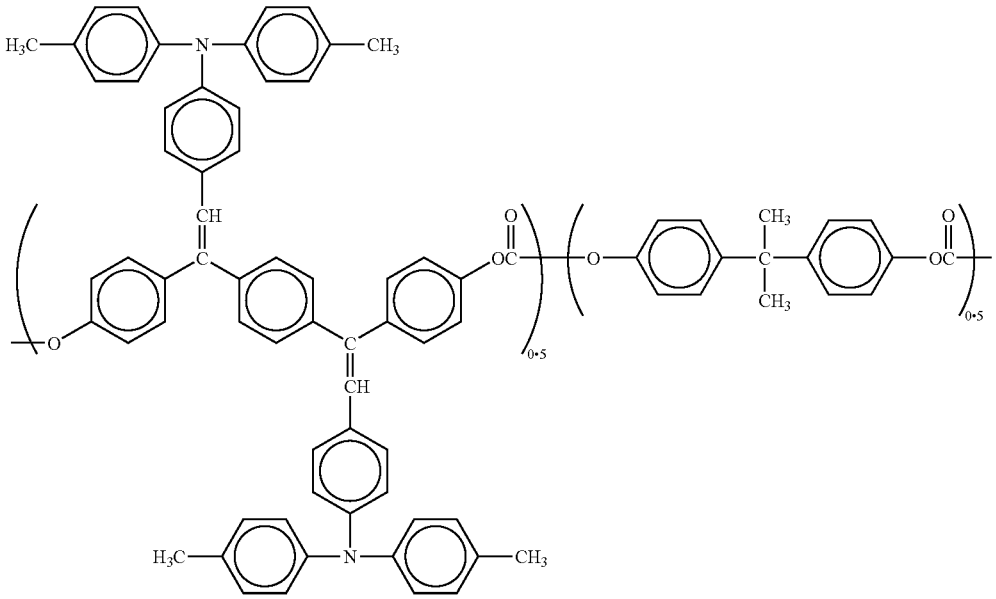
(10D-01)
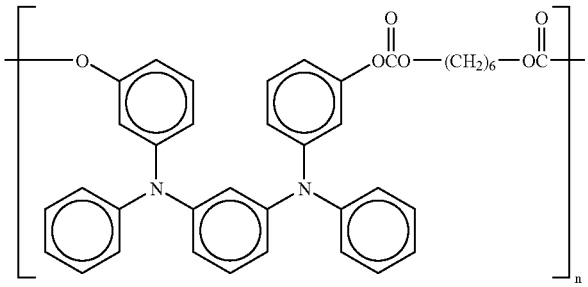
(10D-02)
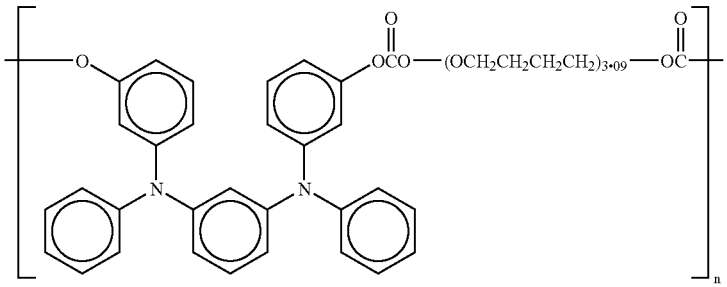
(11D-01)
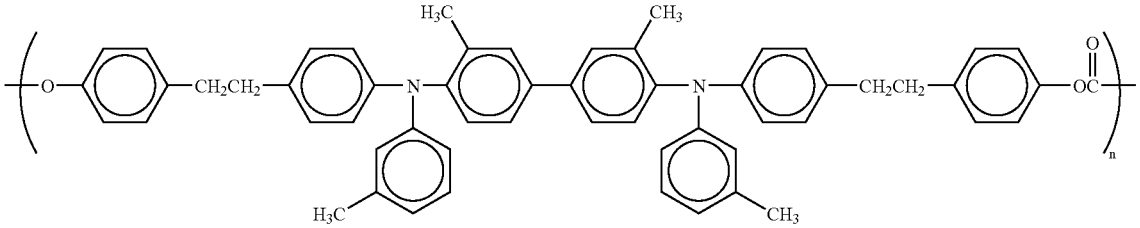

-continued
(11D-02)
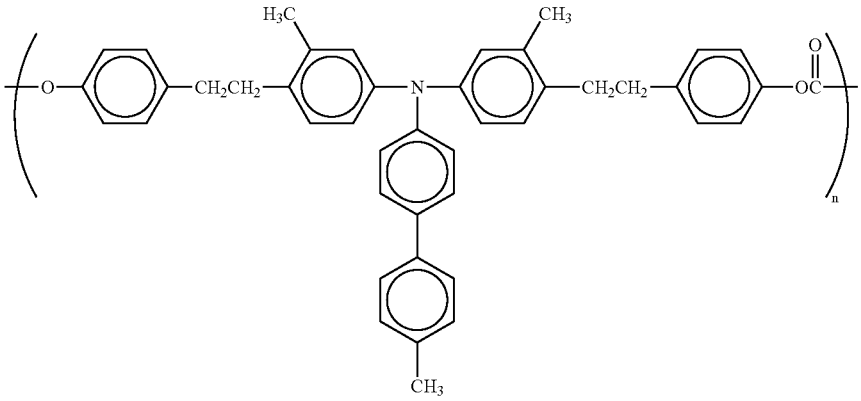
(11D-03)
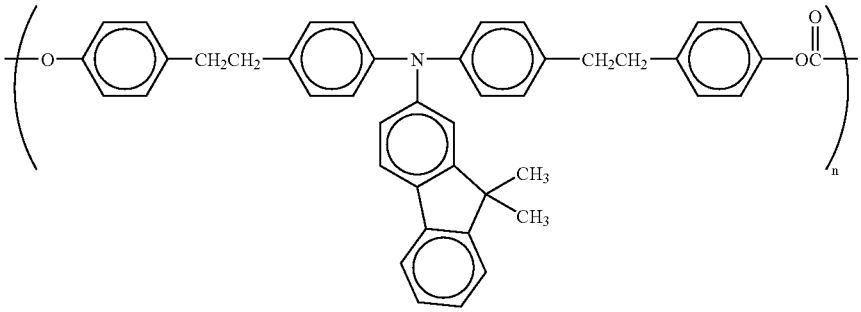
(11D-04)
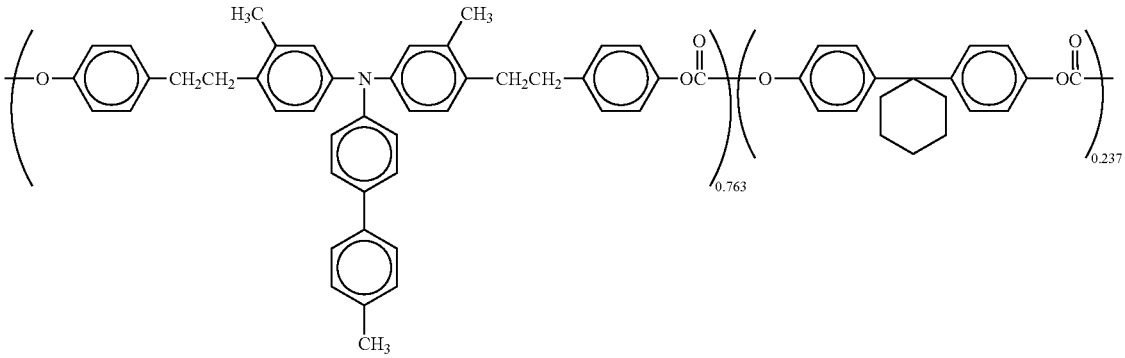
(11D-05)
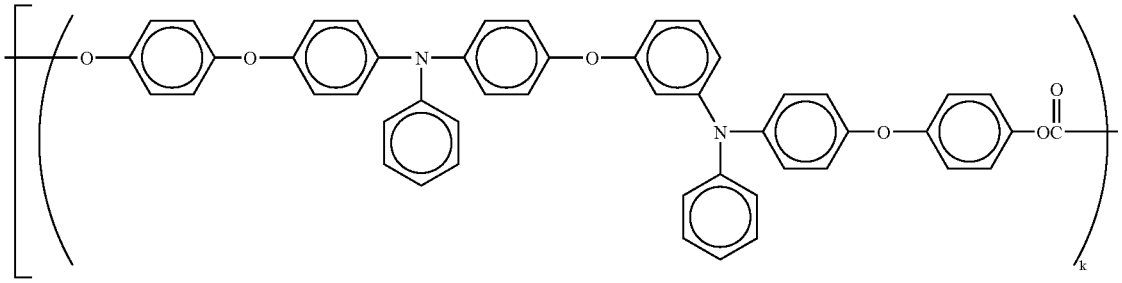

-continued

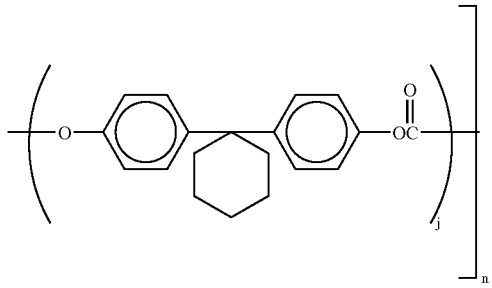

If a photoconductor is manufactured by using the layer construction and the materials described above, the film thickness and the percentage of the materials require preferable ranges. In case of the separate function type (conductive substrate/charge-generating layer/charge transfer layer), a binding agent is used as required in the charge-generating layer. In this case, it is preferable that the percentage of the charge-generating material to the binding agent is 20% by weight or more and the film thickness is 0.01 to 5 μm. It is preferable that the percentage of the charge transport material to the binding agent is 20% by weight to 200% by weight and the film thickness is 5 to 100 μm in the charge transfer layer. In addition, if a high-molecular charge transport material is used, the charge transfer layer may be formed by individually using the material. Further, it is preferable that the charge transport material is contained in the charge-generating layer. Containing the charge transport material allows the layer to have effects in suppressing residual potential and improving sensitivity. It is preferable that in this case, the charge transport material is contained in 20% by weight to 200% by weight with respect to the binding agent.

In case of a single-layer photoconductor, it is preferable that the percentage of the charge-generating layer in the photoconductor is 5% by weight to 95% by weight and the film thickness is 10 to 100 μm. In addition, if it is combined with the charge transport material, it is preferable that the percentage of the transport material to the binding agent is 30% by weight to 200% by weight. In addition, the photoconductive layer may be formed of the high-molecular charge transport material and the charge-generating material, and it is preferable that the percentage of the charge-generating material to the high-molecular type charge transport material is 5% by weight to 95% by weight and the film thickness is 10 to 100 μm.

In addition, in case of the single-layer type photoconductor, it is preferable that the content of the azo compound relating to the present invention to the entire photoconductive layer is 0.1% by weight to 40% by weight, and it is more preferable that it is 0.3% by weight to 25% by weight. In addition, the amount of the high-molecular charge transport material to the entire photoconductive layer is 20% by weight to 95% by weight, and it is more preferable that it is 30% by weight to 80% by weight.

In addition, in the photoconductive layer relating to the present invention, additives such as plasticizer, antioxidant, light stabilizer, thermal stabilizer and lubricant can be added as required. Taken up as plasticizers are halogenated paraffin, dimethyl naphthalene and dimethyl phthalate, and taken up as antioxidant and light stabilizer are phenolic compounds, hydroquinone compounds, hindered phenol compounds, hindered amine compounds, compounds where hindered amine and hindered phenol are present in the same molecule and the like.

The compound expressed by the following formula among the phenol compounds is particularly preferable since it has an effect in improvement of electrification property in repeated use.

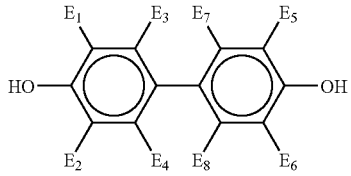

(wherein, "$E_1$", "$E_2$", "$E_3$", "$E_4$", "$E_5$", "$E_6$", "$E_7$" and "$E_8$" represent hydrogen atom, alkyl groups such as methyl group, ethyl group, n-propyl group, iso-propyl group, n-butyl group and t-butyl group, substituted alkyl groups such as benzyl group, methoxymethyl group and methoxymethyl group, alkoxycarbonyl groups such as methoxycarbonyl group and ethoxycarbonyl group and substituted alkylcarbonyl groups such as benzyloxycarbonyl group and methoxyethylcarbonyl group, aryl groups such as phenyl group and naphtyl group, and taken up as its substituents are alkyl groups such as methyl group and ethyl group, phenyl group, methoxy group, ethoxy group, phenoxy group, halogen atoms such as fluorine atom and chlorine atom.)

Shown below are the concrete examples of the phenol compounds expressed by the formula above. However, the phenol compounds relating to the present invention are not limited to them.

(E-1)

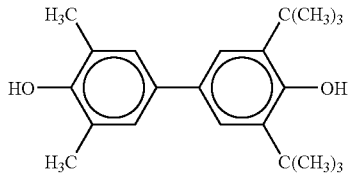

-continued (E-2)

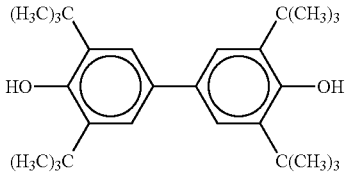

(E-3)

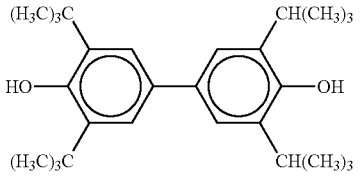

(E-4)

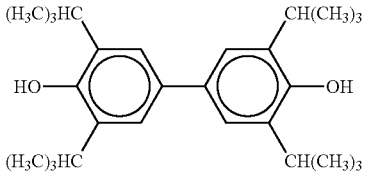

(E-5)

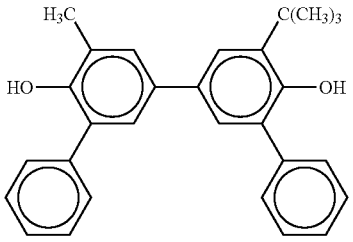

(E-6)

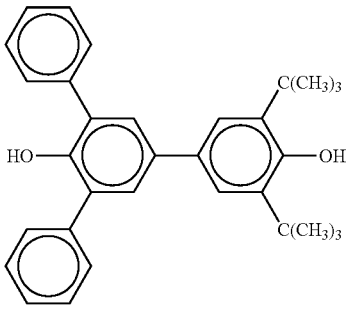

(E-7)

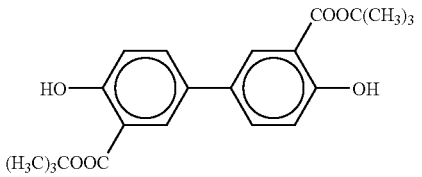

(E-8)

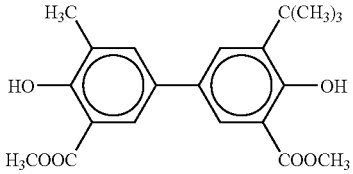

The content of these phenol compounds in the photoconductive layer is each 0.1% by weight to 50% by weight, and is preferably in a range of 0.1 to 30 wt %. If the content of the phenol compound is smaller than 0.1% by weight, an effect in improving durability when it is used repeatedly is not sufficient, and the content is larger than 50% by weight, it results in deterioration in mechanical durability and sensitivity.

Taken as the conductive base materials are metal plates, metal drums or metal foils made of aluminum, nickel, copper, titanium, stainless steel or the like, plastic films on which aluminum, nickel, copper, titanium, gold, tin oxide, indium acetate or the like are vapor deposited, or papers, plastic films or drums on which a conductive material is coated and the like.

In addition, an intermediate layer may be provided on the conductive base material as required. The intermediate layer is generally made of a resin as a major component. However, it is desirable that the resin has high solvent resistance to ordinary organic solvents, considering that a photoconductive layer is coated on the resin with the solvent. Taken up as the resins like this are water-soluble resins such as polyvinyl alcohol, casein and sodium polyacrylate, alcohol-soluble resins such as copolymerized nylon and methoxymethylated nylon, and setting type resins which form a three-dimensional network structure such as polyurethane resin, melamine resin, phenol resin, alkyd-melamine resin and epoxy resin and the like. Fine powder pigments of metal oxides exemplified by titanium oxide, silica, alumina, zirconium oxide, tin oxide, indium oxide or the like may be added to the intermediate layer in order to prevent moire and lower residual potential or the like. These intermediate layers can be formed by using a suitable solvent and a coating process as in the photoconductive layer mentioned above. Further, for the intermediate layer relating to the present invention, silane coupling agent, titanium coupling agent, chromium coupling agent may be used. Besides these, intermediate layers where $Al_2O_3$ is provided by anodic oxidation, or organic materials such as polyparaxylylene (parylene) and inorganic materials such as $SiO_2$, $SnO_2$, $TiO_2$, ITO and $CeO_2$ are provided with vacuum thin film deposition process can be adequately used. It is proper that the thickness of the intermediate layer is 0 to 5 μm.

Further, a protective layer may be provided on the photoconductive layer as required to improve mechanical durability such as abrasion resistance. Taken up as the materials used for the protective layer are ABS resin, olefin-vinyl monomer copolymer resin, chlorinated polyether resin, aryl resin, phenol resin, polyacetal resin, polyamide resin, polyamideimide resin, polyacrylate resin, polyallylsulfon resin, polybutylene resin, polybutyleneterephthalate resin, polycarbonate resin, polyethersulfone resin, polyethylene resin, polyethyleneterephthalate resin, polyimide resin, acrylic resin, polypropylene resin, polyphenyleneoxide resin, polysulfone resin, polystyrene resin, AS resin, butadiene-styrene copolymer resin, polyurethane resin, polyvinyl chloride resin, polyvinylidene chloride resin, epoxy resin and the like. In order to improve abrasion resistance, fluororesin such as polytetrafluoroethylene, silicone resin and resins where inorganic materials such as titanium oxide, tin oxide and potassium titanate are dispersed can be added to the protective layer. As a method of forming the protective layer, a normal coating method can be adopted. In addition, it is proper that the thickness of the protective layer is about 0.1 to 10 μm. In addition, besides the materials above-mentioned, the publicly known materials such as a-C and a-SiC formed with vacuum thin film formation process can be also used as the material for the protective layer.

The photoconductor thus manufactured has good electrification property and sensitivity and is excellent in light resistance and durability. Therefore, it is preferable for a low-speed to high-speed reproduction process, and further, it is possible to apply this photoconductor to a photoconductor for light writing from an analogue copying machine of monochrome or full color and for a page printer which uses a LD or LED light.

What is particularly important for this photoconductor is to use the azo compound having a specifically structured dibenzo[a,c]phenazine azo skeleton and a specifically structured coupler residue for the photoconductor. This allows improvement of sensitivity, electrostatic property, light resistance and durability of the photoconductor. At present, the reasons for improvement of various properties are not known. However, it is presumed that the new coupler residue makes a hetero contribution capable of protecting the azo group of the azo compound with the coupler residue and makes an electronic contribution to increase the oxidation potential of the azo compound. Further, it is considered that, in combination with the dibenzo[a,c]phenazine azo skeleton, the molecular structure of the azo compound resulting from both structures of the azo skeleton and the coupler residue as well as an intermolecular interaction caused by the molecular structure largely affects a high efficiency-charge generation in the photoconductive layer and increases the stability of the azo compound per se resistant to light and oxidizing gases or the like.

Further, by simultaneously using the charge transport material, charge can be quickly transported, thereby electrification property, sensitivity and high durability of electrostatic property can be materialized.

Further, by simultaneously using the acceptor compound, a majority of the electrons generated by light irradiation can be moved to the accepter compound side, high-durability of electrification property, sensitivity and electrostatic property which do not disturb the realization of the photoconductor can be materialized.

Further, by simultaneously using a phenol compound, high-durability of electrostatic property can be realized since the phenol compound functions as an antioxidant.

Next, described are the details of the electrophtography, the electrophotographic apparatus and the process cartridge for the electrophotographic apparatus.

FIG. 1 is a schematic diagram an outline drawing for explaining the electrophtography, the electrophotographic apparatus and the process cartridge for the electrophotographic apparatus relating to the present invention, and the below-mentioned modified examples also fall under the category of the present invention.

In FIG. 1, a photoconductor 1 is provided with the photoconductive layer where the charge-generating layer and the charge transport are sequentially laminated on the conductive support. Even though the photoconductor 1 is of drum shape, it may be a sheet or endless belt. An electrification charger 3, an ante-transport charger 7, a transport charger 10, a separation charger 11 and an ante-cleaning charger 13 use the publicly known mechanism such as corotron, scorotron, solid electrifier (solid state charger) and electrifying roller.

Though the transport mechanism can generally use the electrifier above-mentioned, the electrifier using the combination of the transport charger and the separation charger is effective as shown in FIG. 1.

The light sources such as an image exposure area 5 and a diselectrification lamp 2 can use the entire illuminants such as fluorescent lamp, tungsten lamp, halogen lamp, mercury-vapor lamp, sodium-vapor lamp, light emitting diode (LED), semiconductor laser (LD) and electroluminescence (EL). In addition, in order to irradiate only light of desired wavelength areas, various filters such as sharp cut filter, hand pass filter, near-infrared cut filter, dichotic filter, interference filter and conversion filter can be also used. For the light sources or the like, light is irradiated to the photoconductor by providing, other than the process as shown in FIG. 1, a transport process combined with light irradiation, a diselectrification process, a cleaning process, ante-exposure process or the like.

A toner developed on the photoconductor 1 by a development unit 6 is transported onto a transport paper 9. However, the entire toner is not transported and some portion of the toner which is left on the photoconductor 1. The toner like this is removed from the photoconductor with a fur brush 14 and a blade 15. There is a case where cleaning is performed by only a cleaning brush, and the cleaning brush uses the publicly known brushes such as fur brush and mugfur brush.

If positive (negative) electrification is performed on an photoconductor to expose an image, a positive (negative) latent electrostatic image is formed on the surface of the photoconductor. If this is developed by a negative (positive) toner (electroscopic particles), a positive image can be obtained, and if it is developed by a positive (negative) toner, a negative image can be obtained. For the development mechanism a publicly known method is applied, and for the diselectrification mechanism a publicly known method is used. In FIG. 1, 4 is an eraser, 8 is resist roller and 12 is a separation claw.

Figure 2:
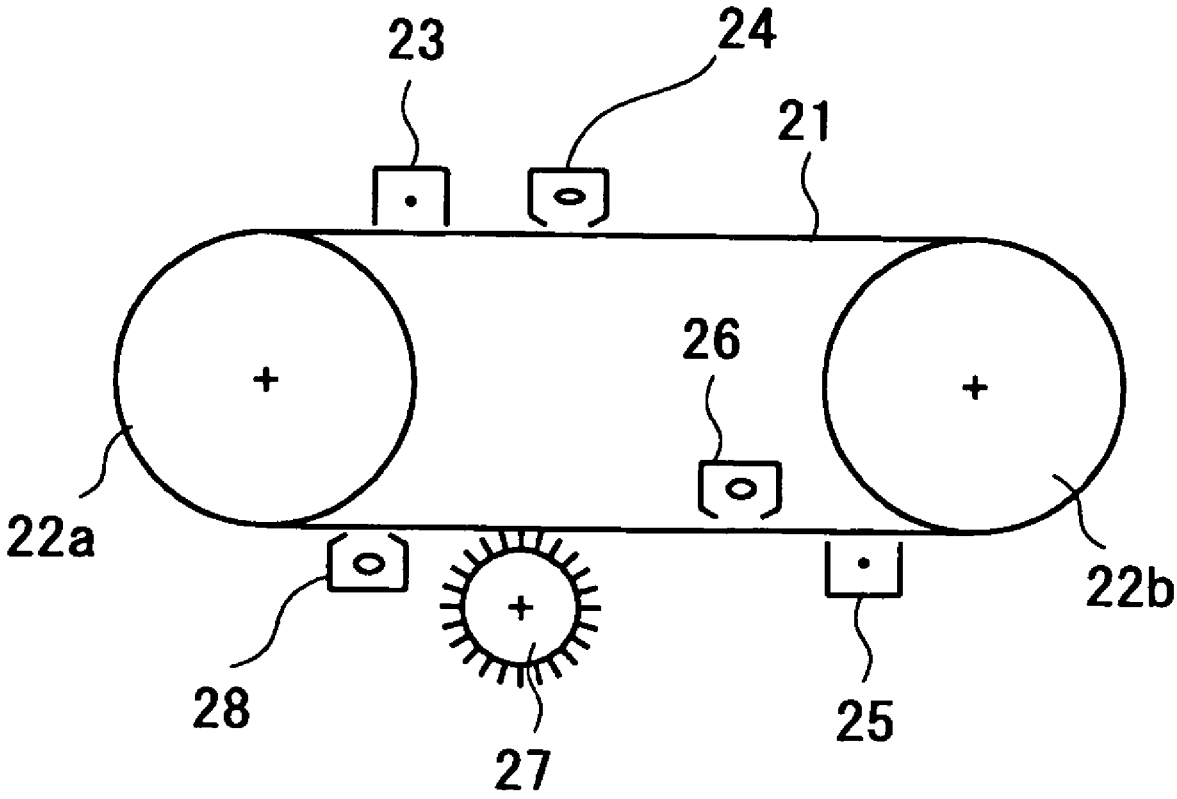
FIG. 2 is a schematic diagram showing one example of the electrophotographic apparatus relating to the present invention.

FIG. 2 shows another example of the electrophotographic process relating to the present invention. A photoconductor 21 has the photoconductive layer relating to the present invention and is driven by rollers 22*a*, 22*b*, electrification is performed by an electrifier 23, an image is exposed and development (not illustrated) is performed by a light source 24, transport is performed by an electrifier 25, ante-cleaning exposure is performed by an light source 26, cleaning is performed by a brush 27 and diselectrification is performed by a light source 28 repeatedly. In FIG. 2, light irradiation of ante-cleaning exposure is performed onto the photoconductor 21 (of course, in this case, the support is a translucent body.) from the side of the support.

Then process illustrated above exemplifies the embodiments in the present invention and of course, other embodiments are possible. For example, in FIG. 2, ante-cleaning exposure is performed from the side of the support. However, it may be performed from the side of the photosensitive layer, or image exposure and light irradiation of diselectrification may be performed from the side of the support.

On the other hand, for the light irradiation process, the ante-cleaning exposure and light irradiation of diselectrification are illustrated. However, in addition thereto, the ante-transport exposure, the process of pre-exposure of image exposure and other publicly known light irradiation process can be provided to irradiate light to the photoconductor.

Figure 3:
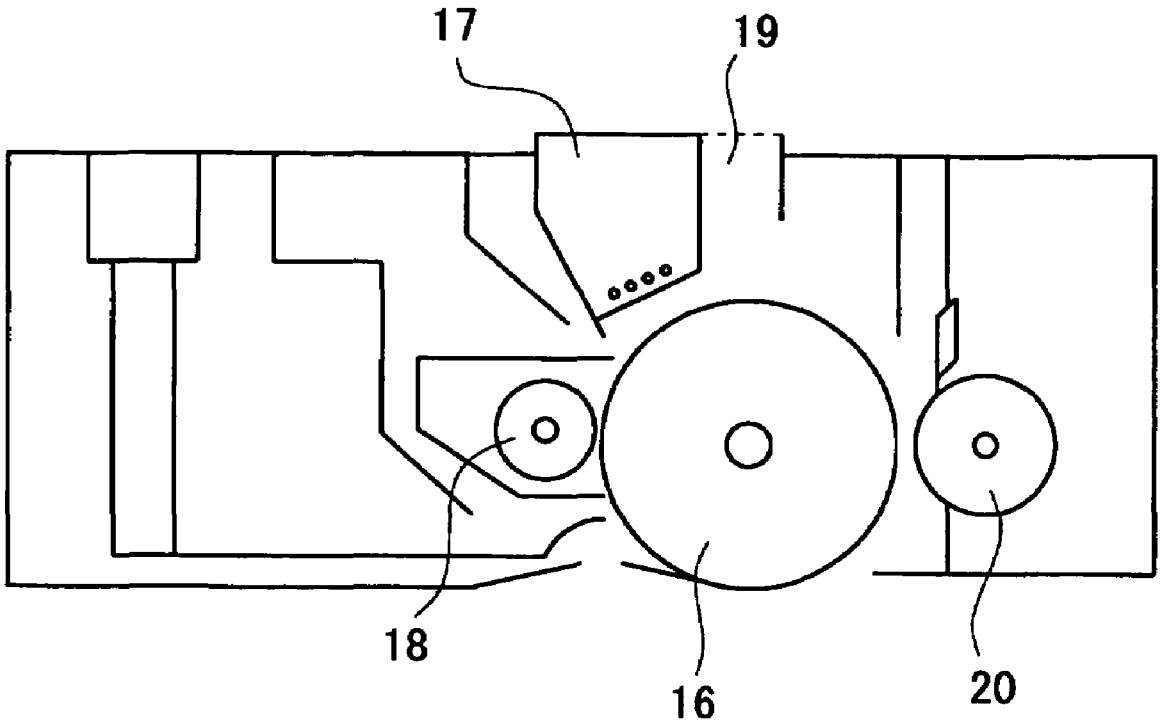
FIG. 3 is a schematic diagram showing one example of the process cartridge relating to the present invention.

The image formation mechanism as shown above may be incorporated into a copying machine, a facsimile and a printer, and may be incorporated and fixed into these apparatuses in the form of a process cartridge. The process cartridge indicates one unit (component), which builds in the photoconductor and includes the electrification mechanism, the exposure mechanism, the development mechanism, the transport mechanism, the cleaning mechanism and the diselectrification mechanism. Various shapes of the cartridge are taken up. However, the one as shown in FIG. 3 is taken up as a general example. A photoconductor 16 is provided with the charge-generating layer and the charge transport layer sequentially laminated on the conductive support. The photoconductive photoconductor 16 is electrified by the electrification charger 17, is exposed by the image exposure section 19, is developed by the development roller 20 and is cleaned by the cleaning brush 18.

Next, concretely described are the details of the azo compound relating to the present invention by Example A. However, the embodiments relating to the present invention are not limited by the description.

EXAMPLE A

Synthesis Example 1

Manufacture of Compound of 2-(t-butoxy) 7,8-naphthalic acid dimethyl ester ($R_1$=$R_2$=$R_3$=$R_4$=H, $R_5$=$CH_3$, $R_6$=t-$C_4H_6$ in Formula (13)

35.25 g (0.2 mol) of p-t-butoxystyrene and 56.84 g (0.4 mol) of acetylenedicarboxylic acid dimethyl ester are dissolved in 200 ml of nitrobenzene, and the reaction was performed at 140° C. for 5 hours and the solution was then naturally cooled down. Further, after nitrobenzene was evaporated under reduced pressure, silicagel column chromatography (as a development solvent: n-hexane: ethyl acetate=9:1) treatment was performed on the residue and 40.78 g of a crude object was obtained.

Next, the objective, 36.63 g (yield: 57.9%) of the naphthalene compound was obtained by the recrystallization of the objective from diisopropyl ether. The melting point was 82.0 to 83.0° C. Shown below are the elemental analytical values.

TABLE 23

| | Elemental analytical value(%) | |
|---|---|---|
| | C | H |
| Actually measured value | 68.32 | 6.46 |
| Calculated value | 68.34 | 6.37 |

Synthesis Example 2

Manufacture of Compound of 2-hydroxy-7,8-naphthalic acid dimethyl ester ($R_1$=$R_2$=$R_3$=$R_4$=H, $R_5$=$CH_3$ in Formula (14)

31.63 g (0.1 mol) of 2-(t-Butoxy) 7,8-naphthalic acid dimethyl ester obtained in Synthesis Example 1 was dissolved in 120 ml of methylene chloride, and 57.01 g (0.5 mol) of trifluoroacetic acid was dripped into the solution for 10 minutes while the solution was stirred at a room temperature, and the stirring reaction continued for 3 hours under the same condition (room temperature). After the reaction was over, the reactant was poured onto an ice, and water was added to separate the phases. The methylene phase was further washed by water twice and the solution was dehydrated by anhydrous magnesium sulfate. Magnesium sulfate was removed by filtration, the residue after methylene chloride was evaporated was recrystallized from toluene to obtain 24.31 g (yield: 93.4%) of the objective naphthalene compound. The melting point was 139.0 to 139.8° C. Shown below are the elemental analytical values.

TABLE 24

| | Elemental analytical value(%) | |
|---|---|---|
| | C | H |
| Actually measured value | 64.60 | 4.56 |
| Calculated value | 64.61 | 4.65 |

Synthesis Example 3

Manufacture of Compound of N-n-hexyl-2-hydroxy-7,8-naphthalic acid imide ($R_1$=$R_2$=$R_3$=$R_4$=H, X=$C_6H_{13-n}$ [Coupler No. C1] in Formula (116)

Stirring reaction was performed on 10.41 g (0.04 mol) of 2-hydroxy-7,8-naphthalic acid dimethyl ester obtained in Synthesis Example 2 and 12.14 g (0.12 mol) of n-hexylamine in 100 ml of ethyleneglycol at 120° C. for 4 hours under the stream of nitrogen gas. After the reaction and cooling-down were over, and after the reactant was poured onto the ice and the solution was made acidic with hydrochloric acid, the crystal deposited was filtered and taken out, after the crystal was washed with 500 ml of ion exchanged water, the crystal was dried under reduced pressure at 60° C. to obtain 9.73 g of the crude objective. Silicagel column chromatography (as a development solvent: toluene:ethyl acetate=4:1) treatment was performed on the crude substance, and the substance was recrystallized from toluene to obtain 7.12 g (yield: 59.9%) of a yellow coupler compound <Coupler No. C1>. The melting point was 165.5 to 166.5° C. Shown below are the elemental analytical values.

TABLE 25

| | Elemental analytical value(%) | | |
|---|---|---|---|
| | C | H | N |
| Actually measured value | 72.84 | 6.51 | 4.68 |
| Calculated value | 72.71 | 6.44 | 4.71 |

Synthesis Example 4

Manufacture of Compound of N-benzyl-2-hydroxy-7,8-naphthalic acid imide ($R_1$=$R_2$=$R_3$=$R_4$=H, X=benzyl in the following formula [Coupler No. C5] in Formula (116)

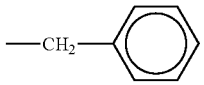

Stirring reaction was performed on 2-hydroxy-7,8-naphthalic acid dimethyl ester obtained in 10.41 g (0.04 mol) of Synthesis Example 2 and 8.57 g (0.08 mol) of benzylamine in 100 ml of ethyleneglycol at 140° C. for 6 hours under the stream of nitrogen gas. After the reaction and cooling-down were over, and after the reactant was poured onto the ice and the solution was made acidic with hydrochloric acid, the crystal deposited was filtered and taken out, after the crystal was washed with an ion exchanged water of 500 ml, the crystal was dried under reduced pressure at 60° C. to obtain 10.21 g of the crude objective. The crude substance was recrystallized from n-butanol to obtain 9.57 g (yield: 78.9%) of an orange coupler compound <Coupler No. C5>. The melting point was 255.2 to 259.0° C. Shown below are the elemental analytical values.

TABLE 26

| | Elemental analytical value(%) | | |
|---|---|---|---|
| | C | H | N |
| Actually measured value | 75.30 | 4.29 | 4.60 |
| Calculated value | 75.24 | 4.32 | 4.62 |

Synthesis Example 5

Manufacture of Compound of N-(2-phenylethyl)-2-hydroxy-7,8-naphthalic acid imide ($R_1$=$R_2$=$R_3$=$R_4$=H, X=phenylmethyl in the following formula [Coupler No. C14] in Formula (116)

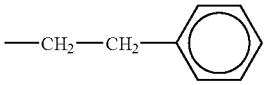

Except the use of 9.69 g (0.08 mol) of phenetylamine in place of 8.57 g (0.08 mol) of benzylamine, the reaction took place in the same way as in Synthesis Example 4 to obtain 10.48 g of the crude objective. The crude substance was recrystallized from n-butanol to obtain 9.95 g (yield: 78.4%) of a yellow coupler compound <Coupler No. C14>. The melting point was 233.5 to 236.5° C. Shown below are the elemental analytical values.

TABLE 27

| | Elemental analytical value(%) | | |
|---|---|---|---|
| | C | H | N |
| Actually measured value | 75.78 | 4.71 | 4.36 |
| Calculated value | 75.70 | 4.77 | 4.41 |

Synthesis Example 6

Manufacture of Compound of N-(3-phenylpropyl)-2-hydroxy-7,8-naphthalic acid imide ($R_1$=$R_2$=$R_3$=$R_4$=H, X=phenylpropyl in the following formula [Coupler No. C24] in Formula (116)

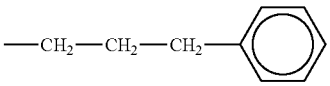

Except the use of 10.82 g (0.08 mol) of 3-phenylpropylamine in place of 8.57 g (0.08 mol) of benzylamine, the reaction took place in the same way as in Synthesis Example 4 to obtain 13.25 g of the crude objective. The crude substance was recrystallized from n-butanol to obtain 11.17 g (yield: 84.3%) of a yellow coupler compound <Coupler No. C24>. The melting point was 206.9 to 212.0° C. Shown below are the elemental analytical values.

TABLE 28

| | Elemental analytical value(%) | | |
|---|---|---|---|
| | C | H | N |
| Actually measured value | 76.20 | 5.38 | 4.21 |
| Calculated value | 76.12 | 5.17 | 4.23 |

Synthesis Example 7

Manufacture of Compound of N-phenyl-2-hydroxy-7,8-naphthalic acid imide ($R_1$=$R_2$=$R_3$=$R_4$=H, X=phenyl in the following formula [Coupler No. C28] in Formula (116)

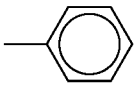

Except the use of 7.45 g (0.08 mol) of aniline in place of 8.57 g (0.08 mol) of benzylamine, the reaction took place in the same way as in Synthesis Example 4 to obtain 12.04 g of the crude objective. The crude substance was recrystallized from n-butanol/toluene (1/1 vol) to obtain 8.15 g (yield: 69.7%) of a yellow coupler compound <Coupler No. C28>. The melting point was 245.5 to 248.9° C. Shown below are the elemental analytical values.

TABLE 29

| | Elemental analytical value(%) | | |
|---|---|---|---|
| | C | H | N |
| Actually measured value | 74.79 | 3.88 | 4.83 |
| Calculated value | 74.73 | 3.83 | 4.84 |

Synthesis Example 8

Manufacture of Compound of 12-hydroxy-benzo[6,7]isoindole[2,1-a]perymidine-14-on, or 9-hydroxy-benzo[4,5]isoindole[2,1-a]perymidine-14-on ($R_1$=$R_2$=$R_3$=$R_4$=H, Y=naphthylene in the following formula <Coupler No. E23> in Formula (118) or Formula (119)

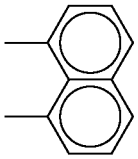

Stirring reaction was performed on 10.41 g (0.04 mol) of 2-hydroxy-7,8-naphthalic acid dimethyl ester obtained in Synthesis Example 2 and 12.66 g (0.08 mol) of 1,8-diaminonaphthalene in 100 ml of ethyleneglycol at 160° C. for 8 hours under the stream of nitrogen gas. After the reaction and cooling-down were over, and after the reactant was poured onto the ice and the solution was made acidic with hydrochloric acid, the crystal deposited was filtered and taken out, after the crystal was washed with 500 ml of ion exchanged water, the crystal was dried under reduced pressure at 60° C. to obtain 9.96 g of the crude objective. The crude substance was recrystallized from nitrobenzene to obtain 8.80 g (yield: 65.4%) of a red coupler compound <Coupler No. E23>. The decomposition point was 398° C. Shown below are the elemental analytical values.

TABLE 30

| | Elemental analytical value(%) | | |
|---|---|---|---|
| | C | H | N |
| Actually measured value | 78.50 | 3.57 | 8.32 |
| Calculated value | 78.56 | 3.60 | 8.33 |

Example A-1

Manufacture of Azo Compound (Azo Compound No. P3)

0.91 g (3 mmol) of N-benzyl-2-hydroxy-7,8-naphthalic acid imide (Coupler Compound No. C5) was dissolved in 100 ml of DMF and 0.76 g (1.5 mmol) of dibenzo[a,c]phenadine-2,7-bisdiazoniumtetrafluoroborate of synthesized beforehand from 2,7-diaminodibenzo[a,c]phenadine was added to the solution at the room temperature. Next, 4.92 g of a 10% by weight sodium acetate aqueous solution was dripped into the solution for 10 minutes and the solution was stirred at a room temperature for 6 hours. The produced precipitate was filtered and taken out, and the precipitate was washed with 120 ml of DMF three times at the room temperature and was then washed with 120 ml of water twice. The precipitate was dried under reduced pressure at 70° C. to obtain the azo compound (Azo Compound No. P3).

The yield, infra-red absorbing spectrum and elemental analytical results of the obtained azo compound are totally shown in Table 31.

Example A-2

Manufacture of Azo Compound (Azo Compound No. P4)

0.46 g (1.5 mmol) of N-benzyl-2-hydroxy-7,8-naphthalic acid imide (Coupler Compound No. C5) was dissolved in 60 ml of DMF and 0.76 g (1.5 mmol) of dibenzo[a,c]phenadine-2,7-bisdiazoniumtetrafluoroborate synthesized beforehand from 2,7-diaminodibenzo[a,c]phenadine was added thereto and the solution was stirred at the room temperature for 30 minutes. Next, a solution comprising 0.39 g (1.5 mmol) of 2-hydroxy-3-phenylcarbamoylnaphthalene (Coupler Compound No. 17) and 40 ml of DMF was added to the solution.

Next, 4.92 g of 10% by weight sodium acetate aqueous solution was dripped for 10 minutes and the solution was stirred at a room temperature for 6 hours. The produced precipitate was filtered and taken out, and the precipitate was washed with 120 ml of DMF three times at the room temperature and was then washed with 120 ml of water twice. The precipitate was dried under reduced pressure at 70° C. to obtain the azo compound (Azo Compound No. P4).

The yield, infra-red absorbing spectrum and elemental analytical results of the obtained azo compound are totally shown in Table 31.

Example A-3

Manufacture of Azo Compound (Azo Compound No. P20)

Except the use 0.91 g (3 mmol) of N-(2-phenylethyl)-2-hydroxy-7,8-naphthalic acid imide (Coupler Compound No. C14) in place of 0.81 g (3 mmol) of N-benzyl-2-hydroxy-7,8-naphthalic acid imide (Coupler Compound No. C5) in Example A-1, the azo compound was manufactured in the same way as in Example A-1 to obtain the azo compound (Azo Compound No. P20).

The yield, infra-red absorbing spectrum and elemental analytical results of the obtained azo compound are totally shown in Table 31.

Example A-4

Manufacture of Azo Compound (Azo Compound No. P21)

Except the use of 0.46 g of (1.5 mmol)N-(2-phenylethyl)-2-hydroxy-7,8-naphthalic acid imide (Coupler Compound No. C14) in place of 0.48 g (1.5 mmol) of N-benzyl-2-hydroxy-7,8-naphthalic acid imide (Coupler Compound No. C5) in Example A-1, the azo compound was manufactured in the same way as in Example A-1 to obtain the azo compound (Azo Compound No. P21).

The yield, infra-red absorbing spectrum and elemental analytical results of the obtained azo compound are totally shown in Table 31.

Example A-5

Manufacture of Azo Compound (Azo Compound No. P27)

Except the use of 0.91 g (3 mmol) of N-(2-phenylethyl)-2-hydroxy-7,8-naphthalic acid imide (Coupler Compound No. C14) in place of 0.99 g (3 mmol) of N-(3-phenylpropyl)-2-hydroxy-7,8-naphthalic acid imide (Coupler Compound No. C24) in Example A-1, the azo compound was manufactured in the same way as in Example A-1 to obtain the azo compound (Azo Compound No. P27).

The yield, infra-red absorbing spectrum and elemental analytical results of the obtained azo compound are totally shown in Table 31.

Example A-6

Manufacture of Azo Compound (Azo Compound No. P28)

Except the use of 0.46 g (1.5 mmol) of N-(2-phenylethyl)-2-hydroxy-7,8-naphthalic acid imide (Coupler Compound No. C14) in place of 0.50 g (1.5 mmol) of N-(3-phenylpropyl)-2-hydroxy-7,8-naphthalic acid imide (Coupler Compound No. C24) in Example A-1, the azo compound was manufactured in the same way as in Example A-1 to obtain the azo compound (Azo Compound No. P28).

The yield, infra-red absorbing spectrum and elemental analytical results of the obtained azo compound are totally shown in Table 31.

Example A-7

Manufacture of Azo Compound (Azo Compound No. P169)

0.50 g (1.5 mmol) of N-(3-phenylpropyl)-2-hydroxy-7,8-naphthalic acid imide (Coupler Compound No. C24) was dissolved in 60 ml of DMF and 0.78 g (1.5 mmol) of 1,1-methyldibenzo[a,c]phenadine-2,7-bisdiazoniumtetrafluoroborate synthesized beforehand from 2,7-diamino-11-methyldibenzo[a,c]phenadine was added to the solution at the room temperature and the solution was stirred at the room temperature for 30 minutes. Next, a solution comprising 2-hydroxy-3-phenylcarbamyol-11H-benzo[a]carbazole (Coupler Compound No. 73) of 0.57 g (1.5 mmol) and 40 ml of DMF was added to the solution. Next, 4.92 g of 10% by weight sodium acetate aqueous solution was dripped into the solution for 10 minutes and the solution was stirred at a room temperature for 6 hours. The produced precipitate was filtered and taken out, and the precipitate was washed with 120 ml of DMF three times at the room temperature and was then washed with 120 ml of water twice. The precipitate was dried under reduced pressure at 70° C. to obtain the azo compound (Azo Compound No. P169).

The yield, infra-red absorbing spectrum and elemental analytical results of the obtained azo compound are totally shown in Table 31.

Example A-8

Manufacture of Azo Compound (Azo Compound No. P207)

0.99 g (3 mmol) of N-(3-phenylpropyl)-2-hydroxy-7,8-naphthalic acid imide (Coupler Compound No. C24) was dissolved in 100 ml of DMF and 0.81 g (1.5 mmol) of 11-chlorodibenzo[a,c]phenadine-2,7-bisdiazoniumtetrafluoroborate synthesized beforehand from 2,7-diamino-11-chlorodibenzo[a,c]phenadine was added to the solution at the room temperature. Next, 4.92 g of 10% by weight sodium acetate aqueous solution was dripped into the solution for 10 minutes and the solution was stirred at a room temperature for 6 hours. The produced precipitate was filtered and taken out, and the precipitate was washed with 120 ml of DMF three times at the room temperature and was then washed with 120 ml of water twice. The precipitate was dried under reduced pressure at 70° C. to obtain the azo compound (Azo Compound No. P207).

The yield, infra-red absorbing spectrum and elemental analytical results of the obtained azo compound are totally shown in Table 31.

Example A-9

Manufacture of Azo Compound (Azo Compound No. P209)

0.50 g (1.5 mmol) of N-(3-phenylpropyl)-2-hydroxy-7,8-naphthalic acid imide (Coupler Compound No. C24) was dissolved in 60 ml of DMF and 0.81 g (1.5 mmol) of 11-chlorodibenzo[a,c]phenadine-2,7-bisdiazoniumtetrafluoroborate synthesized beforehand from 2,7-diamino-11-chlorodibenzo[a,c]phenadine was added to the solution at the room temperature for 30 minutes. Next, 0.57 g (1.5 mmol) of a solution comprising 2-hydroxy-3-phenylcarbamyol-11H-benzo[a]carbazole (Coupler Compound No. 73) and 40 ml of DMF was added to the solution. Next, 4.92 g of 10% by weight sodium acetate aqueous solution was dripped into the solution for 10 minutes and the solution was stirred at a room temperature for 6 hours. The produced precipitate was filtered and taken out, and the precipitate was washed with 120 ml of DMF three times at the room temperature and was then washed with 120 ml of water twice. The precipitate was dried under reduced pressure at 70° C. to obtain the azo compound (Azo Compound No. P209).

The yield, infra-red absorbing spectrum and elemental analytical results of the obtained azo compound are totally shown in Table 31.

Example A-10

Manufacture of Azo Compound (Azo Compound No. P289)

0.159 g (0.50 mmol) of N-(2-phenylethyl)-2-hydroxy-7,8-naphthalic acid imide (Coupler Compound No. C14) was dissolved in 20 ml of DMSO and 0.26 g (0.50 mmol) of 11,12-dimethyldibenzo[a,c]phenadine-2,7-bisdiazoniumtetrafluoroborate synthesized beforehand from 2,7-diamino-11,12-diamethyldibenzo[a,c]phenadine was added and the solution was stirred at the room temperature for 10 minutes. Next, a solution comprising 0.143 g of 2 (5)-hydroxy-7H-benzimidazo[2,1-a]benzisoquinoline-7 (Coupler Compound No. 195) (0.50 mmol) and 20 ml of DMSO was added to the solution. Next, 1.65 g of 10% by weight sodium acetate aqueous solution was dripped into the solution for 10 minutes and the solution was stirred at a room temperature for 6 hours. The produced precipitate was filtered and taken out, and the precipitate was washed with 60 ml of DMSO three times at the room temperature and was then washed with 60 ml of water twice. The precipitate was dried under reduced pressure at 70° C. to obtain the azo compound (Azo Compound No. P289).

The yield, infra-red absorbing spectrum and elemental analytical results of the obtained azo compound are totally shown in Further, the present invention is in detail described by the following application examples. However, this does not limit the embodiments relating to the present invention.

Application Example 1

7.5 parts by weight of the azo compound of Example A-5 (Azo Compound No. P27) relating to the present invention and 500 parts by weight of a tetrahydrofuran solution comprising 0.5% by weight of polyester resin (Viron 200: TOYOBO Co., Ltd.-made) were crushed and mixed in a ball mill, the obtained dispersed liquid was coated on an aluminum vapor-deposited polyester film with a doctor blade and was naturally dried to form a charge-generating layer of about 1 μm in thickness thinknes.

Next, a charge transport layer coating solution comprising 1 part by weight of the charge transport material expressed by the following Structural Formula (D-1), 1 part by weight of polycarbonate resin (Panlite K1300: Teijin Chemicals Ltd-made) and 8 parts by weight of tetrahydrofuran of was prepared, was coated on the charge-generating layer with the doctor blade and was dried at 80° C. for 2 minutes and then 120° C. for 5 minutes to form a charge-generating layer of 20 μm in thickness.

TABLE 31

Figure 4:
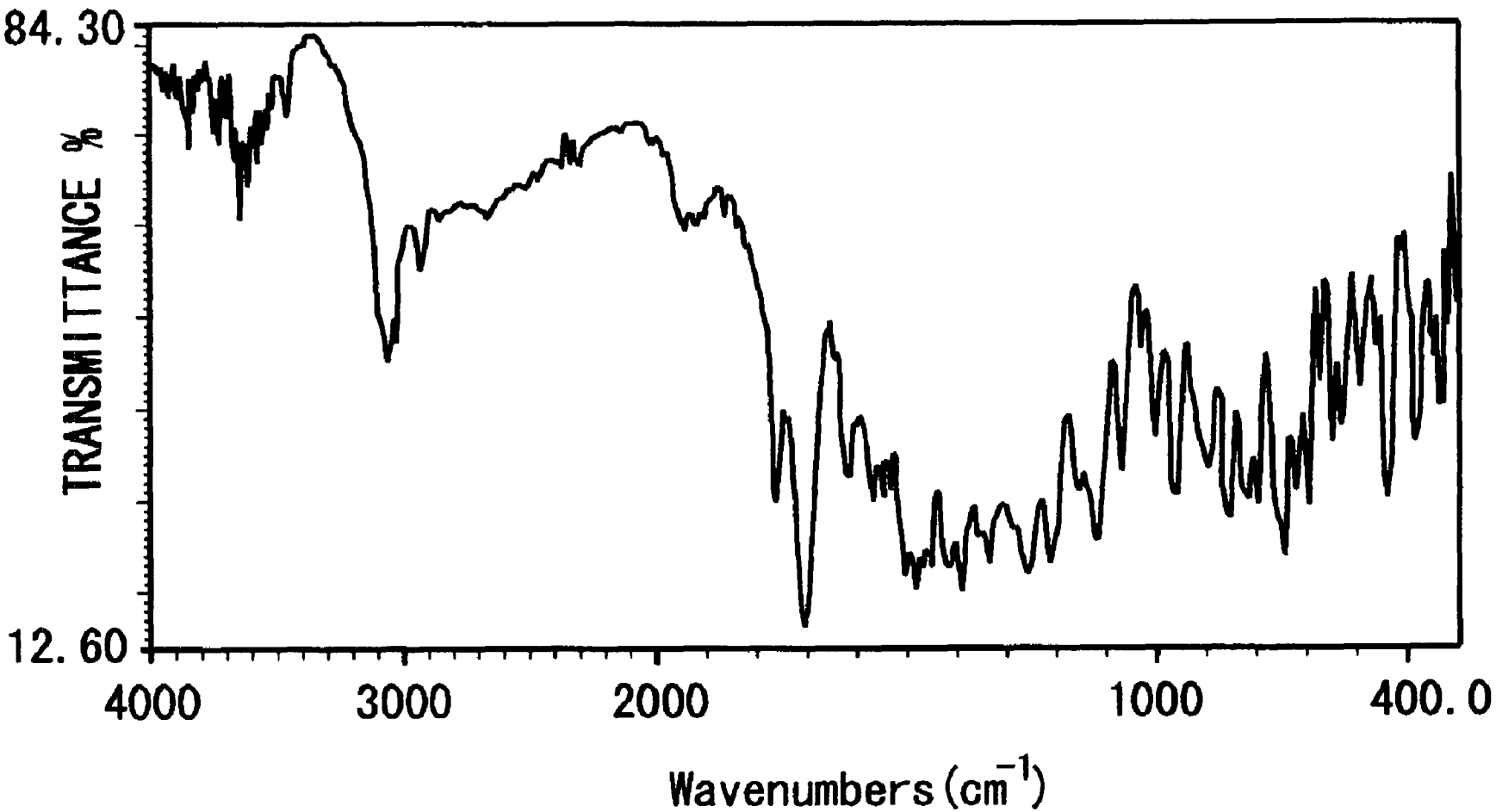
FIG. 4 is a view showing an infrared-absorbing spectrum of the azo compound (Example A-1) relating to the present invention.
Figure 5:
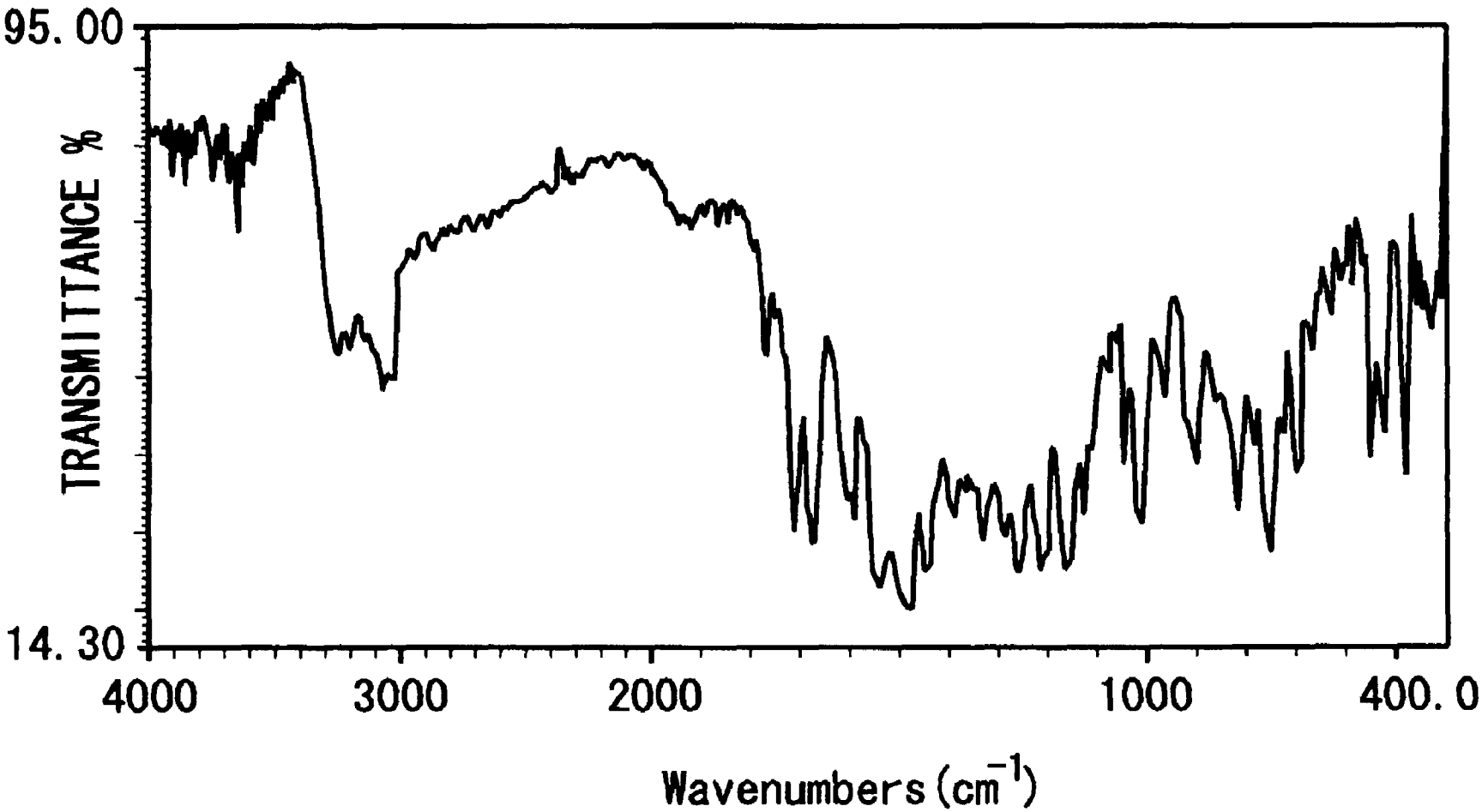
FIG. 5 is another view showing an infrared-absorbing spectrum of the azo compound (Example A-2) relating to the present invention.
Figure 6:
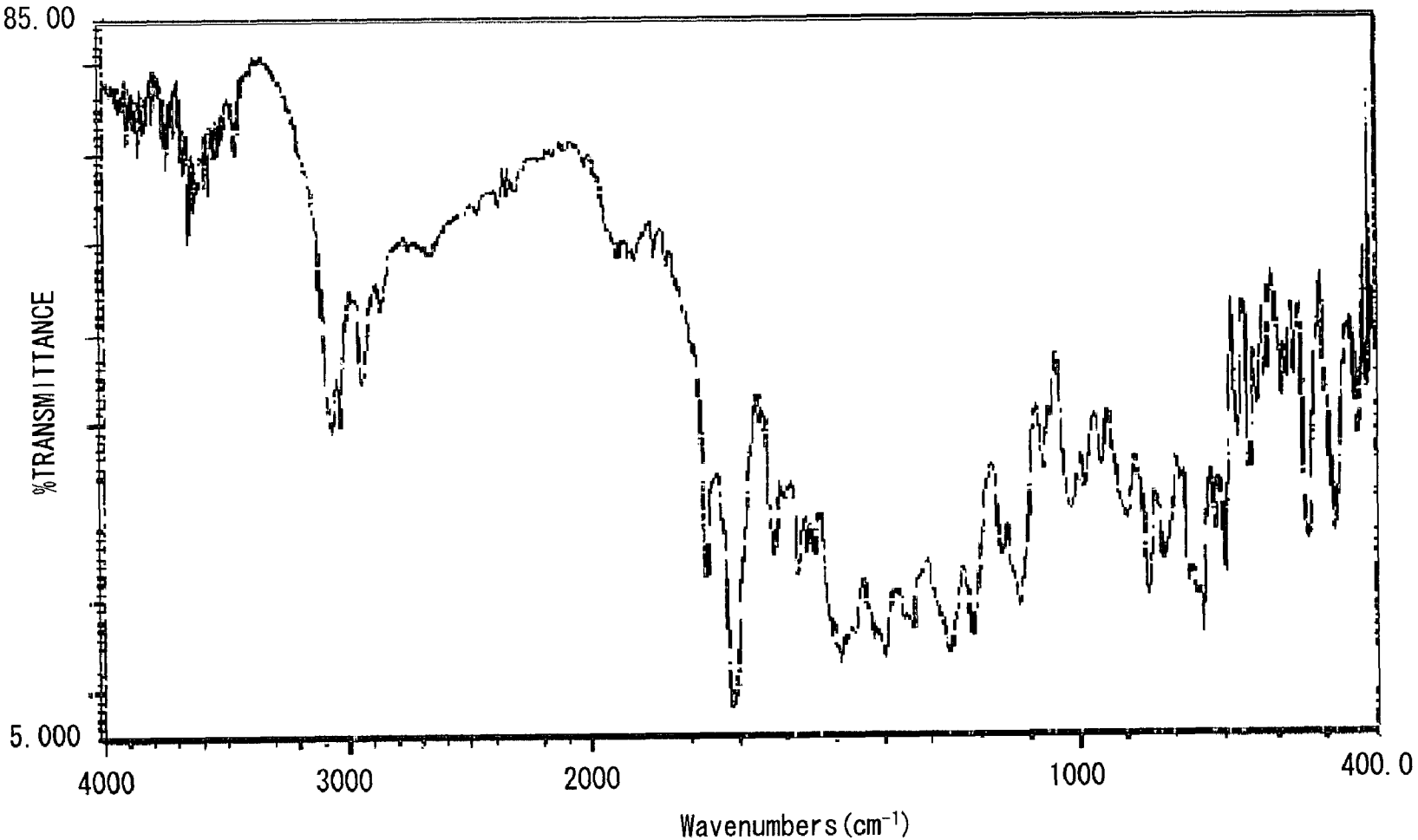
FIG. 6 is another view showing an infrared-absorbing spectrum of the azo compound (Example A-3) relating to the present invention.
Figure 7:
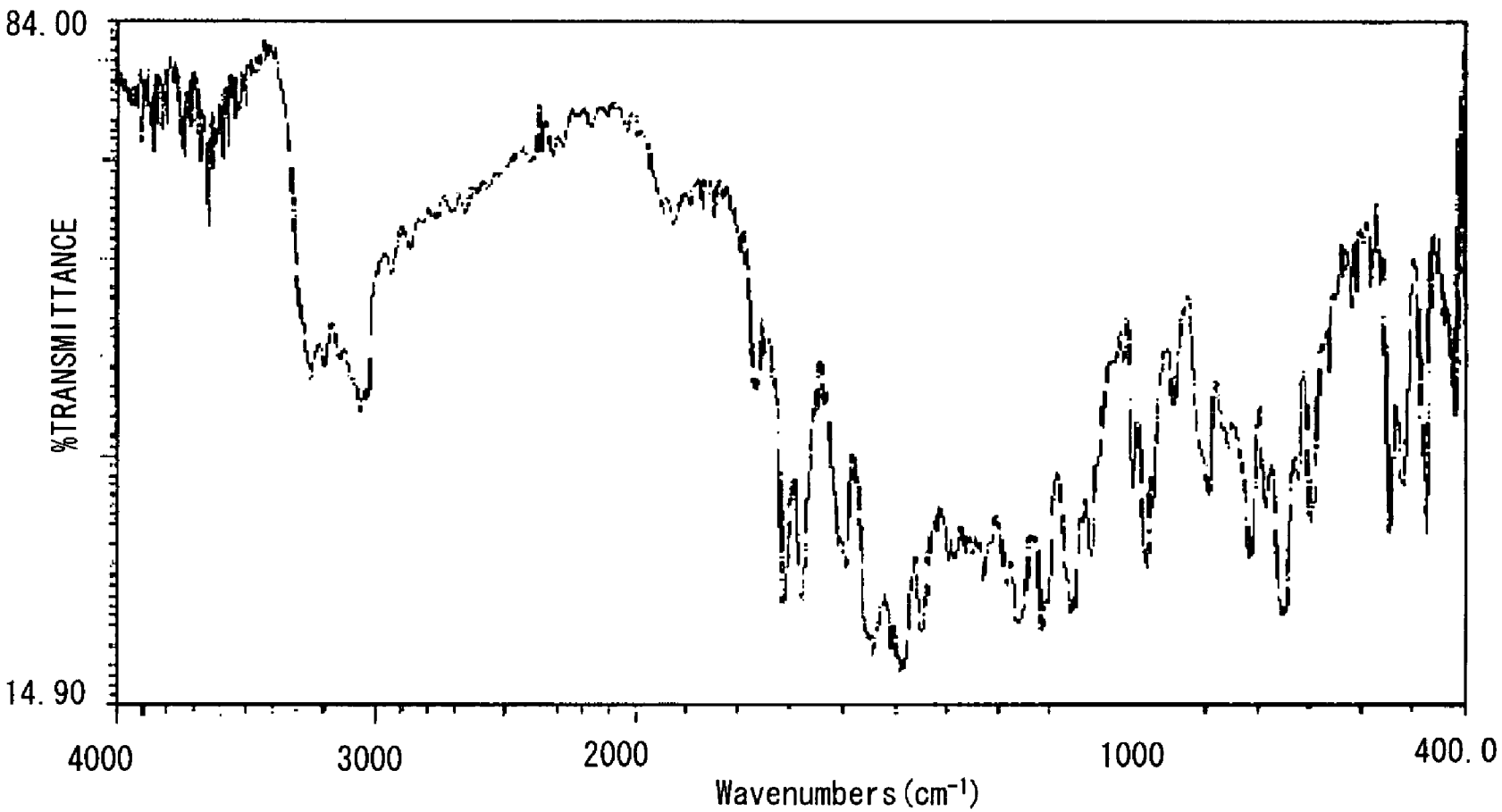
FIG. 7 is another view showing an infrared-absorbing spectrum of the azo compound (Example A-4) relating to the present invention.
Figure 8:
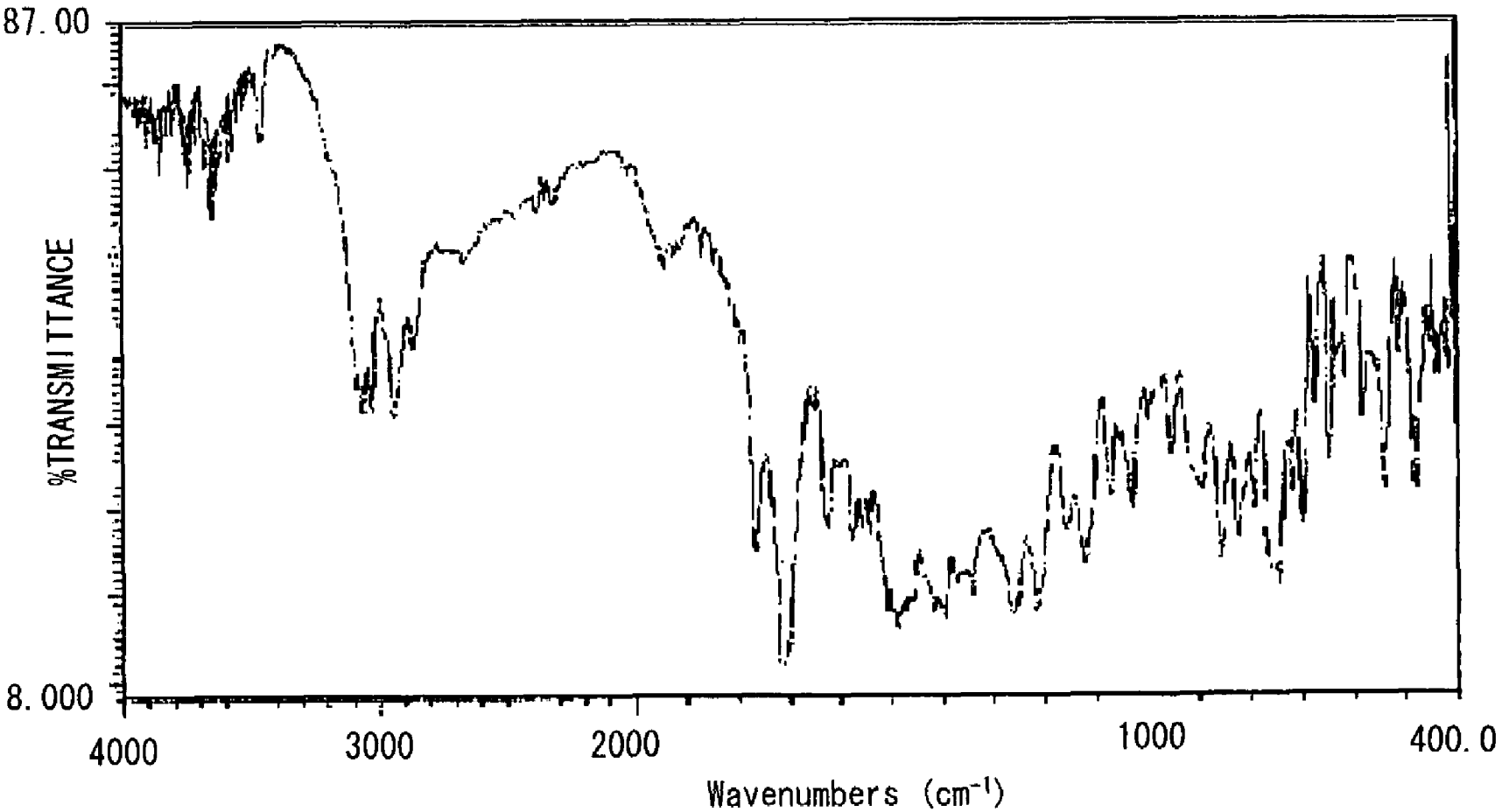
FIG. 8 is another view showing an infrared-absorbing spectrum of the azo compound (Example A-5) relating to the present invention.
Figure 9:
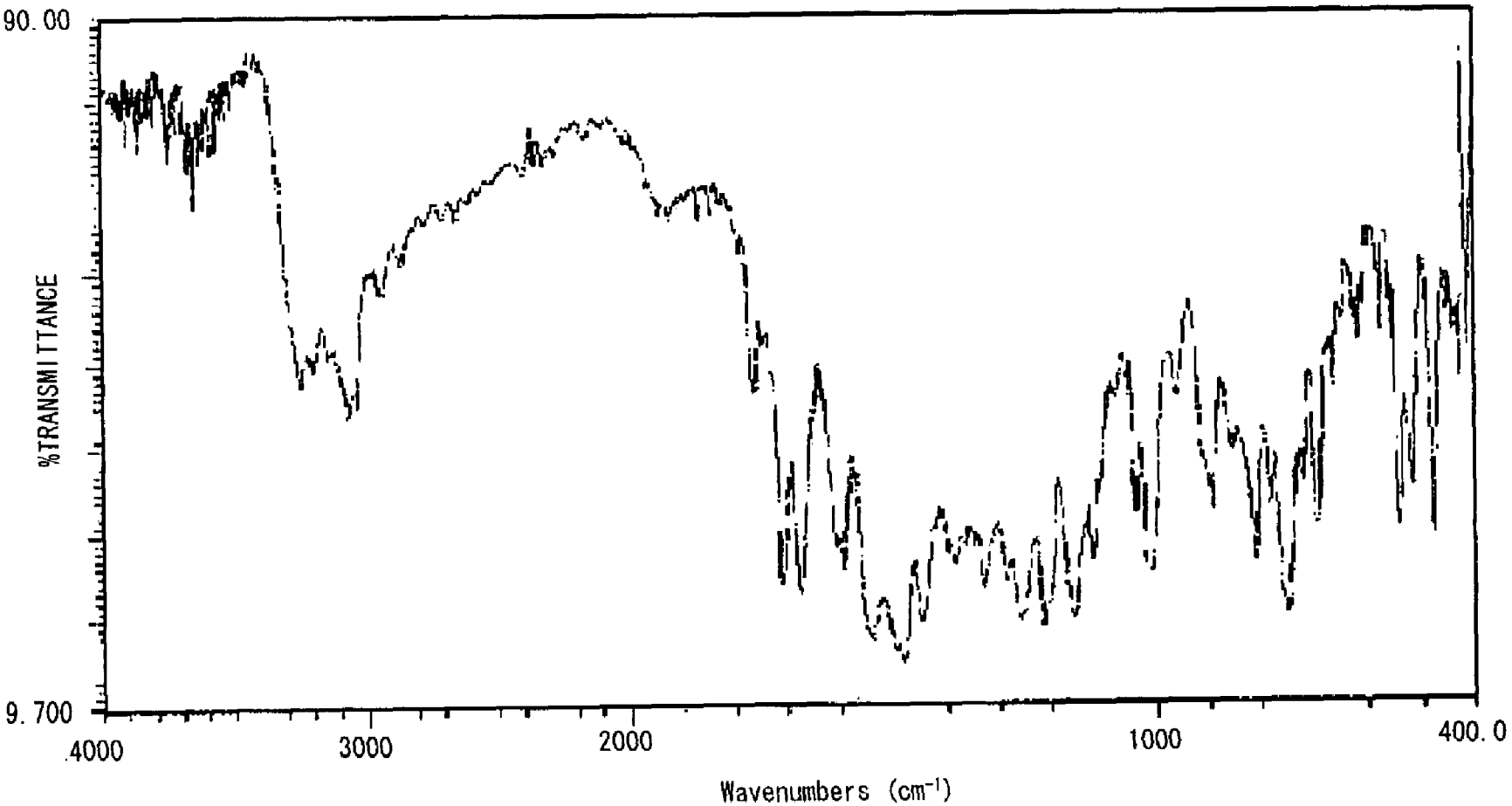
FIG. 9 is another view showing an infrared-absorbing spectrum of the azo compound (Example A-6) relating to the present invention.
Figure 10:
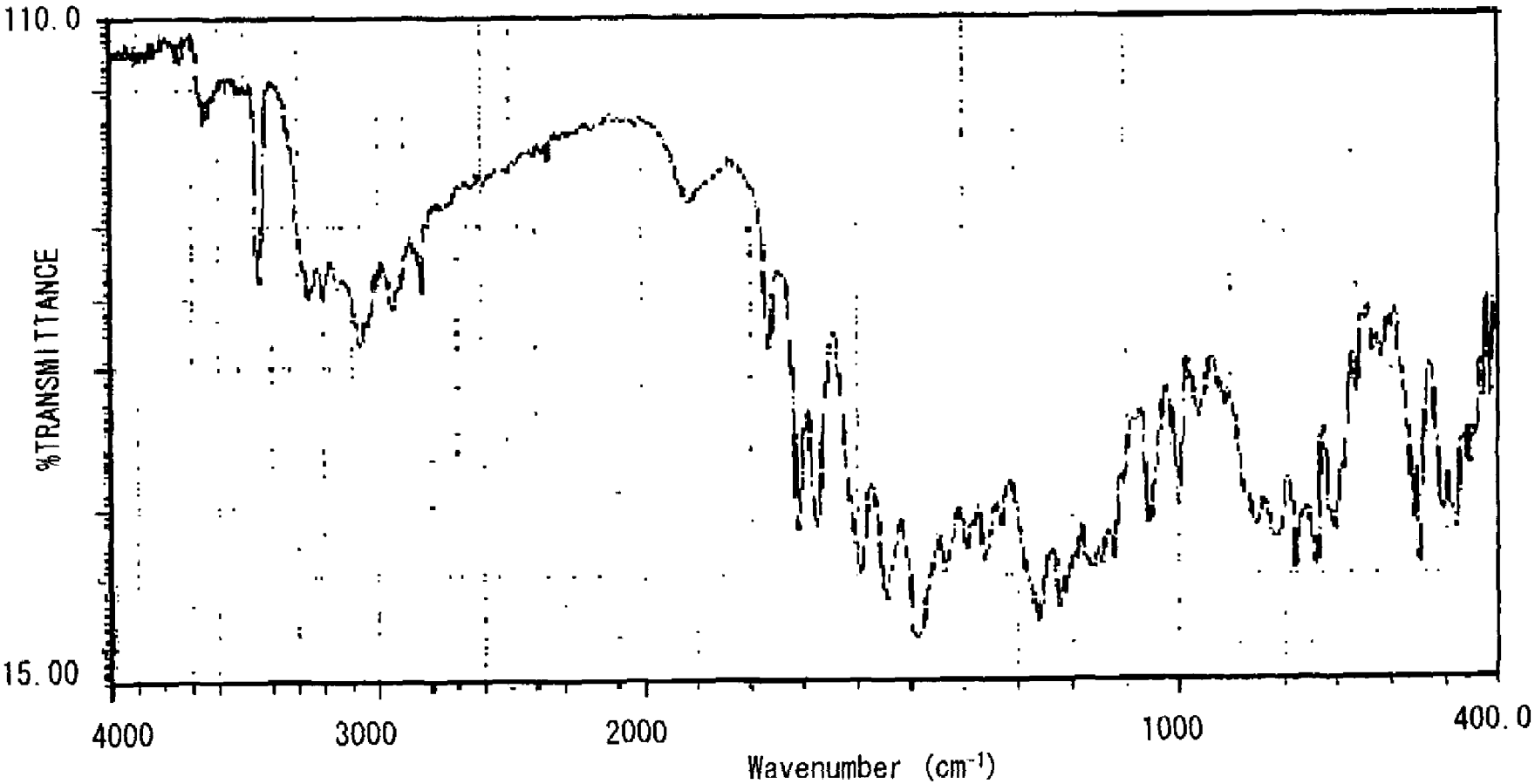
FIG. 10 is another view showing an infrared-absorbing spectrum of the azo compound (Example A-7) relating to the present invention.
Figure 11:
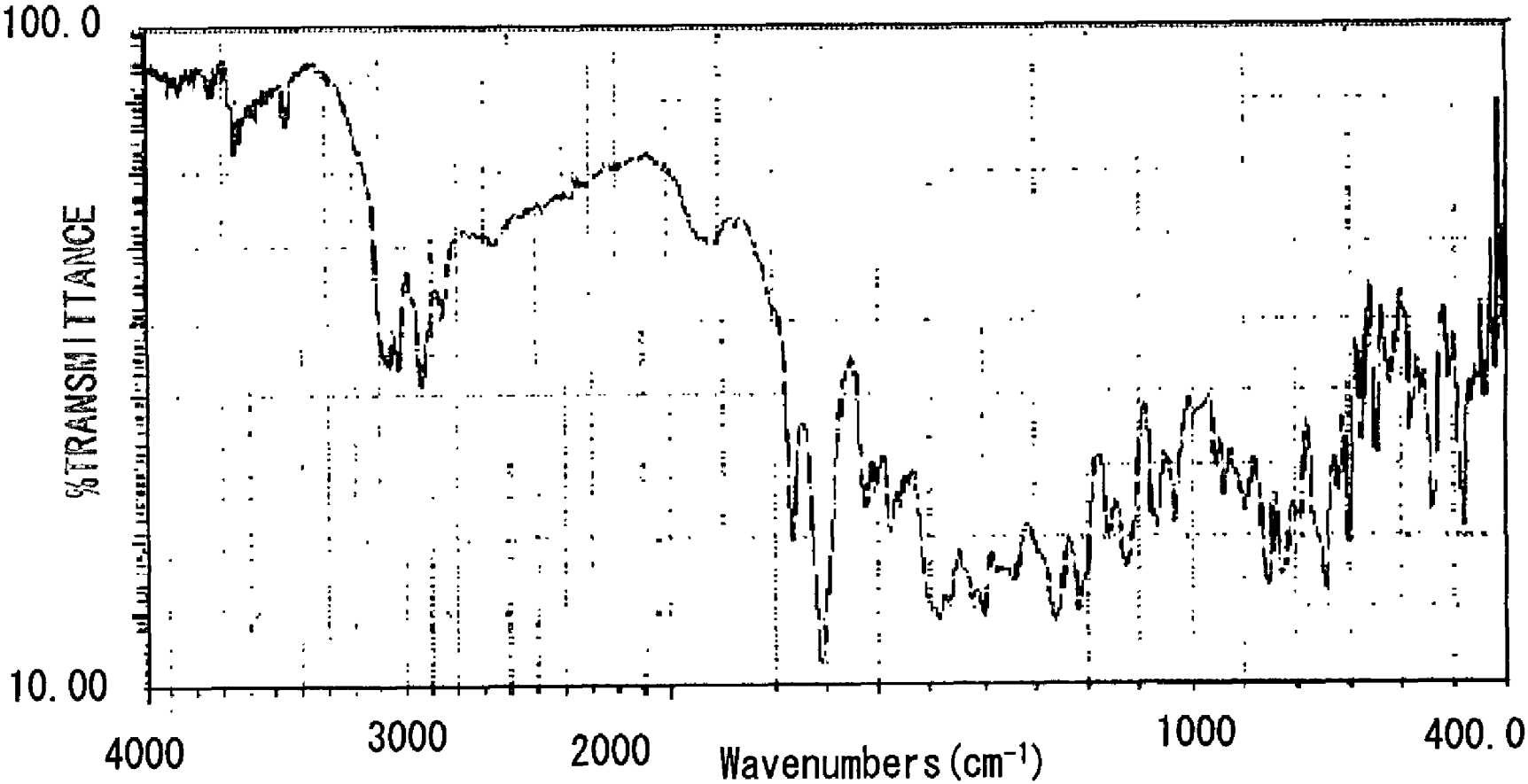
FIG. 11 is another view showing an infrared-absorbing spectrum of the azo compound (Example A-8) relating to the present invention.
Figure 12:
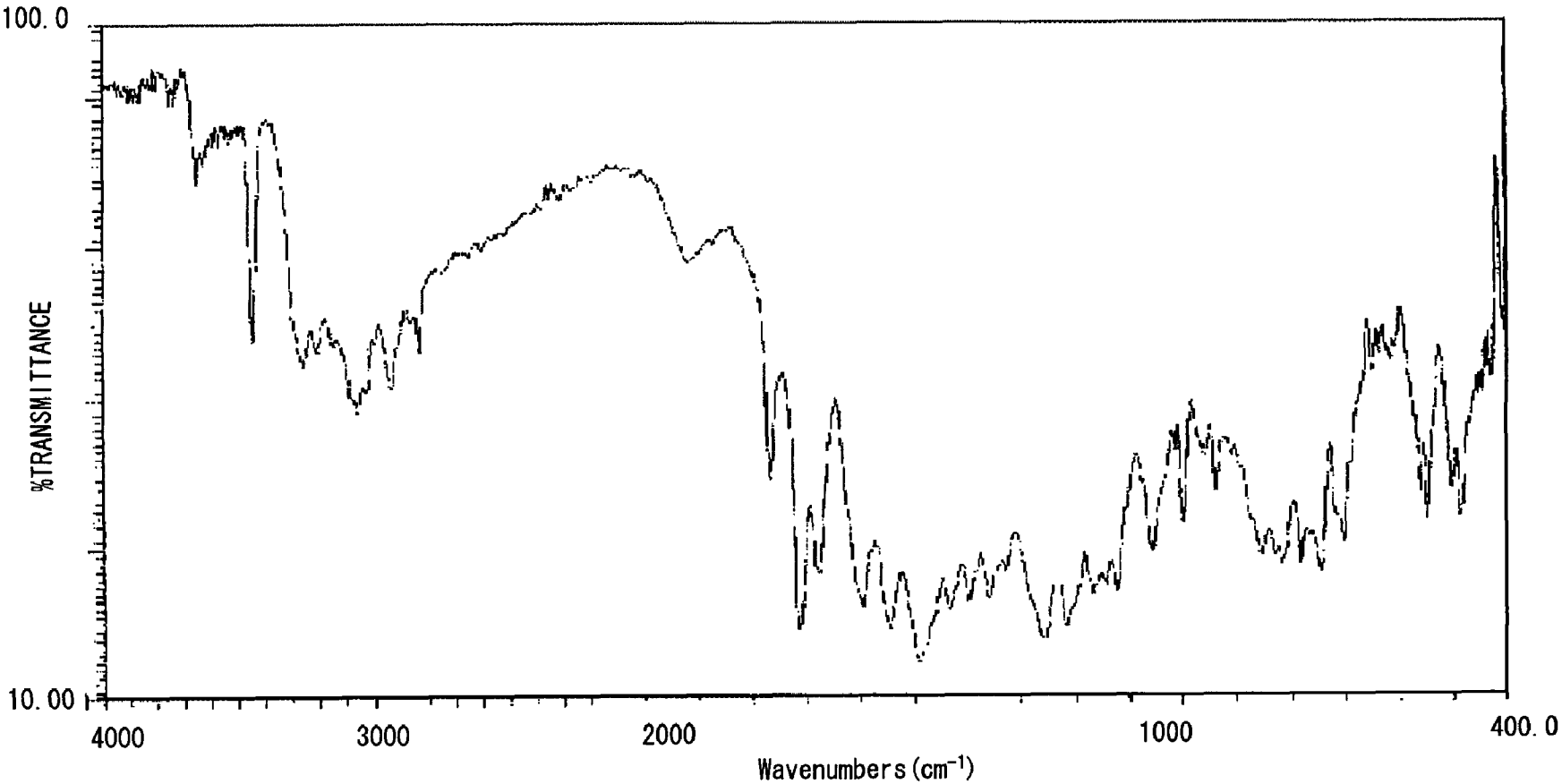
FIG. 12 is another view showing an infrared-absorbing spectrum of the azo compound (Example A-9) relating to the present invention.
Figure 13:
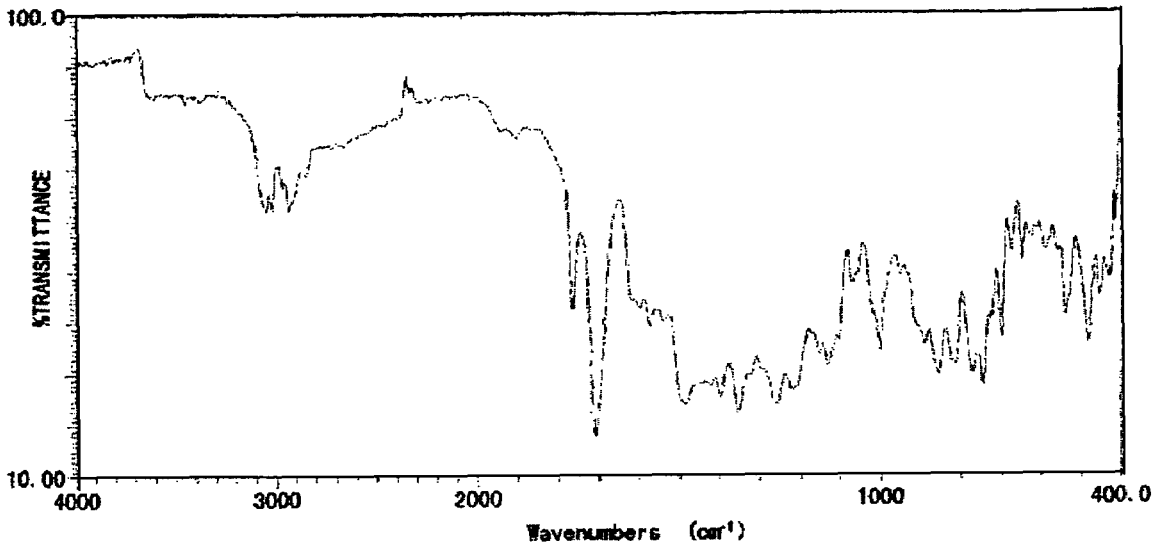
FIG. 13 is another view showing an infrared-absorbing spectrum of the azo compound (Example A-10) relating to the present invention.

| | | | Elemental Analysis(%) | | | |
|---|---|---|---|---|---|---|
| | Azo Compound | Yield(g) Yield(%) | C Actually Measured Value (C Calculated Value) | H Actually Measured Value (H Calculated Value) | N Actually Measured Value (N Calculated Value) | Infra-red Absorbing Spectrum Diagram |
| Example 1 | P3 | 0.82 | 73.81 | 3.33 | 11.73 | FIG. 4 |
| | | −58.2 | −74.19 | −3.65 | −11.93 | |
| Example 2 | P4 | 0.68 | 74.5 | 3.58 | 12.46 | FIG. 5 |
| | | −50.4 | −74.82 | −3.81 | −12.47 | |
| Example 3 | P20 | 0.86 | 74.39 | 3.65 | 11.48 | FIG. 6 |
| | | −74.7 | −74.52 | −3.96 | −11.59 | |
| Example 4 | P21 | 0.74 | 75.16 | 3.78 | 12.5 | FIG. 7 |
| | | −54 | −74.99 | −3.98 | −12.27 | |
| Example 5 | P27 | 0.82 | −75.07 | 4.04 | 11.33 | FIG. 8 |
| | | −54.9 | −74.84 | −4.26 | −11.26 | |
| Example 6 | P28 | 0.73 | 75.38 | 3.85 | 12.23 | FIG. 9 |
| | | −52.5 | −75.15 | −4.13 | −12.09 | |
| Example 7 | P169 | 0.78 | 74.52 | 4.08 | 12.02 | FIG. 10 |
| | | −49 | −74.78 | −4.28 | −11.89 | |
| Example 8 | P207 | 0.93 | 72.02 | 3.79 | 10.9 | FIG. 11 |
| | | −60.5 | −72.33 | −4.01 | −10.88 | |
| Example 9 | P209 | 0.75 | 71.94 | 3.74 | 11.78 | FIG. 12 |
| | | −46.3 | −72.25 | −3.92 | −11.67 | |
| Example 10 | P289 | 0.3 | 74.63 | 3.78 | 12.89 | FIG. 13 |
| | | −61.2 | −74.76 | −3.87 | −13.08 | |

(D-1)

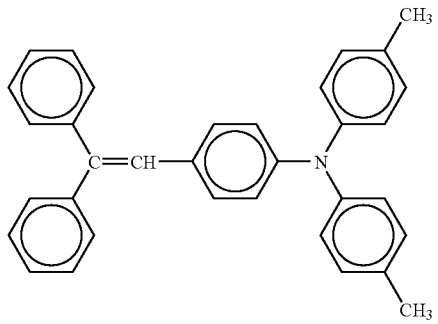

The electrophotographic photoconductor obtained above was electrified by performing a 6 kV corona discharge for 20 seconds at a dark place with Electrostatic copying paper testing equipment EPA-8200 (Kawaguchi Electric Works Co., Ltd.-made) in the environment at 25° C./55% RH. Subsequently, the photoconductor was further left at the dark place for 20 seconds, and then, the surface potential Vo (V) was measured. Next, the light was irradiated to the photoconductor so as to allow the intensity of illumination on the surface of the photoconductor to be 5.3 lux by a tungsten lamp to find a time (second) until the surface potential becomes ½ of Vo and exposure value E½ (lux·second) was calculated. The result was Vo=−1382 volts, E½=1.94 lux·seconds.

The manufacturing materials (coupler compounds) of the azo compounds relating to the present invention can be more easily manufactured than the conventional coupler compounds, and the azo compounds can be also easily manufactured by using this manufacturing material (coupler compound). High-sensitivity electrophotographic photoconductor can be provided by using the azo compounds relating to the present invention as the photosensitive layer material.

Next, the electrophotographic photoconductor relating to the present invention is described in Examples B to D. However, the synthesis examples, manufacturing examples and Examples here referred to never limit embodiments of the synthesis examples, manufacturing examples and examples relating to the present invention. In addition, Examples B, C and D use the following common synthesis examples and manufacturing examples.

common Synthesis Examples and Manufacturing Example of Examples B to D

Synthesis Example 1

Figure 14:
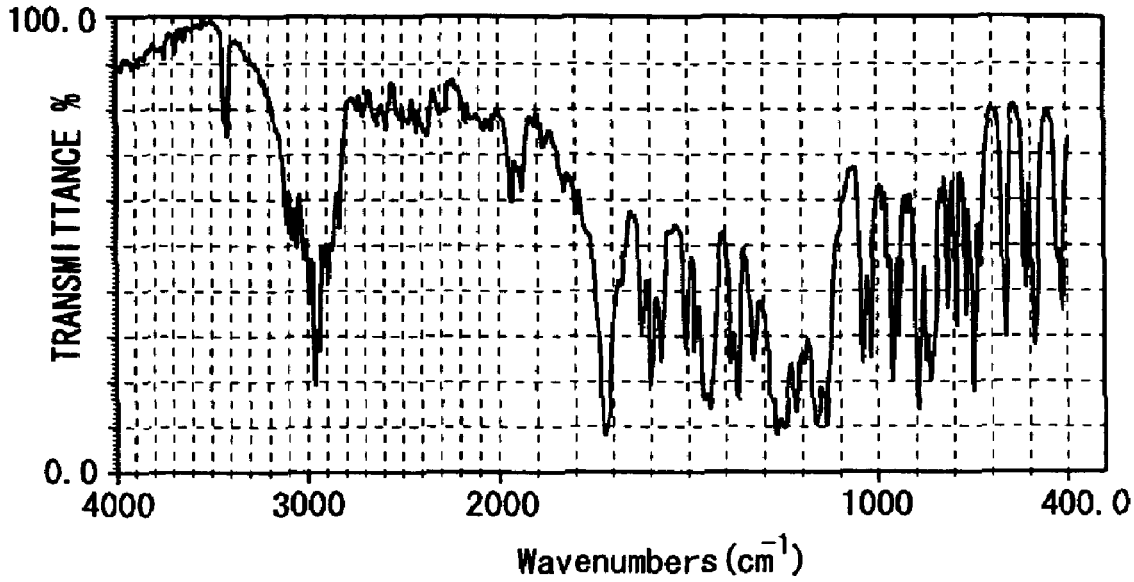
FIG. 14 is an infrared-absorbing spectrum view of the naphthalene compound used for the present invention obtained in Synthesis Example 1 in common with Examples B to D.

Synthesis of 2-(t-butoxy)-7,8-naphthalic acid dimethyl ester 35.25 g (0.2 mol) of p-t-Butoxystyrene and 56.84 g (0.4 mol) of acetylenedicarboxylic acid dimethyl ester were dissolved in 200 ml of nitrobenzene and the reaction was performed at 140° C. for 5 hours. After the solution was naturally cooled down, nitrobenzene was evaporated under reduced pressure, silicagel column chromatography (development solution, n-hexane:ethyl acetate=9:1) treatment was performed on the residue to obtain 40.78 g of a crude product. Further, the product was recrystallized from diisopropyl ether to obtain 36.63 g (yield: 57.9%) of the objective naphthalene compound. The melting point was 82.0 to 83.0° C. The infra-red absorbing spectrum is shown in FIG. 14 and the elemental analytical results are shown in Table 32.

TABLE 32

| | Elemental analytical values | |
|---|---|---|
| | C (%) | H (%) |
| Actually measured values | 68.32 | 6.46 |
| Calculated values | 68.34 | 6.37 |

Synthesis Example 2

Figure 15:
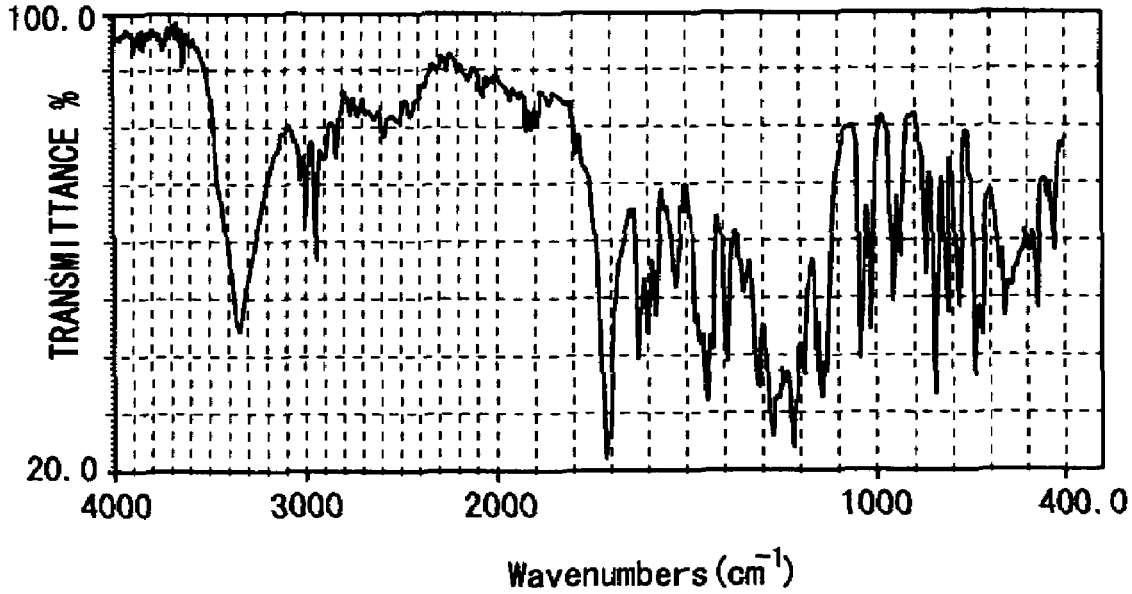
FIG. 15 is an infrared-absorbing spectrum view of the naphthalene compound used for the present invention obtained in Synthesis Example 2 in common with Examples B to D.

Synthesis of 2-hydroxy-7,8-naphthalic acid dimethyl ester 31.63 g (0.1 mol) of 2-(t-Butoxy)-7,8-naphthalic acid dimethyl ester obtained in Synthesis Example 1 was dissolved in 120 ml of methylene chloride, and 57.01 g (0.5 mol) of trifluoroacetic acid was dripped into the solution for 10 minutes while the solution was stirred at the room temperature. Next, the reaction was performed under the same conditions for 3 hours. Subsequently, the reactant was poured into the ice, and after the phases were separated by adding water, the methylene chloride phase was washed with water twice and was dehydrated by anhydrous magnesium sulfate, the residue after methylene chloride was recrystallized from toluene to obtain 24.31 g (yield: 93.4%) of the naphthalene compound. The melting point was 139.0 to 139.8° C. The infra-red absorbing spectrum is shown in FIG. 15 and the elemental analytical results are shown in Table 33.

TABLE 33

| Elemental analytical values | C (%) | H (%) |
|---|---|---|
| Actually measured values | 64.60 | 4.56 |
| Calculated values | 64.61 | 4.65 |

Synthesis Example 3

Synthesis of Coupler Compound No. C5

Figure 16:
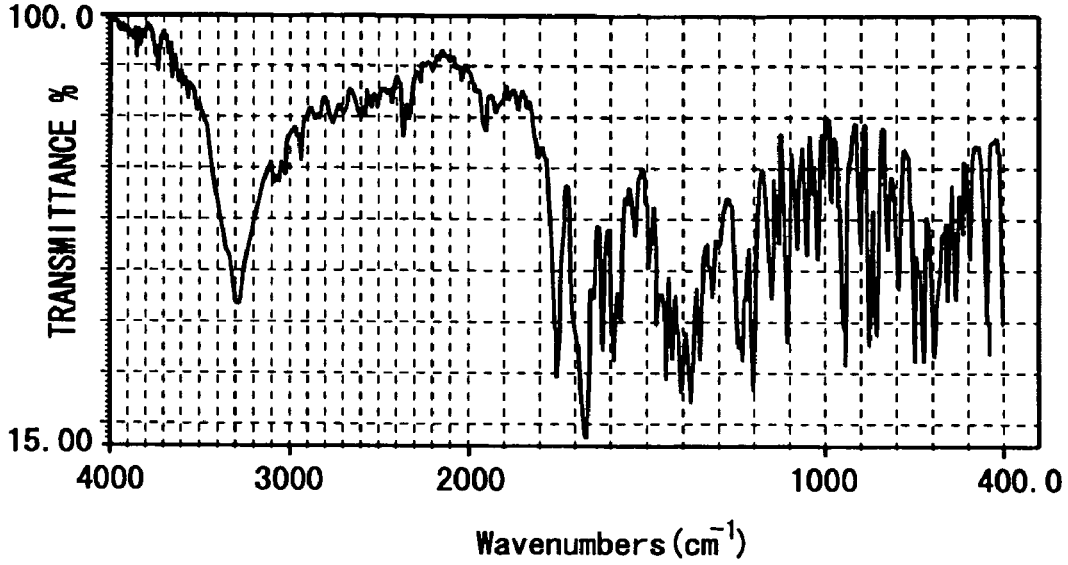
FIG. 16 is an infrared-absorbing spectrum view of the coupler compound used for the present invention obtained in Synthesis Example 3 in common with Examples B to D.

Stirring reaction was performed on 10.41 g (0.04 mol) of 2-hydroxy-7,8-naphthalic acid dimethyl ester obtained in Synthesis Example 2 and 8.57 g (0.08 mol) of benzylamine in 100 ml of ethyleneglycol at 140° C. for 6 hours under the stream of nitrogen gas. After the solution was cooled down, 400 ml of methanol was added to the reactant. After the solution was stirred at the room temperature for 1 hour, the crystal deposited was filtered and taken out and was dried under reduced pressure at 60° C. to obtain 10.21 g of the crude product. The obtained crude product was recrystallized from n-butanol to obtain 7.12 g (yield: 59.9%) of an orange coupler compound <No. C5>. The melting point was 258.0 to 259.5° C. The infra-red absorbing spectrum is shown in FIG. 16 and the elemental analytical results are shown in Table 34.

TABLE 34

| Elemental analytical values | C (%) | H (%) | N (%) |
|---|---|---|---|
| Actually measured values | 75.30 | 4.29 | 4.60 |
| Calculated values | 75.24 | 4.32 | 4.62 |

Manufacturing Example 1

Manufacture of Azo Compound No. P3

Figure 17:
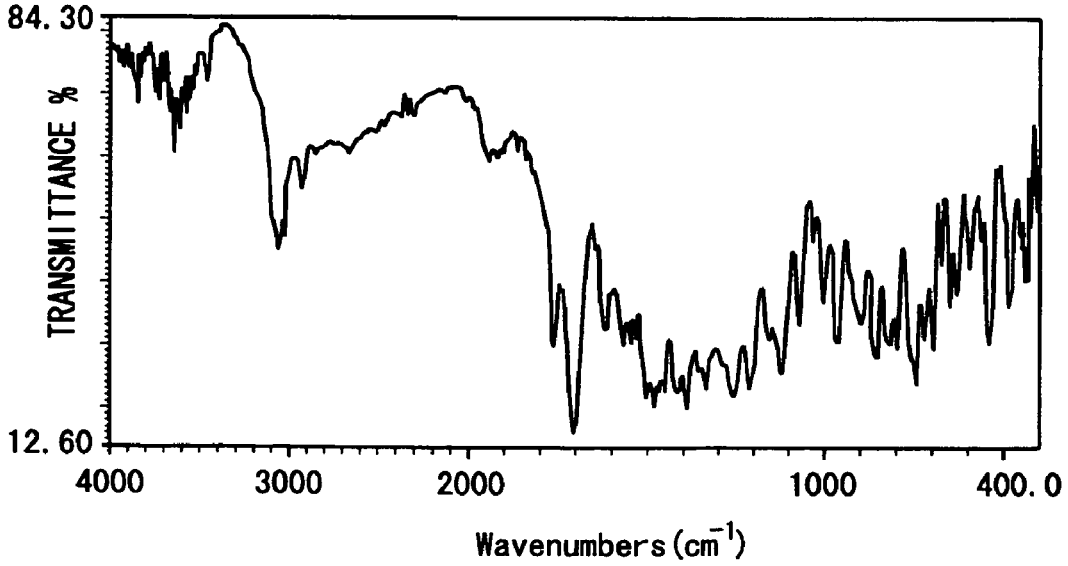
FIG. 17 is an infrared-absorbing spectrum view of the azo compound used for the present invention obtained in Manufacture Example 1 in common with Examples B to D.

0.91 g (3 mmol) of N-benzyl-2-hydroxy-7,8-naphthalic acid imide (Coupler Compound No. C5) obtained in Synthesis Example 3 was dissolved in 100 ml of DMF, and 0.76 g (1.5 mmol) of dibenzo [a,c]phenadine-2,7-bisdiazoniumtetrafluoroborate synthesized beforehand from 2,7-diaminodibenzo[a,c]phenadine was added to the solution at the room temperature. Next, 4.92 g of 10% by weight sodium acetate aqueous solution was dripped into the solution for 10 minutes and the solution was stirred at a room temperature for 6 hours. The produced precipitate was filtered and taken out, and the precipitate was washed with 120 ml of DMF three times at the room temperature and was washed with 120 ml of water twice. The precipitate was dried under reduced pressure at 70° C. to obtain 0.82 g (yield: 58.2%) of the azo compound (No. P3). The infra-red absorbing spectrum is shown in FIG. 17 and the elemental analytical results are shown in Table 35.

TABLE 35

| Elemental analytical values | C (%) | H (%) | N (%) |
|---|---|---|---|
| Actually measured values | 73.81 | 3.33 | 11.73 |
| Calculated values | 74.19 | 3.65 | 11.93 |

Manufacturing Example 2

Manufacture of Azo Compound No. P4

Figure 18:
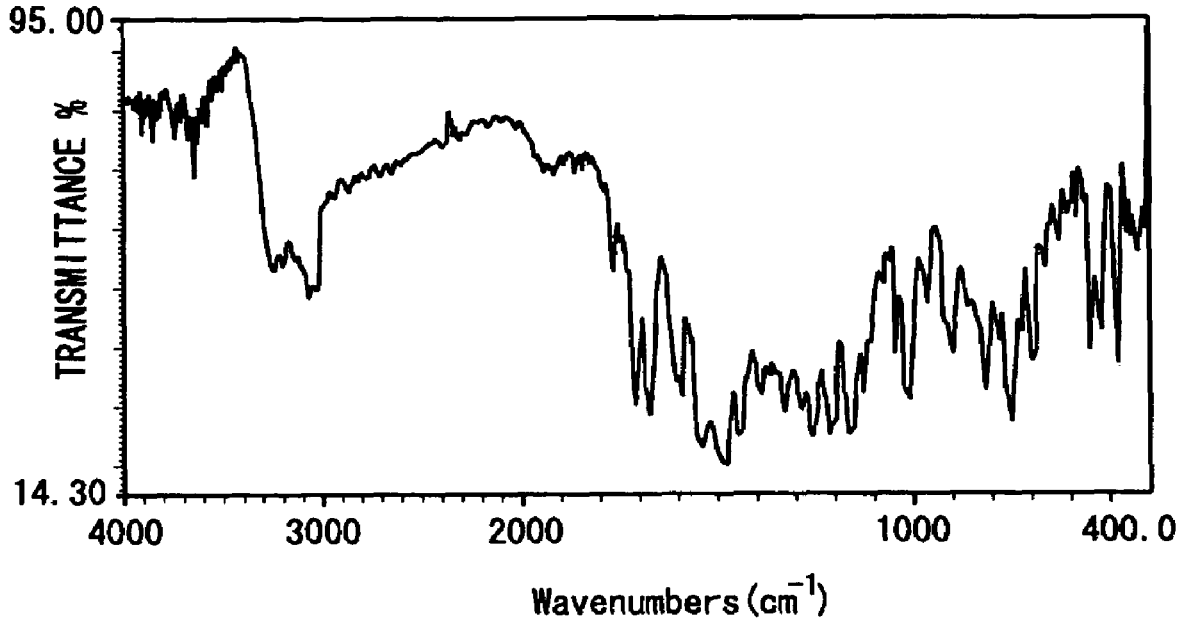
FIG. 18 is an infrared-absorbing spectrum view of the azo compound used for the present invention obtained in Manufacture Example 2 in common with Examples B to D.

0.46 g (1.5 mmol) of N-benzyl-2-hydroxy-7,8-naphthalic acid imide (Coupler Compound No. C5) was dissolved in 60 ml of DMF, and 0.76 g (1.5 mmol) of dibenzo[a,c]phenadine-2,7-bisdiazoniumtetrafluoroborate synthesized beforehand from 2,7-diaminodibenzo[a,c]phenadine was added to the solution at the room temperature. Then, the solution was stirred at the room temperature for 30 minutes. A solution comprising 0.39 g (1.5 mmol) of 2-hydroxy-3-phenylcarbamoylnaphthalene (Coupler Compound No. 17) and 40 ml of DMF was added to the solution. Next, 4.92 g of 10% by weight sodium acetate aqueous solution was dripped into the solution for 10 minutes and the solution was stirred at a room temperature for 6 hours. The produced precipitate was filtered and taken out, and the precipitate was washed with 120 ml of DMF three times at the room temperature and was washed with 120 ml of water twice. The precipitate was dried under reduced pressure at 70° C. to obtain 0.68 g (yield: 50.4%) of the azo compound (No. P4) No. P3). The infra-red absorbing spectrum is shown in FIG. 18 and the elemental analytical results are shown in Table 36.

TABLE 36

| Elemental analytical values | C (%) | H (%) | N (%) |
|---|---|---|---|
| Actually measured values | 74.50 | 3.58 | 12.46 |
| Calculated values | 74.82 | 3.81 | 12.47 |

Example B

Example B-1

7.5 parts by weight of the azo compound (No. P3) obtained in Manufacturing Example 1 and 500 parts by weight of 0.5% tetrahydrofuran solution comprising polyester resin (Viron 200: TOYOBO Co., Ltd.-made) were crushed and mixed in a ball mill. Then, the obtained dispersed liquid was coated on an aluminum vapor-deposited polyester film with a doctor blade and was naturally dried to form a charge-generating layer of about 1 μm in thickness. Next, a charge transport layer coating solution comprising 1 part by weight of α-phenyl-4'-bis(4-methylphenyl)aminostilbene (the charge transport material No. D3) as the charge transport material, 1 part by weight of polycarbonate resin (Panlite K1300: Teijin Chemicals Ltd-made), and 8 parts by weight of tetrahydrofuran was prepared. The charge transport layer coating solution was coated on the charge-generating layer with the doctor blade and was dried at 80° C. for 2 minutes and 120° C. for 5 minutes to form a charge-generating layer with about 20 μm in thickness, thereby the photoconductor was prepared.

Examples B-2 to 17

Except the use of the azo compounds and the charge transport material each shown in Table 37 in place of the azo compounds and the charge transport material used in Example B-1, the photoconductor was prepared in the same way as in Example B-1.

Comparative Example B-1

Except the use of the azo compounds expressed by the following Structural Formula (CGM-1) in place of the azo compounds used in Example B-1, the photoconductor was prepared in the same way as in Example B-1.

(CGM-1)

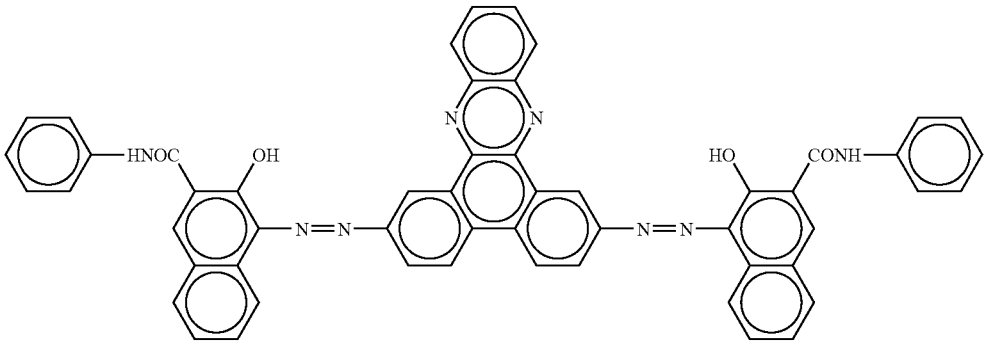

(Evaluation of Electrostatic Property)

After the electrophotographic photoconductor obtained above was electrified by performing a 6 kV corona discharge for 20 seconds at a dark place with Electrostatic copying paper testing equipment EPA-8200 (Kawaguchi Electric Works Co., Ltd.-made) in the environment at 25° C./55% RH, the photoconductor was further left at the dark place for 20 seconds, the surface potential Vo (V) was then measured. Next, light was irradiated to the photoconductor so as to allow the intensity of illumination on the surface of the photoconductor to be 5.3 lux by a tungsten lamp to find a time (second) until the surface potential becomes ½ of Vo and half-reduced exposure value E½ (lux second) was calculated as sensitivity in a visible range. The result was Vo=−1382 volts, E½=1.94 lux seconds. The results are shown in Table 37.

Charge transport material No. D1:

1-phenyl-3-(4-diethylaminostyryl)-5-(4-diethylaminopheny)pyrazoline

Charge transport material No. D2:

9-ethylcarbazole-3-aldehyde-1-methyl-1-henylhydrazone

Charge transport material No. D3: α-phenyl-4'-bis (4-methylphenyl)aminostilbene

Charge transport material No. D4: α-phenyl-4'-diphenylaminostilbene

TABLE 37

| | Azo compound No. | Charge transport material No. | Vo(−V) | E½(l · s) |
|---|---|---|---|---|
| Example 1 | P3 | D3 | 1454 | 2.01 |
| Example 2 | P3 | D1 | 1065 | 2.26 |
| Example 3 | P4 | D2 | 1262 | 3.53 |
| Example 4 | P20 | D1 | 1316 | 5.77 |
| Example 5 | P21 | D1 | 804 | 1.00 |
| Example 6 | P21 | D3 | 1403 | 3.01 |
| Example 7 | P27 | D1 | 1080 | 1.22 |
| Example 8 | P27 | D3 | 1382 | 1.94 |
| Example 9 | P28 | D1 | 991 | 1.12 |
| Example 10 | P169 | D4 | 720 | 3.77 |
| Example 11 | P207 | D3 | 1232 | 1.11 |
| Example 12 | P207 | D4 | 1256 | 1.85 |
| Example 13 | P209 | D2 | 980 | 4.03 |
| Example 14 | P96 | D3 | 1144 | 1.67 |
| Example 15 | P103 | D3 | 1129 | 1.43 |
| Example 16 | P124 | D3 | 1268 | 1.31 |
| Example 17 | P289 | D1 | 976 | 3.14 |

TABLE 37-continued

| | Azo compound No. | Charge transport material No. | Vo(−V) | E½(l · s) |
|---|---|---|---|---|
| Comparative Example 1 | CGM-1 | D3 | 573 | 4.78 |

(Chemical Durability Test)

The electrophotographic photoconductors prepared in Example B-1, Example B-6, Example B-8, Example B-11 and Comparative Example B-1 were left inside NOx gas (NO=40 ppm/$NO_2$=10 ppm) exposure testing equipment at the room temperature for 40 hours. Subsequently, for the electrophotographic photoconductors taken out from the equipment, electrostatic property was evaluated in the same way as in the condition before they were exposed to NOx gas, and rate of change of surface potential Vo (surface potential after exposed to NOx gas/surface potential before exposed to NOx gas) before and after exposed to NOx gas was calculated. The results are shown in Table 38.

TABLE 38

| | Rate of Change of Surface Potential Vo |
|---|---|
| Example 1 | 1.00 |
| Example 6 | 0.98 |
| Example 8 | 1.00 |
| Example 11 | 0.99 |
| Comparative Example 1 | 0.79 |

The results in Table 38 showed that no changes in surface potential were observed even after the photoconductors relating to the present invention were exposed to NOx gas and a stable electrostatic property.

Example B-18

Polyamide resin (CM-8000: Toray Industries, Inc.-made) dissolved in a mixed solvent of methanol/n-butanol=4:1 (volume ratio) was coated on the aluminum vapor-deposited polyester film with doctor blade and was dried at 100° C. for 5 minutes to provide an intermediate layer of 0.5 μm in thickness. Next, 7.5 parts by weight of the exemplified azo compound (No. P27) and 500 parts by weight of a tetrahydrofuran comprising 0.5% by weight of polyvinylbutyral resin (XYHL: Union Carbide Corp.-made) were crushed and mixed in the ball mill, and then the obtained dispersed liquid was coated on the intermediate layer with the doctor blade and was naturally dried to form a charge-generating layer of about 1 μm in thickness. Next, a charge transport layer coating solution comprising 1 part by weight of α-phenyl-4'-bis (4-methylphenyl) aminostilbene (the charge transport material No. D3), 1 part by weight of polycarbonate resin (PCX-5: Teijin Chemicals Ltd-made), 0.001 parts by weight of silicone oil (KF-50: Shin-Etsu Chemical Co., Ltd.-made) and 8 parts by weight of tetrahydrofuran was prepared, was coated on the charge-generating layer with the doctor blade and was dried at 80° C. for 2 minutes and 120° C. for 5 minutes to form a charge-generating layer of about 20 μm in thickness, thereby the photoconductor was prepared.

Example B-19

Except the use of the exemplified azo compound (No. P207) in place of the azo compounds used in Example B-18, the photoconductor was prepared in the same way as in Example B-18.

Comparative Example B-2

Except the use of the azo compounds expressed by the following Structural Formula (CGM-1) in place of the azo compounds used in Example B-18, the photoconductor was prepared in the same way as in Example B-18.

(Evaluation of Repeatability)

The electrophotographic photoconductors prepared in Example B-18, Example B-19 and Comparative Example B-2 were mounted on a drum rotating at a linear velocity of 260 mm/s, negative electrification, white exposure and light quench were respectively repeated 3,000 times, and the initial electrification potential, the electrification potential Vd (V) after 3,000 times and the post-exposure potential Vl (V) were measured. The results are shown in Table 39.

TABLE 39

| | Initial | | Potential after 3,000 times | |
|---|---|---|---|---|
| | Vd (−V) | VI (−V) | Vd (−V) | VI (−V) |
| Example 18 | 805 | 100 | 790 | 115 |
| Example 19 | 800 | 100 | 790 | 110 |
| Comparative Example 2 | 750 | 150 | 600 | 305 |

The results in Table 39 showed a very small change in potential fluctuation and a stable repeatability for the photoconductor relating to the present invention, even after 3,000 times.

Example C

Example C-1

A solution of polyamide resin (CM-8000: Toray Industries, Inc.-made) dissolved in a mixed solution of methanol/butanol was coated on the aluminum vapor-deposited polyester film with the doctor blade and was dried at 100° C. for 5 minutes to provide an intermediate layer of 0.5 μm in thickness. Next, after the material and a solution comprising 0.5 g of the azo compound (Exemplified Compound No. P3), 0.5 g of polycarbonate resin (PCX-5: Teijin Chemicals Ltd-made) and 19 g of tetrahydrofuran were dispersed in a ball mill, the charge transport material, the accepter compound, tetrahydrofuran and the silicone oil were added so as to allow the composition ratios to be 2% by weight of the azo compound, 50% by weight of polycarbonate resin, 30% by weight of the charge transport material expressed by the following Structural Formula (CTM-1), 18% by weight of the accepter compound expressed by the Structural Formula (Q-3) and 0.001% by weight of silicone oil (KF-50: Shin-Etsu Chemical Co., Ltd.-made), to prepare a photoconductor coating solution with 20% by weight of solid content. The photoconductor thus prepared was coated on the intermediate layer with the doctor blade, and was dried at 120° C. for 20 minutes to prepare a single-layer type electrophotographic photoconductor having a photoconductor of 20 μm in thickness.

Example C-2 to 9

Except the use of the azo compound, the charge transport material and the acceptor compound each shown in Table 40 in place of the charge transport material and the acceptor compound used in Example C-1, the photoconductor was prepared in the same way as in Example C-1.

(CTM-1)

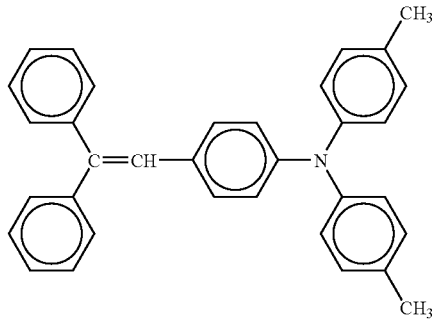

(CTM-2)

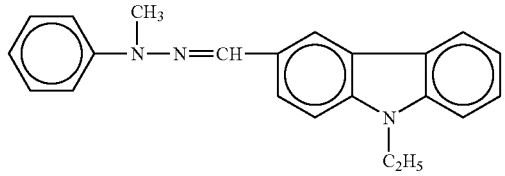

Example C-10

A solution of polyamide resin (CM-8000: Toray Industries, Inc.-made) dissolved in a mixed solution of methanol/butanol was coated on the aluminum vapor-deposited polyester film with the doctor blade and was dried at 100° C. for 5 minutes to provide an intermediate layer of 0.5 μm. Next, after the material and a solution comprising 0.5 g of the azo compound (Exemplified Compound No. P21), 0.5 g of polycarbonate resin (PCX-5: Teijin Chemicals Ltd-made) and 19 g of tetrahydrofuran were dispersed in a ball mill, the charge transport material, the accepter compound, the phenol compound, tetrahydrofuran and the silicone oil were added so as to allow the composition ratios of the azo compound to be 2% by weight, polycarbonate resin to be 47.5% by weight, the charge transport material expressed by the following Structural Formula (CTM-2) to be 30% by weight, the accepter compound expressed by the Structural Formula (Q-3) to be 18% by weight, the phenol compound expressed by the Structural Formula (E-2) to be 2.5% by weight and silicone oil (KF-50: Shin-Etsu Chemical Co., Ltd.-made) to be 0.001% by weight, to prepare a photoconductor coating solution with solid content of 20% by weight. The photoconductor thus prepared was coated on the intermediate layer with the doctor blade, and was dried at 120° C. for 20 minutes to prepare a single-layer type electrophotographic photoconductor having a photoconductor of 20 μm in thickness.

Example C-11 to 13

Except the use of the azo compound shown in Table 40 in place of the azo compound and the charge transport material used in Example C-10, the photoconductor was prepared in the same way as in Example C-10.

Comparative Example C-1

Except the use of the azo compound expressed by the following Structural Formula (CGM-1) in place of the azo compound used in Example C-1, the photoconductor was prepared in the same way as in Example C-1.

(CGM-1)

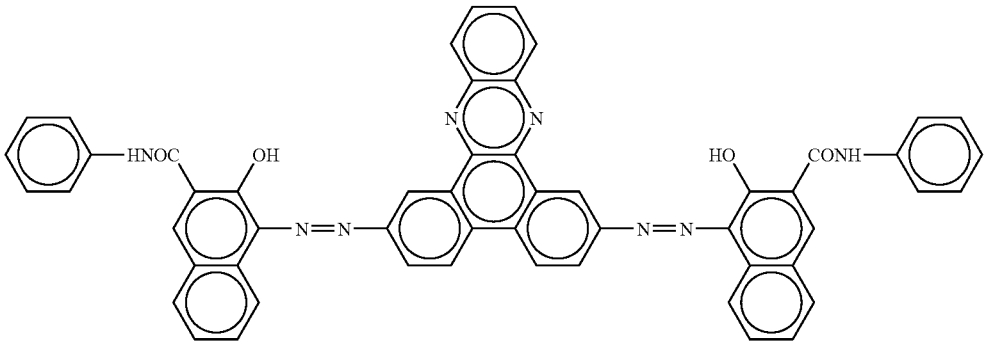

(Evaluation 1)

After the single-layer type electrophotographic photoconductors in Examples C-1 to 13 and Comparative Example C-1 were electrified by performing a 6 kV corona discharge for 20 seconds at a dark place with Electrostatic copying paper testing equipment EPA-8200 (Kawaguchi Electric Works Co., Ltd.-made) in the environment at 25° C./55% RH, the photoconductor was further left at the dark place for 20 seconds. Then, the surface potential Vo (V) was then measured, and next, light was irradiated to the photoconductor so as to allow the intensity of illumination on the surface of the photoconductor to be 5.3 lux by a tungsten lamp to find a time (second) until the surface potential becomes ½ of Vo and half-reduced exposure value E½ (lux second) was calculated as sensitivity in the visible range. The results are shown in Table 40.

TABLE 40

| | Azo compound | Charge Transport Material | Acceptor Compound | Phenol Compound | Vo(V) | E½(1 · s) |
|---|---|---|---|---|---|---|
| Example 1 | P3 | CTM-1 | Q-3 | — | 1301 | 1.60 |
| Example 2 | P4 | CTM-2 | Q-1 | — | 1306 | 3.03 |
| Example 3 | P20 | CTM-2 | Q-2 | — | 1434 | 4.10 |
| Example 4 | P27 | CTM-1 | Q-3 | — | 1412 | 1.52 |
| Example 5 | P96 | CTM-1 | Q-3 | — | 1289 | 1.55 |
| Example 6 | P103 | CTM-1 | Q-3 | — | 1305 | 1.31 |
| Example 7 | P124 | CTM-1 | Q-3 | — | 1366 | 1.19 |
| Example 8 | P169 | CTM-1 | Q-3 | — | 1036 | 3.41 |
| Example 9 | P209 | CTM-1 | Q-1 | — | 1149 | 3.11 |
| Example 10 | P21 | CTM-2 | Q-3 | E-2 | 1326 | 2.58 |
| Example 11 | P28 | CTM-2 | Q-3 | E-2 | 1400 | 2.59 |
| Example 12 | P207 | CTM-1 | Q-3 | E-2 | 1330 | 1.05 |
| Example 13 | P289 | CTM-1 | Q-3 | E-2 | 1365 | 2.78 |
| Comparative Example 1 | CGM-1 | CTM-1 | Q-3 | — | 809 | 4.77 |

(Evaluation 2)

The single-layer type photographic photoconductors in Example C-4, Example C-12 and Comparative Example C-1 were mounted on a drum rotating at a linear velocity of 260 mm/s, positive electrification, exposure and light quench were performed 5,000 times. Next, the initial electrification potential, the electrification potential Vd (V) after 5,000 times and the post-exposure potential VI (V) were measured. The results are shown in Table 41.

TABLE 41

| | Initial Potential | | Potential after 5,000 times | |
|---|---|---|---|---|
| | Vd (V) | V1 (V) | Vd (V) | V1 (V) |
| Example 4 | 800 | 110 | 790 | 130 |
| Example 12 | 800 | 100 | 790 | 115 |
| Comparative Example 1 | 780 | 145 | 620 | 295 |

Example D-1

A solution of polyamide resin (CM-8000: Toray Industries, Inc.-made) dissolved in a mixed solution of methanol/ butanol was coated on the aluminum vapor-deposited polyester film with the doctor blade and was dried at 100° C. for 5 minutes to provide an intermediate layer of 0.5 μm. Next, after the material and a solution comprising 0.5 g of the azo compound (Exemplified Compound No. P3), 0.5 g of the high-molecular charge transport material (Exemplified Compound No. 1D-01) and 19 g of tetrahydrofuran were dispersed in a ball mill, the high-molecular charge transport material, the accepter compound, tetrahydrofuran and the silicone oil were added so as to allow the composition ratios of the azo compound to be 2% by weight, the high-molecular charge transport material to be 80% by weight, the accepter compound expressed by the following Structural Formula (Q-3) to be 18% by weight, and silicone oil (KF-50: Shin-Etsu Chemical Co., Ltd.-made) to be 0.001% by weight, to prepare a photoconductor coating solution with solid content of 20% by weight. The photoconductor thus prepared was coated on the intermediate layer with the doctor blade, and was dried at 120° C. for 20 minutes to prepare a single-layer type electrophotographic photoconductor having a 20 μm thick photoconductor.

Examples D-2 to 6

Except the use of the azo compound, the high-molecular charge transport material and the acceptor compound each shown in Table 42 in place of the azo compound, the high-molecular charge transport material and the acceptor compound used in Example D-1, the photoconductor was prepared in the same way as in Example D-1.

Example D-7

A solution of polyamide resin (CM-8000: Toray Industries, Inc.-made) dissolved in a mixed solution of methanol/butanol was coated on the aluminum vapor-deposited polyester film with the doctor blade and was dried at 100° C. for 5 minutes to provide an intermediate layer of 0.5 μm. Next, after the material and a solution comprising 0.5 g of the azo compound (Exemplified Compound No. P21), the 0.5 g of high-molecular charge transport material (Exemplified Compound No. 11D-04) and 19 g of tetrahydrofuran were dispersed in a ball mill, the high-molecular charge transport material, the accepter compound, the phenol compound, tetrahydrofuran and the silicone oil were added so as to allow the composition ratios of the azo compound to be 2% by weight, the high-molecular charge transport material to be 77.5% by weight, the accepter compound expressed by the following Structural Formula (Q-3) to be 18% by weight, the phenol compound expressed by the Structural Formula (E-2) to be 2.5% by weight and silicone oil (KF-50: Shin-Etsu Chemical Co., Ltd.-made) to be 0.001% by weight, to prepare a photoconductor coating solution with solid content of 20% by weight. The photoconductor thus prepared was coated on the intermediate layer with the doctor blade, and was dried at 120° C. for 20 minutes to prepare a single-layer type electrophotographic photoconductor having a photoconductor of 20 μm in thickness.

Examples D-8 to 13

Except the use of the azo compound shown in Table 42 in place of the azo compound and the high-molecular charge transport material used in Example D-7, the photoconductor was prepared in the same way as in Example D-7.

Comparative Example D-1

Except the use of the azo compound expressed by the following Structural Formula (CGM-1) in lace of the azo compound used in Example D-1, the photoconductor was prepared in the same way as in Example D-1.

TABLE 42

(CGM-1)

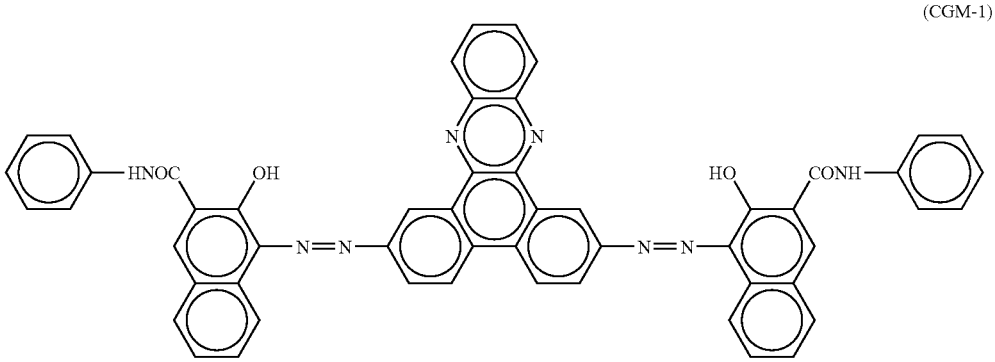

| | Azo compound | Charge Transport Material | Acceptor Compound | Phenol Compound |
|---|---|---|---|---|
| Example1 | P3 | 1D-01 | Q-3 | — |
| Example2 | P4 | 5D-03 | Q-1 | — |
| Example3 | P20 | 3D-01 | Q-2 | — |
| Example4 | P27 | 2D-08 | Q-3 | — |
| Example5 | P169 | 7D-01 | Q-3 | — |
| Example6 | P209 | 9D-01 | Q-1 | — |
| Example7 | P21 | 11D-04 | Q-3 | E-2 |
| Example8 | P28 | 10D-01 | Q-3 | E-2 |
| Example9 | P96 | 8D-01 | Q-3 | E-2 |
| Example10 | P103 | 6D-01 | Q-3 | E-2 |
| Example11 | P124 | 4D-01 | Q-3 | E-2 |

TABLE 42-continued (CGM-1)

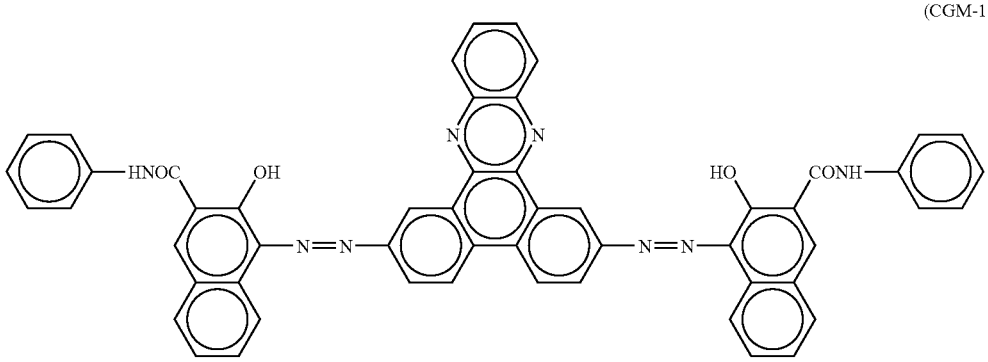

| | Azo compound | Charge Transport Material | Acceptor Compound | Phenol Compound |
|---|---|---|---|---|
| Example12 | P207 | 11D-02 | Q-3 | E-2 |
| Example13 | P289 | 2D-17 | Q-3 | E-2 |
| Comparative Example1 | CGM-1 | 1D-01 | Q-3 | — |

(Evaluation 1)

After the single layer-type electrophotographic photoconductors in Embodiments D-1 to 13 and Comparative Example D-1 were electrified by performing a 6 kV corona discharge for 20 seconds at a dark place with Electrostatic copying paper testing equipment EPA-8200 (Kawaguchi Electric Works Co., Ltd.-made) in the environment at 25° C./55% RH, the photoconductors were further left at the dark place for 20 seconds, the surface potential Vo (V) was then measured, next, light was irradiated to the photoconductors so as to allow the intensity of illumination on the surfaces of the photoconductors to be 5.3 lux by a tungsten lamp to find a time (second) until the surface potential becomes ½ of Vo and half-reduced exposure value E½ (lux second) was calculated as sensitivity in the visible range. Subsequently, abrasion test of 3,000 revolutions with load of 1 kg was performed on the surfaces of the photoconductors by using CS-5 abrasion ring in Taper Abrasion Tester (Toyo Seiki Co., Ltd.-made) according to JIS K7204 (1995). The results are shown in Table 43.

TABLE 43

| | Vo (V) | E½ (I · S) | Quantity of abrasion (mg) |
|---|---|---|---|
| Enbodiment 1 | 1322 | 1.62 | 5.9 |
| Enbodiment 2 | 1330 | 2.98 | 3.5 |
| Enbodiment 3 | 1381 | 4.00 | 5.7 |
| Enbodiment 4 | 1389 | 1.33 | 6.3 |
| Enbodiment 5 | 1145 | 3.21 | 4.1 |
| Enbodiment 6 | 1251 | 3.02 | 2.7 |
| Enbodiment 7 | 1373 | 2.45 | 3.0 |
| Enbodiment 8 | 1395 | 2.60 | 4.5 |
| Enbodiment 9 | 1231 | 1.56 | 3.3 |
| Enbodiment 10 | 1238 | 1.39 | 6.9 |
| Enbodiment 11 | 1360 | 1.21 | 5.2 |
| Enbodiment 12 | 1343 | 1.00 | 2.0 |
| Enbodiment 13 | 1300 | 2.10 | 2.5 |
| Comparative Example 1 | 911 | 5.18 | 8.8 |

(Evaluation 2)

The single-layer type photographic photoconductors in Example D-4, Example C-12 and Comparative Example C-1 were mounted on a drum rotating at a linear velocity of 260 mm/s, positive electrification, exposure and light quench were performed 5,000 times. Next, the initial electrification potential, the electrification potential Vd (V) after 5,000 times and the post-exposure potential VI (V) were measured. The results are shown in Table 44.

TABLE 44

| | Initial Potential | | Potential after 5,000 times | |
|---|---|---|---|---|
| | Vd (V) | V1 (V) | Vd (V) | V1 (V) |
| Example 4 | 800 | 100 | 790 | 130 |
| Example 12 | 800 | 100 | 790 | 120 |

What is claimed is:

1. An electrophotographic photoconductor, comprising:

a photoconductive layer on a conductive support, wherein the electrophotographic photoconductor contains an azo compound expressed by Formula (1)

(1)

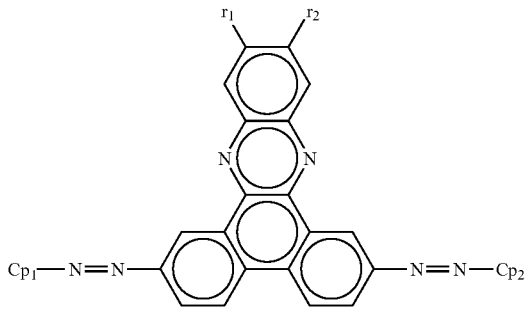

-continued (2)

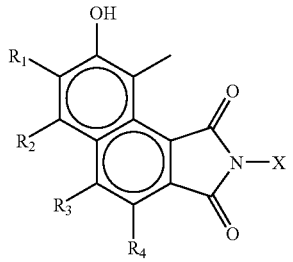

(3)

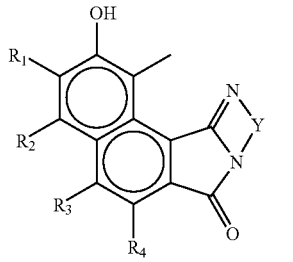

(4)

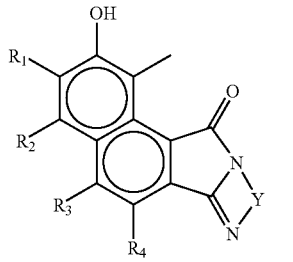

wherein, in Formula (1), $r_1$ and $r_2$ represent one of hydrogen atom, alkyl group, alkoxy group, halogen atom, nitro group, amino group, cyano group, acetyl group, benzoyl group which may have a substituent, carboxyl group, alkoxycarbonyl group, phenoxycarbonyl group which may have a substituent and aryl group which may have a substituent, $CP_1$ and $CP_2$ represent a coupler residue, and at least one of the $CP_1$ and the $CP_2$ is a coupler residue selected from a group consisting of Formula (2), Formula (3) and Formula (4), wherein, in Formula (2), Formula (3) and Formula (4), $R_1$, $R_2$, $R_3$ and $R_4$ represent one of hydrogen atom, alkyl group, alkoxy group, halogen atom, amino group, hydroxy group, nitro group, cyano group, acetyl group, benzoyl group which may have a substituent, alkoxycarbonyl group, phenoxycarbonyl group which may have a substituent and carbamoyl group which may have a substituent, provided that $R_1$ and $R_2$ may be mutually bonded to form one of a substituted or non-substituted ring by alkylene group, a substituted or non-substituted unsaturated aliphatic ring and a substituted or non-substituted aromatic ring, X represents one of hydrogen atom, a substituted or non-substituted alkyl group, a substituted or non-substituted cycloalkyl group, a substituted or non-substituted aromatic hydrocarbon group, a substituted or non-substituted heterocyclic group and a substituted or non-substituted amino group, and Y represents one of a substituted or non-substituted alkylene group, a substituted or non-substituted cycloalkylene group, a substituted or non-substituted aralkylene group, a substituted or non-substituted bivalent organic residue having aromaticity, a substituted or non-substituted bivalent organic residue having heterocyclic aromaticity, bivalent organic residue containing carbonyl group expressed by —CO-Z-, provided that Z represents one of a substituted or non-substituted alkylene, a substituted or non-substituted cycloalkylene, a substituted or non-substituted bivalent organic residue having aromaticity and a substituted or non-substituted bivalent organic residue having heterocyclic aromaticity.

2. An electrophotographic photoconductor according to claim 1, wherein at least one of said $CP_1$ and said $CP_2$ is a coupler residue expressed by Formula (5) in the azo compounds expressed by said Formula (1)

(5)

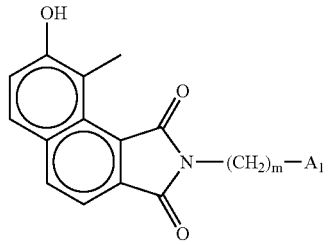

wherein, $A_1$ represents one of a substituted or non-substituted aromatic hydrocarbon group or a substituted or non-substituted heterocyclic group, and m represents the integer of 1 to 6.

3. An electrophotographic photoconductor according to claim 1, wherein at least one of said $CP_1$ and said $CP_2$ is a coupler residue expressed by one of Formula (6) and Formula (7) in the azo compounds expressed by said Formula (1)

(6)

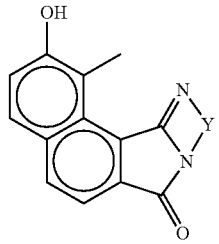

(7)

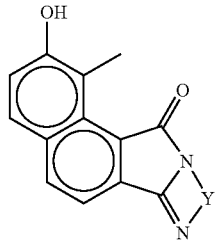

wherein,

Y represents one of a substituted or non-substituted alkylene group, a substituted or non-substituted cycloalkylene group, a substituted or non-substituted aralkylene group, a substituted or non-substituted bivalent organic residue having aromaticity, and a substituted or non-substituted bivalent organic residue having heterocyclic aromaticity, a substituted or non-substituted bivalent organic residue having heterocyclic aromaticity, bivalent organic residue containing carbonyl group expressed by —CO-Z-, provided that Z represents one of a substituted or non-substituted alkylene, a substituted or non-substituted cycloalkylene, a substituted or non-substituted bivalent organic residue having aromaticity and a substituted or non-substituted bivalent organic residue having heterocyclic aromaticity.

4. An electrophotographic photoconductor according to claim 1, wherein at least one of said $CP_1$ and said $CP_2$ is a coupler residue expressed by Formula (8) in the azo compounds expressed by said Formula (1)

(8)

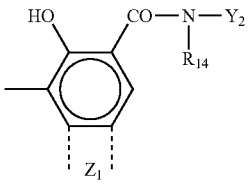

wherein, $Z_1$ represents one of a bivalent organic residue which condenses with a benzene ring to form a substituted or non-substituted hydrocarbon ring and a bivalent organic residue which condenses with a benzene ring to form a substituted or non-substituted heterocyclic ring, $R_{14}$ represents one of hydrogen atom, a substituted or non-substituted alkyl group and a substituted or non-substituted phenyl group, and $Y_2$ represents one of a substituted or non-substituted hydrocarbon ring group and a substituted or non-substituted heterocyclic ring.

5. An electrophotographic photoconductor according to claim 1, wherein at least one of said $CP_1$ and said $CP_2$ is a coupler residue expressed by one of Formula (9) and Formula (10) in the azo compounds expressed by said Formula (1)

(9)

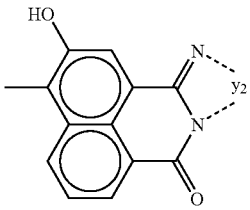

(10)

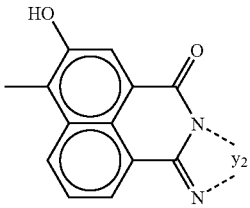

wherein, $y_2$ represents one of a bivalent group of aromatic hydrocarbon and a bivalent group of heterocyclic group containing nitrogen atom, wherein the rings may be either substituted or non-substituted.

6. An electrophotographic photoconductor according to claim 1, wherein the azo compound expressed by said Formula (1) is an azo compound obtained by allowing a diazonium compound expressed by Formula (11) to react with a coupler compound expressed by Formula (12)

(11)

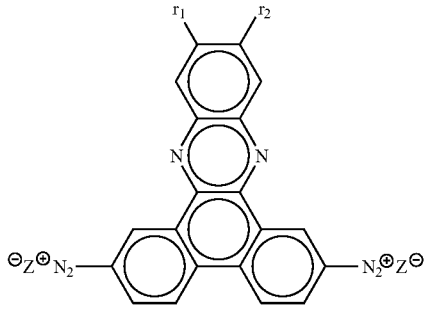

(12)

H—Cp wherein, in Formula (11), $r_1$ and $r_2$ represent one of hydrogen atom, alkyl group, alkoxy group, halogen atom and nitro group, and z- represents an anion functional group and wherein, in Formula (12)

Cp represents a coupler residue.

7. An electrophotographic photoconductor according to claim 1, wherein the photoconductive layer contains a charge-generating material and a charge transport material, and the charge-generating material is an azo compound expressed by Formula (1).

8. An electrophotographic photoconductor according to claim 1 which is a single layer-type electrophotographic photoconductor, wherein a single layer photoconductive layer is provided on the electroconductive support directly or through an intermediate layer.

9. An electrophotographic photoconductor according to claim 8, wherein said photoconductive layer further comprising a charge transport material.

10. An electrophotographic photoconductor according to claim 9, wherein said charge transport material is a stilbene compound expressed by Formula (T19)

(T19)

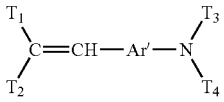

wherein, $T_1$ and $T_2$ independently represent one of a substituted or non-substituted alkyl group or a substituted or non-substituted aryl group, and $T_3$ and $T_4$ independently represent one of hydrogen atom, a substituted or non-substituted alkyl or a substituted or non-substituted aryl group and heterocyclic group, wherein $T_1$ and $T_2$ may be mutually bonded to form a ring, and Ar' represents one of a substituted or non-substituted aryl group and heterocyclic group.

11. An electrophotographic photoconductor according to claim 8, wherein said photoconductive layer further contains an acceptor compound.

12. An electrophotographic photoconductor according to claim 11, wherein said acceptor compound is a 2,3-diphenylindene compound expressed by the following formula

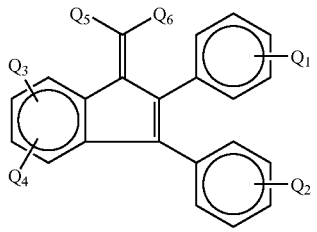

wherein, $Q_1$, $Q_2$, $Q_3$ and $Q_4$ represent one of hydrogen atom, a substituted or non-substituted alkyl group, cyano group and nitro group, and $Q_5$ and $Q_6$ represent one of a hydrogen atom-substituted or non-substituted aryl group, cyano group, alkoxycarbonyl group and aryloxycarbonyl group.

13. An electrophotographic photoconductor according to claim 8, wherein said photoconductive layer further contains a phenol compound.

14. An electrophotographic photoconductor according to claim 13, wherein said phenol compound is a phenol compound expressed by the following formula

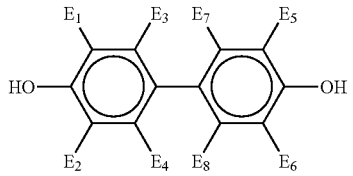

wherein, $E_1$, $E_2$, $E_3$, $E_4$, $E_5$, $E_6$, $E_7$ and $E_8$ represent one of hydrogen atom, a substituted or non-substituted alkyl group or non-substituted alkyl, a substituted or non-substituted or non-substituted alkoxycarbonyl group, a substituted or non-substituted aryl group and a substituted or non-substituted alkoxy group.

15. An electrophotographic photoconductor according to claim 9, wherein said charge transport material is a high-molecular charge transport material.

16. An electrophotographic photoconductor according to claim 15, wherein said high-molecular transport material is a polymer of at least one of polycarbonate, polyurethane, polyester and polyether.

17. An electrophotographic photoconductor according to claim 16, wherein said high-molecular charge transport material is a high-molecular compound having a triarylamine structure.

18. An electrophotographic photoconductor according to claim 17, wherein said high-molecular charge transport material is a polycarbonate having a triarylamine structure.

19. An electrophotographic photoconductor according to claim 18, wherein said high-molecular charge transport material is a polycarbonate having a triarylamine structure expressed by the following Formula (1)

(1D)

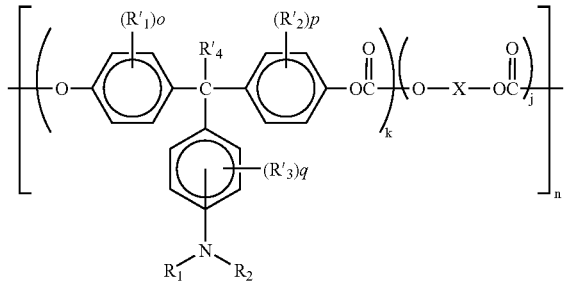

wherein, $R'_1$, $R'_2$ and $R'_3$ independently represent one of a substituted or non-substituted alkyl group and halogen atom, and $R'_4$ represents hydrogen atom or represent a substituted or non-substituted alkyl group, $R_1$ and $R_2$ represent a substituted or non-substituted aryl group, o, p and q independently represent the integer of 0 to 4, k and j represent the compositions, where $0.1 \leqq k \leqq 1$ and $0 \leqq 1 \leqq 0.9$, and n represents a repeating unit and is the integer of 5 to 5,000, X represents one of the bivalent group of an aliphatic group, and a bivalent group expressed by the following Formula (A)

(A)

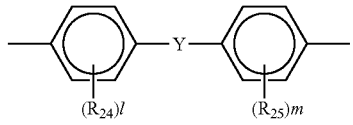

wherein, $R_{24}$ and $R_{25}$ independently represent one of a substituted or non-substituted alkyl group, aryl group and halogen atom, and l and m represent the integer of 0 to 4, Y represents one of a single bond, a straight chain, branched or cyclic alkylene group with 1 to 12 carbon atoms, —O—, —S—, —SO—, —$SO_2$—, —CO—, —CO—O-Z-O-—CO—, wherein, Z represents an aliphatic bivalent group, and the following Formula (B)

(B)

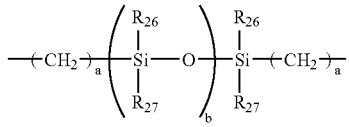

wherein, a represents the integer of 1 to 20, and b represents the integer of 1 to 2,000. $R_{26}$ and $R_{27}$ represent one of a substituted or non-substituted alkyl group and aryl group and $R_{24}$, $R_{25}$, $R_{26}$, $R_{27}$ may be identical or different.

20. An electrophotographic photoconductor according to claim 18, wherein said high-molecular transport material is a polycarbonate having a triarylamine structure expressed by the following Formula (2D)

(2D)

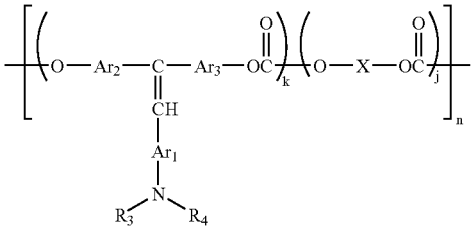

wherein, $R_3$ and $R_4$ represent a substituted or non-substituted aryl group, and $Ar_1$, $Ar_2$ and $Ar_3$ represent the same or different allylene group, k and j represent the compositions where $0.1 \leqq k \leqq 1$ and $0 \leqq j \leqq 0.9$, and n represents a repeating unit and is the integer of 5 to 5,000, X represents one of an aliphatic bivalent group, and a bivalent group expressed by the following Formula (A)

(A)

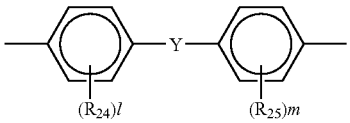

wherein, $R_{24}$ and $R_{25}$ independently represent one of a substituted or non-substituted alkyl group, aryl group and halogen atom, and l and m represent the integer of 0 to 4, Y represents one of a single bond, a straight chain, branched or cyclic alkylene group with 1 to 12 carbon atoms, —O—, —S—, —SO—, —$SO_2$—, —CO—, —CO—O-Z-O—CO—, wherein, Z represents the bivalent group of an aliphatic group, and the following Formula (B)

(B)

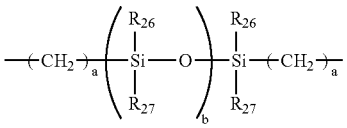

wherein, a represents the integer of 1 to 20, and b represents the integer of 1 to 2,000, $R_{26}$ and $R_{27}$ represent one of a substituted or non-substituted alkyl group and aryl group and $R_{24}$, $R_{25}$, $R_{26}$, $R_{27}$ may be identical or different.

21. An electrophotographic photoconductor according to claim 18, wherein said high-molecular transport material is a polycarbonate having a triarylamine structure expressed by the following Formula (3)

(3D)

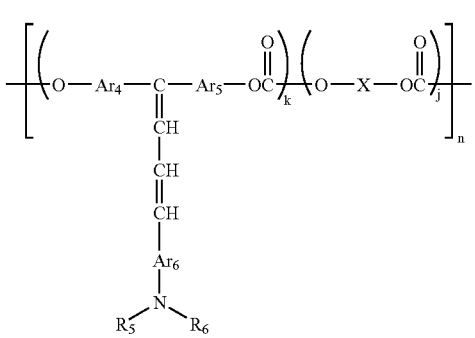

wherein, $R_5$ and $R_6$ represent a substituted or non-substituted aryl group, $Ar_4$, $Ar_5$ and $Ar_4$ represent the same or different allylene group, k and j represent the compositions where $0.1 \leqq k \leqq 1$ and $0 \leqq j \leqq 0.9$, and n represents a repeating unit and is the integer of 5 to 5,000, X represents one of an aliphatic bivalent group, and a bivalent group expressed by the following Formula (A)

(A)

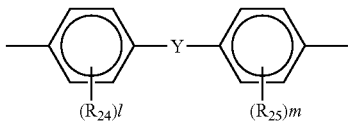

wherein, $R_{24}$ and $R_{25}$ independently represent one of a substituted or non-substituted alkyl group, aryl group and halogen atom, and l and m represent the integer of 0 to 4, Y represents one of a single bond, a straight chain, branched or cyclic alkylene group with 1 to 12 carbon atoms, —O—, —S—, —SO—, —$SO_2$—, —CO—, —CO—O-Z-O—C—, wherein, Z represents an aliphatic bivalent group, and the following Formula (B)

(B)

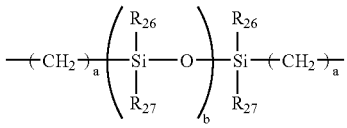

wherein, a represents the integer of 1 to 20, and b represents the integer of 1 to 2,000, $R_{26}$ and $R_{27}$ represent one of a substituted or non-substituted alkyl group and aryl group, $R_{24}$, $R_{25}$, $R_{26}$, $R_{27}$ may be identical or different.

22. An electrophotographic photoconductor according to claim 18, wherein said high-molecular transport material is a polycarbonate having a triarylamine structure expressed by the following Formula (4D)

(4D)

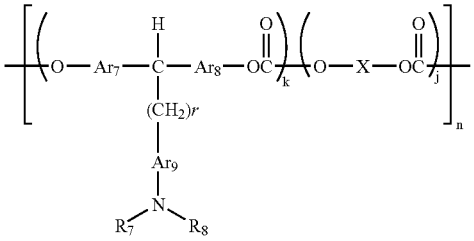

wherein, $R_7$ and $R_8$ represent a substituted or non-substituted aryl group, and $Ar_7$, $Ar_8$ and $Ar_9$ represent the same or different allylene group, k and j represent the compositions where $0.1 \leqq k \leqq 1$ and $0 \leqq j \leqq 0.9$, and n represents a repeating unit and is the integer of 5 to 5,000, r represents the integer of 1 to 5, X represents one of an aliphatic bivalent group, and a bivalent group expressed by the following Formula (A)

(A)

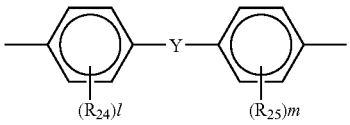

wherein, $R_{24}$ and $R_{25}$ independently represent one of a substituted or non-substituted alkyl group, aryl group and halogen atom, and l and m represent the integer of 0 to 4, Y represents one of a single bond, a straight chain, branched or cyclic alkylene group with 1 to 12 carbon atoms, —O—, —S—, —SO—, —$SO_2$—, —CO—, —CO—O-Z—O—CO—, wherein, Z represents an aliphatic bivalent group, and the following Formula (B)

(B)

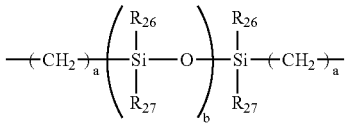

wherein, a represents the integer of 1 to 20, and b represents the integer of 1 to 2,000, $R_{26}$ and $R_{27}$ represent one of a substituted or non-substituted alkyl group and aryl group, $R_{24}$, $R_{25}$, $R_{26}$, $R_{27}$ may be identical or different.

23. An electrophotographic photoconductor according to claim 18, wherein said high-molecular transport material is a polycarbonate having a triarylamine structure expressed by the following Formula (5D)

(5D)

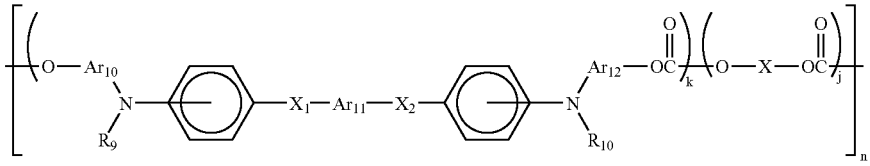

wherein, $R_7$ and $R_8$ represent a substituted or non-substituted aryl group, and $Ar_7$, $Ar_8$ and $Ar_9$ represent the same or different allylene group, k and j represent the compositions where $0.1 \leqq k \leqq 1$ and $0 \leqq j \leqq 0.9$, and n represents a repeating unit and is the integer of 5 to 5,000, r represents the integer of 1 to 5, X represents one of an aliphatic bivalent group, and a bivalent group expressed by the following Formula (A)

(A)

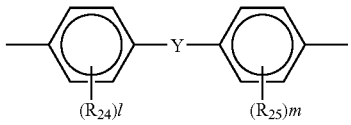

wherein, $R_{24}$ and $R_{25}$ independently represent one of a substituted or non-substituted alkyl group, aryl group and halogen atom, and l and m represent the integer of 0 to 4, Y represents one of a single bond, a straight chain, branched or cyclic alkylene group with 1 to 12 carbon atoms, —O—, —S—, —SO—, —$SO_2$—, —CO—, —CO—O-Z-O—CO—, wherein, Z represents an aliphatic bivalent group, and the following Formula (B)

(B)

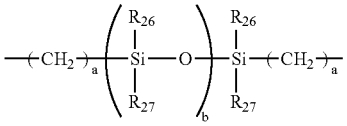

wherein, a represents the integer of 1 to 20, and b represents the integer of 1 to 2,000, $R_{26}$ and $R_{27}$ represents one of a substituted or non-substituted alkyl group and aryl group, $R_{24}$, $R_{25}$, $R_{26}$, $R_{27}$ may be identical or different.

24. An electrophotographic photoconductor according to claim 18, wherein said high-molecular transport material is a polycarbonate having a triarylamine structure expressed by the following Formula (6D)

(6D)

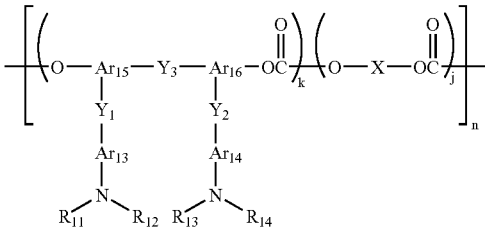

wherein, $R_{11}$, $R_{12}$, $R_{13}$ and $R_{14}$ represent a substituted or non-substituted aryl group, and $Ar_{13}$, $Ar_{14}$, $Ar_{15}$ and $Ar_{16}$ represent the same or different allylene group, $Y_1$, $Y_2$ and $Y_3$ represent one of a single bond, a substituted or non-substituted alkylene group, a substituted or non-substituted cycloalkylene group, a substituted or non-substituted alkyleneether group, oxygen atom, sulfur atom and vinylene group and may be the same or different, k and j represent the compositions where $0.1 \leqq k \leqq 1$ and $0 \leqq j \leqq 0.9$, and n represents a repeating unit and is the integer of 5 to 5,000, X represents one of an aliphatic bivalent group, and a bivalent group expressed by the following Formula (A)

(A)

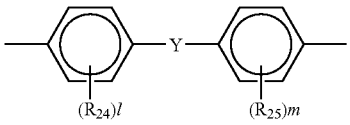

wherein, $R_{24}$ and $R_{25}$ independently represent one of a substituted or non-substituted alkyl group, aryl group and halogen atom, and l and m represent the integer of 0 to 4, Y represents one of a single bond, a straight chain, branched or cyclic alkylene group with 1 to 12 carbon atoms, —O—, —S—, —SO—, —$SO_2$—, —CO—, —CO—O-Z-O—CO—, wherein, Z represents an aliphatic bivalent groups, and the following Formula (B)

(B)

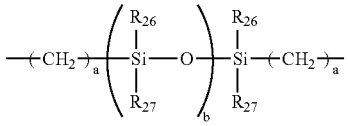

wherein, a represents the integer of 1 to 20, and b represents the integer of 1 to 2,000, $R_{26}$ and $R_{27}$ represent one of a substituted or non-substituted alkyl group and aryl group, $R_{24}$, $R_{25}$, $R_{24}$, $R_{27}$ may be identical or different.

25. An electrophotographic photoconductor according to claim 18, wherein said high-molecular transport material is a polycarbonate having a triarylamine structure expressed by the following Formula (7D)

(7D)

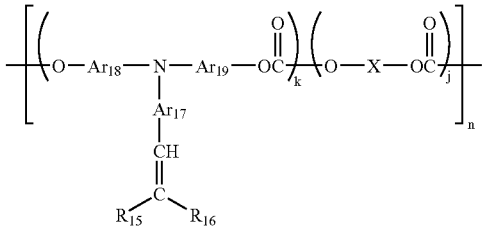

wherein, $R_{15}$ and $R_{16}$ represent one of hydrogen atom, and a substituted or non-substituted aryl group, and may form a ring, $Ar_{17}$, $Ar_{18}$ and $Ar_{19}$ represent the same or different allylene group, k and j represent the compositions where $0.1 \leqq k \leqq 1$ and $0 \leqq j \leqq 0.9$, and n represents a repeating unit and is the integer of 5 to 5,000, X represents one of an aliphatic bivalent group, and a bivalent group expressed by the following Formula (A)

(A)

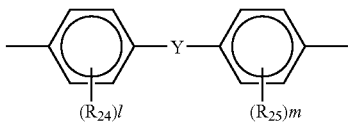

wherein, $R_{24}$ and $R_{25}$ independently represent one of a substituted or non-substituted alkyl group, aryl group and halogen atom, and l and m represent the integer of 0 to 4, Y represents one of a single bond, a straight chain, branched or cyclic alkylene group with 1 to 12 carbon atoms, —O—, —S—, —SO—, —$SO_2$—, —CO—, —CO—O-Z-O—CO—, wherein, Z represents an aliphatic bivalent group, and the following Formula (B)

(B)

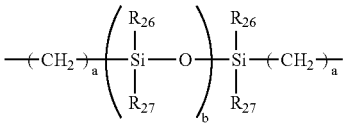

wherein, a represents the integer of 1 to 20, and b represents the integer of 1 to 2,000, $R_{26}$ and $R_{27}$ represent one of a substituted or non-substituted alkyl group and aryl group, $R_{24}$, $R_{25}$, $R_{26}$, $R_{27}$ may be identical or different.

26. An electrophotographic photoconductor according to claim 18, wherein said high-molecular transport material is a polycarbonate having a triarylamine structure expressed by the following Formula (8D)

(8D)

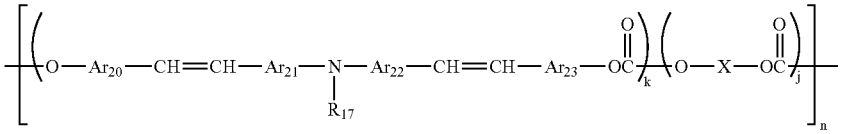

wherein, $R_{17}$ represents a substituted or non-substituted aryl group, $Ar_{20}$, $Ar_{21}$ , $Ar_{22}$ and $Ar_{23}$ represent the same or different allylene group, k and j represent the compositions where $0.1 \leqq k \leqq 1$ and $0 \leqq j \leqq 0.9$, and n represents a repeating unit and is the integer of 5 to 5,000, r represents integer of 1 to 5, X represents one of an aliphatic bivalent group, and a bivalent group expressed by the following Formula (A)

(A)

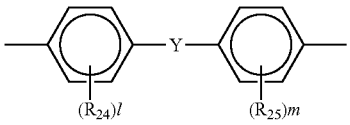

wherein, $R_{24}$ and $R_{25}$ independently represent one of a substituted or non-substituted alkyl group, aryl group and halogen atom, and l and m represent the integer of 0 to 4, Y represents one of a single bond, a straight chain, branched or cyclic alkylene group with 1 to 12 carbon atoms, —O—, —S—, —SO—, —$SO_2$—, —CO—, —CO—O-Z-O—CO—, wherein, Z represents an aliphatic bivalent group, and the following Formula (B)

(B)

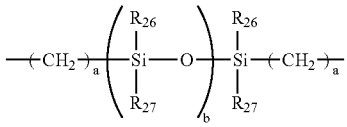

wherein, a represents the integer of 1 to 20, and b represents the integer of 1 to 2,000, $R_{26}$ and $R_{27}$ represent one of a substituted or non-substituted alkyl group and aryl group, $R_{24}$, $R_{25}$, $R_{26}$, $R_{27}$ may be identical or different.

27. An electrophotographic photoconductor according to claim 18, wherein said high-molecular transport material is a polycarbonate having a triarylamine structure expressed by the following Formula (9D)

(9D)

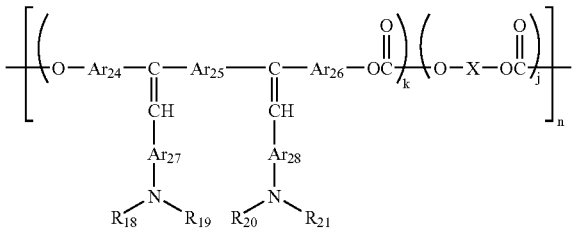

wherein, $R_{18}$, $R_{19}$, $R_{20}$ and $R_{21}$ represent a substituted or non-substituted aryl group, $Ar_{24}$, $Ar_{25}$, $Ar_{26}$, $Ar_{27}$ and $Ar_{28}$ represent the same or different allylene group, k and j represent the compositions where $0.1 \leqq k \leqq 1$ and $0 \leqq j \leqq 0.9$, and n represents a repeating unit and is the integer of 5 to 5,000, X represents one of an aliphatic bivalent group, and a bivalent group expressed by the following Formula (A)

(A)

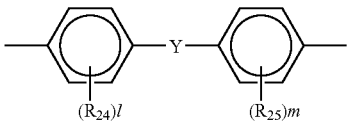

wherein, $R_{24}$ and $R_{25}$ independently represent one of a substituted or non-substituted alkyl group, aryl group and halogen atom, and l and m represent the integer of 0 to 4, Y represents one of a single bond, a straight chain, branched or cyclic alkylene group with 1 to 12 carbon atoms, —O—, —S—, —SO—, —$SO_2$—, —CO—, —CO—O-Z-O—CO—, wherein, Z represents an aliphatic bivalent group, and the following Formula (B)

(B)

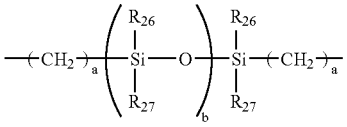

wherein, a represents the integer of 1 to 20, and b represents the integer of 1 to 2,000, $R_{26}$ and $R_{27}$ represent one of a substituted or non-substituted alkyl group and aryl group, $R_{24}$, $R_{25}$, $R_{26}$, $R_{27}$ may be identical or different.

28. An electrophotographic photoconductor according to claim 18, wherein said high-molecular transport material is a polycarbonate having a triarylamine structure expressed by the following Formula (10D)

(10D)

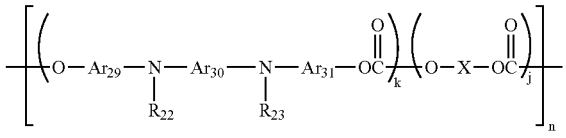

wherein, $R_{22}$ and $R_{23}$ represent a substituted or non-substituted aryl group, $Ar_2g$, $Ar_{30}$ and $Ar_{31}$ represent the same or different allylene group, k and j represent the compositions where $0.1 \leqq k \leqq 1$ and $0 \leqq j \leqq 0.9$, and n represents a repeating unit and is the integer of 5 to 5,000, X represents one of an aliphatic bivalent group, and a bivalent group expressed by the following Formula (A)

(A)

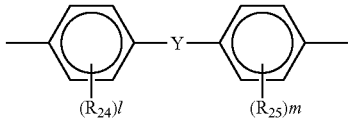

wherein, $R_{24}$ and $R_{25}$ independently represent one of a substituted or non-substituted alkyl group, aryl group and halogen atom, and l and m represent the integer of 0 to 4, Y represents one of a single bond, a straight chain, branched or cyclic alkylene group with 1 to 12 carbon atoms, —O—, —S—, —SO—, —$SO_2$—, —CO—, —CO—O-Z-O—CO—, wherein, Z represents an aliphatic bivalent group, and the following Formula (B)

(B)

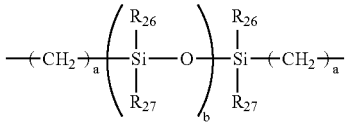

wherein, a represents the integer of 1 to 20, and b represents the integer of 1 to 2,000, $R_{26}$ and $R_{27}$ represent one of a substituted or non-substituted alkyl group and aryl group, $R_{24}$, $R_{25}$ , $R_{26}$, $R_{27}$ may be identical or different.

29. An electrophotographic photoconductor according to claim 18, wherein said high-molecular transport material is a polycarbonate having a triarylamine structure expressed by the following Formula (11D)

(11D)

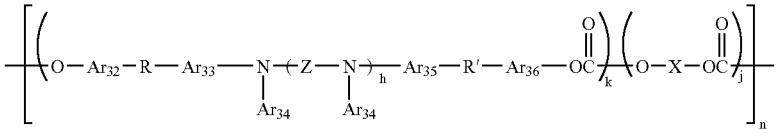

wherein, $Ar_{32}$, $Ar_{33}$, $Ar_{35}$ and $Ar_{36}$ represent a substituted or non-substituted allylene group, and $Ar_{34}$ represents a substituted or non-substituted aryl group, Z represents allylene group or —$Ar_{37}$-Za-$Ar_{37}$", $Ar_{37}$ represents a substituted or non-substituted allylene group, Za represents one of O, S and allylene group, R and R' represent one of a straight chain or branched allylene group and —O—, h represents 0 or 1, k and j represent the compositions where $0.1 \leqq k \leqq 1$ and $0 \leqq j \leqq 0.9$, and n represents a repeating unit and is the integer of 5 to 5,000, X represents one of an aliphatic bivalent group, a substituted or non-substituted aromatic bivalent group, a bivalent group that can be formed by bonding these groups and bivalent group expressed by the following Formula (A'), Formula (F) and Formula (G)

(A')

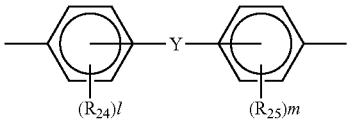

(F)

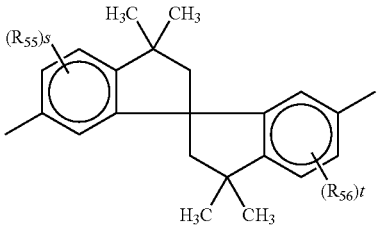

(G)

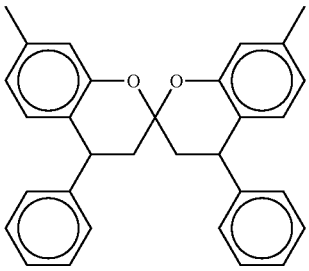

wherein, $R_{24}$, $R_{25}$, $R_{55}$ and $R_{56}$ independently represent one of a substituted or non-substituted alkyl group, a substituted or non-substituted aryl group and halogen atom, l and m represent the integer of 0 to 4, s and t independently represent the integer of 0 to 3, $R_{24}$, $R_{25}$, $R_{55}$, $R_{54}$ may be the same or different if a plurality of them are present, respectively, Y represents one of a single bond, a straight chain, branched or cyclic alkylene group with 1 to 12 carbon atoms, a bivalent group comprising an alkylene with 1 to 10 carbon atoms, at least one oxygen atom and at least one sulfur atom, —O—, —S—, —SO—, —$SO_2$—, —CO—, —COO—, —CO—O-$Z_1$-O—CO— and —CO-$Z_2$—CO— wherein, $Z_1$ and $Z_2$ represent one of an aliphatic bivalent group and a substituted or non-substituted allylene group, and the following Formula (B) and Formulas (H) (I) (J) (K) (L) (M) and (N)

(B)

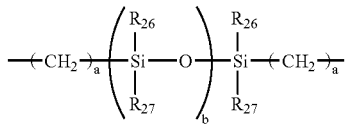

(H)

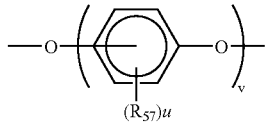

(I)

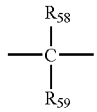

(J)

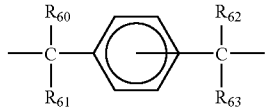

(K)

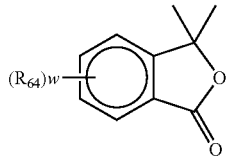

(L)

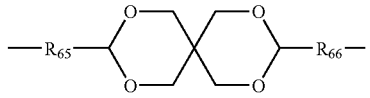

(M)

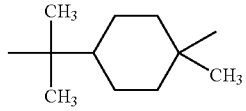

(N)

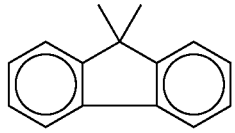

wherein, $R_{26}$ and $R_{27}$ independently represent one of a substituted or non-substituted alkyl group and a substituted or non-substituted aryl group, $R_{57}$, $R_{58}$ and $R_{64}$ independently represent one of halogen atom, a substituted or non-substituted alkyl group and a substituted or non-substituted aryl group and a substituted or non-substituted aryl group, $R_{59}$, $R_{60}$, $R_{61}$ , $R_{62}$ and $R_{63}$ independently represent one of hydrogen atom, halogen atom, a substituted or non-substituted alkyl group, a substituted or non-substituted alkoxy group and a substituted or non-substituted aryl group, $R_{58}$ and $R_{59}$ may be bonded to form ring having 5 to 12 carbon atoms, $R_{65}$ and $R_{66}$ represent an alkylene group with a single bond or having 1 to 4 carbon atoms, a represents the integer of 1 to 20, b represents the integer of 1 to 2000, u and w represent the integer of 0 to 4 and v represents 1 or 2, $R_{26}$, $R_{27}$, $R_{57}$ and $R_{64}$ may be the same or different if a plurality of them are present, respectively.

30. An electrophotographic photoconductor according to claim 15, wherein said photoconductive layer further contains an acceptor compound.

31. An electrophotographic photoconductor according to claim 30, wherein said acceptor compound is a 2,3-diphenylindene compound expressed by the following Formula.

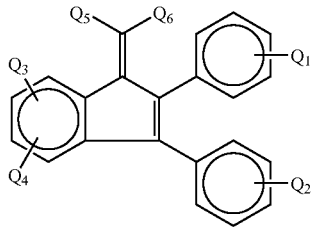

wherein, $Q_1$, $Q_2$, $Q_3$ and $Q_4$ represent one of hydrogen atom, halogen atom, a substituted or non-substituted alkyl group, cyano group and nitro group, and $Q_5$ and $Q_6$ represent one of a hydrogen atom-substituted or non-substituted aryl group, cyano group, alkoxycarbonyl group and aryloxycarbonyl group.

32. An electrophotographic photoconductor according to claim 15, wherein said photoconductive layer further contains a phenol compound.

33. An electrophotographic photoconductor according to claim 32, wherein said phenol compound is a phenol compound expressed by the following Formula

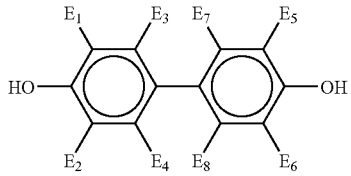

wherein, $E_1$, $E_2$, $E_3$, $E_4$, $E_5$, $E_6$, $E_7$, and $E_8$ represent one of hydrogen atom, a substituted or non-substituted alkyl group, a substituted or non-substituted alkoxycarbonyl group, a substituted or non-substituted aryl group and a substituted or non-substituted alkoxy group.

* * * * *